US010184240B2

(12) United States Patent
Matsuura et al.

(10) Patent No.: US 10,184,240 B2
(45) Date of Patent: Jan. 22, 2019

(54) TANK AND METHOD FOR CONSTRUCTING DIKE

(71) Applicant: KAJIMA CORPORATION, Tokyo (JP)

(72) Inventors: Masanori Matsuura, Sagamihara (JP); Toshimichi Ichinomiya, Fuchu (JP); Shuji Yanai, Tama (JP); Yuji Watanabe, Tama (JP); Tomoyoshi Yoshiwara, Kawaguchi (JP); Shinichi Yoshimura, Fukuoka (JP); Ryo Mizutani, Higashimurayama (JP); Kazumasa Okubo, Chofu (JP); Kosuke Furuichi, Hachioji (JP); Shinichi Yamanobe, Inagi (JP); Tomoaki Honda, Tokyo (JP); Yuki Yokota, Chofu (JP)

(73) Assignee: KAJIMA CORPORATION, Tokyo (JP)

( * ) Notice: Subject to any disclaimer, the term of this patent is extended or adjusted under 35 U.S.C. 154(b) by 0 days.

(21) Appl. No.: 15/525,196

(22) PCT Filed: Sep. 9, 2015

(86) PCT No.: PCT/JP2015/075593
§ 371 (c)(1),
(2) Date: May 8, 2017

(87) PCT Pub. No.: WO2016/072151
PCT Pub. Date: May 12, 2016

(65) Prior Publication Data

US 2018/0195264 A1 Jul. 12, 2018

(30) Foreign Application Priority Data

Nov. 6, 2014 (JP) ..... 2014-225903

(51) Int. Cl.
*E04B 1/22* (2006.01)
*E04B 1/04* (2006.01)
(Continued)

(52) U.S. Cl.
CPC ..... *E04B 1/046* (2013.01); *B65D 90/024* (2013.01); *B65D 90/08* (2013.01); *E04B 1/22* (2013.01);
(Continued)

(58) Field of Classification Search
CPC ..... E04B 1/046; E04G 2021/127; E04G 23/0218; E04H 7/20; E04C 5/125
See application file for complete search history.

(56) References Cited

U.S. PATENT DOCUMENTS 2,958,983 A * 11/1960 Hoover ..... E04H 7/28 52/192
6,282,863 B1 * 9/2001 Christian ..... E04H 7/06 52/747.1
(Continued)

FOREIGN PATENT DOCUMENTS

JP S48-65721 A 9/1973
JP S49-75201 U 6/1974
(Continued)

OTHER PUBLICATIONS

Oct. 15, 2015 Office Action Japanese Patent Application No. 2014-051060.
(Continued)

*Primary Examiner* — Babajide A Demuren
(74) *Attorney, Agent, or Firm* — Oliff PLC

(57) ABSTRACT

In an LNG tank, a dike is formed by arranging precast blocks in the circumferential direction and layering the precast blocks in the vertical direction. Each of the precast blocks has loop joints on the top, bottom, left, and right side faces,
(Continued)

and concrete is deposited between each two precast blocks adjacent in the circumferential direction and the vertical direction, whereby masonry joints are formed in the vertical direction and the circumferential direction. Prestress is imparted to the dike by PC steel members. The PC steel members are provided in the circumferential direction and the vertical direction of the dike, and are arranged so as to avoid the masonry joints in the circumferential direction and the vertical direction. Therefore, it is possible to construct the dike in a short time, and it is possible to provide a tank or the like that can reduce the construction period.

30 Claims, 89 Drawing Sheets

(51) Int. Cl.

| | |
|---|---|
| ***E04B 1/61*** | (2006.01) |
| ***E04H 7/02*** | (2006.01) |
| ***B65D 90/08*** | (2006.01) |
| ***E04C 5/12*** | (2006.01) |
| ***E04G 21/12*** | (2006.01) |
| ***E04H 7/20*** | (2006.01) |
| ***B65D 90/02*** | (2006.01) |
| *E04B 1/32* | (2006.01) |
| *E04G 23/02* | (2006.01) |
| *F17C 3/00* | (2006.01) |

(52) U.S. Cl.
CPC ..... *E04B 1/6187* (2013.01); *E04C 5/125* (2013.01); *E04G 21/12* (2013.01); *E04H 7/02* (2013.01); *E04H 7/20* (2013.01); *E04B 1/3211* (2013.01); *E04G 23/0218* (2013.01); *E04G 2021/127* (2013.01); *F17C 3/00* (2013.01); *F17C 2223/0161* (2013.01)

(56) References Cited

U.S. PATENT DOCUMENTS

| | | | | |
|---|---|---|---|---|
| 8,534,480 | B1 | 9/2013 | Hanna | |
| 2004/0134144 | A1 | 7/2004 | Morrison et al. | |
| 2009/0308005 | A1* | 12/2009 | Ireland | E04B 1/046 52/250 |
| 2013/0001954 | A1* | 1/2013 | Garc A Maestre | F03D 13/20 290/55 |
| 2014/0013699 | A1* | 1/2014 | Gallinat | E04B 1/043 52/583.1 |
| 2016/0046437 | A1* | 2/2016 | Hoyle | B65D 90/024 220/565 |
| 2016/0160491 | A1* | 6/2016 | Ladret | E04B 1/043 52/223.6 |

FOREIGN PATENT DOCUMENTS

| | | | |
|---|---|---|---|
| JP | S49-44489 | B1 | 11/1974 |
| JP | S50-113019 | A | 9/1975 |
| JP | S54-71439 | U | 5/1979 |
| JP | S54-74513 | A | 6/1979 |
| JP | S54-110620 | A | 8/1979 |
| JP | S59-41548 | A | 3/1984 |
| JP | S59-106656 | A | 6/1984 |
| JP | S60-175668 | A | 9/1985 |
| JP | S61-81979 | A | 4/1986 |
| JP | S61-126248 | A | 6/1986 |
| JP | H06-10420 | A | 1/1994 |
| JP | H06-330637 | A | 11/1994 |
| JP | H07-62926 | A | 3/1995 |
| JP | H07-180395 | A | 7/1995 |
| JP | H08-312148 | A | 11/1996 |
| JP | H09-273247 | A | 10/1997 |
| JP | H10-194378 | A | 7/1998 |
| JP | 2002-348891 | A | 12/2002 |
| JP | 2005-76220 | A | 3/2005 |
| JP | 3802009 | B2 | 7/2006 |
| JP | 2007-169900 | A | 7/2007 |
| JP | 2009-161976 | A | 7/2009 |
| JP | 2009-203787 | A | 9/2009 |
| JP | 2011-99550 | A | 5/2011 |
| JP | 2011-122389 | A | 6/2011 |
| JP | 2011-132710 | A | 7/2011 |
| JP | 2011-252304 | A | 12/2011 |
| JP | 2012-57314 | A | 3/2012 |
| JP | 2013-53465 | A | 3/2013 |
| JP | 2013-91984 | A | 5/2013 |
| JP | 2014-051060 | A | 3/2014 |
| JP | 2014-080138 | A | 5/2014 |
| JP | 2014-091672 | A | 5/2014 |
| JP | 2014-151926 | A | 8/2014 |

OTHER PUBLICATIONS

Mar. 18, 2015 Office Action issued in Japanese Patent Application No. 2014-225903.

Dec. 22, 2015 International Search Report issued in International Patent Application No. PCT/JP2015/075593.

May 9, 2017 International Preliminary Report on Patentability issued in International Patent Application No. PCT/JP2015/075593.

* cited by examiner (a)

(b)

(a)

(b)

(a)

(b)

(c)

(d)

(a)

(b)

(c)

(a)

(b)

(a)

(b)

(c)

(a)

(b)

(a)

(b)

(a)

(b)

(a)

(b)

(a)

(b)

TANK AND METHOD FOR CONSTRUCTING DIKE

TECHNICAL FIELD

The present invention relates to an on-ground tank or the like configured to contain and store an LNG (Liquefied Natural Gas) or the like.

BACKGROUND ART

An example of an on-ground tank configured to contain and store an LNG is shown in FIG. 89. An LNG tank 100 shown in FIG. 89 includes a dike 20 disposed on a bottom slab 5, which is supported by piles 4 in the ground 7, and also includes an inner tank 3*a* and an outer tank 3*b*, which are made from metallic plates and other components and disposed inside the dike. The LNG is stored in the inner tank 3*a*, and the spacing between the inner tank 3*a* and the outer tank 3*b* is used to maintain the LNG in a cold condition. A side wall portion 31*b* of the outer tank 3*b* is disposed along the dike 20.

The dike 20 is provided to prevent liquid leakage and spill of the LNG to the outside even if the inner tank 3*a* and the outer tank 3*b* are damaged and/or broken. The dike 20 is configured to withstand the liquid pressure of the LNG even in a low temperature environment. Thus, prestress is applied to the dike 20 by tension members (not shown) disposed in the vertical direction and the circumferential direction of the dike 20.

When an LNG tank is built up, the construction of an inner facility (e.g., the inner tank and the outer tank) starts upon finishing the construction of the dike to a certain height. Thus, the reduction in a construction period of the dike in an initial stage of a construction work has a great impact to a period of the entire construction work. In view of this, an example of building up the dike with precast members is described in Patent Literature Document 1.

In the example of Patent Literature Document 1, a ring base and a wall body are united in a precast block, and a plurality of precast blocks are arranged circularly at predetermined intervals along an outer circumferential line of a tank. Concrete is then poured and disposed between the precast blocks at a construction site for connection and closing/sealing, thereby constructing a lower wall body of the dike.

An example of a joining structure for joining upper and lower precast blocks to each other is shown in FIG. 90. In the example of FIG. 90, each of the upper and lower precast blocks 200 is provided with coupling joints 201, which have fixing elements. The upper and lower precast blocks 200 are arranged such that the respective coupling joints are lapped, a formwork (mold) 300 is disposed, and concrete 400 is poured and disposed between the precast blocks 200, thereby forming a masonry joint between the precast blocks 200.

Patent Literature Document 2 describes that one precast block has a reinforcing steel rod embedded therein and a reinforcing steel rod receiving hole formed therein, the reinforcing steel rod receiving hole of this precast block receives a reinforcing steel rod protruding from another precast block, and grout is poured between the precast blocks to form a joining structure that has the lapped reinforcing steel rods of the two precast blocks.

Patent Literature Document 3 describes a building that has a party wall made from precast walls. The party wall is built up by placing an upper precast wall on a lower precast wall. A U-shaped hook is partly embedded in the lower precast wall beforehand such that the hook is exposed and extends upward, and another U-shaped hook is partly embedded in the upper precast wall beforehand such that the hook is exposed and extends downward. A slab is provided on the lower precast wall, and the upper precast wall is stacked on the lower precast wall with a flattening mortar layer being interposed between the precast walls, thereby joining the precast walls to each other. The U-shaped hooks of the precast walls are arranged such that the U-shaped hooks overlap in the horizontal direction in a recess formed in the upper precast beforehand. A rod-like member is inserted through the respective hooks, and then mortar is loaded into the recess to fix the U-shaped hooks and the rod-like member.

Patent Literature Document 4 describes a joining structure for joining a pair of reinforced concrete structures that face each other. One of the two facing reinforced concrete structures has a protruding reinforcing steel rod protruding from an end face thereof and a spiral sheath pipe receiving hole, and the other of the two facing reinforced concrete structures has a spiral sheath pipe. This joining structure allows the protruding reinforcing steel rod to be inserted in the spiral sheath pipe and an approximately half of the spiral sheath pipe to be inserted in the spiral sheath pipe receiving hole. With this condition, the grout is loaded around the protruding reinforcing steel rod, which is inserted in the spiral sheath pipe, and cured to provide the joining structure.

LISTING OF REFERENCES

Patent Literature Documents

PATENT LITERATURE DOCUMENT 1: Japanese Patent Application Laid-Open Publication No. 2011-122389

PATENT LITERATURE DOCUMENT 2: Japanese Patent Application Laid-Open Publication No. 2012-57314

PATENT LITERATURE DOCUMENT 3: Japanese Patent Application Laid-Open Publication No. Hei 9-273247

PATENT LITERATURE DOCUMENT 4: Japanese Patent No. 3802009

SUMMARY OF THE INVENTION

Problems to be Solved by the Invention

The method of Patent Literature Document 1 uses the precast blocks to enable the easy construction of the lower wall body, but pouring and placing the concrete at the work site still occupies a considerable part, and therefore the method cannot provide a sufficient merit with regard to the work period (construction period) reduction.

When an LNG tank is built up, the construction of the dike and the construction of the inner facility such as the inner tank and the outer tank of the tank, which are built inside the dike, proceed in parallel. In order to reduce the work period, therefore, it is desired that the construction of the dike and the construction of the inside facility do not interfere with each other.

For example, when a masonry joint between the precast blocks is formed by concrete or the like, and the work of disposing the formworks from the inside is conducted, then such work may interfere with the inner facility construction work and it may become an obstacle to the work period reduction. Although the method of Patent Literature Document 1 can easily construct the lower wall body with the precast blocks, the method does not take such problem into account.

In the example of FIG. 90, when the masonry joint is formed, it is necessary to pour and dispose the concrete 400 while the upper precast block 200 is present, i.e., it is necessary to conduct a so-called "reverse pouring and disposing." Thus, an air gap is likely to be formed (air is likely to be trapped) below the upper precast block 200 when the concrete 400 is poured and disposed. Even if a countermeasure such as use of non-breezing and non-shrinkage cement is taken in order to avoid this, the reverse pouring and disposing itself is difficult, and the air gap possibly remains. Also, because it is necessary to use a large and highly rigid formwork 300, the cost increases.

The method of Patent Literature Document 2 pours and loads the pressurized grout between the precast blocks via a grout introduction hole that communicates with the reinforcing steel rod receiving hole after the two precast blocks are arranged. This method requires the grout introduction hole to be formed in the side face of the precast block. Also, when the pressurized grout is loaded from the grout introduction hole, there is a possibility that insufficient loading may occur.

When the joining structure uses the concrete structure having the above-described protruding reinforcing steel rods, it is necessary for the two main steel rods to have a sufficient overlapping length (hereinafter referred to as "fixation length") in order to securely transfer the force from the main steel rod of one concrete structure to the main steel rod of the other concrete structure. If the fixing elements are attached to the free ends of the two main steel rods, respectively, then it is possible to reduce the fixation length. However, the work of attaching the fixing elements to the main steel rods is conducted in advance at a factory or the like, and the work incurs costs and takes labor. Thus, there is a room for improvements in terms of the efficiency of the construction work.

An object of the present invention is to provide a tank or the like that allows the construction of a dike to be finished in a short time, and reduces a construction work period.

Solution to the Problems

In order to solve the above-mentioned problems, according to a first invention, there is provided a tank having a dike. The dike is formed by arranging precast blocks in a circumferential direction and stacking the precast blocks in a vertical direction, and each of the precast blocks is provided with joints on a left side and a right side of the precast block and at least one of an upper portion and a lower portion of the precast block. A filler is provided between the precast blocks adjacent to each other in the vertical direction and the circumferential direction of the dike so as to form masonry joints in the vertical direction and the circumferential direction of the dike. Prestress is introduced to the dike by tension members in the circumferential direction of the dike and tension members in the vertical direction of the dike, and the tension members in the vertical direction arranged so as to avoid the masonry joints in the vertical direction.

According to the present invention, the dike is constructed by use of the precast blocks, and the filler is required only in a portion of the masonry joints and therefore made minimal. Thus, it is possible to shorten a construction period for constructing the dike and to start an internal equipment and facility work earlier so as to shorten an entire construction period. In addition, as the masonry joint between the blocks, a filler structure is used in which joints or the like are buried. Thus, it is possible to provide a force bearing capability, an endurance durability, and a liquid tightness, which are required to the dike including the masonry joints, with the higher reliability. Yet in addition, sheath pipes through which the tension members run in the vertical direction are not required to be arranged in the masonry joints. Thus, it is possible to make the construction easier.

Preferably, the tension members in the circumferential direction may be arranged as to avoid the masonry joints in the circumferential direction.

By employing this configuration, the sheath pipes through which the tension members in the circumferential direction extend are not required to be arranged in the masonry joints. Thus, it is possible to make the construction easier.

Preferably, each of the joints may be any of a loop joint, a mechanical joint, and a joint having a fixing element.

By employing this configuration, a force bearing capability or the like required for the masonry joints can be ensured even when a joint length is short. Thus, it is possible to make a width of the masonry joints narrower and to reduce an amount of the filler so as to further shorten the construction period of the dike. In addition, the tension members are densely arranged in the precast blocks without the tension members being arranged in the masonry joints. Thus, it is possible to arrange a similar amount of the tension members as a whole to the case of the conventional construction method.

Preferably, a lower (or bottom) face of a main body of each of the precast blocks may incline upward toward the outside of the dike.

By employing this configuration, it is possible to prevent a void being generated (air being trapped) below the bottom face of the main body of the block when the filler is provided as the masonry joint.

Preferably, a plate protruding from a main body of each of the precast blocks may be provided on an inner face of each of the precast blocks.

By employing this configuration, the plate can be used for an inner formwork when the filler is provided as the masonry joint. Thus, it is possible to eliminate a work for, for example, locating the inner formwork from the inside of the dike.

Preferably, a plurality of plates of the precast blocks may be continuous in the circumferential direction and the vertical direction of the dike, and an inner face of the dike may be covered by the plates.

By employing this configuration, it is possible to constitute a side wall portion of an outer tank by the plates of the precast blocks.

According to a second invention, there is provided a method of constructing a dike of a tank. The method includes: arranging precast blocks in a circumferential direction of the dike and stacking the precast blocks in the vertical direction of the dike, each of the precast blocks being provided with joints on a left side and a right side of the precast block and at least one of an upper side and a lower side of the precast block; providing a filler between the precast blocks adjacent to each other in the circumferential direction and the vertical direction of the dike to form masonry joints in the vertical direction and the circumferential direction of the dike; and introducing prestress to the dike by tension members in the circumferential direction of the dike and the vertical direction of the dike. The tension members in the vertical direction are arranged so as to avoid the masonry joints in the vertical direction.

According to the second invention, preferably, the precast blocks in a first row (first tier) may be slidably placed on a bottom slab and the prestress may be introduced to the precast blocks in the first row by the tension members in the circumferential direction of the dike. Then, the filler may be provided between the precast blocks and the bottom slab to form the masonry joints in the circumferential direction.

By employing this configuration, at a lower end portion of the dike, it is possible to prevent a large inward bending moment, which acts to deform the dike inward, from being generated on a vertical plane. Thus, it is possible to simplify the configuration of the dike and to obtain further merits in terms of both the necessary materials and the construction period.

Preferably, the precast blocks may be arranged on one or more height adjustable supporting members when the precast blocks are stacked in the vertical direction. Thus, it is possible to appropriately support the blocks at a predetermined position.

According to a tank of the first invention, preferably the tank may have a joining structure of an upper and lower precast blocks. In the joining structure, preferably, each of the upper precast blocks may include joints protruding downward from a main body of each of the upper precast blocks, and each of the lower precast blocks may include holes opening only in top face of a main body of each of the lower precast blocks and the joints may be buried in an upper portion of the main body. A filler may be provided on the main body of each of the lower precast blocks, and the joints of each of the upper precast blocks may be inserted into the holes of each of the lower precast blocks.

Preferably, each of the joints of each of the upper and lower precast blocks may be a joint having a fixing element in which the fixing element is provided at a free end of a reinforcing steel bar or rod.

Preferably, a bottom face of the main body of each of the upper precast blocks may be preferably inclined upward.

Preferably, a plate configured to protrude upward from the main body may be provided on a side face of the main body of each of the lower precast blocks.

Yet preferably, a leakage preventing mechanism configured to prevent the filler from leaking from the plates may be provided.

According to a method of constructing a dike of a tank of the first invention, preferably, in order to join an upper and lower precast blocks, each of the upper precast blocks may include joints protruding downward from a main body of each of the upper precast blocks, and each of the lower precast blocks may include holes opening only in a top face of a main body of each of the lower precast block and may have joints being buried at an upper portion of the main body. The method may include: a step (a) of providing a filler on the main body of each of the lower precast blocks, and a step (b) of inserting the joints of each of the upper precast blocks into the holes of each of the lower precast blocks.

Preferably, each of the joints of each of the upper and lower precast blocks may be a joint having a fixing element in which the fixing element is provided at a free end of a reinforcing steel bar.

Preferably, in the step (b), a bracket provided at each of the upper precast blocks may be supported by an extendable member, while the extendable member is being contracted.

Preferably, a bottom face of the main body of each of the upper precast blocks may be preferably inclined upwardly.

Preferably, a plate configured to protrude upward from the main body may be provided on a side face of the main body of each of the lower precast blocks.

Yet preferably, in the step (b), a leakage of the filler from the plates may be prevented by a leakage preventing mechanism.

Yet preferably, in the step (a), formworks may be provided at positions other than the plates at an upper portions of the lower precast blocks. After the step (b), the formworks may be removed.

Yet preferably, at least a part of each of the formworks may be inclined at upper portions of the formworks in a direction departing from the main body of each of the lower precast blocks.

As described above, after a filler is provided in advance on the lower precast block, the joints of the upper precast block are inserted into the holes of the lower precast block. By doing this, it is possible to easily form a joining structure in which the joints of the upper and lower precast blocks are lapped with each other. In addition, it is possible to ensure the filler to be filled between the upper and lower precast blocks by applying the pressure from the upper precast block. Thus, the trapping of the air is prevented, the construction work is simplified, and the formworks are made minimal. Also, it is not required to provide a hole for press fitting of the filler on the side face of each of the precast blocks.

By use of the joints having the fixing elements as the coupling joints, it is possible to make the lapping length of the joint small and to shorten the holes provided in the precast block. Also, it brings about an advantage in which the diameter of each hole is made small. In addition, by providing the plate protruding upward from the main body at the precast block, it is possible to use the plate as the formwork so as to simplify the installation work of the formworks. Further, it is possible to prevent the filler from leaking from the plate(s) by use of the leakage preventive mechanism.

Each of the precast blocks is supported by an extendable member such as a jack or the like and gradually lowered while being supported when the precast block is installed. Thus, it is possible to ensure the precast blocks to be installed with a higher accuracy with the inclination or the fall of the precast blocks being prevented. Also, the inclined portion is provided on a bottom face of the main body of the precast block. Thus, it is possible to ensure the filler to be filled between the precast blocks. Further, the formwork is provided separately from the plate, the formwork is inclined, and a gap is provided between the formwork and the upper precast block. Thus, it is possible to simplify the drainage of an excessive filler.

According to a precast block of a tank of the first invention, preferably, each of the precast blocks includes a main body and a plate protruding from the main body and functioning as a formwork for the filler when forming the masonry joints.

By employing this configuration, it is possible to use the plate protruding from the main body of the precast block as the formwork and to form the masonry joints by the filler. Thus, it is possible to eliminate a work for installing the formwork from one side of the dike and an accompanying work thereof. Accordingly, it is possible to avoid an interference with a work on one side of the dike and to reduce the construction period.

Preferably, the plate may be configured to protrude at four positions including the upper left position (corner), the upper right position, the lower left position and the lower right position in a circumference of the main body. At least two positions of the four positions may each have a shape in which a right-angled corner is cut out. Shapes of the four positions may be defined such that two rectangular areas substantially identical to each other can be created when portions of which corners are cut out are combined.

By defining the shape of the plate at the four positions (corners) in the circumference of the main body, it is possible to allow only two or less plates to overlap with each other at a contact position of the upper, lower, right and left precast blocks. This makes the installation of the precast blocks easier.

Preferably, the plate may include a fixing mechanism configured to fix the plate such that the plate is lapped with the plate of a different precast block in a front-rear direction. Yet preferably, the fixing mechanism may be at least one of a convex portion and a receiving portion into which the convex portion can be inserted.

By fixing the plates with the fixing mechanism such that the plates of blocks adjacent to each other are lapped with each other, it is possible to appropriately construct the dike by fixing the positions of the plates. In addition, by use of the convex portion or the receiving portion as the fixing mechanism, it is possible to make the fixation of the position of the plates easier.

For example, preferably, the plate may be provided so as to protrude upward, downward, rightward, and leftward from the main body, the convex portion may be provided at one of the upward and downward protruding portions of the plate and the receiving portion may be provided at the other of the upward and downward protruding portions of the plate. The convex portion may be provided at one of the rightward and leftward protruding portions of the plate and the receiving portion may be provided at the other of the rightward and leftward protruding portions of the plate. The protruding portion provided with the receiving portion may be positioned in front of the protruding portion provided with the convex portion.

In this case, it brings about an advantage in which the dike can be constructed with one kind of blocks in which the convex portion and the receiving portion are provided.

Alternatively, the plate may be provided so as to protrude upward, downward, rightward and leftward from the main body, and the convex portions may be provided at the upward, downward, rightward and leftward protruding portions of the main body. Also, preferably, the plate may be also provided so as to protrude upward, downward, rightward and leftward from the main body, and the receiving portions may be provided at the upward, downward, rightward and leftward protruding portions of the main body.

In this case, it is possible to construct the dike by allocating the blocks with the convex portion and the block with the receiving portion in a zigzag manner. As the plate of each of the blocks is provided only with the convex portion or the receiving portion, it brings about an advantage that it is possible to reduce the workload of machining and processing the plates. This reduces the cost.

For example, the four positions including the upper right position (corner), the upper left position, the lower right position, and the lower left position in the circumference of the main body, at which the upward, downward, rightward and leftward protruding portions intersect, may each have a shape in which a right-angled corner is cut out and chamfered in an oblique direction, and shapes of the four positions may be defined such that two rectangular areas substantially identical to each other can be created when portions of which corners are cut out are combined.

Alternatively, out of the four positions including the upper right position, the upper left position, the lower right position, and the lower left position in the circumference of the main body, at which the upward, downward, rightward, and leftward protruding portions intersect, a lower position of two positions on one diagonal line may have a shape in which a right-angled corner is cut out in a recessed (internal) corner shape, two positions on the other diagonal line may have a shape in which a right-angled corner is cut out and chamfered in an oblique direction, and shapes of the four positions may be defined such that two rectangular areas substantially identical to each other can be created when portions of which corners are cut out are combined.

More particularly, by use of those kinds of blocks, it is possible to avoid an interference with a work at one side of the dike, as mentioned above, and to shorten the construction period. In addition, it makes the construction of the dike easier.

According to the tank of the first invention, preferably, the precast blocks may be joined together in vertical and horizontal directions, and masonry joints may be formed by the filler between the main bodies of the precast blocks adjacent to each other.

Also, preferably, the plates of the precast blocks adjacent to each other may be lapped with each other in a front-rear direction, and the plates of a number not exceeding two may be lapped in the front-rear direction at a contact position of the upper, lower, right, and left precast blocks.

Yet also, the plates of the precast blocks adjacent to each other may be fixed together by a fixing mechanism such that the plates are lapped with each other in the front-rear direction. Yet also, preferably, a protruding portion provided with the receiving portion of the plate of one precast block out of the precast blocks adjacent to each other may be lapped in front of a protruding portion provided with the convex portion of the plate of the other precast block.

Furthermore, the precast block with the convex portion and the precast block with the receiving portion may be arranged in a zig zag manner, and the precast block with the receiving portion may be arranged in front of the precast block with the convex portion.

According to a method of constructing a dike of the tank of the first invention, preferably, the precast blocks may be joined together in vertical and horizontal directions, and masonry joints may be formed by a filler between the main bodies of the precast blocks adjacent to each other.

Also, preferably, a plate of one precast block out of the precast blocks adjacent to each other may be lapped in front of a plate of the other precast block, and the convex portion provided at the plate of the other precast block may be inserted into the receiving portion provided at the plate of the one precast block.

Preferably, the receiving portion may include cutout-like or hook-like portions provided at the plate, and the convex portion(s) may be inserted into the receiving portion by lowering the precast block. Furthermore, preferably, the receiving portion may include cutouts or notches, and the convex portion may be inserted into the receiving portion by lowering the precast block in an oblique direction.

In this case, it is possible to lower the precast block to insert the convex portion into the receiving portion. Thus, installation of the precast blocks is made easier.

According to a tank of the first invention, preferably, a joining structure, which is a structure to join a first precast block to a second precast block, may be provided in a dike. The first precast block may include: a first end face positioned at one end of the first precast block; first main reinforcing steel bars buried in the first precast block; and first holes extending from the first end face to the inside of the first precast block. The second precast block may include: a second end face positioned at one end of the second precast block; and second main reinforcing steel bars buried in the second precast block and protruding from the second end face to be inserted into the first holes. The first holes may be filled with a solidifying material which buries the second main reinforcing steel bars inserted into the first holes. A fixing element may be provided at a free end of each of the second main reinforcing steel bars, and a folded portion, which is folded in a direction departing from the first end face, may be provided at each of the first main reinforcing steel bars.

According to this joining structure, the folded portion folded in the direction departing from the first end face is provided, and the free end of each first reinforcing steel bar at the first end face side is folded. Thus, it is possible to ensure the transmission of the force to be performed between the folded portions of the first main reinforcing steel bars and the second main reinforcing steel bars inserted into the first holes. In addition, as the folded portion is provided at the free end of each of the first main reinforcing steel bars, it is possible to shorten the fixing length without the fixing element being attached at the free end of the first main reinforcing steel bar. In the above-mentioned joining structure, as the fixing elements can be also eliminated, it is not required to perform in advance a work for attaching the fixing elements to the first main reinforcing steel bars in a manufacturing factory or the like. Thus, it is possible to suppress the cost or the labor associated with the machining and processing. Accordingly, it is possible to improve the workability. In particular, in the manufacturing factory, the labor for burying the first main reinforcing steel bars with the folded portions is the same as the labor for burying the main reinforcing steel bars without the main reinforcing steel bars. Also, it is possible to perform the construction only by filling the first holes with the solidifying material and inserting the second main reinforcing steel bars into the first holes. As a result, a higher workability is achievable from this viewpoint.

The folded portions may be buried in the first precast block. In this case, as it can eliminate the pouring and disposing of the concrete for burying the folded portions, it is possible to further simplify the construction work. As the holes, it is sufficient to prepare the first holes only through which the second main reinforcing steel bars are inserted. Thus, it is possible to reduce the size of each of the holes to be formed in advance.

A plurality of folded portions and a plurality of first holes may be alternately arranged along the first end face, and each of the folded portions may be arranged at an approximately middle point of a line segment connecting two first holes adjacent to each other.

A plurality of folded portions and a plurality of first holes may be alternately arranged along the first end face, and each of the folded portions may be arranged at a proximity position to each of the first holes. In this case, as the distance between the first main reinforcing steel bar and the associated second main reinforcing steel bar inserted into the first hole is made closer, it is possible to further smoothen the transmission of the force in these main reinforcing steel bars. Furthermore, by arranging the folded portion at the proximity position to the first hole, it is possible to directly transmit the force between the second main reinforcing steel bar inserted into the first hole and the folded portion and also to clearly define the transmission path of the force. Also, even if steel wires or the like, which are different from the first main reinforcing steel bar, are buried in the vicinity of the first end face, it is possible to directly and smoothly transmit the force in these main reinforcing steel bars without being affected by the steel wires or the like by arranging the folded portion at the proximity position to the first hole.

The first precast block may further include second holes extending from the first end face to the inside of the first precast block, the second holes may be filled with the solidifying material, and the folded portion may be provided in each of the second holes. In this case, as the first holes and the second holes are entirely filled with the solidifying material, it is possible to transmit the force between the first main reinforcing steel bar and the second main reinforcing steel bar via the hardened solidifying material. As a result, by increasing the strength of the solidifying material, it is possible to effectively increase the strength of the joints between the first main reinforcing steel bar and the second main reinforcing steel bar.

The first precast block may further include tie hoops arranged in planes intersecting with the first main reinforcing steel bars, and the tie hoops that are positioned outside the first holes on the planes may be anticorrosion reinforcing steel bars. In this case, the tie hoops positioned outside the first holes has the thinner thickness of the concrete positioned outside the tie hoops as compared to the tie hoops positioned at positions other than the outside of the first holes. As a result, the tie hoops positioned outside the first holes is more likely to be corroded than the tie hoops positioned at the positions other than the outside of the first holes. For this reason, as mentioned above, the tie hoops positioned outside the first holes are the anticorrosion reinforcing steel bars. Thus, it is possible to further surely suppress the corrosion of the tie hoops even when the thickness of the concrete positioned outside the tie hoops is thin.

According to a method of constructing a dike of the tank of the first invention, the method includes, when forming the joining structure, a step of placing a formwork so as to surround a first end face; a step of filling the first end face with a solidifying material after placing the formwork; a step of inserting the second main reinforcing steel bars into the first holes after filling the solidifying material; and a step of hardening the solidifying material after inserting the second main reinforcing steel bars.

According to the above-mentioned joining method, the formwork is arranged so as to surround the first end face and the solidifying material is filled into the first end face. After that, the second main reinforcing steel bars are inserted into the first holes and the solidifying material is hardened. In this way, the second main reinforcing steel bars may be inserted after the formwork is arranged in advance and the solidifying material is loaded into the formwork. Thus, it is possible to increase the workability of the work for joining the first precast block to the second precast block.

According to another method of constructing a dike of the tank of the first invention, the method includes: when forming the joining structure, a step of filling first holes with a solidifying material; a step of inserting the second main reinforcing steel bars into the first holes such that a gap is formed between a first end face and a second end face; a step of placing a formwork so as to surround the gap; and a step of filling the gap with the solidifying material from a hole formed at the formwork to harden the solidifying material.

According to the above-mentioned joining method, the second main reinforcing steel bars are inserted into the first holes while forming the gap between the first end face and the second end face, with the first holes being in advance filled with the solidifying material. Then, the formwork is provided so as to surround the gap, and subsequently the gap is filled with the solidifying material from the hole formed in the formwork so as to harden the solidifying material. In this case, the solidifying material for burying the gap may be loaded and hardened after the first holes is filled with the solidifying material in advance filled and the second main reinforcing steel bars are inserted into the first holes. Thus, it is possible to increase the workability of the work for joining the first precast block to the second precast block.

According to yet another method of constructing a dike of the tank of the first invention, the method includes: when forming the above-mentioned joining structure, a step of arranging a water stop rubber on the first end face or the second end face; a step of filling the first holes with a solidifying material; a step of inserting the second main reinforcing steel bars into the first holes and thrusting the first end face or the second end face against the water stop rubber to press the water stop rubber; and a step of hardening the solidifying material after the second main reinforcing steel bars are inserted.

According to the above-mentioned joining method, the second main reinforcing steel bars are inserted into the first holes and the water stop rubber is pressed by the first end face or the second end face, after the water stop rubber is arranged at the first end face or the second end face and the first holes are filled with the solidifying material. Thus, as the pressed water stop rubber expands between the first end face and the second end face, it is possible to increase the water stop performance at the joining portion between the first precast block and the second precast block. In addition, according to the above-mentioned joining method, as the formworks are not required and the labor for arranging the formworks can be thus eliminated, it is possible to further increase the workability.

Advantageous Effects of the Invention

The present invention can provide a tank or the like, that can achieve the construction of the dike in a short time, and reduce the work period.

BRIEF DESCRIPTION OF THE DRAWINGS

FIG. 73(*b*) is a cross-sectional view taken along the line M-M in FIG. 72.

FIG. 78(*b*) is corresponding to FIG. 73(*b*) and illustrates a cross-sectional view of the precast member 10*z* of the 26th embodiment.

FIG. 82(*b*) is corresponding to FIG. 78(*b*) and illustrates a cross-sectional view of the precast member 10α in the 27th embodiment.

FIG. 86(*b*) is a cross-sectional view taken along the line R-R in FIG. 86(*a*).

MODE FOR CARRYING OUT THE INVENTION

Preferred embodiments of the present invention will now be described with reference to the accompanying drawings.

First Embodiment (1. LNG Tank 1)

Figure 1:
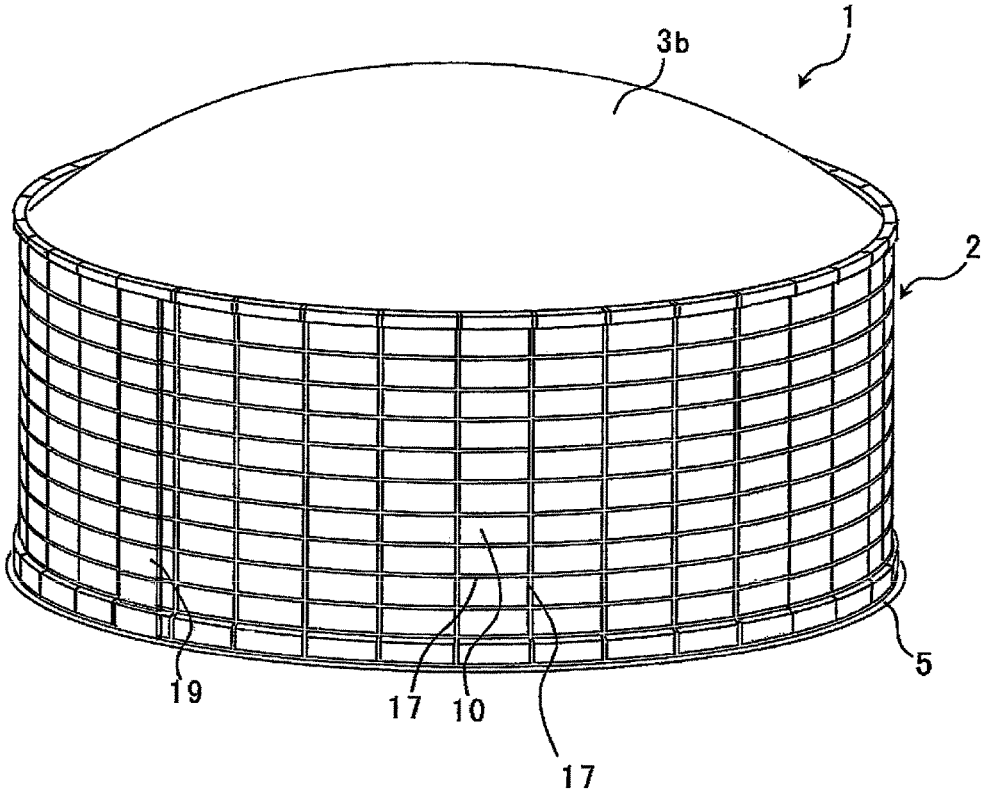
FIG. 1 is a view that shows an LNG tank 1.
Figure 89:
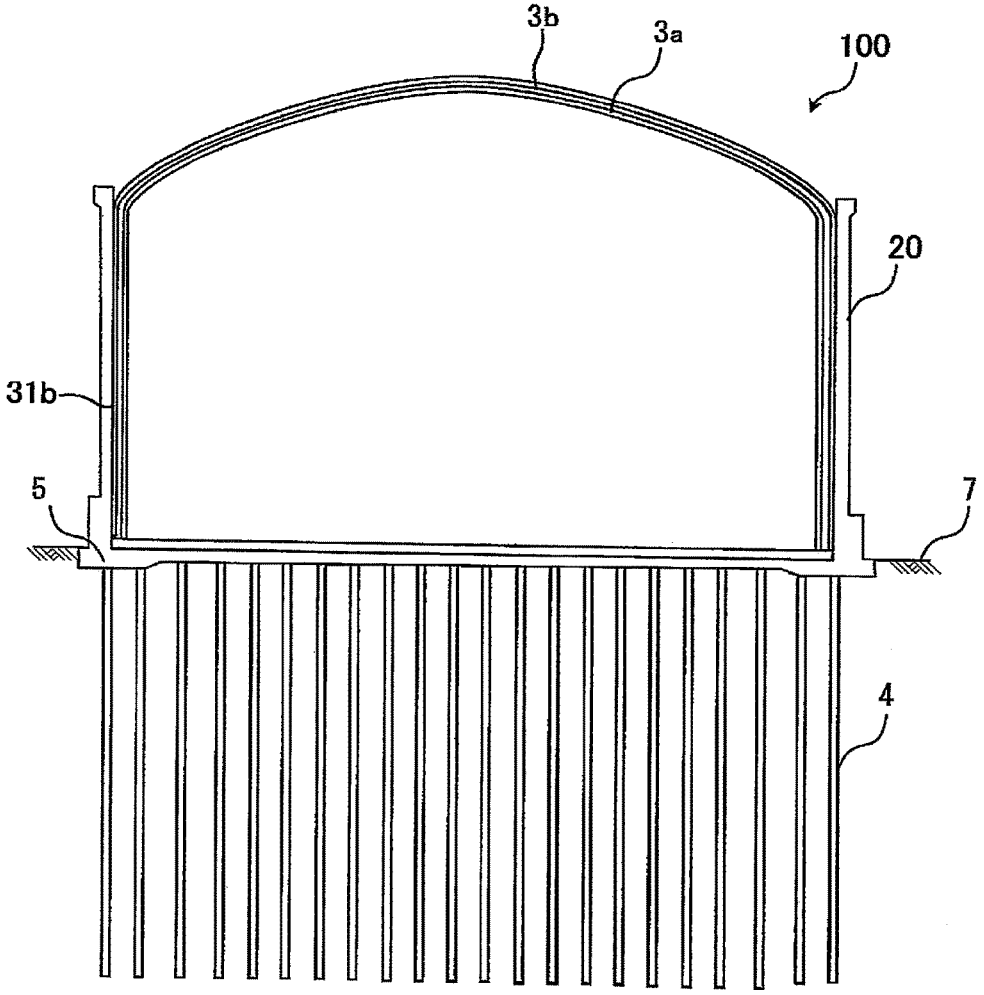
FIG. 89 is a view that depicts the LNG tank 100.

FIG. 1 is a view that shows an LNG tank 1 according to this embodiment of the present invention. In this LNG tank 1, a dike 2 is formed from precast blocks 10 (occasionally referred to as "blocks" in the following description). Other configurations of the LNG tank 1 are substantially the same as the LNG tank 100, which are described with reference to FIG. 89, and the same reference numerals are used in the following description.

The precast blocks 10 are arranged in the circumferential direction of the dike 2 and stacked in the vertical direction. Concrete (filler) is poured and disposed between each two adjacent blocks 10 in the circumferential direction and the vertical direction of the dike 2 such that the concrete forms masonry joints 17 extending in the vertical direction and the circumferential direction of the dike 2. Non-shrinkage cement is used as the concrete, but the present invention is not limited in this regard.

Prestress is imparted to the dike 2 by PC steel members (tension members) arranged in the circumferential direction and the vertical direction. Pilasters 19 are outwardly protruding portions of the dike 2, and are provided for fixing the PC steel members in the circumferential direction.

(2. Block 10)

Figure 2:
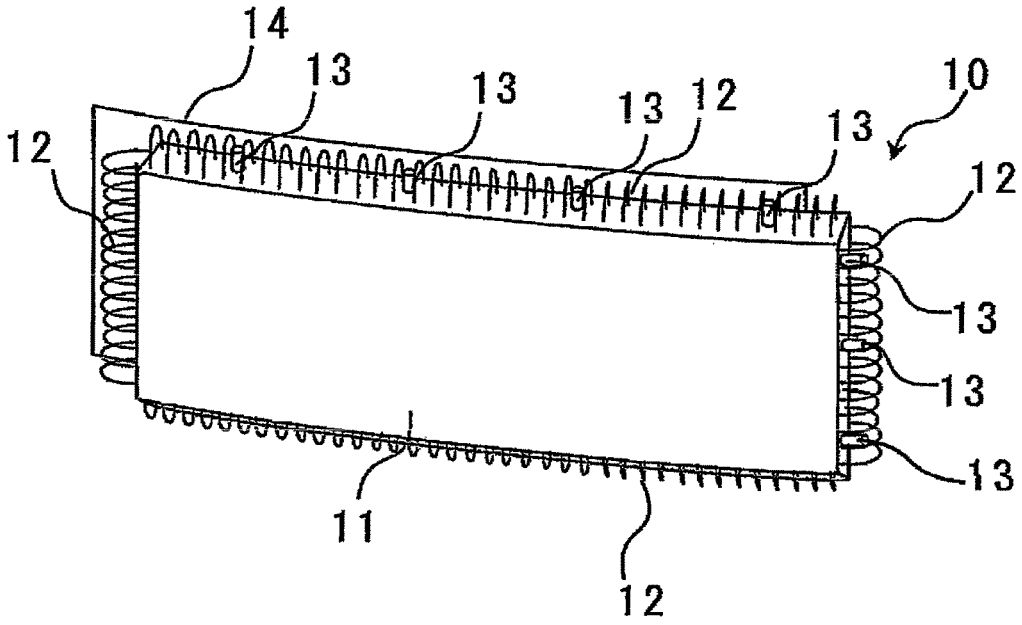
FIG. 2 is a view that shows a block 10.

FIG. 2 illustrates the block 10. The block 10 has a block main body (hereinafter referred to as "main body") 11, loop joints 12, sheath pipes (tubes) 13, a plate 14 and other parts.

Regarding the overall dimension of the block 10, the height is approximately 3.5 m and the width is approximately 7.5 m, for example. It should be noted that the dimensions of the block 10 are not limited to the above-mentioned values as long as the block can be carried and conveyed by a vehicle, can be transferred at a work site, and can easily be built up (installed) at the work site.

The main body 11 is a concrete member that has a rectangular plate shape, and bends in an arc shape that corresponds to the radius of the tank or the like. A bottom face of the main body 11 inclines upward and outward. In this specification, the "outward" is a term when viewed from the dike 2. The term "inward" is used in a similar way.

The loop joints 12 are disposed on the top and bottom faces of the main body 11 as well as on the right and left faces of the main body 11. Each of the loop joints 12 is a protruding portion of the U-shaped reinforcing steel bar from the main body 11, including the bending portion and the straight portions of the U shape. The right-left direction corresponds to the circumferential direction of the dike 2.

The sheath pipes 13 are disposed inside the main body 11 such that they extend in the up-down direction as well as in the right-left direction. Upper and lower ends of those sheath pipes 13 which extend in the up-down direction protrude from the top and bottom faces of the main body 11 respectively, and right and left ends of those sheath pipes 13 which extend in the right-left direction protrude from the right and left faces of the main body 11 respectively. The sheath pipes 13 are used such that the PC steel members pass through the sheath pipes 13.

The plate 14 is a metallic plate member, which is attached to the inner face of the main body 11. The plate 14 is offset from the inner face of the main body 11 such that it protrudes from the main body 11.

In the example shown in FIG. 2, the plate 14 is offset upward and leftward from the inner face of the main body 11 such that the upper end and the left end of the plate 14 protrude upward and leftward from the main body 11, respectively. The upward protruding length of the plate 14 is at least equal to or greater than the width of the masonry joint 17 in the circumferential direction, and the leftward protruding length of the plate 14 is at least equal to or greater than the width of the masonry joint 17 in the vertical direction.

In this embodiment, on the other hand, because the plate 14 is offset upward and leftward from the inner face of the main body 11, the lower end and the right end of the inner face of the main body 11 is not covered with the plate 14.

The foregoing description explains the fundamental structure of the block 10, and it should be noted that the block 10 used for the dike 2 is not limited to the above-described configuration. As will be described below, the block 10 may have a slightly different configuration from the above-described configuration depending upon the location and the like of the block 10.

(3. Method of Constructing the Dike 2)

Now, a method of constructing the dike 2 with the blocks 10 will be described.

Figure 3:
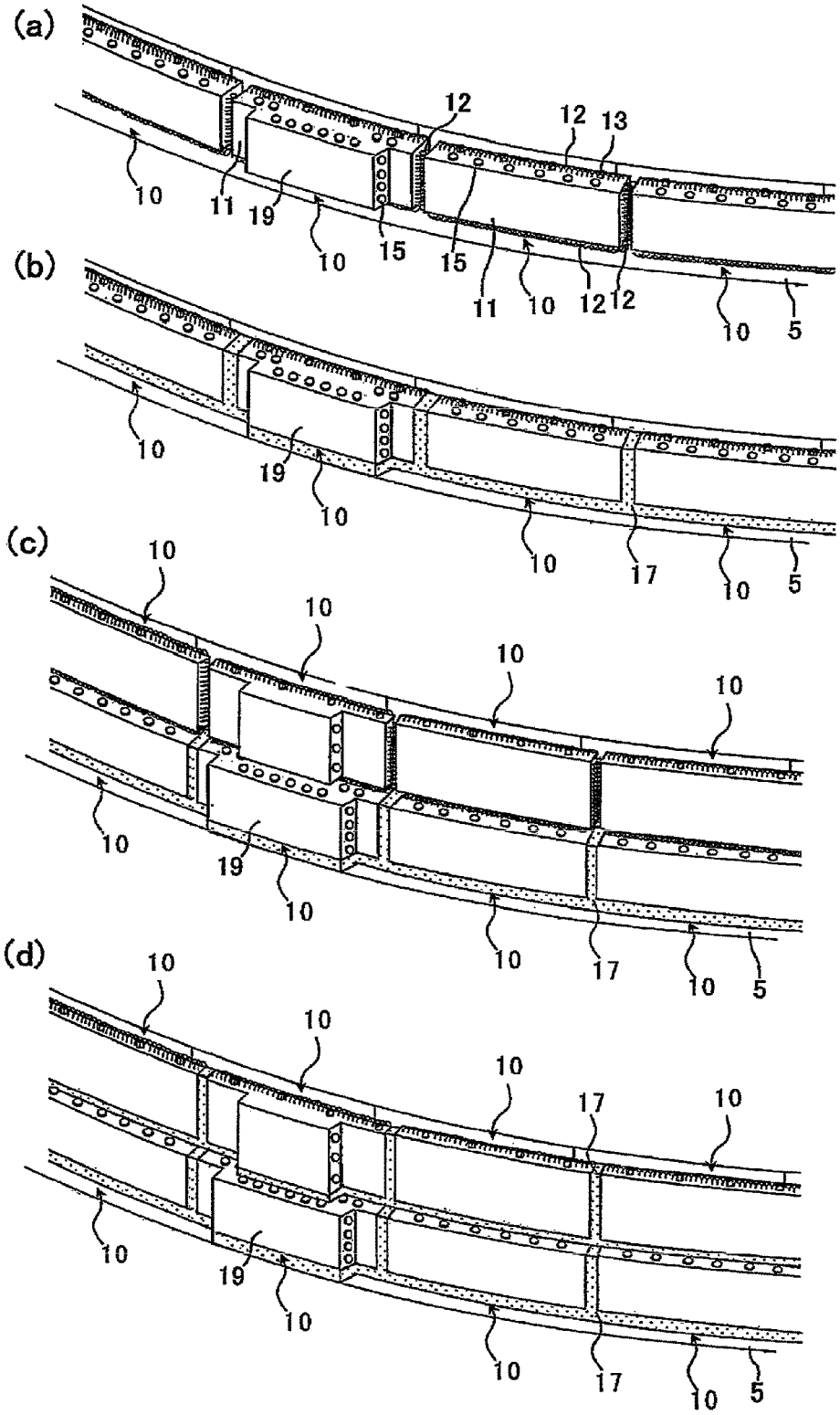
FIG. 3 is a set of views that show a method of constructing a dike 2.

In this embodiment, after the bottom slab 5 and other parts are constructed, the blocks 10 of the first row (bottom row, first tier) are arranged in the circumferential direction of the dike 2, as shown in FIG. 3(*a*).

The main body 11 of each of the blocks 10 of the first row, which are disposed on the bottom slab 5, has a thick(er) wall because the PC steel members are disposed double, i.e., inside and outside, in the vertical direction. The loop joints 12 and the sheath pipes 13 are provided on an inner portion of the main body 11 in a similar manner to the above-described configuration, and the fixing elements 15 for use with the PC steel members are provided on the top face of an outer portion of the main body 11. The fixing elements 15 are connected to the sheath pipes extending in the up-down direction, which are disposed in the outer portion of the main body 11, and the lower ends of the sheath pipes protrude from the bottom face of the outer portion of the main body 11. The loop joints 12 are also provided on the bottom face of the outer portion of the main body (see FIG. 5(*b*), which will be described below).

As will be described later, the sheath pipes 13 extending in the up-down direction and provided on the inner portion of each main body 11 are connected to the sheath pipes 13 extending in the up-down direction and provided on each block 10 of the second row. Similarly, the sheath pipes 13 extending in the up-down direction and provided in two main bodies 11 of each two stacked blocks are connected to each other. The sheath pipes 13 extending in the up-down direction and provided in the main body 11 of each block 10 of the uppermost row (top row) are connected to the fixing elements 15 provided on the top face of the main body 11, respectively (see FIG. 9(*a*), which will be described below).

In this embodiment, only the blocks 10 of the first row have the thick wall to place the vertical PC steel members double, i.e., inside and outside, thereon. However, if necessary, the blocks 10 of a plurality of rows may have the thick wall.

When the block 10 has the pilaster 19, the main body 11 of the block 10 protrudes outward, and the fixing elements 15 are provided on the side faces of the protruding main body 11. The fixing elements 15 are connected to the sheath pipes (not shown) extending in the right-left direction and provided in the main body 11.

Figure 4:
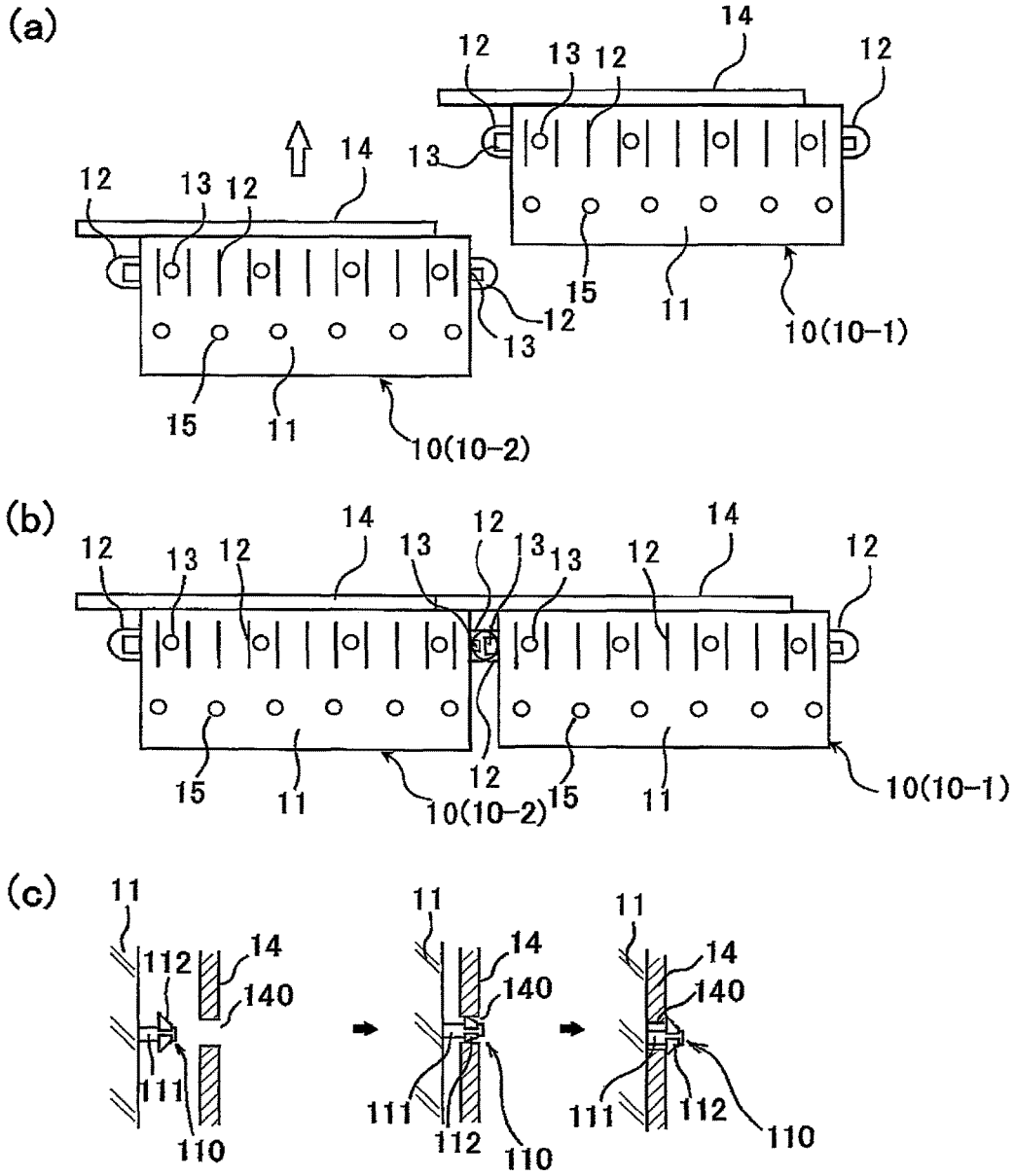
FIG. 4 is another set of views that show the method of constructing the dike 2.

When the blocks 10 are arranged in the circumferential direction, the block 10-2 is moved from the outside of the dike 2 toward the inside, for example, as indicated by the arrow in FIG. 4(*a*), which is a schematic view of the block arrangement, such that the block 10-2 is positioned on the left of the block 10-1, as shown in FIG. 4(*b*). The loop joints 12 of the adjacent blocks 10-1 and 10-2 overlap one after another in the up-down direction.

The left end of the plate 14 of the block 10-1 overlaps the inner face of the right end of the main body 11 of the block 10-2. With this positional relationship, the left end of the plate 14 of the block 10-1 is fixed. The plate 14 of the block 10-1 and the plate 14 of the block 10-2 are continuous in the circumferential direction of the dike 2.

FIG. 4(*c*) is a view useful to describe a method of fixing the plate 14. In this embodiment, as shown in the left illustration, a fixation tool 110 that has a shaft 111 and a blade 112 at the free end of the shaft 111 is provided on the inner face of the right end of the main body 11 of the block 10. On the other hand, a hole 140 is formed in the left end of the plate 14. The blade 112 is elastically supported by a spring or the like such that the blade 112 can retract into the shaft 111.

When the block 10-2 is disposed, as shown in FIGS. 4(*a*) and 4(*b*), the fixation tool 110 at the right end of the main body 11 of the block 10-2 is inserted into the hole 140 of the left end of the plate 14 of the block 10-1. As shown in the middle illustration and the right illustration of FIG. 4(*c*), the blade 112 retracts in the shaft 111 when the blade 112 moves through the hole 140, and elastically returns to the original position after the blade 112 passes through the hole 140. As a result, the left end of the plate 14 of the block 10-1 engages with the fixation tool 110, and the position of the plate 14 is fixed by the fixation tool. The above-described work can be conducted from the outside of the dike 2. Thus, it does not interfere with the inner facility construction work.

In this embodiment, as shown in FIG. 4(*a*) and other drawings, a next block 10 is disposed on the left of the block 10, and the plate 14 protrudes leftward from the main body 11 to allow the above-described fixing method to be performed. It should be noted that if a next block 10 is disposed on the right of the block 10, and the above-described fixing method should be used, the plate 14 may protrude rightward from the main body 11, and the fixation tool may be provided on the inner face of the left end of the main body 11.

Figure 5:
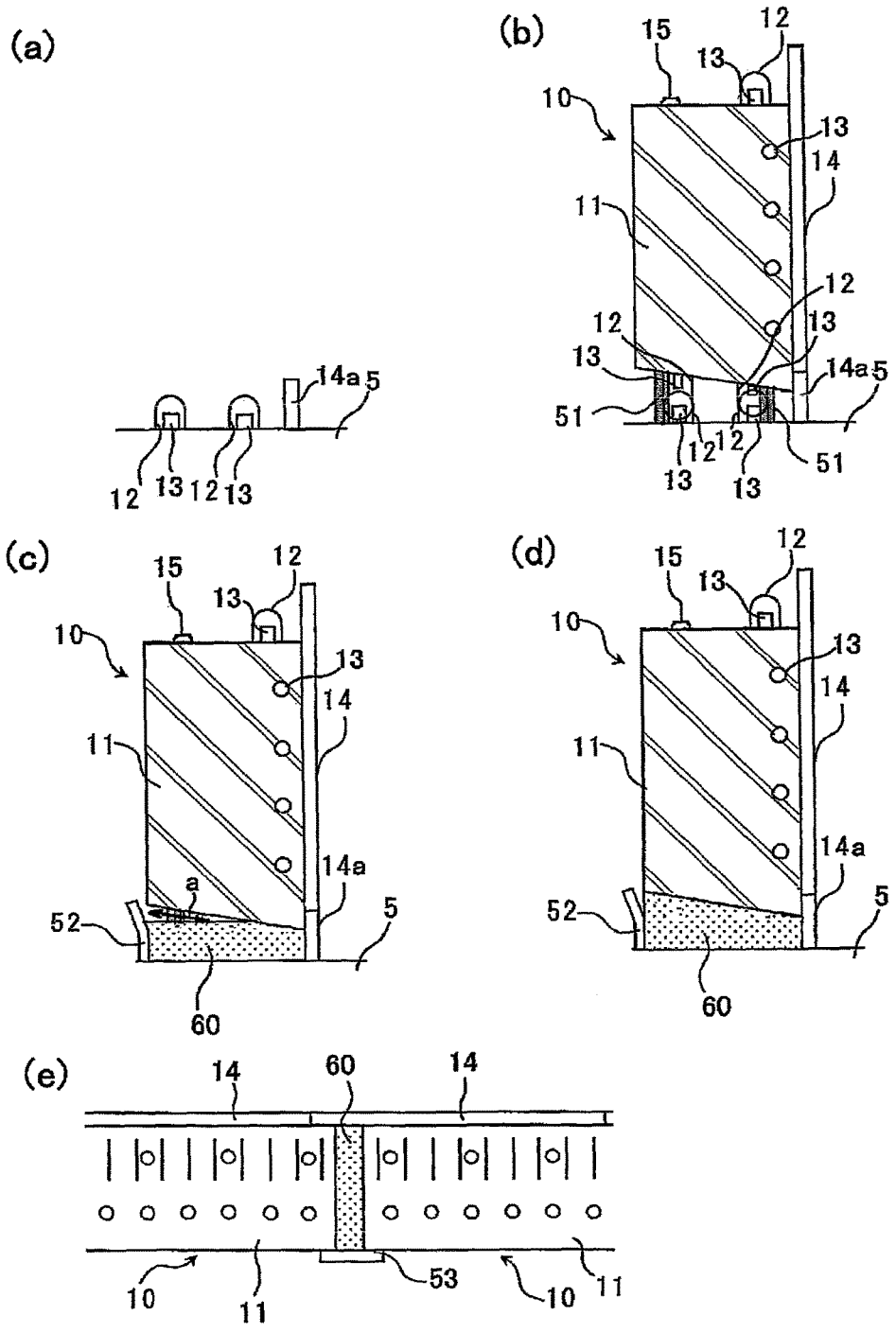
FIG. 5 is still another set of views that show the method of constructing the dike 2.

As depicted in FIG. 5(*a*), the loop joints 12, the sheath pipes 13 and the plates 14*a* are arranged on the bottom slab 5 along the outer circumference of the dike 2. When the blocks 10 of the first row are disposed in the above-described manner, as shown in FIG. 5(*b*), the loop joints 12 of the bottom slab 5 overlap the loop joints 12 provided on the bottom faces of the respective main bodies 11 of the blocks 10 in the circumferential direction of the dike 2.

The plates 14*a* of the bottom slab 5 are fixed to the inner faces of the lower ends of the respective main bodies 11 of the blocks 10 with the fixation tools (not shown) and the like in a similar manner to the above-described configuration such that the plates 14*a* become continuous to the plates 14 of the blocks 10 in the vertical direction. The blocks 10 are arranged and supported by support members 51 provided on the bottom slab 5. The height of each of the support members 51 is adjustable, and the adjustment may be made depending upon the width of the masonry joint 17 and a purpose of providing the support members, e.g., maintaining the horizontal posture of the blocks 10.

It should be noted that a ring-shaped convex portion may be provided on the bottom slab 5 along the outer circumference of the dike 2, and the loop joints 12, the sheath pipes 13 and the plates 14*a* may be provided on the convex portion.

After the blocks 10 are disposed in the above-described manner, the sheath pipes 13 of each two adjacent blocks 10 in the circumferential direction are connected to each other, the bottom slab 5 and the sheath pipes 13 of the blocks 10 are connected to each other, and necessary reinforcing bars (not shown) are disposed in the masonry joints 15.

Figure 6:
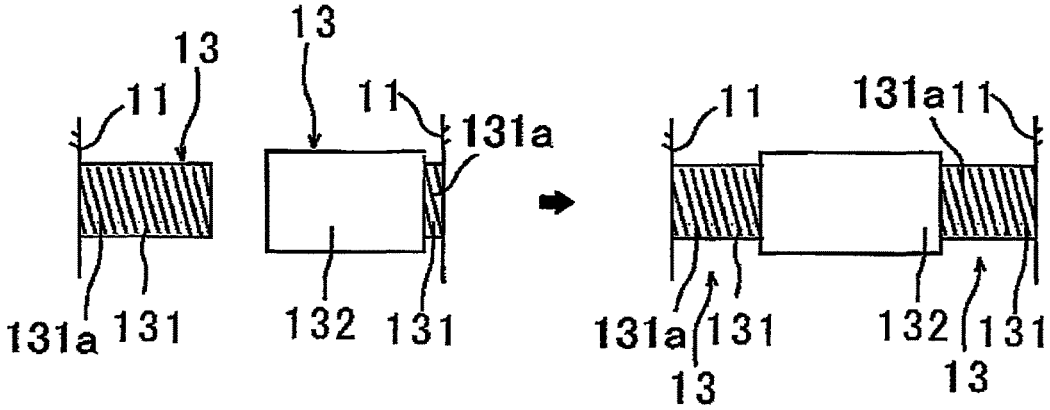
FIG. 6 is a view useful to describe the connection of sheath pipes 13.

FIG. 6 is a view useful to describe the above-described connection of the sheath pipes 13. FIG. 6 illustrates an example when the sheath pipes 13 of two adjacent blocks 10 in the circumferential direction are connected to each other.

In this embodiment, as shown in the left illustration, the end of one of the sheath pipes 13 has a connecting tube 132 placed over a main body 131. A spiral convex thread 131*a* is formed on the outer circumferential face of the main body 131, and the thread engages with a spiral groove (not shown) formed in the inner circumferential face of the connecting tube 132. The connecting tube 132 is pulled out from the main body 131 as the connecting tube 132 is rotated. The end of the connecting tube 132, which is pulled out, is fitted over the main body 131 of the other sheath pipe 13, and the connecting tube 132 is rotated to connect the two sheath pipes 13 to each other, as shown in the right illustration.

After that, outer formworks 52 are disposed, as shown in FIG. 5(*c*), and concrete 60 is poured and disposed between the bottom faces of the main bodies 11 of the blocks 10 and the bottom slab 5. On this occasion, the plates 14*a* of the bottom slab 5 serve as inner formworks. An upper portion of each outer formwork 52 bends outward and a gap is left between each main body 11 of the block 10 and the associated outer formwork to allow the pouring and disposing of the concrete. The pouring and disposing of the concrete 60 is conducted from the outside while using this gap.

Because the bottom face of the main body 11 of each block 10 inclines upward and outward, the air moves along the inclination, as indicated by the arrow a, after the concrete 60 reaches the bottom face of the main body during the pouring and disposing of the concrete 60. Thus, the air is released to the outside from the gap. Accordingly, a trouble such as the trapping of the air below the bottom face of the main body 11 does not occur. The structure obtained after the pouring and disposing of the concrete 60 in the above-mentioned manner is shown in FIG. 5(*d*).

The outer formworks 53 are disposed as shown in FIG. 5(*e*), and the concrete 60 is poured and disposed between the main bodies 11 of each two adjacent blocks 10 in the circumferential direction. On this occasion, the left end of the plate 14 of one of the two blocks 10 serves as the inner formwork.

The concrete 60 is poured and disposed between the blocks 10 and the bottom slab 5 and between each two adjacent blocks 10 in the circumferential direction in the above-described manner, and the masonry joints 17 are formed in the circumferential direction of the dike 2 and in the vertical direction of the dike 2. The resulting structure is shown in FIG. 3(*b*).

Subsequently, as shown in FIG. 3(*c*), the blocks 10 of the second row are arranged in the circumferential direction of the dike 2 in a similar manner.

Figure 7:
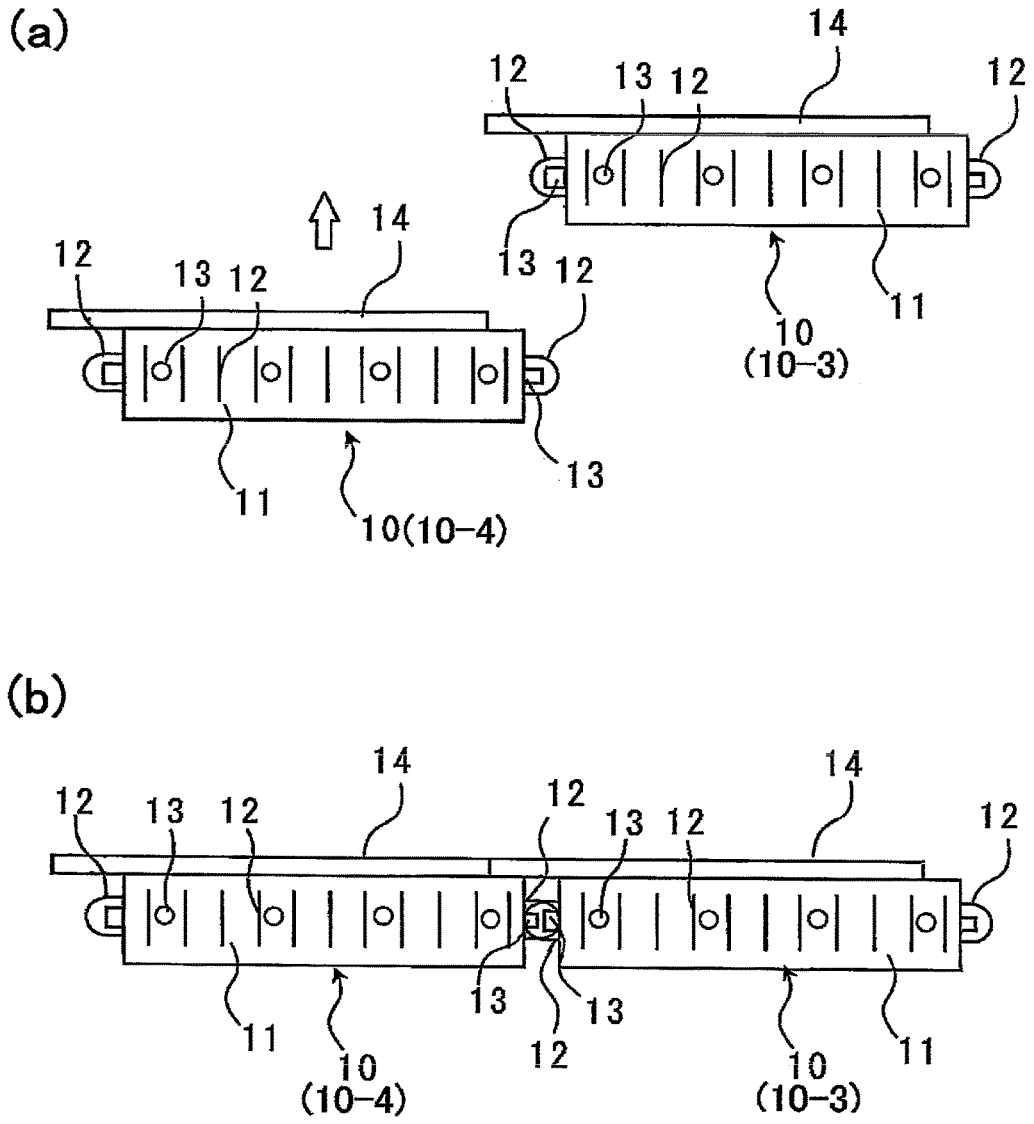
FIG. 7 is a set of views that show the method of constructing a dike 2.

On this occasion, the block 10-4 is moved from the outside of the dike 2 toward the inside, as indicated by the arrow in FIG. 7(*a*), such that the block 10-4 is positioned on the left of the block 10-3, as shown in FIG. 7(*b*). Similar to the above-described manner, the loop joints 12 of the adjacent blocks 10-3 and 10-4 overlap one after another in the up-down direction.

Similar to the above-described manner, the left end of the plate 14 of the block 10-3 is fixed with a fixation tool (not shown) and the like provided on the inner face of the right end of the block 10-4 such that the plate 14 of the block 10-3 becomes continuous to the plate 14 of the block 10-4 in the circumferential direction of the dike 2.

Figure 8:
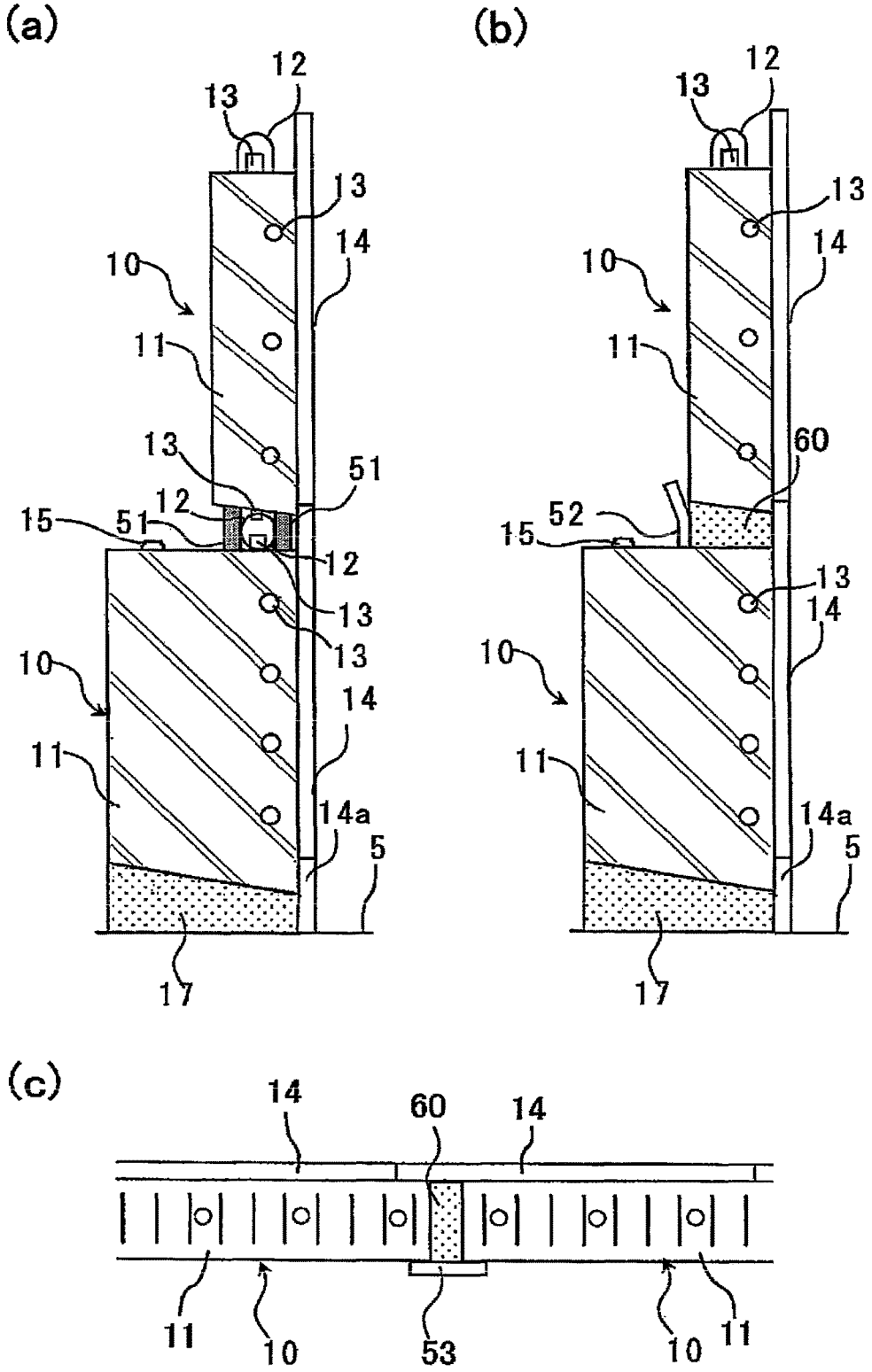
FIG. 8 is another set of views that show the method of constructing the dike 2.

As the blocks 10 of the second row are disposed in the above-described manner, as shown in FIG. 8(*a*), the loop joints 12 on the top faces of the inner portions of the respective main bodies 11 of the blocks 10 of the first row overlap the loop joints 12 on the bottom faces of the main bodies 11 of the blocks 10 of the second row in the circumferential direction. Similar to the above-described manner, the blocks 10 of the second row are supported by the supporting members 51 disposed on the top faces of the main bodies 11 of the blocks 10 of the first row.

The plates 14 that protrude upward from the respective main bodies 11 of the blocks 10 of the first row are fixed to the inner faces of the lower ends of the corresponding main bodies 11 of the blocks 10 of the second row with fixation tools (not shown) in a similar manner to the above-described manner. Thus, the plates 14 of the blocks 10 of the first row become continuous to the plates 14 of the blocks 10 of the second row in the vertical direction.

After that, the sheath pipes 13 of each two adjacent blocks 10 in the circumferential direction of the second row are connected to each other, and the sheath pipes 13 of the blocks 10 of the first row are connected to the sheath pipes 13 of the blocks 10 of the second row in a similar manner to the above-described manner. Also, necessary reinforcing bars (not shown) are provided in the masonry joints 17.

Subsequently, as shown in FIG. 8(*b*), outer formworks 52 that are similar to the above-described outer formworks are disposed, and the concrete 60 is poured and disposed between the main bodies 11 of the blocks 10 of the first row and the main bodies 11 of the blocks 10 of the second row. The upper ends of the plates 14 of the blocks 10 of the first row serve as inner formworks. Because of the inclination of the bottom face of each main body 11 of each block 10 of the second row, a trouble such as the trapping of the air below the bottom face of the main body 11 during and after the pouring and disposing of the concrete 60 does not occur.

The outer formwork 53 is disposed as shown in FIG. 8(*c*), and the concrete 60 is also poured and disposed between the main bodies 11 of each two adjacent blocks 10 in the circumferential direction. The left end of the plate 14 of the one of the two blocks 10 serves as the inner formwork in a similar manner to the above-described configuration.

As described above, the concrete 60 is poured and disposed between the blocks 10 of the first row and the blocks 10 of the second row, and between each two adjacent blocks 10 of the second row in the circumferential direction, and the masonry joints 17 are formed extending in the circumferential direction of the dike 2 and in the vertical direction of the dike 2. This condition is illustrated in FIG. 3(*d*).

Figure 9:
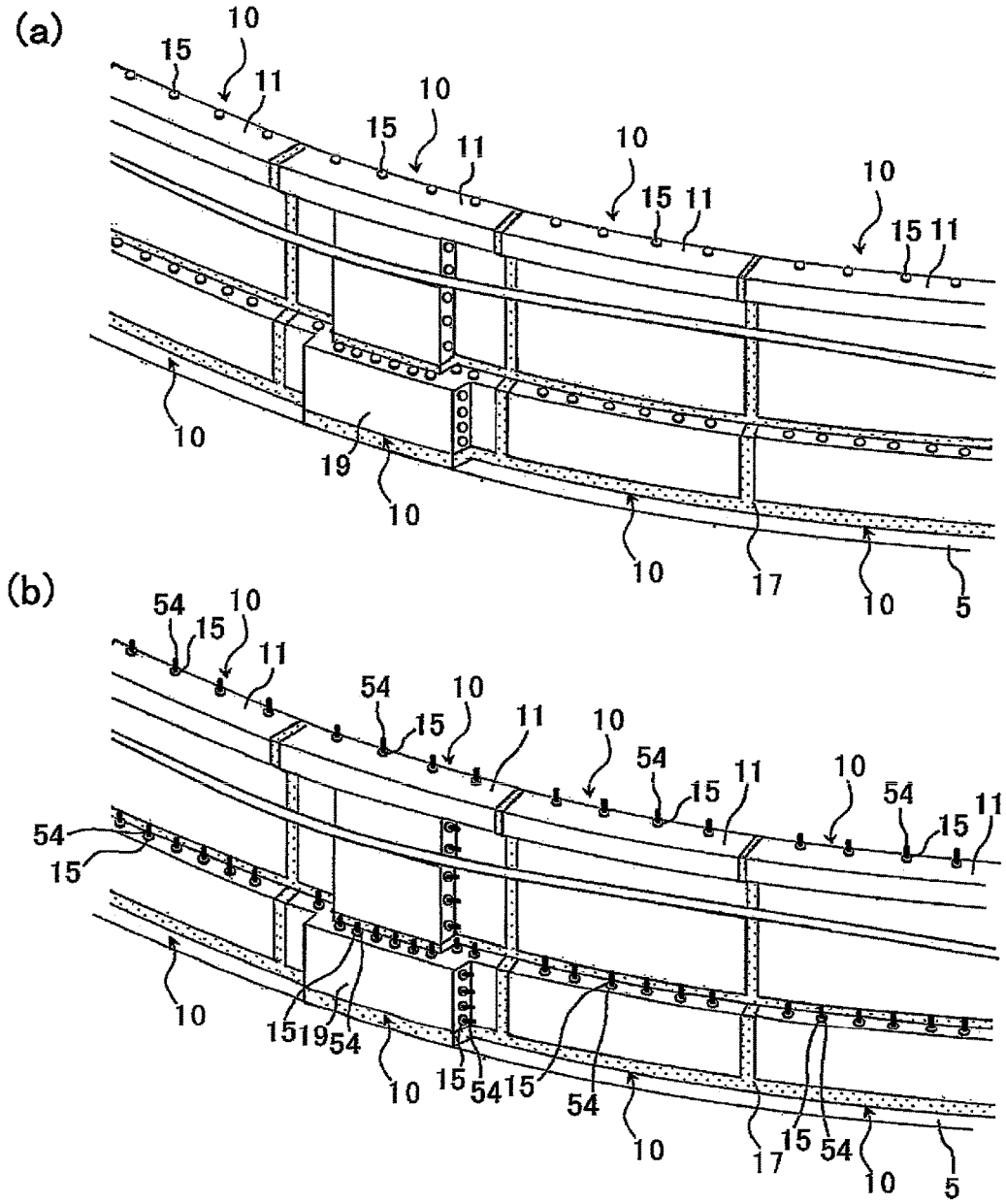
FIG. 9 is still another set of views that show the method of constructing the dike 2.

In this manner, the blocks 10 are arranged in the circumferential direction of the dike 2 and stacked in the vertical direction, and that the masonry joints 17 are formed. Accordingly, the blocks 10 are disposed up to the top row of the dike 2, as shown in FIG. 9(*a*).

It should be noted that an upper end of each of the main bodies 11 of the blocks 10 in the top row has an enlarged width. Also, no coupling joints are provided on the upper face of each main body 11, but the fixing elements 15 are provided on the upper face of each main body 11. The fixing elements 15 are connected to the respective sheath pipes (not shown) extending in the up-down direction inside each main body 11.

The plates 14 of the respective blocks 10 are continuous in the circumferential direction of the dike 2 and in the vertical direction of the dike 2, as described above. Thus, the inner side of the dike 2 is covered with the plates 14, and the plates 14 constitute the side wall portion of the outer tank 3*b*.

It should be noted that the construction work for the inner facility, such as a roof of the outer tank 3*b* and the inner tank 3*a*, may start in an early stage, i.e., when the blocks 10 are stacked to a certain extent. Because no work is necessary inside the dike 2 when the dike 2 is constructed, there is no interference between the construction work for the dike and the construction work for the inner facility. This also contributes to the early start of the construction work for the inner facility and the work period reduction. In some occasions, it may be possible to start the construction work for the dike 2 and the construction work for the inner facility at the same time.

Finally, the prestress is imparted to the dike 2 by the PC steel members 54, as shown in FIG. 9(*b*). As the construction work for the inner facility, such as the roof of the outer tank 3*b* and the inner tank 3*a*, is completed, the construction of the LNG tank 1 is finished as shown in FIG. 1.

The above-mentioned fixing elements 15 of the blocks 10 of the uppermost row and the fixing elements 15 of the blocks 10 of the first row are used to fix the PC steel members 54 extending in the vertical direction. The fixing elements 15 on the side faces of the pilasters 19 are used to fix the PC steel members 54 in the circumferential direction. These PC steel members 54 are provided such that the PC steel members 54 extend through the sheath pipes 13 disposed in the blocks 10 and on the bottom slab 5.

Figure 10:
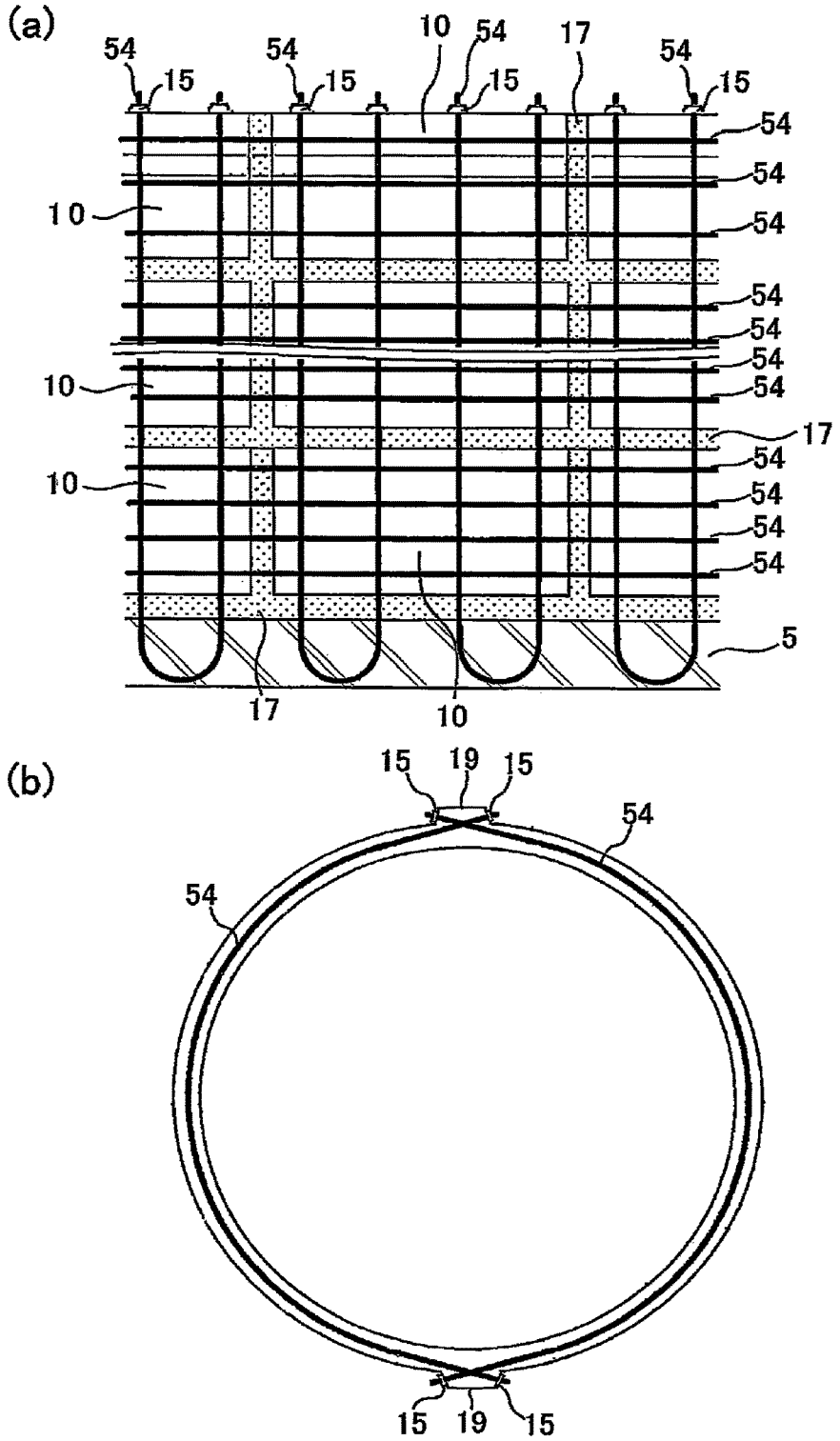
FIG. 10 is a set of views that show an arrangement of PC steel members 54.

FIG. 10(*a*) is a view in which the arrangement of the PC steel members 54 is indicated by the bold lines. The vertical direction of the drawing is the vertical direction of the dike 2, and the horizontal direction of the drawing is the circumferential direction of the dike 2.

As illustrated in the drawing, each of the PC steel members 54 extending in the vertical direction is turned like "U," and both ends of each PC steel member 54 are connected to the fixing elements 15 of the associated block 10 in the uppermost row, respectively. The turning back portion of each PC steel member 54 arrives at the bottom slab 5. The PC steel members 54 are disposed while avoiding the masonry joints in the vertical direction. Similarly, the PC steel members 54 are also provided in the outer portions of the blocks 10 of the first row.

On the other hand, the PC steel members 54 extending in the circumferential direction avoid the masonry joints 17 in the circumferential direction. As shown in FIG. 10(*b*), the PC steel members 54 are fixed by the fixing elements 15 provided on the side faces of the pilasters 19.

As described above, this embodiment can reduce the work period of the dike construction and start the construction work for the inner facility in an early stage, thereby achieving the reduction in the overall construction work period, because the dike 2 is constructed by using the precast blocks 10, and the pouring and disposing of the concrete is only conducted to the masonry joints at the construction site, i.e., the pouring and disposing of the concrete at the construction site is reduced to the minimum. In addition, the concrete structure, in which the coupling joints and the like are embedded, is used as the masonry joints 17 between the blocks 10. Therefore, the concrete structure that possesses the proved reliability as a sufficient structural material to be used at a very low temperature is used, and the precast blocks 10 are united as an RC wall. This realizes with high reliability that the dike 2, including the masonry joints 17, has a load bearing capacity, durability, and liquid-tightness that are necessary to the dike 2.

Those PC steel members 54 which extend in the circumferential direction avoid the masonry joints 17 extending in the circumferential direction of the dike 2, and those PC steel members 54 which extend in the vertical direction avoid the masonry joints 17 extending in the vertical direction of the dike 2. Thus, it is not necessary to dispose the sheath pipes, which are used for the PC steel members 54 to pass therethrough, on the masonry joints 17. Accordingly, the construction work becomes easy, and the masonry joints 17 have an enhanced reliability.

In this embodiment, because the loop joints 12 are used, it is possible to ensure a necessary load bearing capability and other properties to the masonry joints 17 even if the joint length (the protruding length of the joint reinforcing steel bar from the main body 11) is short. Thus, it is possible to reduce the width of each masonry joint 17 to approximately 50 cm-60 cm. This can further reduce an amount of concrete 60 to be poured and disposed, and reduce the construction work period of the dike 2. Although no PC steel members 54 are disposed on the masonry joints 17, the PC steel members 54 are densely disposed in the blocks 10, and therefore it is possible to dispose an almost same amount of tension members, as a whole, when compared to a conventional construction method. In addition, because the loop joints 12 are used, there is another advantage that the blocks 10 can be built up with a low cost.

Because the bottom face of the main body 11 of each block 10 inclines upward and outward of the dike 2, it is possible to prevent the air gap from being created below the main body 11 of the block 10 when the concrete 60 is poured and disposed as the masonry joint 17.

Because the plate 14 protrudes upward or laterally from the associated main body 11, it is possible to utilize the plate 14 as the inner formwork when the concrete 60 is poured and disposed as the masonry joint 17. Thus, a work such as disposing the inner formwork from the inside of the dike 2 becomes unnecessary.

Because the plates 14 of the respective blocks 10 are continuous in the circumferential direction of the dike 2 and in the vertical direction of the dike 2, and the inner face of the dike 2 is covered with the plates 14, the plates 14 can form the side wall portion of the outer tank 3*b* of the LNG tank 1.

The present invention is, however, not limited to this configuration. For example, the tank structure including the dike 2 of this embodiment may be used for not only the LNG tank but an LPG (liquefied petroleum gas) tank or the like.

Also, the shapes and the like of the dike 2 and the main body 11 of the block 10 may be altered. For example, the shape of the dike 2 is not limited to the circular shape, when looked at in the plan view, as shown in FIG. 1, but the shape of the dike 2 may be a polygonal shape when looked at in the plan view. The shape of the block 10 may also vary with the shape of the dike 2 in an appropriate manner. For example, each of the main bodies 11 may be a flat plate having no curving portion, and the dike 2 that is polygonal in the plan view may be constructed by assembling such main bodies. The blocks 10 of the lowermost row may be united to a portion of the outer periphery of the bottom slab 5, as disclosed in Patent Literature Document 1. In this configuration, it is possible to dispense with the coupling joints at the bottom faces of the main bodies of the blocks 10.

Figure 11:
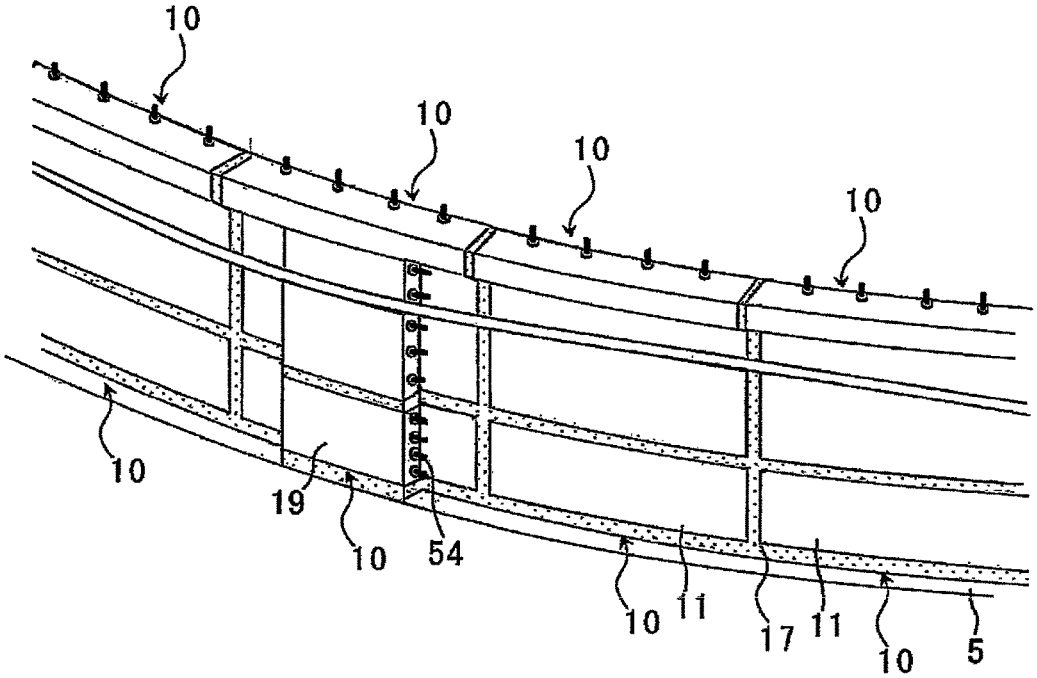
FIG. 11 is a view that shows another example of the dike 2.

In this embodiment, each of the blocks 10 of the first row has a thick wall, and the prestress is applied to the outer portion of the block in the vertical direction. However, this configuration is not indispensable. As shown in FIG. 11, the wall thickness of each block 10 of the first row may be thin and equal to the wall thickness of the block of the second and remaining rows, and the prestress may be dispensed with.

Now, examples that have different coupling joints for the precast blocks will be described in a second embodiment and a third embodiment. The second and third embodiments will be described while primarily focusing on the differences between them and the first embodiment, and the description of other configurations will be omitted.

Second Embodiment

Figure 12:
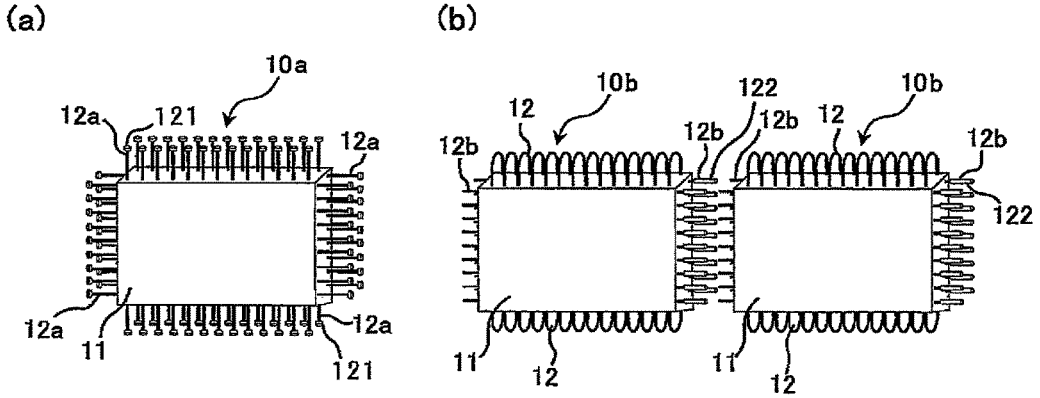
FIG. 12 is a set of views that show an arrangement of coupling joints.

FIG. 12(*a*) schematically illustrates the arrangement of the coupling joints of the second embodiment. In this drawing, the sheath pipes 13 and the plate 14 are not illustrated.

In the block 10*a* of FIG. 12(*a*), each of coupling joints 12*a* has a fixing element 121 at a free end of the reinforcing steel rod or bar, and the coupling joints 12*a* are provided on the top and bottom faces of the main body 11 as well as on the right and left faces of the main body 11.

When the coupling joints 12*a* having the fixing elements are disposed in this manner, there are advantages that it is possible to reduce the length of each coupling joint while ensuring necessary load bearing capability and other properties to the masonry joints 17 whereby the width of each masonry joint 17 can be reduced. When the coupling joints 12*a* having the fixing elements are used, there are advantages that the work of disposing the blocks 10*a* is easy, and the interference between the reinforcing steel bars in the masonry joints 17 and the coupling joints 12*a* is unlikely to occur. It should be noted that each of the coupling joints 12*a* having the fixing elements may have a free end that bends inward. This configuration provides an advantage that a covering depth (thickness) from the outer surface of the concrete 60 of the masonry joint 17 to the fixing element 121 becomes large.

Third Embodiment

FIG. 12(*b*) is similar to FIG. 12(*a*) and illustrates the arrangement of the coupling joints of the third embodiment.

In the block 10*b* of FIG. 12(*b*), the loop joints 12 are disposed on the top and bottom faces of each main body 11, and mechanical joints 12*b* are disposed on the right and left faces of the main body 11. In this example, those mechanical joints 12*b* which are provided on one of the right and left faces are male joints, and those mechanical joints 12*b* which are provided on the other of the right and left faces are female joints. As the free ends of the male joints are inserted and fixed in the couplers 122 of the female joints, the male joints and the female joints of two adjacent blocks 10*b* are connected to each other.

When the mechanical joints 12*b* are disposed in this manner, there are advantages that it is possible to reduce the length of each coupling joint while ensuring necessary load bearing capability and other properties to the masonry joints 17 whereby the width of each masonry joint 17 can be reduced. Also, there are advantages that the coupling joints have reliable strength, and the interference between the reinforcing steel bars in the masonry joints 17 and the coupling joints is unlikely to occur.

It should be noted that the arrangements of the coupling joints are not limited to the above-described example of FIG. 12(*a*), the above-described example of FIG. 12(*b*) and the above-described example of FIG. 2. For example, the coupling joints to be provided on the top and bottom faces and the right and left faces may include a combination of any of the loop joints 12, the coupling joints 12*a* having the fixing elements, the mechanical joints 12*b*, and other suitable joints. Specifically, the mechanical joints 12*b* may be provided on the top and bottom faces as well as the right and left faces, or the mechanical joints 12*b* may be provided on the right and left faces and the coupling joints 12*a* having the fixing elements may be provided on the top and bottom faces.

Next, examples that use different methods for fixing the plates will be described in a fourth embodiment to a seventh embodiment. Similar to the above-described embodiments, the fourth to seventh embodiments will be described while primarily focusing on the differences between them and the first embodiment, and the description of other configurations will be omitted.

Fourth Embodiment

Figure 13:
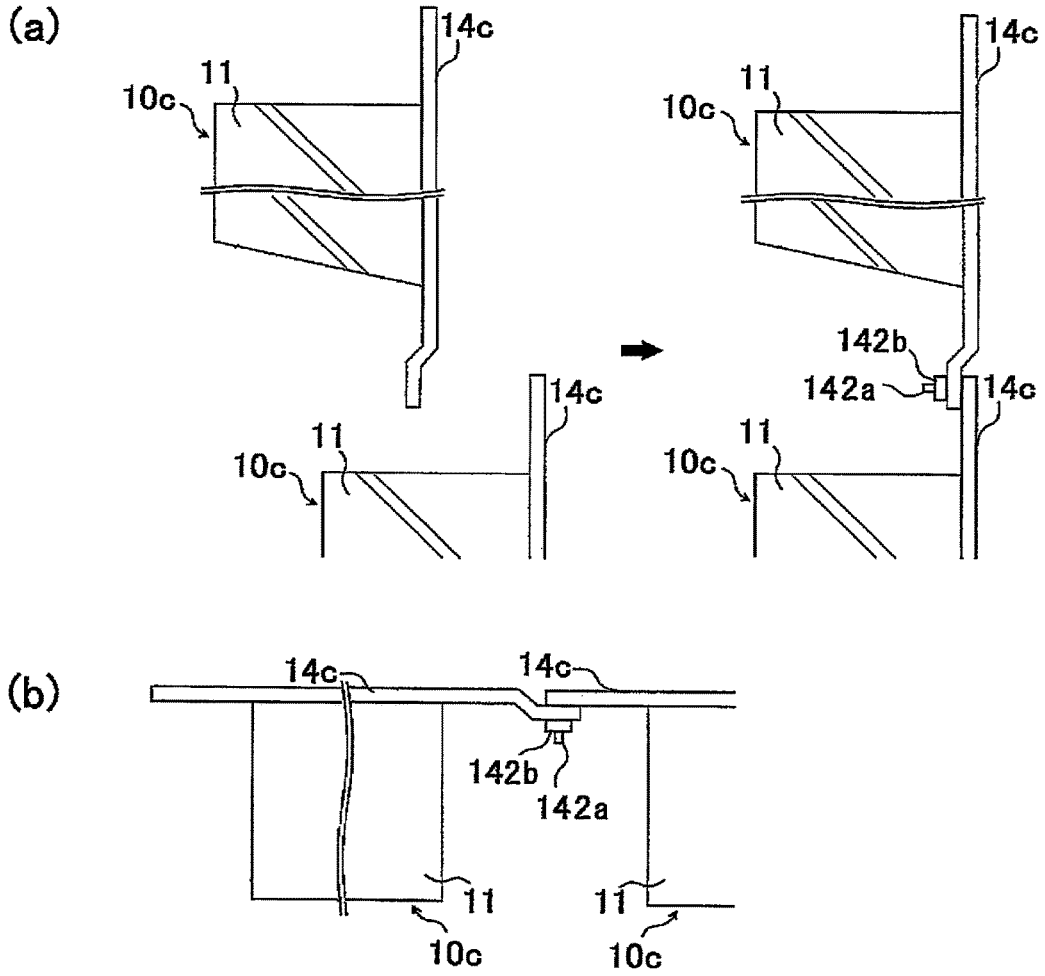
FIG. 13 is a set of views that show a method of fixing plates 14*c*.

FIG. 13 is a set of views that show a method of fixing the plates 14*c* according to the fourth embodiment. It should be noted that for the sake of simplification, FIG. 13 only illustrates the main body 11 of the block 10*c* and the plate 14*c*. This also applies to FIG. 14 to FIG. 16, which will be described later.

FIG. 13(*a*) depicts an example of arranging the blocks 10*c* in the vertical direction of the dike 2. As shown in the left illustration, each block 10*c* has the plate 14*c* that protrudes upward and downward from the main body 11, and the plate 14*c* bends such that the lower end of the plate 14*c* is offset outward. A plurality of screw holes (not shown) are formed at the upper end and the lower end of the plate 14*c* such that the screw holes are spaced from each other in the right-left direction of the plate 14*c* (in the direction perpendicular to the drawing sheet).

In this example, as shown in the right illustration, the lower end of the plate 14*c* of the upper block 10*c* overlaps the upper end of the plate 14*c* of the lower block 10*c*, and the positions of the screw holes of the two plates 14*c* are aligned with each other. Screws 142*a* are inserted into the screw holes, and nuts 142*b* are engaged over the screws 142*a* to position and fix the two plates 14*c*.

The above-described process applies when the blocks 10*c* are arranged in the circumferential direction of the dike 2. Specifically, as shown in FIG. 13(*b*), the plate 14*c* of each main body 11 also protrudes rightward and leftward from the main body 11, and the right end of the plate 14*c* is offset outward. A plurality of screw holes (not shown) are formed at the right end and the left end of the plate 14*c* such that the screw holes are spaced from each other in the up-down direction of the plate 14*c* (in the direction perpendicular to the drawing sheet).

As shown in FIG. 13(*b*), the left end of the plate 14*c* of one of the two blocks 10*c* overlaps the right end of the plate 14*c* of the other block 10*c*, and the positions of the screw holes of the two plates 14*c* are aligned with each other. Similar to the above-described manner, the two plates 14*c* are positioned and fixed by the screws 142*a* and the nuts 142*b*.

Fifth Embodiment

Figure 14:
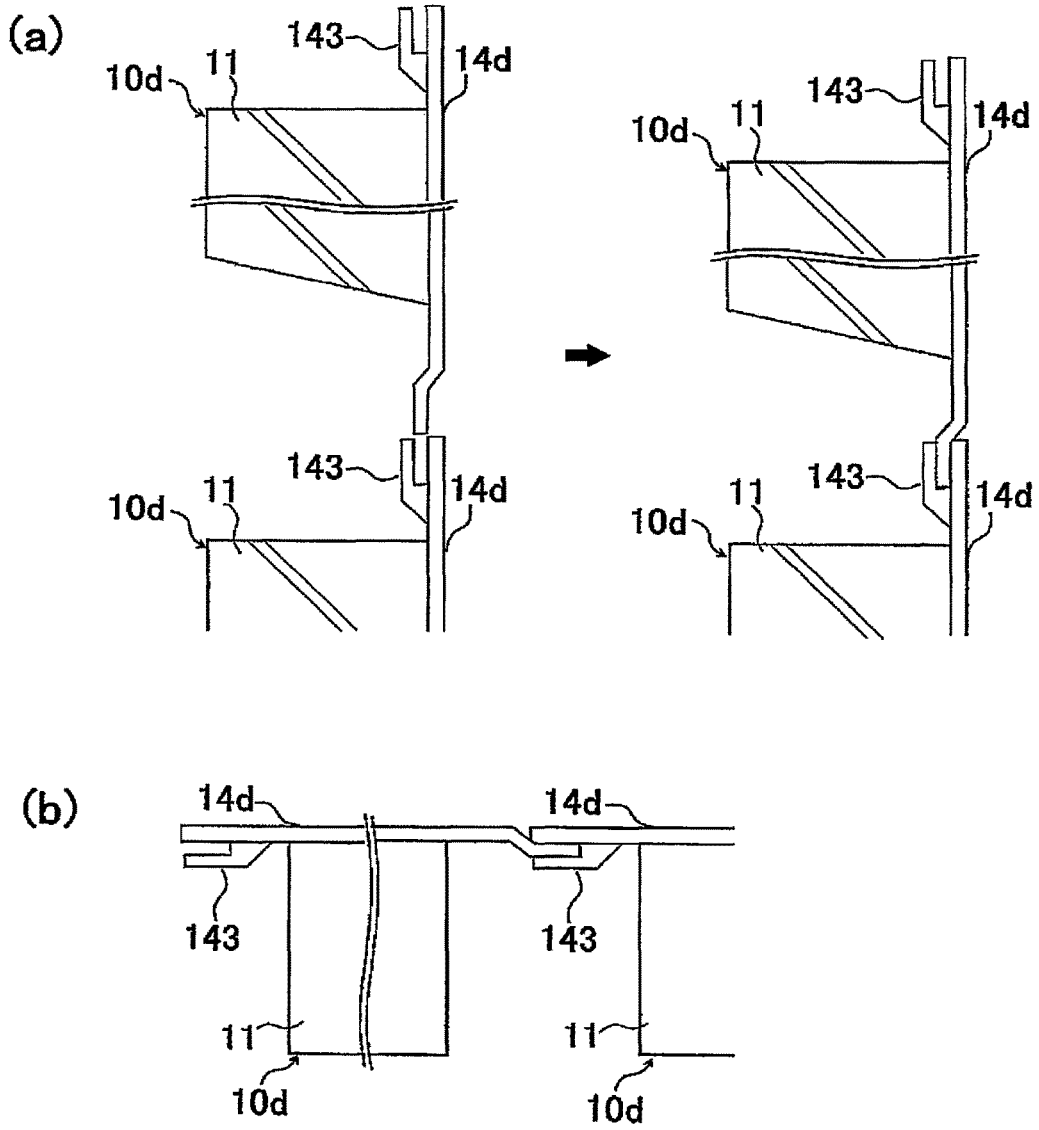
FIG. 14 is a set of views that show a method of fixing plates 14*d*.

FIG. 14 is a set of views that show a method of fixing the plates 14*d* according to the fifth embodiment.

FIG. 14(*a*) depicts an example of arranging the blocks 10*d* in the vertical direction of the dike 2. As shown in the left illustration, each block 10*d* has the plate 14*d* that protrudes upward and downward from the main body 11, and the lower end of the plate 14*d* is offset outward. This is similar to the above-described structure. In addition, the upper end of each plate 14*d* has hook-like receiving portions 143 on the outer face of the plate 14*d*. The receiving portions 143 are spaced from each other in the right-left direction of the plate 14*d* (in the direction perpendicular to the drawing sheet).

In this example, as shown in the right illustration, the lower end of the plate 14*d* of the upper block 10*d* is received in the receiving portions 143 at the upper end of the plate 14*d* of the lower block 10*d* to position and fix the two plates 14*d*.

The above-described process applies when the blocks 10*d* are arranged in the circumferential direction of the dike 2. Specifically, as shown in FIG. 14(*b*), the plate 14*d* of each main body 11 also protrudes rightward and leftward from the main body 11, and the right end of the plate 14*d* is offset outward. In addition, the left end of each plate 14*d* has hook-like receiving portions 143 on the outer face of the plate 14*d*. The receiving portions 143 are spaced from each other in the up-down direction of the plate 14*d* (in the direction perpendicular to the drawing sheet).

As shown in FIG. 14(*b*), the receiving portions 143 at the left end of the plate 14*d* of one of the two blocks 10*d* receive the right end of the plate 14*d* of the other block 10*d* to position and fix the two plates 14*d*.

Sixth Embodiment

Figure 15:
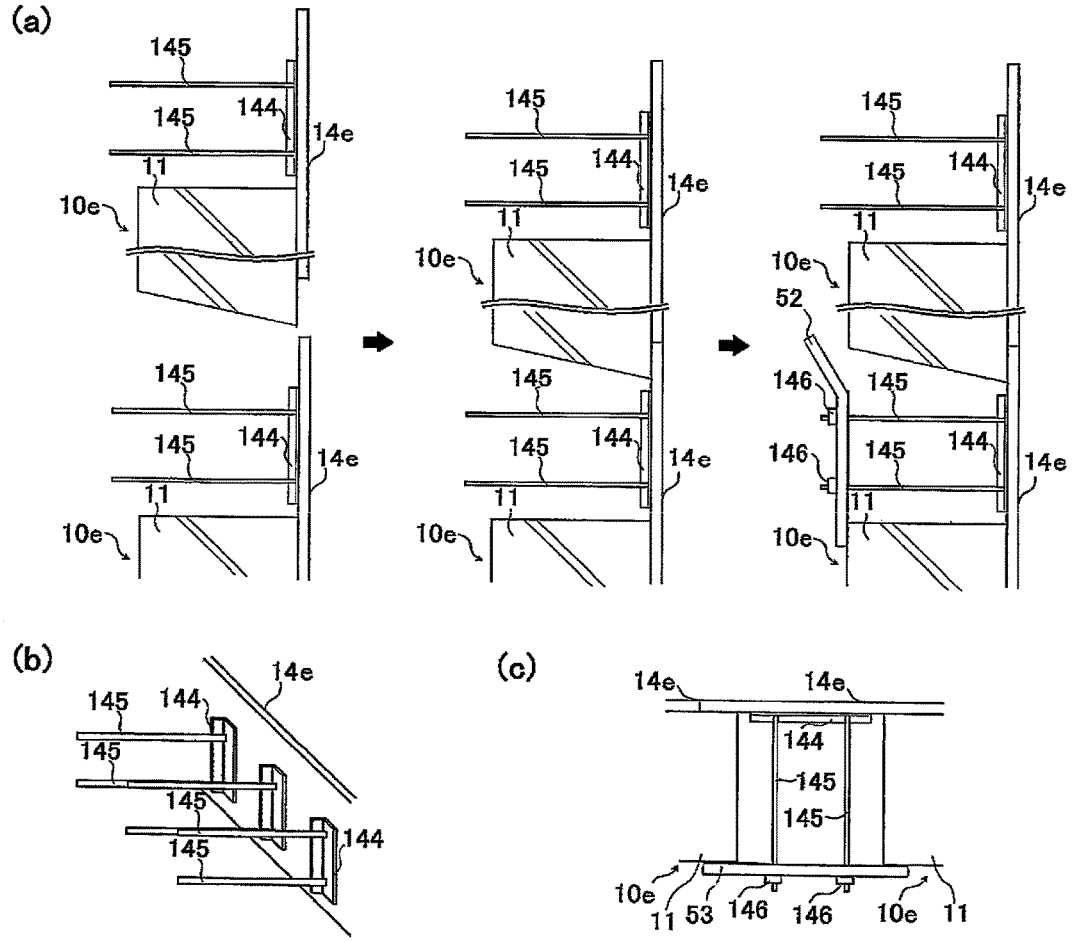
FIG. 15 is a set of views that show a method of fixing plates 14*e*.

FIG. 15 is a set of views that show a method of fixing the plates 14*e* according to the sixth embodiment.

FIG. 15(*a*) depicts an example of arranging the blocks 10*e* in the vertical direction of the dike 2. As shown in the left illustration, each block 10*e* has a plate 14*e*, which protrudes from the main body 11, and steel plates 144 such as angle steel plates, which are attached to the upper end of the plate 14*e*. A pair of upper and lower screw steel rods 145 is attached to each steel plate 144 at one ends of the respective screw steel rods. As shown in FIG. 15(*b*), the steel plates 144 are spaced from each other in the right-left direction of the plate 14*e* (in the direction perpendicular to the drawing sheet of FIG. 15(*a*)) and the screw steel rods 145 are spaced from each other in the right-left direction of the plate 14*e*.

In this example, after the upper block 10*e* is disposed as shown in the middle illustration of FIG. 15(*a*), the formwork 52 is disposed as shown in the right illustration of FIG. 15(*a*). When the formwork 52 is attached, the other ends of the screw steel rods 145 are inserted in screw holes (not shown) formed in the formwork 52, and the nuts 146 are engaged over the screw steel rods 145. This positions and fixes the plate 14*e*. After the formwork 52 is disposed, the concrete 60 is poured and disposed in the same manner as described above, thereby forming the masonry joints 17.

The above-described process applies when the blocks 10*e* are arranged in the circumferential direction of the dike 2. Specifically, as shown in FIG. 15(*c*), the steel plates 144, which are similar to the above-described steel plates, are attached to the left end of the plate 14*e*, which protrudes from the main body 11, of the block 10*e* such that the steel plates 144 are spaced from each other in the up-down direction (in the direction perpendicular to the drawing sheet). A pair of right and left screw steel rods 145, which are similar to the above-described screw steel rods, is also attached to each of the steel plates 144.

In this case, as shown in FIG. 15(*c*), the block 10*e* is disposed on the left of one of the blocks 10*e*, and then the ends of the screw steel rods 145 are inserted in screw holes (not shown) formed in the formwork 53 in a similar manner as described above in order to dispose the formwork 53. The nuts 146 are engaged over the ends of the screw steel rods to position and fix the plates 14*e*.

Seventh Embodiment

Figure 16:
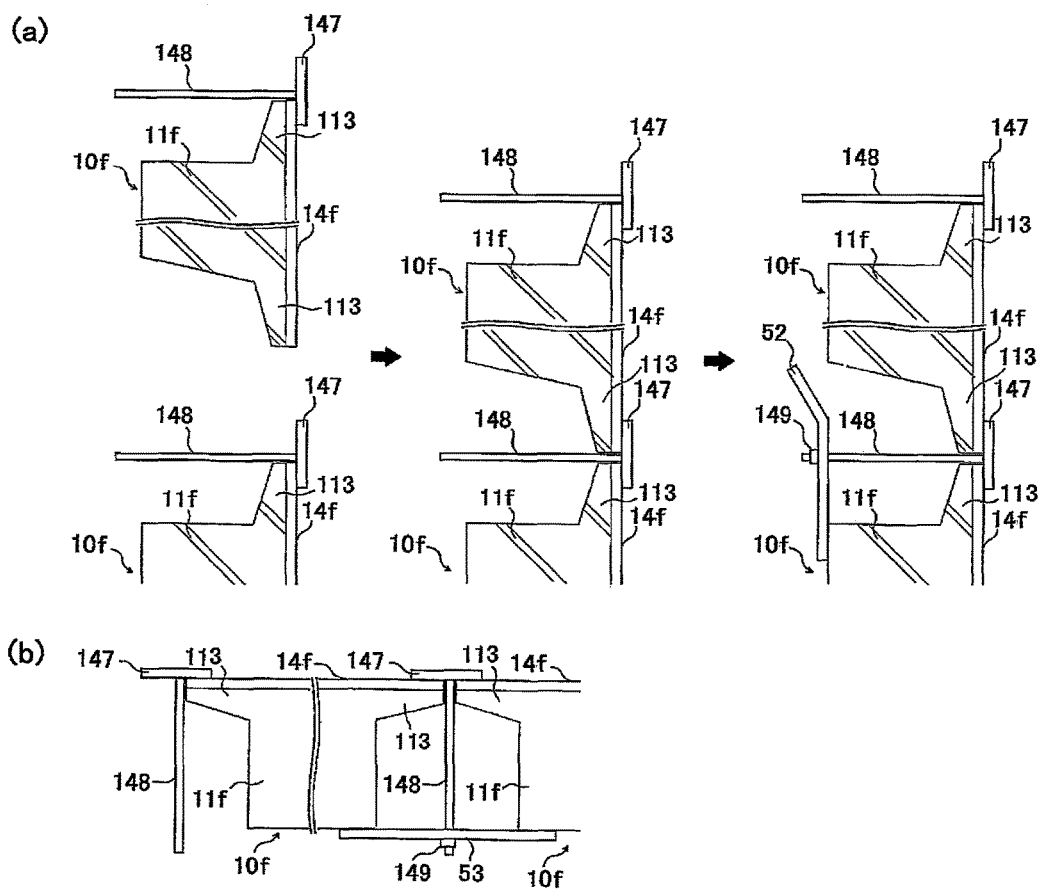
FIG. 16 is a set of views that show a method of fixing plates 14*f*.

FIG. 16 is a set of views that show a method of fixing the plates 14*f* according to the seventh embodiment.

FIG. 16(*a*) depicts an example of arranging the blocks 10*f* in the vertical direction of the dike 2. As shown in the left illustration, each block 10*f* has a main body 1 if and protruding portions 113 at the top and bottom faces of the main body 1 if respectively. The plate 14*f* extends over an entire inner face of the main body 1 if including the protruding portions 113.

A steel plate 147 is attached to the inner face of the upper end of the plate 14*f*, and the steel plate 147 extends in the right-left direction of the plate 14*f* (in the direction perpendicular to the drawing sheet) from the right end to the left end. The upper portion of the steel plate 147 protrudes upward from the plate 14*f*, and one end of each of the screw steel rods 148 is attached to the protruding portion of the steel plate 147. The screw steel rods 148 are spaced from each other in the right-left direction of the steel plate 147.

In this example, the upper block 10*f* is disposed such that the lower end of the plate 14*f* is positioned outside the steel plate 147 as shown in the middle illustration, and then the formwork 52 is disposed as shown in the right illustration. When the formwork 52 is disposed, the other ends of the screw steel rods 148 are inserted in screw holes (not shown) formed in the formwork 52, and the nuts 149 are engaged over the screw steel rods 148. This positions and fixes the plate 14*f*. After that, the concrete 60 is poured and disposed in a similar manner as described above, thereby forming the masonry joints 17.

The above-described process applies when the blocks 10*f* are arranged in the circumferential direction of the dike 2. Specifically, as shown in FIG. 16(*b*), the main body 11*f* of the block 10*f* also has the protruding portions 113 on the right and left faces thereof, and the steel plate 147 is attached to the inner face of the left end of the plate 14*f* such that the steel plate 147 extends in the up-down direction of the plate 14*f* (in the direction perpendicular to the drawing sheet) from the lower end to the upper end. The left end of the steel plate 147 protrudes leftward from the plate 14*f*, and one end of each of the screw steel rods 148 is attached to the protruding portion of the steel plate 147. The screw steel rods 148 are spaced from each other in the up-down direction of the steel plate 147.

In this case, the block 10*f* is disposed on the left of one of the two blocks 10*f* as shown in FIG. 16(*b*), and then ends of the screw steel rods 148 are inserted in screw holes (not shown) formed in the formwork 53 to dispose the formwork 53 in a similar manner as described above. The nuts 149 are engaged over the ends of the screw steel rods 148 to position and fix the plate 14*f*.

Similar to the first embodiment, it is possible to fix the plates from outside the dike 2 with any of the methods of the fourth to the seventh embodiments. Selection of one method from these methods may be made depending upon easiness of the construction work or the like.

Eighth Embodiment

In this type of tank, generally, the dike is rigidly combined to the bottom slab, and the prestress is applied to the dike by the tension members in the circumferential direction. In a normal situation, which excludes events such as liquid spill from the inner tank, therefore, a large bending moment, which is directed inward to deform the dike inward, is generated in the vertical plane at the lower end of the dike. Usually, in order to prevent the cracking and the like of the dike due to the bending moment, the prestress is introduced by the PC steel members 54 that extend the entire height of the dike 2 in the vertical direction as shown in FIG. 10(*a*). In the first embodiment, the lower end of the dike 2 has the thick wall and additional prestress is introduced to the outer portion by the PC steel members 54 extending in the vertical direction in order to reduce the above-described bending moment.

However, when the precast blocks are built up to construct the dike 2 as in the present invention, the inventors believe that the prestress may be omitted in the vertical direction. This will be described as an eighth embodiment. The eighth embodiment will be described while primarily focusing on the differences between the eighth embodiment and the first embodiment, and the description of other configurations will be omitted.

Figure 17:
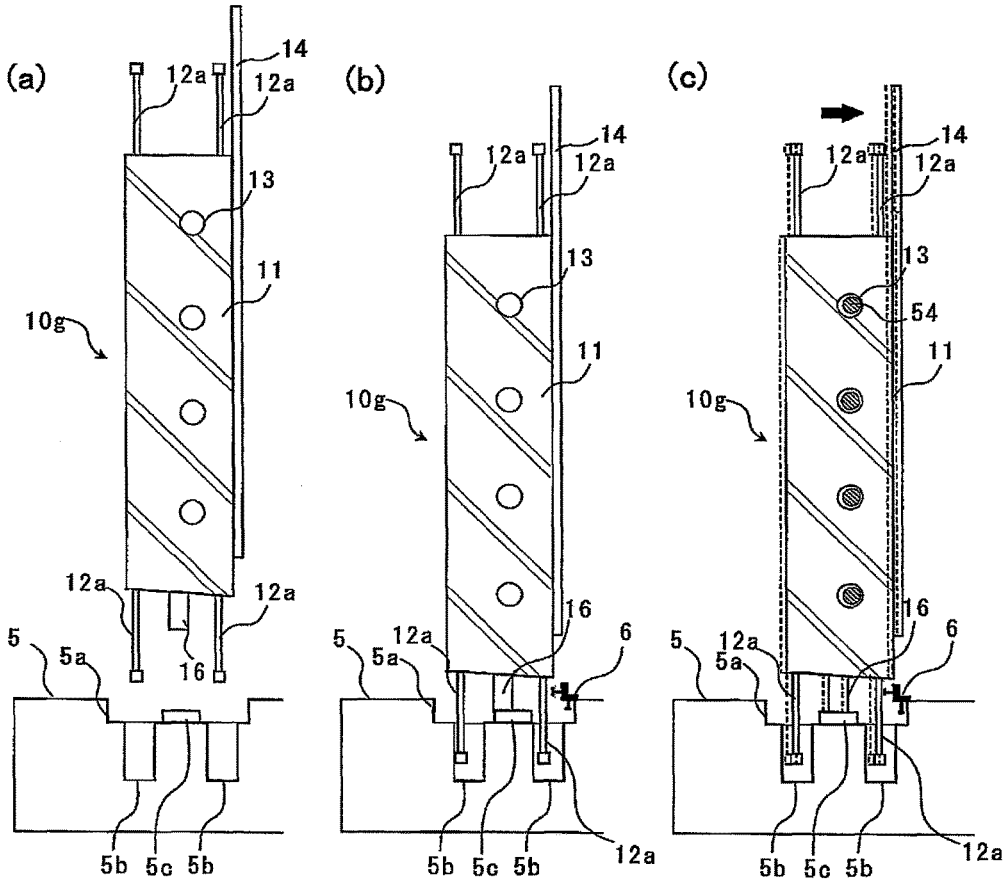
FIG. 17 is a set of views that show a method of constructing a dike 2.

In this embodiment, as shown in FIG. 17(*a*), a block 10*g* that includes the coupling joints 12*a* having the fixing elements on the top and bottom faces of the block 10*g* and that has no sheath pipes 13 extending in the up-down direction is used. A pedestal 16 that protrudes downward is provided on the bottom face of the main body 11 of each of the blocks 10*g* of the first row. Teflon (registered trademark) coating is applied onto the bottom face of each pedestal 16. The pedestal 16 is, for example, an H-steel that has a steel plate at its bottom. It should be noted that although not illustrated in the drawings, the coupling joints disposed on the right and left faces of each block 10*g* are also the coupling joints 12*a* having the fixing elements.

A groove 5*a* is formed in the bottom slab 5 such that the groove 5*a* extends along the outer periphery of the dike 2. Holes 5*b* are formed in the groove 5*a* to receive the coupling joints 12*a* having the fixing elements of each block 10*g*. Also, a slide plate 5*c* is disposed in the groove 5*a* at a position that corresponds to the pedestal 16 of the block 10*g*. The slide plate 5*c* supports the pedestal 16 of the block 10*g* such that the pedestal 16 can slide. The slide plate 5*c* is a steel plate, and Teflon (registered trademark) coating is applied onto the surface of the steel plate.

As shown in FIG. 17(*b*), each of the blocks 10*g* is disposed by inserting the coupling joints having the fixing elements 12*a* into the holes 5*b* of the bottom slab 5, respectively, and placing the pedestal 16 on the slide plate 5*c*. The main body 11 of the block 10*g* is disposed above the groove 5*a* of the bottom slab 5 to a certain extent, and a corner anchor 6 is disposed between the groove 5*a* and the bottom face of the main body 11 along the inner periphery of the dike 2. The corner anchor 6 is, for example, an L-steel, which has a round (or circular) shape when viewed in the plan view, and the L-steel has anchors that will be embedded in the concrete 60 (will be described later). The anchors are attached to the vertical side face and the horizontal side face of the "L" shape of the L-steel, respectively.

Figure 20:
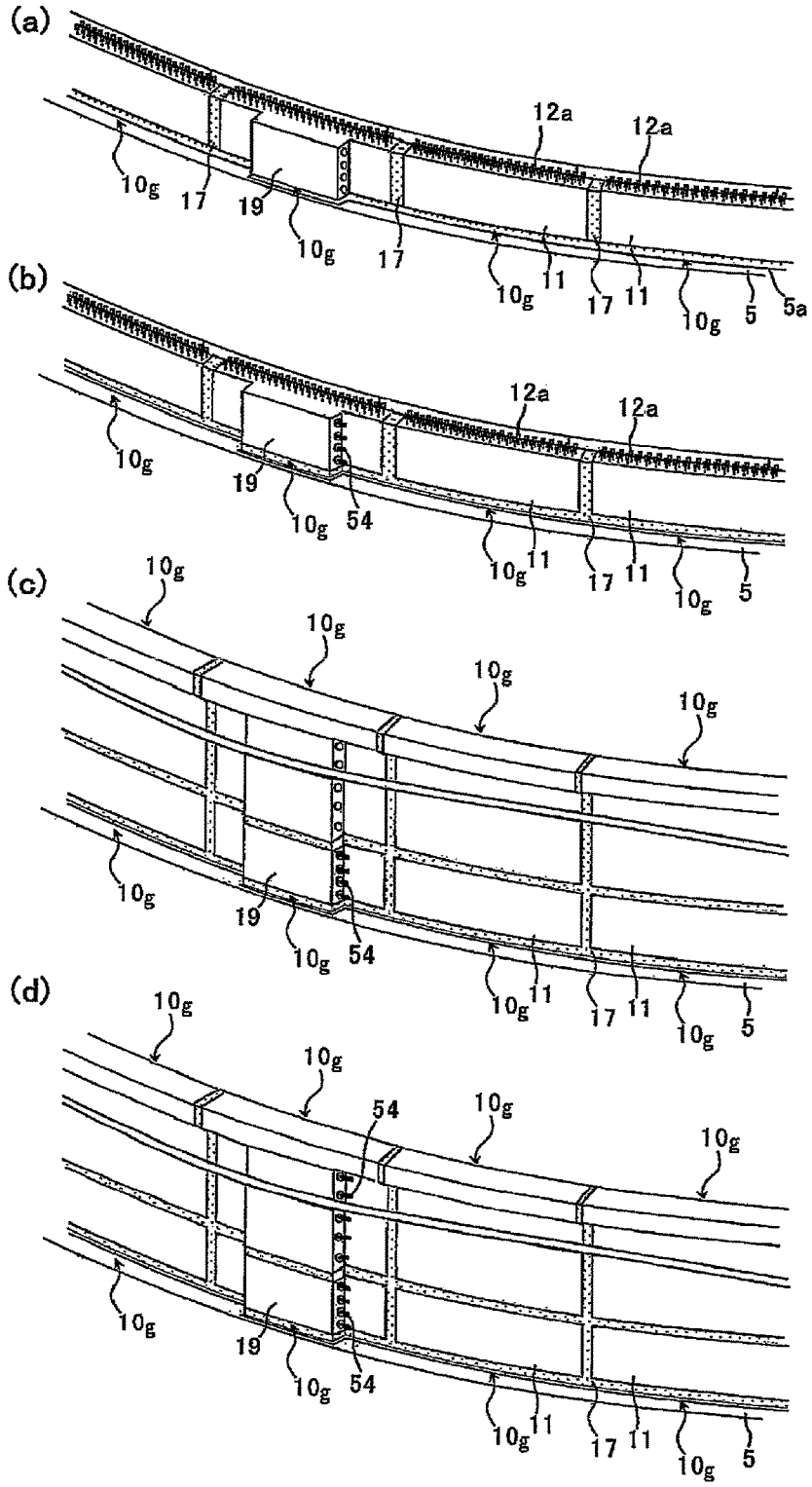
FIG. 20 is yet another set of views that show the method of constructing the dike 2.

In the above-described manner, the blocks 10*g* are disposed on the bottom slab 5 and arranged in the circumferential direction of the dike 2. Subsequently, the concrete is poured and disposed between the main bodies 11 of each two adjacent blocks 10*g* in the circumferential direction to form the masonry joints 17 in the vertical direction. This situation is shown in FIG. 20(*a*). Here, when the concrete is poured and disposed, a bottom formwork is disposed at the bottom between the main bodies 11 of each two adjacent blocks 10*g*, in addition to the above-mentioned outer formwork.

In this embodiment, subsequently, the PC steel members 54 are disposed in the blocks 10*g* of the first row in the circumferential direction, as shown in FIG. 17(*c*), thereby applying the prestress in the circumferential direction by the tension of the PC steel members 54. Then, the blocks 10*g* of the first row are caused to slide, as indicated by the arrow, and slightly move inward of the dike 2.

Figure 18:
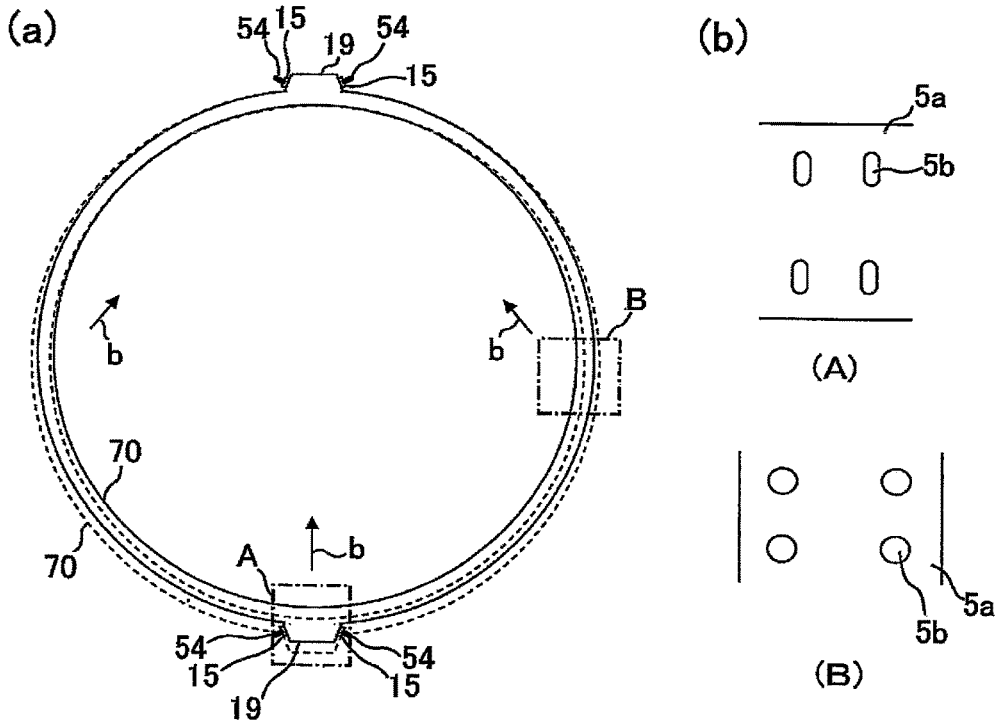
FIG. 18 is another set of views that show the method of constructing the dike 2.

FIG. 18(*a*) schematically shows the change in the circumferential shape 70 of the blocks 10*g* of the first row. In this embodiment, the prestress is introduced while the position of one of the pilasters 19 (upper pilaster 19 in the drawing), which are used to fix the PC steel members 54, is fixed. Then, each block 10*g* moves inward, i.e., toward the fixed pilaster 19, as indicated by the arrow b.

FIG. 18(*b*) shows the shapes of the holes 5*b* formed in the groove 5*a* of the bottom slab 5 in the areas A and B, which are indicated in FIG. 18(*a*). Each of the holes 5*b* is formed such that the hole 5*b* has a size and shape with a sufficient margin that allows the coupling joint having the fixing element 12*a* to move in the above-described direction. For example, as shown in the illustration of the area A, the hole 5*b* at a position that faces the fixed pilaster 19 is an elongated hole that extends toward the fixed pilaster 19. As shown in the illustration of the area B, the hole 5*b* at a position that is turned 90 degrees from the fixed pilaster 19 is a wide hole having a large diameter in order to allow the coupling joint to move toward the fixed pilaster 19, i.e., to move diagonally.

Figure 19:
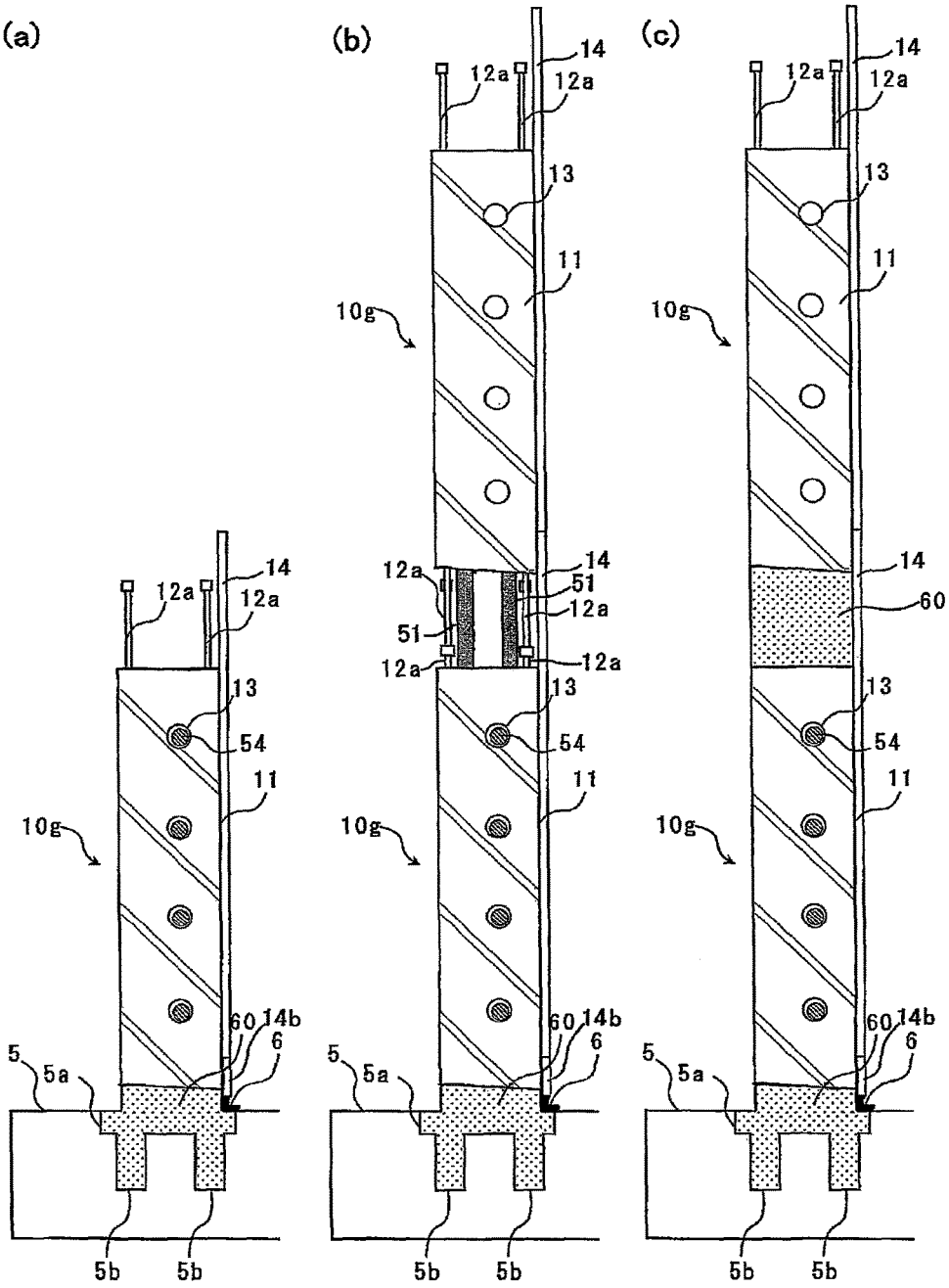
FIG. 19 is still another set of views that show the method of constructing the dike 2.

After the prestress is introduced in the above-described manner, a plate 14*b* is disposed as shown in FIG. 19(*a*) to close the gap between the corner anchor 6 and the main body 11 of each block 10*g*. Then, the concrete 60 is poured and disposed between the bottom face of the main body 11 of each block 10*g* of the first row and the bottom slab 5 with an outer formwork, which is similar to the above-described outer formwork. Thus, the masonry joints 17 extending in the circumferential direction are formed. This situation is shown in FIG. 20(*b*).

The subsequent procedures are generally the same as those in the first embodiment. Specifically, as shown in FIG. 19(*b*), the blocks 10*g* of the second row are placed on the blocks 10*g* of the first row, and arranged in the circumferential direction of the dike 2. It should be noted that the pedestals 16 are omitted from the blocks 10*g* in the second and subsequent rows, and each upper block 10*g* is supported by support members 51 provided on the top face of the main body 11 of an associated lower block 10*g*.

After that, as shown in FIG. 19(*c*), the concrete 60 is poured and disposed between the main bodies 11 of the blocks 10*g* of the first row and the main bodies 11 of the blocks 10*g* of the second row to form the masonry joints 17 in the circumferential direction. Also, the concrete is poured and disposed between the main bodies 11 of each two adjacent blocks 10*g* in the circumferential direction to form the masonry joints 17 in the vertical direction.

Then, the blocks 10*g* are arranged in the circumferential direction of the dike 2 and stacked in the vertical direction, thereby forming the masonry joints 17 in the circumferential direction and the vertical direction of the dike 2. Thus, as shown in FIG. 20(*c*), the blocks 10*g* are arranged up to the uppermost row of the dike 2.

After the blocks 10*g* are arranged up to the uppermost row of the dike 2 in this manner, the PC steel members 54 are disposed in the blocks 10*g* of the second and subsequent rows in the circumferential direction of the dike 2 to introduce the prestress, thereby completing the construction of the dike 2, as shown in FIG. 20(*d*).

In this embodiment, the blocks 10*g* of the first row are slidable. After the prestress is introduced in the circumferential direction of the dike 2 and the deformation of the blocks 10*g* is finished, the blocks 10*g* are fixed to the bottom slab 5. Unlike a conventional cast-in-place concrete pile method, therefore, it is possible to introduce the prestress in a condition that receives no restrictions from the bottom slab 5. Although the prestress is introduced to the upper portion of the dike 2 in the circumferential direction in order to resist the liquid pressure upon liquid spill, the blocks 10*g* of the first row are fixed to the bottom slab 5 after the blocks 10*g* have deformed upon the introduction of the prestress, as described above. Thus, as compared to a case where the dike is constructed by a conventional construction method, it is possible to significantly reduce the above-described inward bending moment that would be generated at the lower end of the dike 2. Accordingly, it is possible to omit the prestress in the vertical direction, including the above-described additional prestress, and there is no need for the lower end of the dike 2 to have a thick wall. Consequently, the structure of the dike 2 is simplified, and further merits are obtained in terms of both the necessary materials and the construction work period.

It should be noted that it may be possible to introduce the prestress by the PC steel members 54 that span the entire length of the dike 2 in the vertical direction as shown in FIG. 10(*a*), which is similar to the first embodiment. In this case, in order to allow the PC steel members 54 to extend through the dike, the sheath pipes 13 are disposed in the blocks 10*g* in the up-down direction and the sheath pipes 13 are also provided on (in) the bottom slab 5, as in the first embodiment. The positions of the sheath pipes 13 on the bottom slab 5 are aligned with the positions of the sheath pipes 13 extending in the up-down direction of the blocks 10*g* after the displacement, because the blocks 10*g* of the first row are displaced upon the introduction of the prestress as described above. If flexibility is imparted to the connecting tubes 132 of the sheath pipes 13, the connection of the sheath pipes 13 would be easy even when there is some positional discrepancy between the sheath pipes 13 of the blocks 10*g* and the sheath pipes 13 on the bottom slab 5.

Ninth Embodiment

Now, an example that uses a different structure to slidably dispose the precast blocks will be described as a ninth embodiment. The ninth embodiment will be described while primarily focusing on the differences between the ninth embodiment and the eighth embodiment, and the description of similar configurations will be omitted.

Figure 21:
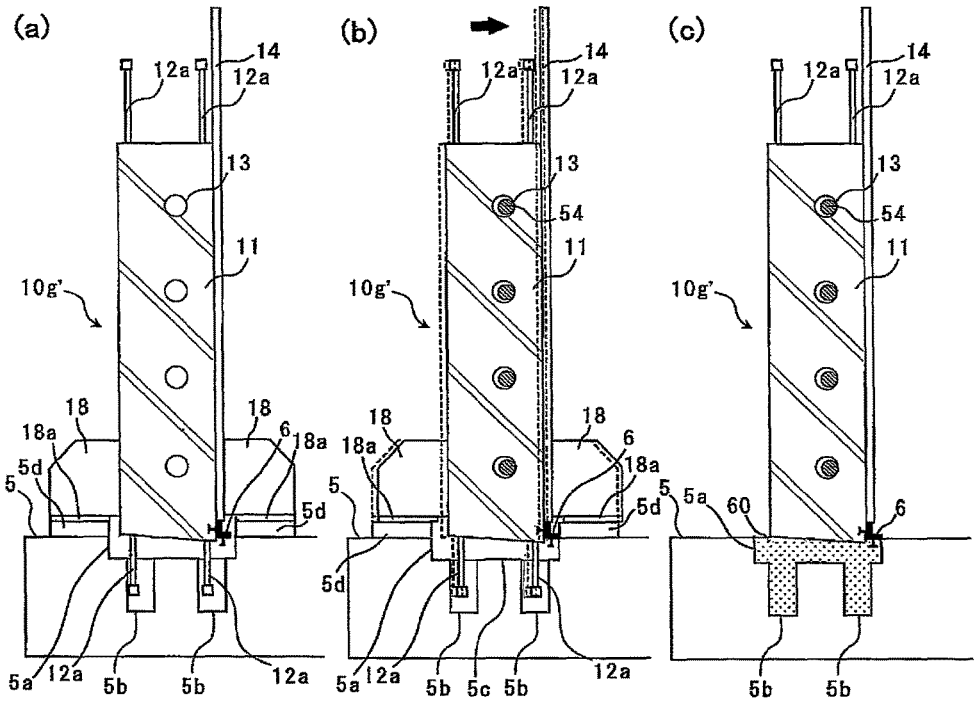
FIG. 21 is another set of views that show the method of constructing the dike 2.

As shown in FIG. 21(*a*), the block 10*g*' of this embodiment has temporary brackets 18 attached on the outer face of each main body 11 and on the plate 14 of the inner face of the main body 11 respectively, instead of the pedestal 16. A sliding portion 18*a* is provided at the bottom of each bracket 18. The bracket 18 and the sliding portion 18*a* are made from a steel material such as a steel plate and a steel bar, and Teflon (registered trademark) coating or the like is applied onto the bottom face of the sliding portion 18*a*.

The above-described corner anchor 6 is attached to the lower end of the main body 11 of each block 10*g*' beforehand. The corner anchor 6 has an anchor that is provided on the vertical side face of the "L" shape, and the anchor is buried in the main body 11. The corner anchor 6 has another anchor that is provided on the horizontal side face of the "L" shape, and this anchor is buried in the concrete 60, which will be described later.

On the bottom slab 5, support members 5*d* are provided along sides of the groove 5*a*, instead of the slide plate 5*c*. Each support member 5*d* supports the associated bracket 18 such that the bracket 18 can slide, and can adjust its height, which is similar to the above-described support member 51. The support member 54 may be a jack, a jack base or the like, with Teflon (registered trademark) coating being applied onto the upper face of thereof.

As shown in FIG. 21(*a*), the blocks 10*g*' are disposed by inserting the coupling joints having the fixing elements 12*a* into the respective holes 5*b* of the bottom slab 5, placing the sliding portions 18*a* of the brackets 18 on the support members 5*d*, and arranging the blocks 10*g*' in the circumferential direction of the dike 2. In the ninth embodiment, each block 10*g*' is disposed such that the horizontal side face of the "L" shape of each corner anchor 6 is approximately level to the upper face of the bottom slab 5 upon adjustments of the height of the respective support member 5*d* and the like.

After that, the vertical masonry joints 17 are formed between main bodies 11 of each two adjacent blocks 10*g*' in the circumferential direction in a similar manner to the above-described manner, and then the PC steel members 54 are provided in the blocks 10*g*' of the first row in the circumferential direction, thereby introducing the prestress in the circumferential direction by the tension of the PC steel members 54.

Then, as indicated by the arrow in FIG. 21(*b*), the blocks 10*g*' of the first row slide, as in the previous embodiment, such that the blocks 10*g*' slightly move inward of the dike 2. Subsequently, as shown in FIG. 21(*c*), the concrete 60 is poured and disposed between the bottom faces of the main bodies 11 of the blocks 10*g*' of the first row and the bottom slab 5 to form the masonry joints 17 in the circumferential direction. The support members 5*d* and the brackets 18 are removed upon the jacking down and the like.

In this embodiment, as described above, the prestress is introduced to the blocks 10*g*' of the first row in the circumferential direction of the dike 2. This is similar to the previous embodiment. After the deformation is completed, the masonry joints 17 are formed between the blocks 10*g*' of the first row and the bottom slab 5. Thus, this embodiment provides similar advantages to the eighth embodiment. The brackets 18 and the support members 5*d* are different from the above-described slide plates 5*c* and the like in that the brackets 18 and the support members 5*d* do not remain in the concrete 60. Thus, the brackets 18 and the support members 5*d* may be used again or for other purposes.

Tenth Embodiment (1. Precast Block 10*h*)

Figure 22:
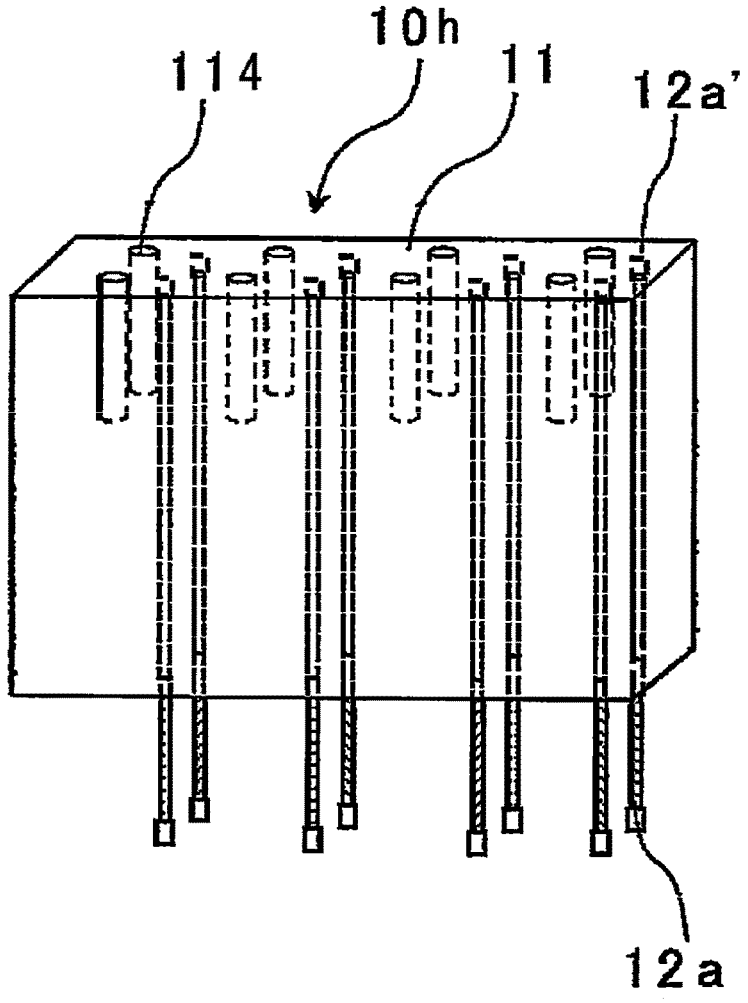
FIG. 22 is a view that illustrates a precast block 10*h*.
Figure 23:
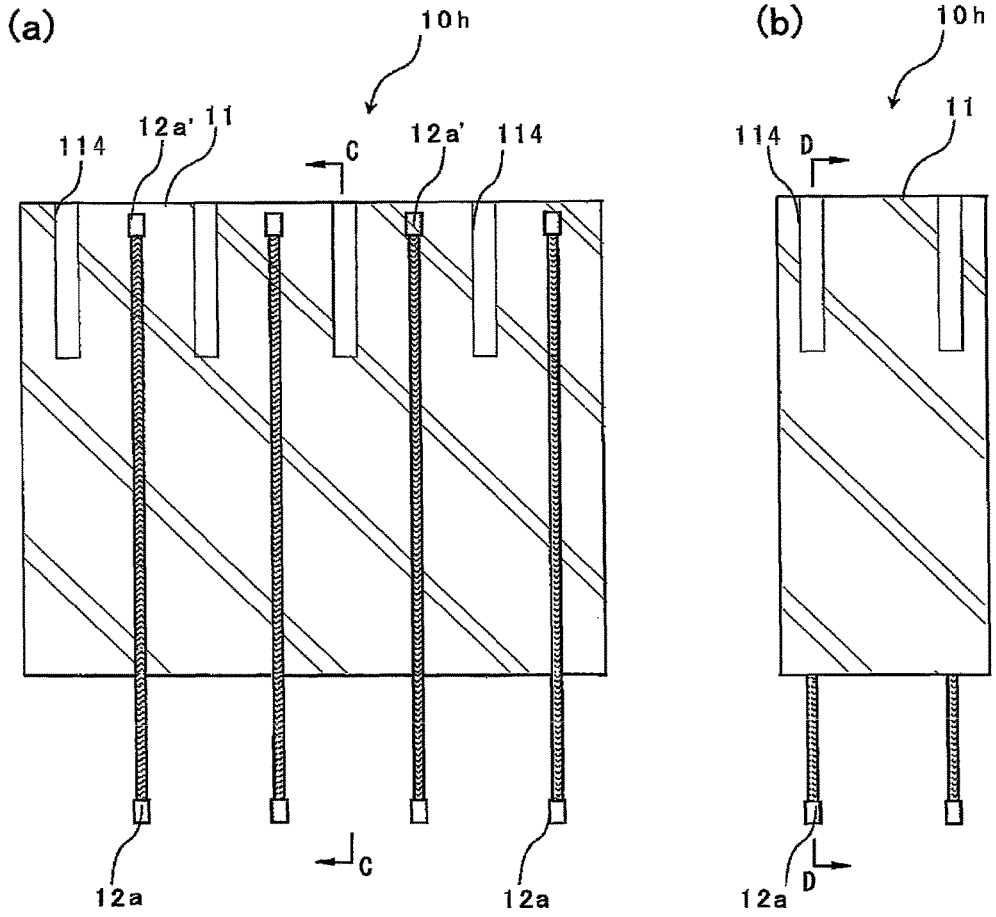
FIG. 23 is a set of cross-sectional views of a main body 11 of the block 10*h*.

Now, a tenth embodiment of the present invention will be described. The tenth embodiment is an example of a structure for joining blocks in the LNG tank 1 according to the present invention. FIG. 22 is a view that shows a block 10*h* used in this joining structure. FIG. 23 is a set of cross-sectional views that show the main body 11 of the block 10*h*. Specifically, FIG. 23(*a*) is a cross-sectional view of the main body 11 in the width direction, and FIG. 23(*b*) is a cross-sectional view of the main body 11 in the thickness direction. FIG. 23(*a*) is a cross-sectional view taken along the line D-D in FIG. 23(*b*), and FIG. 23(*b*) is a cross-sectional view taken along the line C-C in FIG. 23(*a*).

The block 10*h* includes a main body 11, which is a concrete member having a rectangular plate shape, reinforcing steel rods, which protrude downward from a bottom face of the main body 11, and coupling joints 12*a*, which have fixing elements and are provided at free ends of the reinforcing steel rods. Similar to the previous embodiments, coupling joints 12*a*', which have reinforcing steel rods and fixing elements, are embedded in the upper portion of the main body 11.

Holes 114 are also formed in the upper portion of the main body 11 such that the holes 114 are only open in the top face of the main body 11. The holes 114 and the coupling joints having the fixing elements 12*a*' are alternately arranged in the width direction of the main body 11. The coupling joint having the fixing element 12*a* and the coupling joint having the fixing element 12*a*' are constituted by the two fixing elements provided at opposite ends of the same reinforcing steel rod, respectively. In FIG. 22, the locations of the reinforcing steel rods and the holes 114 in the main body 11 are indicated by the broken line. This is also true in FIG. 27, which will be described later.

It may be possible to dispose coupling joints such as mechanical joints and coupling joints having fixing elements, which may be similar to the coupling joints having the fixing elements 12*a*, on the right and left faces of the main body 11. However, such coupling joints are not particularly relevant to the joining of the upper and lower blocks 10*h*, which will be described later, and therefore the description of such coupling joints will be omitted here.

(2. Method of Joining the Precast Blocks 10, and the Joining Structure)

Next, a method of joining the upper and lower blocks 10, and the joining structure made by this joining method will be described.

Figure 24:
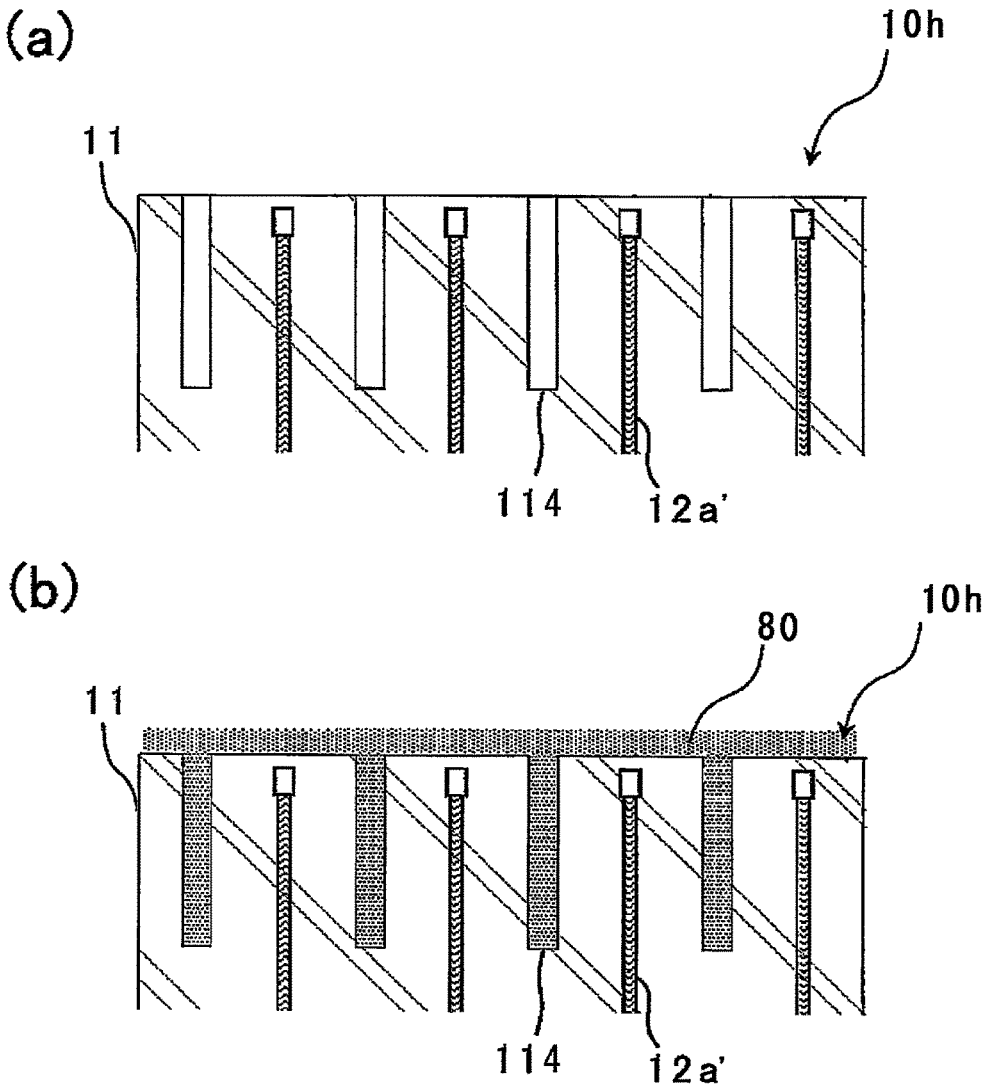
FIG. 24 is a set of views that are useful to describe the joining of upper and lower blocks 10*h*.

In this embodiment, the above-described blocks 10*h* are arranged as shown in FIG. 24(*a*), and the vicinity of the upper face of the main body 11 is surrounded by a formwork (not shown). Then, mortar 80, which is a filler, is provided on the main body 11 as shown in FIG. 24(*b*). The mortar 80 is laid over the top face of the main body 11, and also loaded into the holes 114. The mortar 80 is, for example, a non-shrinkage retarded mortar, which is prepared by adding a retarder such that the mortar is cured in a long time such as 5-6 hours or more.

Figure 25:
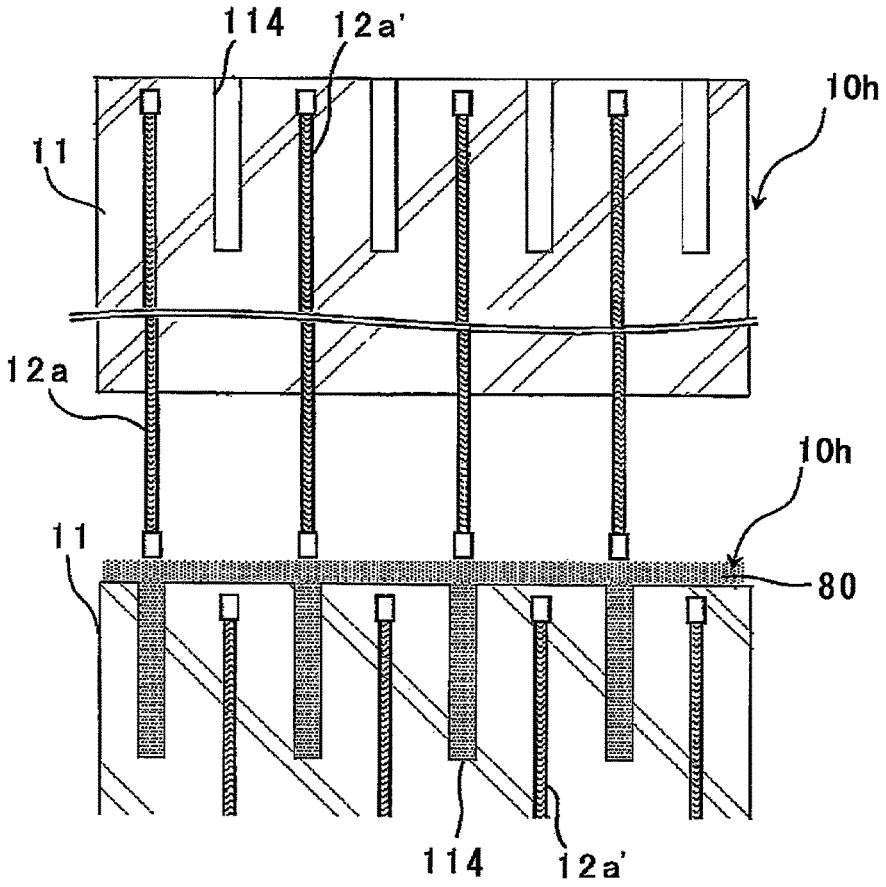
FIG. 25 is another set of views that are useful to describe the joining of the upper and lower blocks 10*h*.
Figure 25:
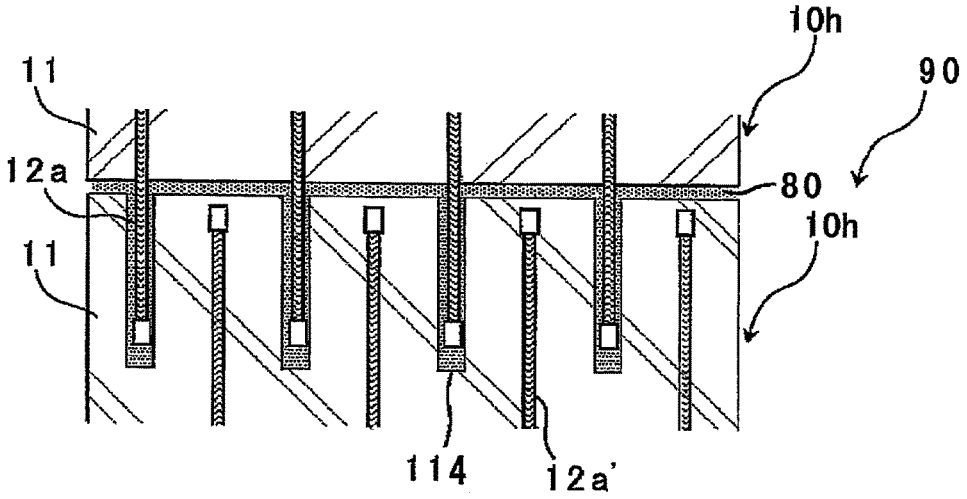

Subsequently, a new block 10*h* is disposed above the block 10*h*, as shown in FIG. 25(*a*). It should be noted that the main body 11 of the upper block 10*h* is the main body that is turned over from the main body 11 of the lower block 10*h* in the width direction (right-left direction in the drawing). This makes it possible to align the positions of the holes 114 of the main body 11 of the lower block 10*h* with the positions of the coupling joints having the fixing elements 12*a* of the main body 11 of the upper block 10*h*.

After that, the upper block 10*h* is moved down to a predetermined position. Thus, as shown in FIG. 25(*b*), the coupling joints having the fixing elements 12*a* of the upper block 10*h* are inserted in the holes 114 of the main body 11 of the lower block 10*h*, and the mortar 80 is pushed (pressed) by main body 11 of the upper block 10*h* such that the resulting pressure causes the gap between the main bodies 11 of the upper and lower blocks 10*h* to be filled with the mortar 80. The mortar 80 that is pushed out in the lateral directions is properly removed.

Figure 90:
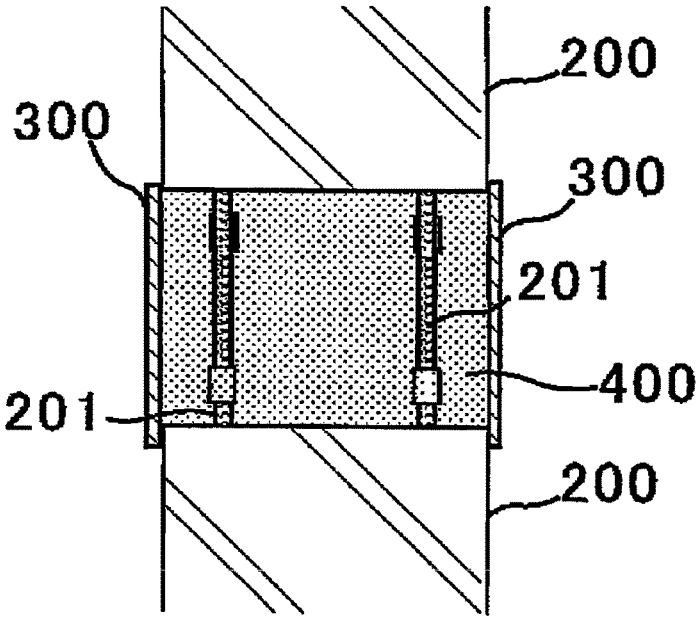
FIG. 90 is a view that depicts the structure for joining the upper and lower precast blocks 200.

As the mortar 80 is cured, the joining structure 90, which is made by the upper and lower blocks 10*h*, is formed. In this joining structure 90, the coupling joints having the fixing elements 12*a* of the upper block 10*h* lap the coupling joints having the fixing elements 12*a*' of the lower block 10*h* in a similar manner to the manner described with reference to FIG. 90.

In this embodiment, as described above, the mortar 80 is firstly provided on the lower block 10*h*, and then the coupling joints having the fixing elements 12*a* of the upper block 10*h* are inserted in the holes 114 of the lower block 10*h*. Thus, it is possible to easily form the joining structure 90, with the coupling joints of the upper and lower blocks 10*h* being lapped. The pressure from the upper block 10*h* can fill the gap between the upper and lower blocks 10*h* with the mortar 80 in a reliable manner without trapping the air. The relevant work is easy and the formworks to be used are insignificant. It is not necessary to form holes in the side faces of the block 10*h*, which would otherwise be used for pressurizedly loading the mortar 80.

Because the coupling joints having the fixing elements 12*a* are used as the coupling joints, the lap length of the coupling joints is small, and the holes 114 formed in the block 10*h* are short. Also, there is an advantage that the diameter of each of holes 114 is small. It should be noted that the coupling joints are not limited to the coupling joints having the fixing elements 12*a*. For example, the coupling joints may be mere reinforcing steel rods. Also, the filler is not limited to the mortar 80. Other types of grout materials, such as resin, may be used.

Eleventh Embodiment (1. LNG Tank 1*a*)

An example that uses the above-described joining structure in the dike of the LNG tank 1 (1*a*) according the present invention will be described as an eleventh embodiment. The eleventh embodiment will be described while primarily focusing on the differences between the eleventh embodiment and the tenth embodiment, and the description of similar configurations will be omitted.

Figure 26:
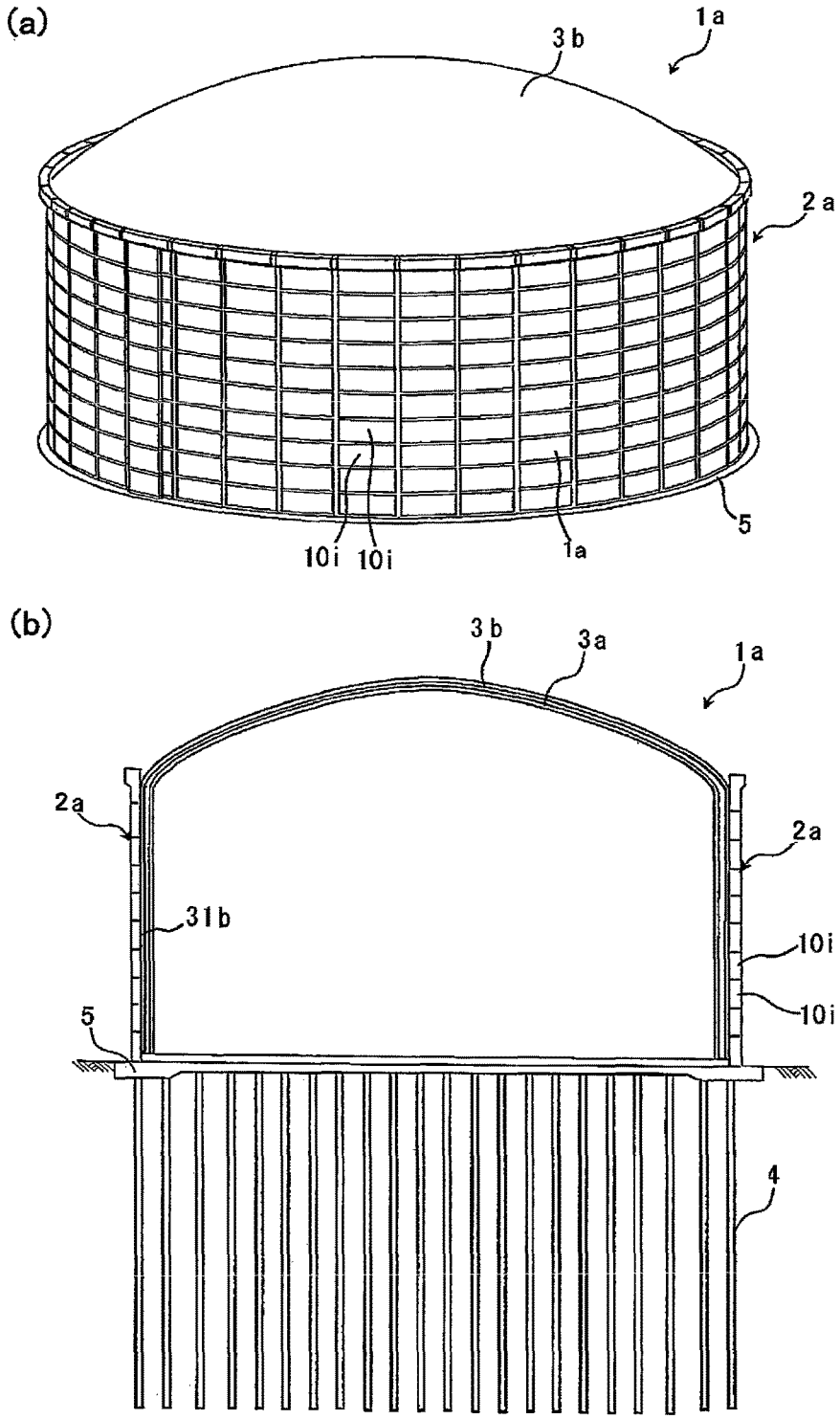
FIG. 26 is a set of views that show an LNG tank 1*a*.

FIG. 26 is a set of views that show an LNG tank 1*a*. Specifically, FIG. 26(*a*) is a perspective view of the LNG tank 1*a*, and FIG. 26(*b*) is a vertical cross-sectional view of the LNG tank 1*a*.

The LNG tank 1*a* is a tank that is built up on the ground and configured to store an LNG. The LNG tank 1*a* includes a dike 2*a* disposed on a bottom slab 5, which is supported by piles 4 in the ground, and also includes an inner tank 3*a* and an outer tank 3*b*. The inner tank 3*a* and outer tank 3*b* are made from metallic plates and other components and disposed inside the dike 2*a*. The LNG is stored in the inner tank 3*a*, and the spacing between the inner tank 3*a* and the outer tank 3*b* is used to keep the LNG in a cold condition. A side wall 31*b* of the outer tank 3*b* is provided along the dike 2*a*.

The dike 2*a* is provided to prevent liquid leakage of the LNG to the outside even if the inner tank 3*a* and the outer tank 3*b* are damaged and/or broken. In this embodiment, the precast blocks 10*i* are arranged in the circumferential direction of the dike 2*a* and stacked in the vertical direction, and the masonry joints are formed between each two adjacent blocks 10*i* in the circumferential direction and the vertical direction of the dike 2*a* to build up the dike 2*a*. It should be noted that the prestress is applied to the dike 2*a* by tension members (not shown) disposed in the vertical direction and the circumferential direction of the dike.

(2. Precast Block 1*a*)

Figure 27:
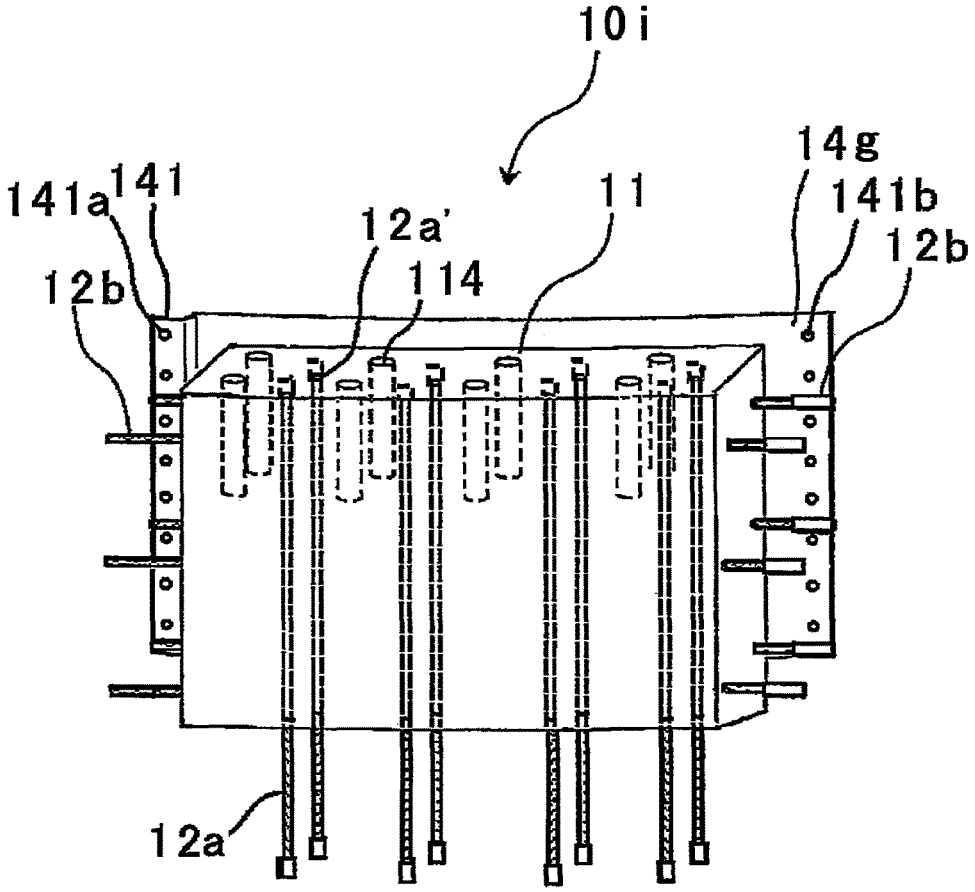
FIG. 27 is a view that illustrates a block 10*i*.

FIG. 27 illustrates the precast block 10*i*. Similar to the tenth embodiment, the block 10*i* includes the main body 11, the coupling joints having the fixing elements 12*a* on the bottom face of the main body 11, the holes 114 in the upper portion of the main body 11, and the coupling joints having the fixing elements 12*a*' on (in) the upper portion of the main body 11. In addition, the block 10*i* includes mechanical joints 12*b* on the right and left faces of the main body 11.

The main body 11 bends in an arc shape that corresponds to the radius of the tank or the like, and the bottom face of the main body 11 inclines upward and outward.

A plate 14*g* is attached to the inner face of the main body 11. The plate 14*g* is a metallic plate member, and protrudes upward, rightward and leftward from the main body 11. The left end 141 of the plate 14*g* bends such that the left end 141 is shifted outward. A plurality of holes 141*a* is formed in the left end 141 in the up-down direction. On the other hand, a plurality of holes 141*b* is formed in the right end of the plate 14*g* in the up-down direction.

It should be noted that the plate 14*g* is not present on (plate 14*g* does not extend over) the lower portion of the inner face of the main body 11 to an extent that the plate 14*g* protrudes upward from the main body 11. Sheath pipes through which the tension members pass and other parts are also provided on the main body 11, but the illustration thereof is omitted here.

(3. Method of Joining the Blocks 10*i*, and the Joining Structure)

In this embodiment, the blocks 10*i* are arranged in the circumferential direction of the dike 2*a* and stacked in the vertical direction when the dike 2*a* is built up, in a similar manner as described above. Thus, the joining structure that connects the upper and lower blocks 10*i* is formed. In the following description, the method of joining the upper and lower blocks 10*i*, and the joining structure that is made from this joining method will be described.

Figure 28:
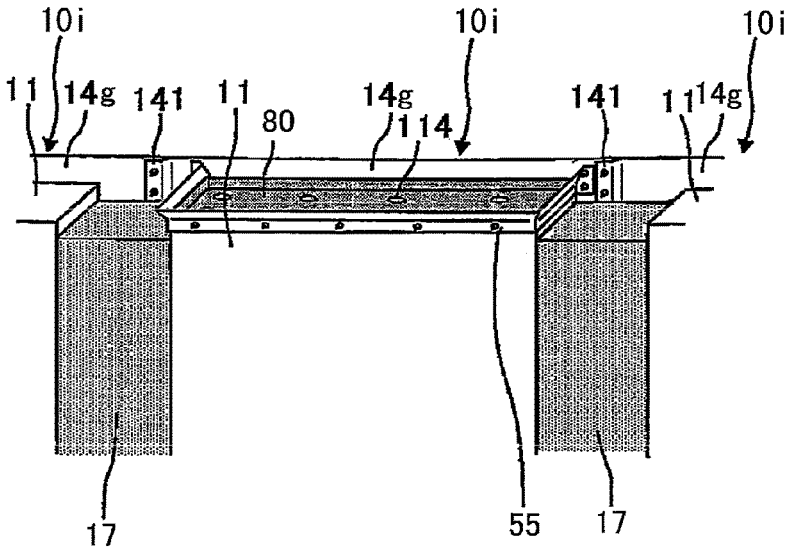
FIG. 28 is a set of views that are useful to describe the joining of the upper and lower blocks 10*i*.
Figure 28:
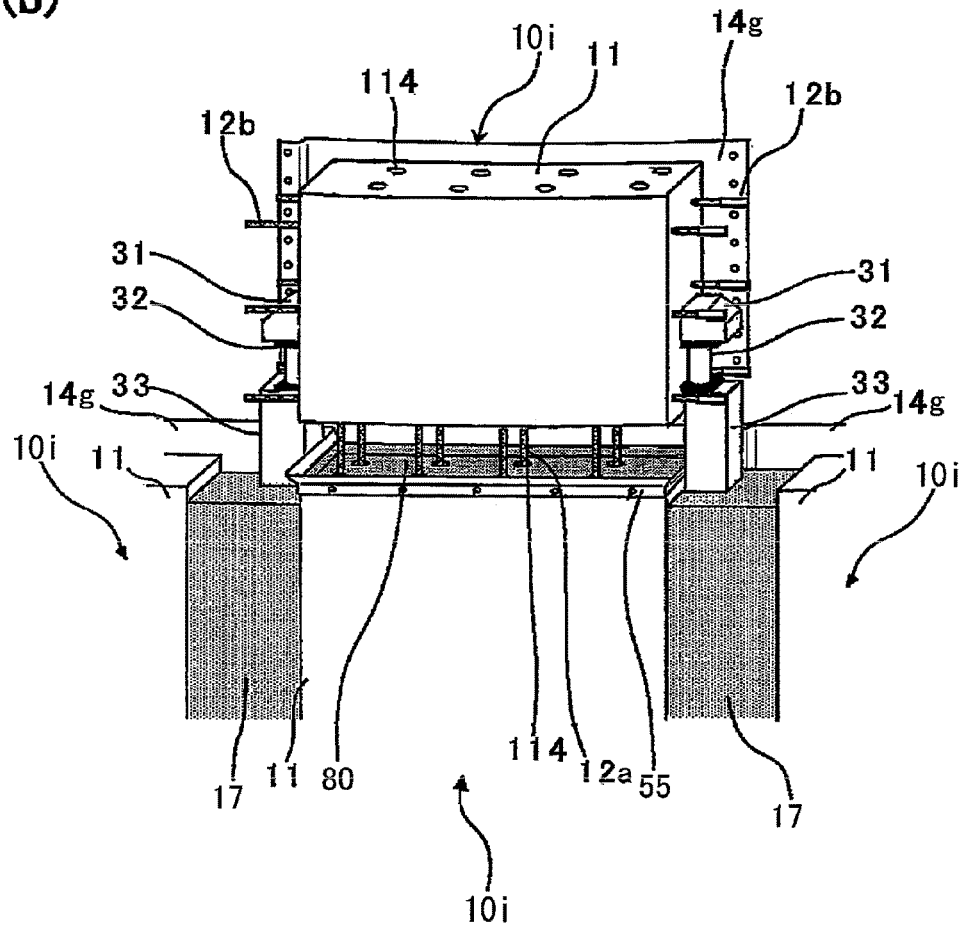

FIG. 28(*a*) illustrates the blocks 10*i* arranged in the circumferential direction of the dike 2*a*. The blocks 10*i* are arranged such that the left end 141 of the plate 14*g* of each block 10*i* overlaps the right end of the plate 14*g* of another block 10*i*. At this situation, the positions of the holes 141*a* (see FIG. 27) of the left end 141 of the plate 14*g* of the block 10*i* are aligned with the positions of the holes 141*b* (see FIG. 27) of the right end of the plate 14*g* of the next block 10*i*. Thus, screws pass through the holes 141*a* and 141*b* and nuts are engaged over the screws to fix the plates 14*g* of the two blocks 10*i* to each other.

The concrete is poured and disposed between the main bodies 11 of each two adjacent blocks 10*i* up to a position slightly lower than the top faces of the main bodies 11, thereby forming the masonry joints 17. The ends of the mechanical joints 12*b* (see FIG. 27) protruding from the right face of the main body 11 of the left block 10*i*, and the ends of the mechanical joints 12*b* (see FIG. 27) protruding from the left face of the main body 11 of the right block 10*i* are joined to each other and embedded in the masonry joints 17.

As shown in FIG. 28(*a*), when new blocks 10*i* are stacked on the lower blocks 10*i*, which are arranged in the above-described manner, the outer formwork 55 is placed on the main body 11 of each of the lower blocks 10*i* at a position that avoids the plate 14*g* such that the upper face of the main body 11 is surrounded by the outer formwork 55 and the plate 14*g*, and then the mortar 80 is disposed on the main body 11 in a similar manner to the tenth embodiment. The upper portion of the outer formwork 55 inclines in a direction apart from the main body 11, and the plate 14*g* is fixed to the outer formworks 55 with screws and nuts or the like.

Then, as shown in FIG. 28(*b*), a new block 10*i* is disposed on the corresponding block 10*i*. When the new block 10*i* is disposed, temporary brackets 31 are attached to the right and left faces of the main body 11 of this new block 10*i*, and supported by the jacks 32 (extendable members). The jacks 32 are placed on supporting posts 33 provided on the upper faces of the masonry joints 17, respectively. One of the jacks 32 and relevant parts in this situation are depicted in FIG. 30(*a*), and the cross-sectional view of the main body 11 of the block 10*i* in the thickness direction is shown in FIG. 31(*a*).

Figure 29:
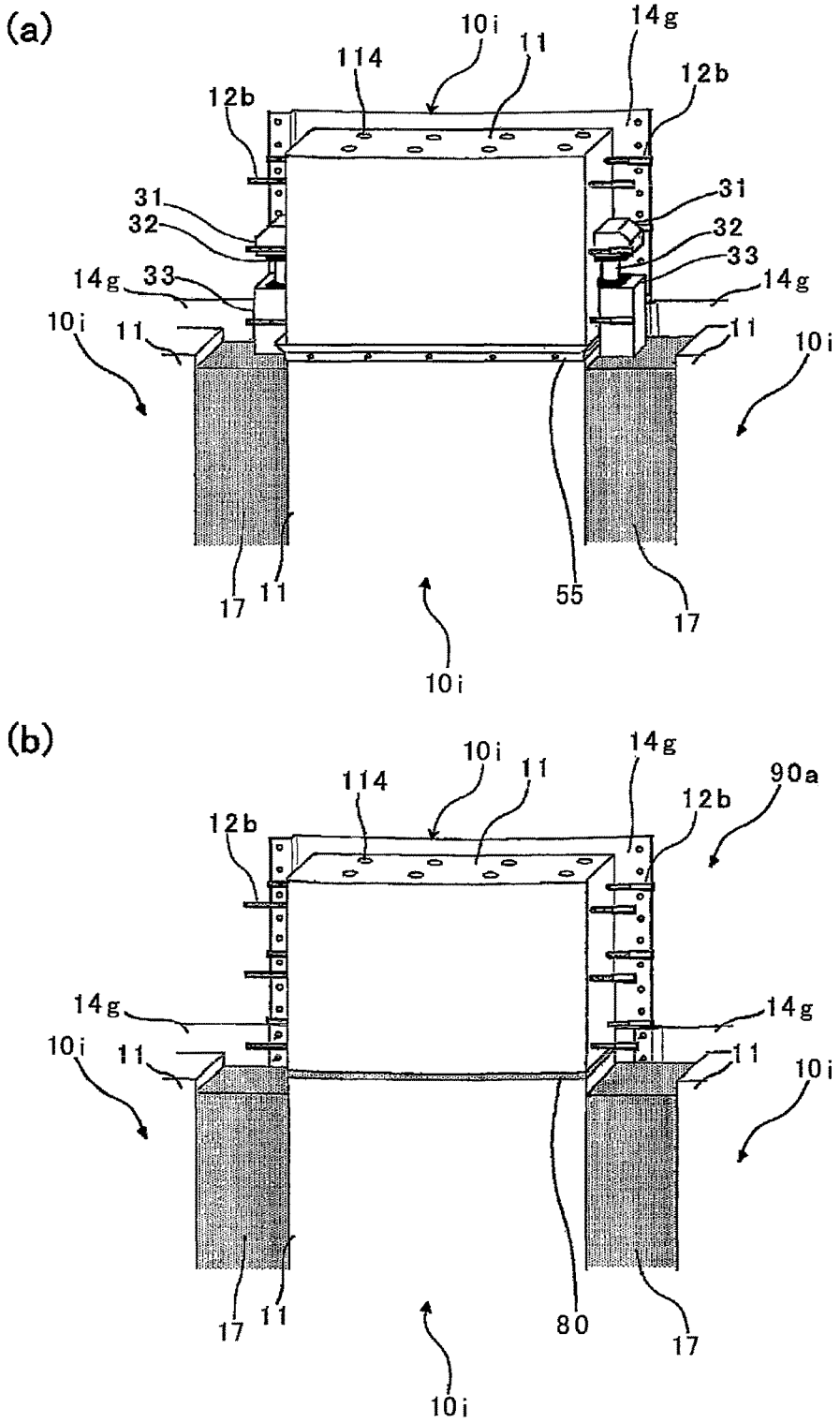
FIG. 29 is another set of views that are useful to describe the joining of the upper and lower blocks 10*i*.
Figure 30:
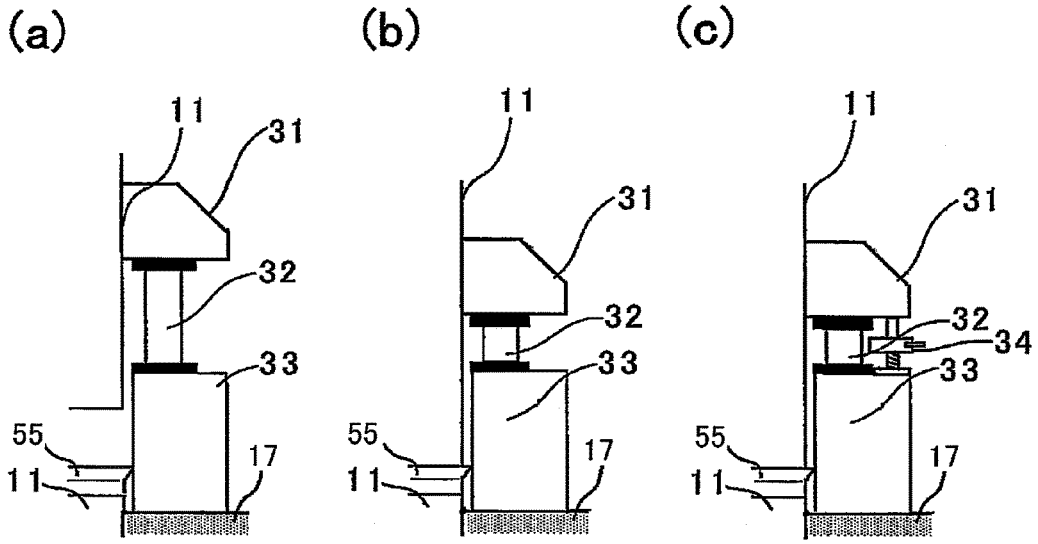
FIG. 30 is a set of views that illustrate a jack 32 and other elements.

After that, as shown in FIG. 30(*b*), the jack 32 is retracted such that the upper block 10*i* is moved down to a predetermined position. As a result, as shown in FIG. 31(*b*), the coupling joints having the fixing elements 12*a*, which protrude downward from the main body 11 of the upper block 10*i*, are inserted down to the vicinities of the bottoms of the holes 114 of the main body 11 of the associated lower block 10*i*. Also, the mortar 80 is pressed by the main body 11 of the upper block 10*i*. The upper and lower blocks 10*i* in this situation are shown in FIG. 29(*a*).

Figure 31:
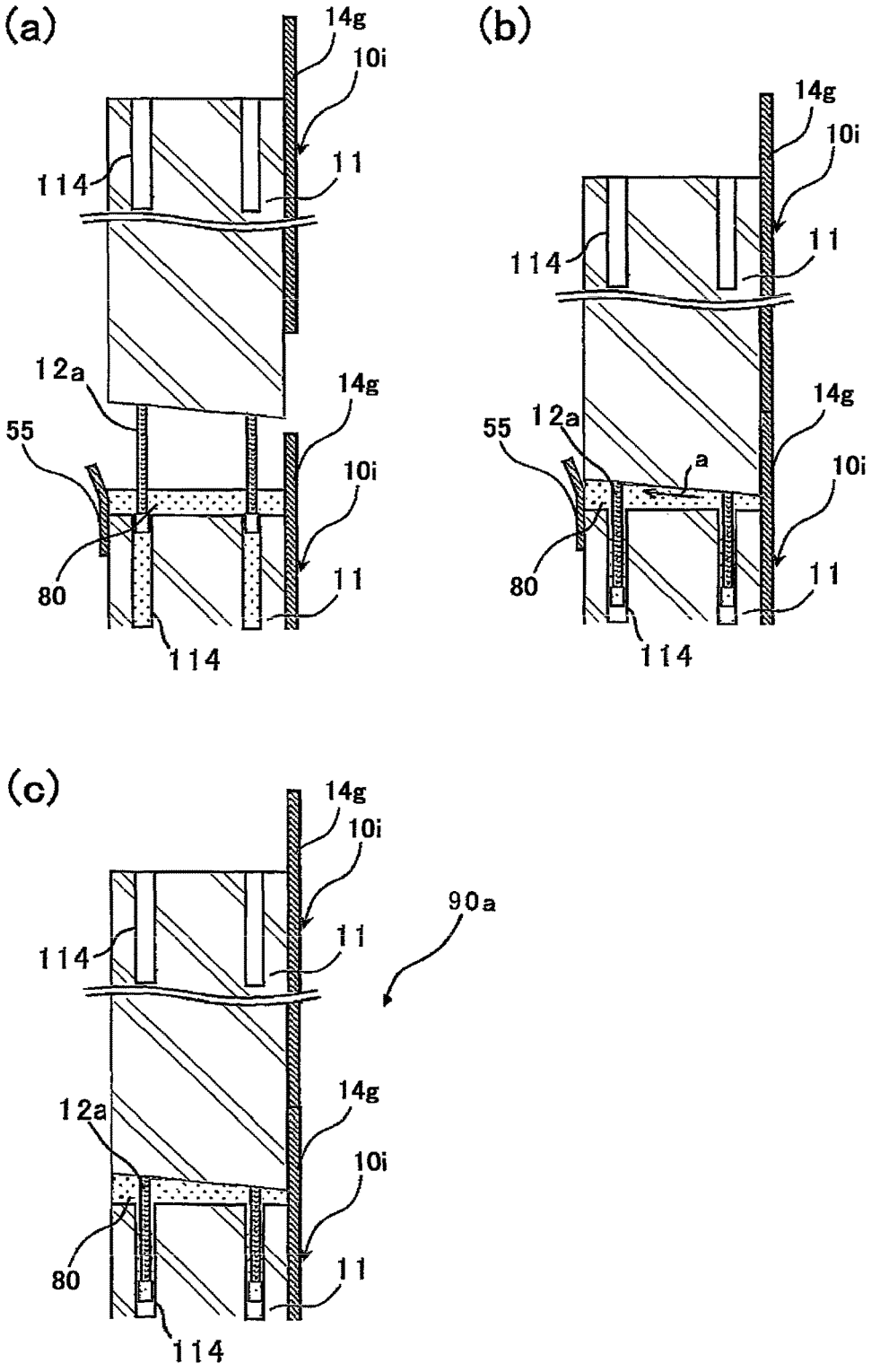
FIG. 31 is a set of vertical cross-sectional views of the block 10*i*.

As shown in FIG. 31(*b*), the inclination of the outer formwork 55 leaves (creates) a gap between the main body 11 of the upper block 10*i* and the outer formwork 55, and therefore, surplus or unnecessary mortar 80, which is forced out by the pressure exerted from the main body 11 of the upper block 10*i*, is discharged from the gap.

Because the bottom face of the main body 11 inclines, as described above, the surplus mortar 80 smoothly moves to the above-mentioned gap along the inclination, as indicated by the arrow a, and the air is appropriately discharged. Thus, the air is not trapped under the bottom face of the main body 11.

After that, as shown in FIG. 30(*c*), a jack base 34 is disposed between the supporting post 33 and the bracket 31 such that the jack base 34 supports the bracket 31 to hold the block 10*i*, and then the jack 32 is removed. The removed jack 32 may be used when another block 10*i* is disposed.

As the mortar 80 is cured upon elapsing of the time, the outer formwork 55, the brackets 31, the supporting posts 33 and the jack bases 34 are removed. Then, as shown in FIG. 29(*b*), the joining structure 90*a* including the upper and lower blocks 10*i* is formed. The removed outer formwork 55 and other parts may be used when another block 10*i* is disposed.

FIG. 31(*c*) depicts the cross-sectional view of the block 10*i* in the thickness direction in the above-mentioned situation. As described above, the plates 14*g* of each two adjacent blocks 10*i* in the circumferential direction of the dike 2*a* are connected to each other. When the upper block 10*i* is disposed, the plates 14*g* of the upper and lower blocks 10*i* become continuous to each other as shown in FIG. 31(*c*). Accordingly, these plates 14*g* can form the side wall portion 31*b* of the outer tank 3*b* of the LNG tank 1*a*.

The above-described eleventh embodiment can provide similar advantages to the tenth embodiment. Because the block 10*i* has the plate 14*g* that protrudes upward from the main body 11, the plate 14*g* can be used as the inner formwork. Thus, the work for installing the formworks is simplified, and the work for installing the inner formworks from inside the dike 2*a* and related works become unnecessary. Accordingly, there is no interference with the construction work for the inner facility such as the inner tank 3*a* and the outer tank 3*b*, which is conducted inside the dike 2*a*. This enables the early start of the inner facility construction work and results in the reduction in the work period.

When the block 10*i* is disposed, the brackets 31 attached to the right and left faces of the block 10*i* are supported by the jacks 32 while the block 10*i* is being gradually moved down. Thus, the tilting and/or the falling of the block 10*i* are prevented, and it is possible to precisely position the block 10*i* in a reliable manner. In addition, because the bottom face of the main body 11 of the block 10*i* inclines, it is possible to fill the gap between the upper and lower blocks 10*i* with the mortar 80 in a reliable manner without trapping the air, as described above.

It should be noted that the shape of the dike 2*a* is not limited to the circular shape, when viewed in the plan view, as shown in FIG. 26. The shape of the dike 2*a* may be a polygonal shape when viewed in the plan view. Similarly, the shape of the block 10*i* may be arbitrarily decided in accordance with the shape of the dike 2*a*. For example, the main body 11 may not have an arc-like bending portion, i.e., the main body 11 may be a flat plate member, and a plurality of main bodies 11 may be assembled to construct the dike 2*a* that is polygonal when viewed in the plan view.

Likewise, the bottom face of the main body 11 is not limited to the one described with reference to FIG. 27 and other drawings, i.e., the bottom face being inclined upward and outward. For example, the bottom face of the main body 11 may be inclined upward from the center of the width direction of the main body 11 toward opposite ends.

Figure 32:
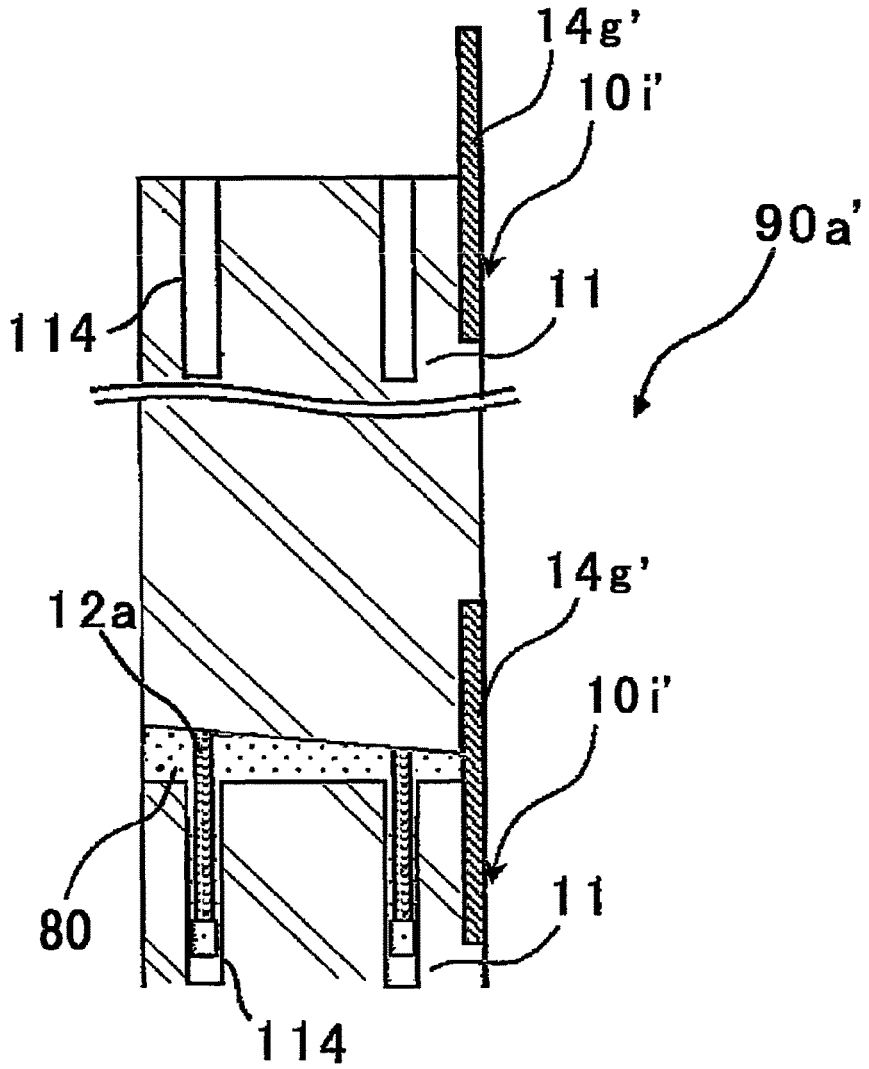
FIG. 32 illustrates a block 10*i*' and a joining structure 90*a*'.

The plate 14*g* may also be modified. As seen in the block 10*i*' and the joining structure 90*a*' in FIG. 32, the plate 14*g*' may only be provided on the upper end of the inner face of the main body 11 and protrude upward from the main body 11.

Figure 33:
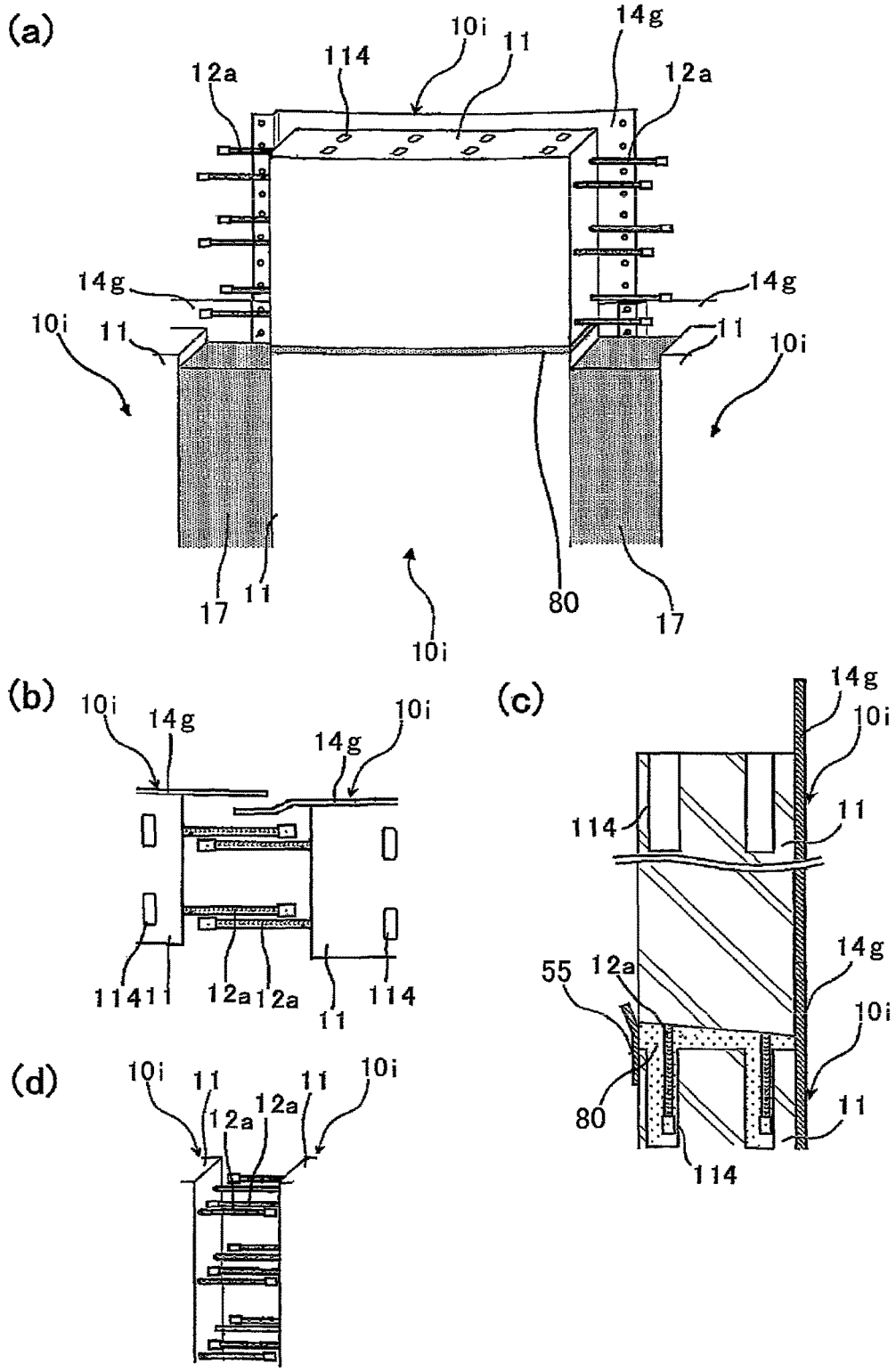
FIG. 33 is a set of views that illustrate a method of arranging the blocks 10*i*.

The coupling joints to be provided on the right and left faces of the main body 11 are not limited to the mechanical joints 12*b*. For example, the coupling joints may be the coupling joints having the fixing elements 12*a* or the like. In this case, when there is no adjacent block 10*i*, it is possible to dispose the block 10*i* as shown in FIG. 33(*a*) in a similar manner to the above-described manner. It should be noted, however, that when a new block 10*i* is disposed next to this block 10*i*, the coupling joints having the fixing elements 12*a* of the two blocks 10*i* may interfere with each other when viewed in the plan view, and the new block 10*i* may not be able to descend straight.

In such case, a slidable jig may be provided between the bracket 31 and the jack 32 when the new block 10*i* is disposed, such that the new block 10*i* can slide in the thickness direction of the main body 11.

Specifically, when a new block 10*i* is disposed, the new block 10*i* (right block 10*i* in FIG. 33(*b*)) is firstly offset outward from the next block 10*i*, such that the coupling joints having the fixing elements 12*a* of the two blocks 10*i* do not interfere with each other when viewed in the plan view. FIG. 33(*b*) shows the plan view of the blocks 10*i*.

Then, the new block 10*i* is caused to descent in a similar manner to the previous embodiment. When the lower ends of the coupling joints having the fixing elements 12*a*, which protrude downward from the main body 11 of the block 10*i*, are inserted to the middle of the respective holes 114 of the main body 11 of the lower block 10*i*, the block 10*i* is caused to slide inward to eliminate the offset. Subsequently, the block 10*i* is further moved down to the above-described predetermined position, and the block 10*i* is disposed as shown in FIG. 33(*c*). The gap between the two adjacent blocks 10*i* in this situation is shown in FIG. 33(*d*). The coupling joints having the fixing elements 12*a* on the left face of the main body 11 are present at a slightly different height from the coupling joints having the fixing elements 12*a* on the right face of the main body 11, and the coupling joints having the fixing elements 12*a* of the two adjacent blocks 10*i* lap each other in the up-down direction. The concrete will be poured and disposed between the two main bodies 11 of the two adjacent blocks 10*i* to form the masonry joints. It should be noted that the plates 14*g* are omitted in the FIG. 33(*d*).

As understood from the foregoing, it is possible to dispose a new block 10*i* while avoiding the interference between the coupling joints having the fixing elements 12*a* on the right and left faces. In order to enable the above-described sliding, it may be desired that each of the holes 114 formed in the top face of the main body 11 of the block 10*i* may be an elongated hole or the like, which is elongated in the thickness direction of the main body 11. Although the new block 10*i* is firstly offset outward and caused to slide inward later to eliminate the offset in this example, these movements may be conducted in a reverse order. Specifically, the new block 10*i* may firstly be offset inward and caused to slide outward later to eliminate the offset.

In this embodiment, the outer formwork 55 is separated from the plate 14*g*, and the outer formwork 55 has the inclined upper portion to form (leave) the gap between the outer formwork 55 and the upper block 10*i* such that extra mortar 80 can easily be discharged. It should be noted that only a certain part of the outer formwork 55 may have the above-described inclination as the circumstances demand so.

It should be noted that the method of discharging the mortar 80 is not limited to this method. For example, if the area surrounded by the outer formwork 55 is slightly expanded such that the area becomes larger than the bottom face of the main body 11 of the upper block 10*i*, the gap to be used to discharge the mortar 80 is formed between the outer formwork 55 and the upper block 10*i* in a similar manner to the above-described configuration.

Figure 34:
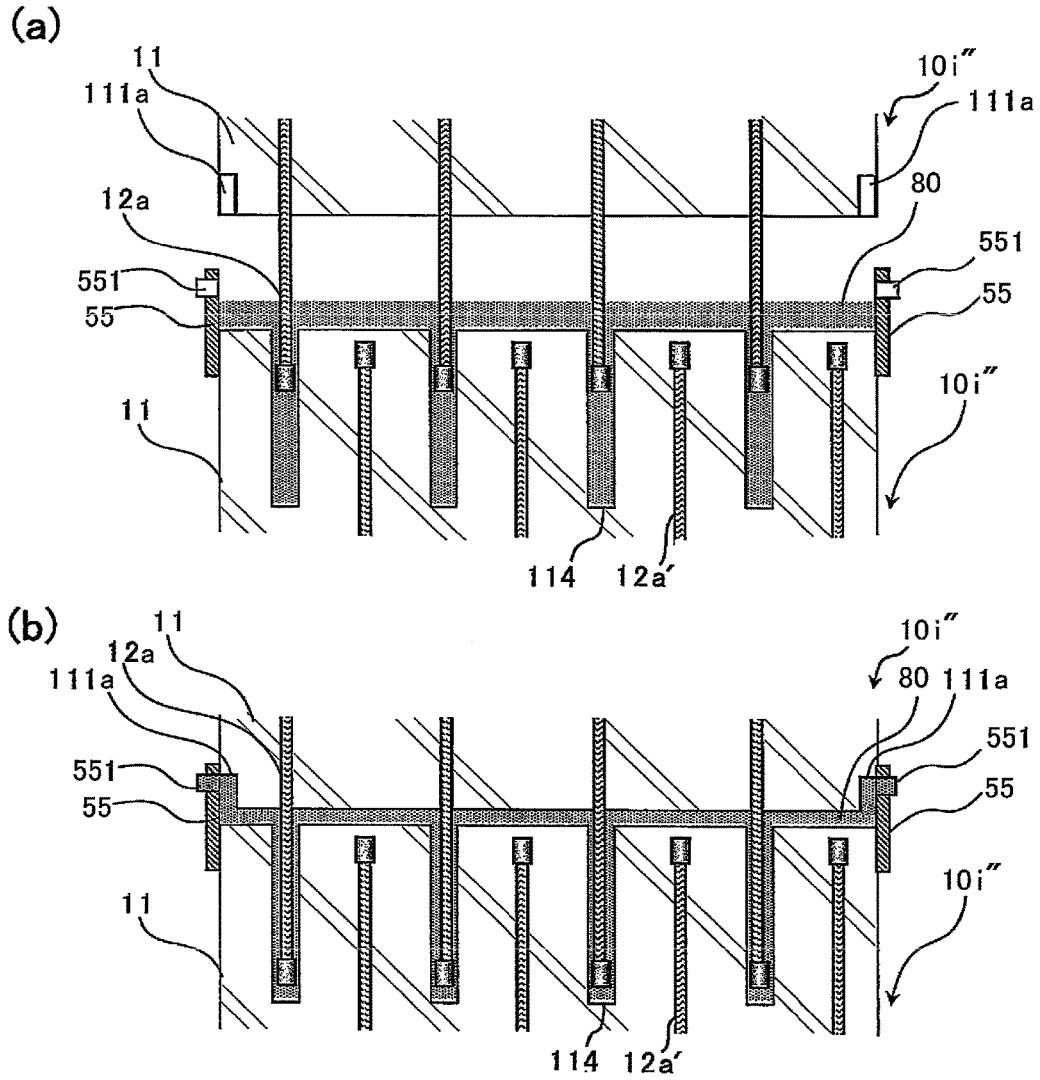
FIG. 34 is a set of views that are useful to describe the joining of upper and lower blocks 10*i*".

As shown in FIG. 34(*a*), grooves 111*a* may be formed in the side faces of the main body 11 of the block 10*i*" such that each of the grooves 111*a* extends upwards from the bottom face of the main body 11, and hollow passages 551, such as pipes, may be provided in the outer formwork 55, thereby making it possible to discharge the extra mortar 80.

Specifically, as shown in FIG. 34(*b*), the grooves 111*a* are communicated with the hollow passages 551 when the upper block 10 is disposed at the above-mentioned predetermined position. Thus, it is possible to discharge the extra mortar 80 to the outside through the grooves 111*a* and the hollow passages 551. In this configuration, the outer formwork 55 does not necessarily have the above-mentioned inclination.

Although the LNG tank 1*a* is described as the structure that includes the joining structure 90*a* in this embodiment, use of the joining structure of this embodiment is not limited to the LNG tank, but the joining structure may be used in various types of structures. For example, the joining structure may be used to join column members to each other with the precast blocks, or to join wall members to beam members.

In the eleventh embodiment, the screws and the nuts are used to fix the plate 14*g* to the outer formwork 55. In this case, when the upper block 10*i* is disposed as shown in FIG. 31(*b*), it is possible to push (force) the plate 14*g* against the lower part of the inner face of the main body 11 of the upper block 10*i* upon tightening the nuts or the like. This causes the plate 14*g* to closely contact the lower part of the inner face of the main body 11, and prevents the extra mortar 80 from leaking to the inside of the dike 2*a* from the plate 14*g*. In order to more securely prevent the leakage of the mortar 80, however, use of a separate mechanism for preventing the leakage may be effective.

The following passages will describe examples of this leakage preventing mechanism with reference to FIG. 35 to FIG. 41 as a twelfth embodiment to an eighteenth embodiment, respectively. These embodiments will be described while primarily focusing on the differences between them and the eleventh embodiment, and the description of similar configurations will be omitted. Similar to FIG. 31, each of FIG. 35 to FIG. 41 shows a cross-sectional view of the main body 11 of the precast block in the thickness direction.

Twelfth Embodiment

Figure 35:
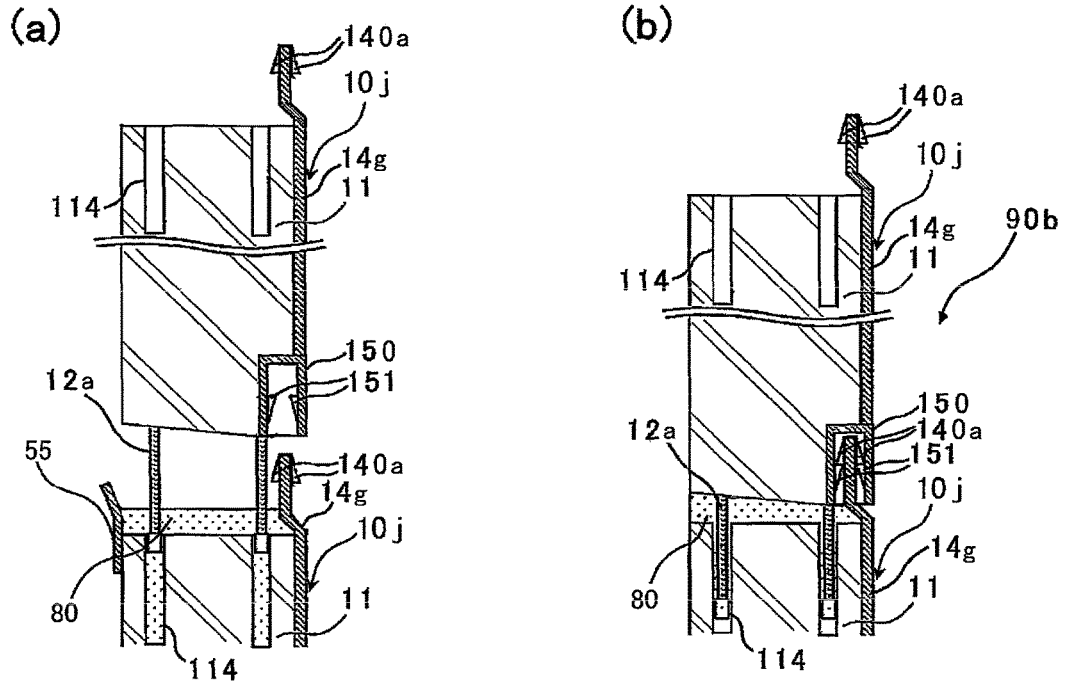
FIG. 35 is a set of views that are useful to describe the joining of upper and lower blocks 10*j*.

In the twelfth embodiment, as shown in FIG. 35(*a*), a check valve portion 150 is provided at the lower part of the inner face of the main body 11 of each precast block 10*j*. The check valve portion 150 is a box having an open bottom, and extends in the width direction of the main body 11 (in the direction perpendicular to the drawing sheet; this direction is simply referred to as "width direction" hereinafter). The check valve portion spans the entire width of the main body 11.

Inside the check valve portion 150, packings 151 (water stops) are provided such that the packings 151 protrude from the opposite faces of the main body 11 in the width direction, respectively, and the packings 151 span the entire width of the main body.

On the other hand, the upper end of each plate 14*g* bends such that the upper end of the plate 14*g* shifts outward, and a packing 140*a* is provided on the free end of the plate 14*g* such that the packing 140*a* protrudes inward and outward and spans the entire width of the plate.

When the upper block 10*j* is disposed, as shown in FIG. 35(*b*), the upper end of the plate 14*g* of the lower block 10*j* is inserted in the check valve portion 150 of the upper block 10*j*, and the packing 140*a* at the free end of the plate 14*g* is brought on top of the packing 151 such that the packing 140*a* is engaged with the packing 151 while the packing 140*a* is being fitted in the packing 151.

The packings 140*a* and 151 form a check valve structure (leakage preventing mechanism) to prevent the leakage of the mortar 80. In this manner, the joining structure 90*b* including the upper and lower block 10*j* is formed.

Thirteenth Embodiment

Figure 36:
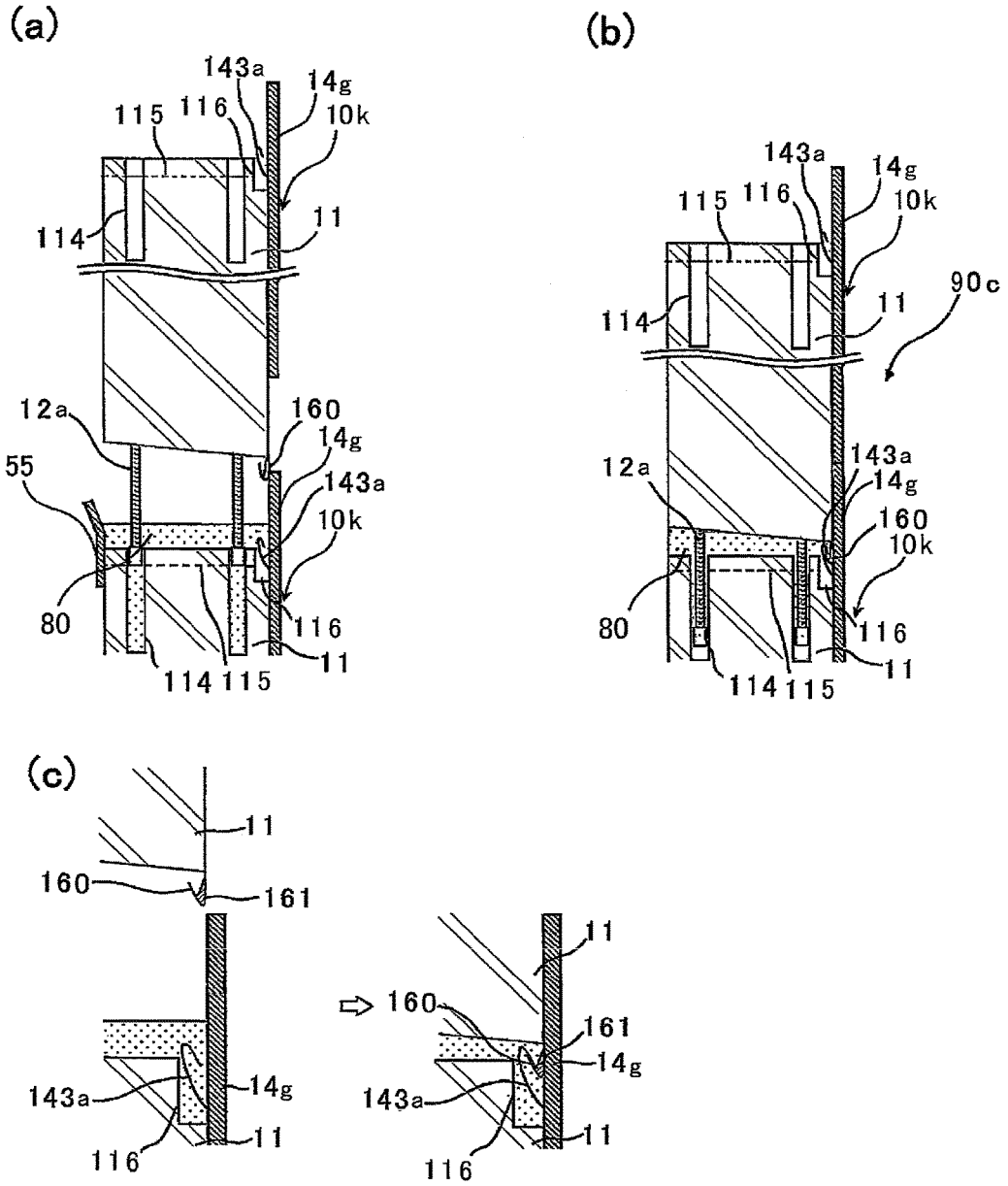
FIG. 36 is a set of views that are useful to describe the joining of upper and lower blocks 10*k*.

In the thirteenth embodiment, as shown in FIG. 36(*a*), a recess 116 is formed at the inner portion of the top face of the main body 11 of each precast block 10*k* such that the recess 116 extends along the plate 14*g* in the width direction and spans the entire width of the main body 11. On the top face of the main body 11, a groove 115 is formed in the thickness direction of the main body 11 such that the groove 115 extends through the holes 114 and reaches the recess 116, and the mortar can flow in the groove 115.

A plate member 143*a* having elasticity is attached to the plate 14*g* such that the plate member 143*a* extends in the width direction and spans the entire width of the plate 14*g*. The plate member 143*a* is provided inside the recess 116. A water stop plate 160, which also possesses elasticity, is attached to the lower end of the inner face of the main body 11 such that the water stop plate 160 extends in the width direction and spans the entire width of the main body 11. The free end of the plate member 143*a* turns back (folds) downward, and the free end of the water stop plate 160 turns back upward.

When the upper block 10*k* is disposed, as shown in FIG. 36(*b*), the turning back portion of the water stop plate 160 of the upper block 10*k* engages with the turning back portion of the plate member 143*a* of the lower block 10*k*.

As shown in the left illustration of FIG. 36(*c*), a packing 161 is provided on the water stop plate 160 such that the packing 161 extends in the width direction and spans the entire width of the water stop plate 160. When the block 10*k* is disposed, as shown in the right illustration of FIG. 36(*c*), the packing 161 (leakage preventing mechanism) closely contacts the plate 14*g* of the lower block 10*k* to prevent the leakage of the mortar 80. In this manner, the joining structure 90*c* that includes the upper and lower blocks 10*k* is formed.

Fourteenth Embodiment

Figure 37:
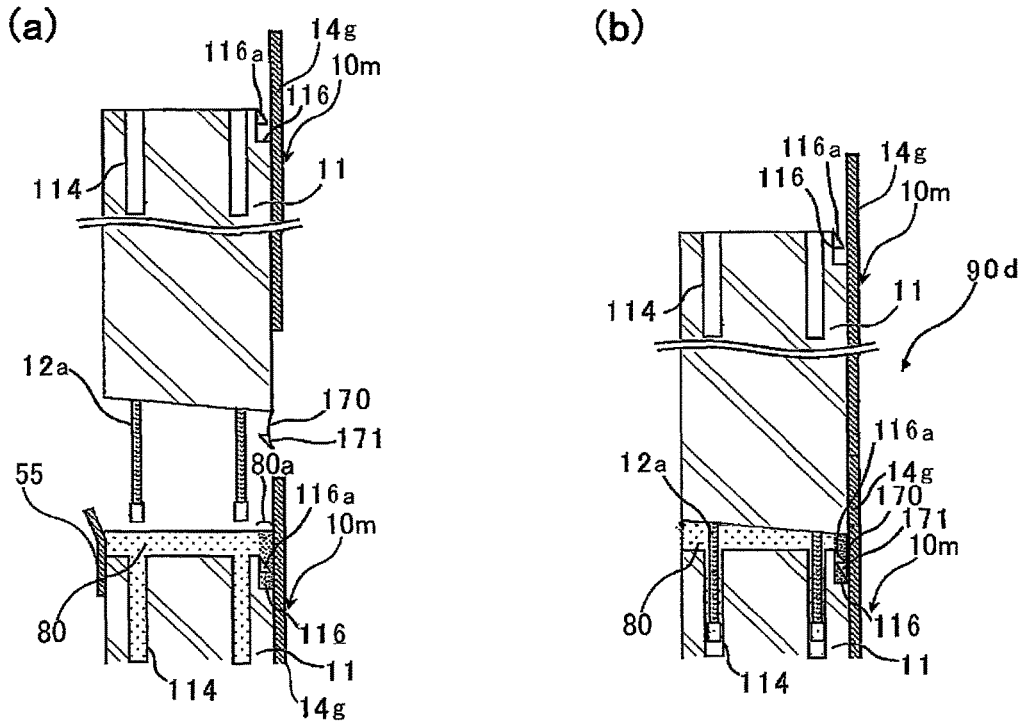
FIG. 37 is a set of views that are useful to describe the joining of upper and lower blocks 10*m*.

In the fourteenth embodiment, as shown in FIG. 37(*a*), the recess 116 that is similar to the recess in the previous embodiment, is formed in the main body 11 of a precast block 10*m*. In the recess 116, a packing 116*a* is provided such that the packing 116*a* protrudes inward and extends in the width direction. The packing 116*a* spans the entire width of the recess 116. It should be noted that stiff-consistency mortar, which is slightly stiffer than the mortar 80, is loaded in an area 80*a* in the horizontal plane, which corresponds to the recess 116.

A water stop plate 170 having elasticity is provided at the bottom of the inner face of the main body 11 such that the water stop plate 170 extends in the width direction and spans the entire width of the main body 11. A packing 171, which projects outward, is provided at the free end of the water stop plate 170 such that the packing 171 extends in the width direction and spans the entire width of the water stop plate 170.

When the upper block 10*m* is disposed, as shown in FIG. 37(*b*), the water stop plate 170 of the upper block 10*m* is inserted in the recess 116 of the main body 11 of the lower block 10*m*, and the packing 171 of the water stop plate 170 is brought below the packing 116*a* such that the packing 171 is engaged with the packing 116*a*.

The packings 116*a* and 171 form a check valve structure (leakage preventing mechanism) to prevent the leakage of the mortar 80. In this manner, the joining structure 90*d* that includes the upper and lower blocks 10*m* is formed.

Fifteenth Embodiment

Figure 38:
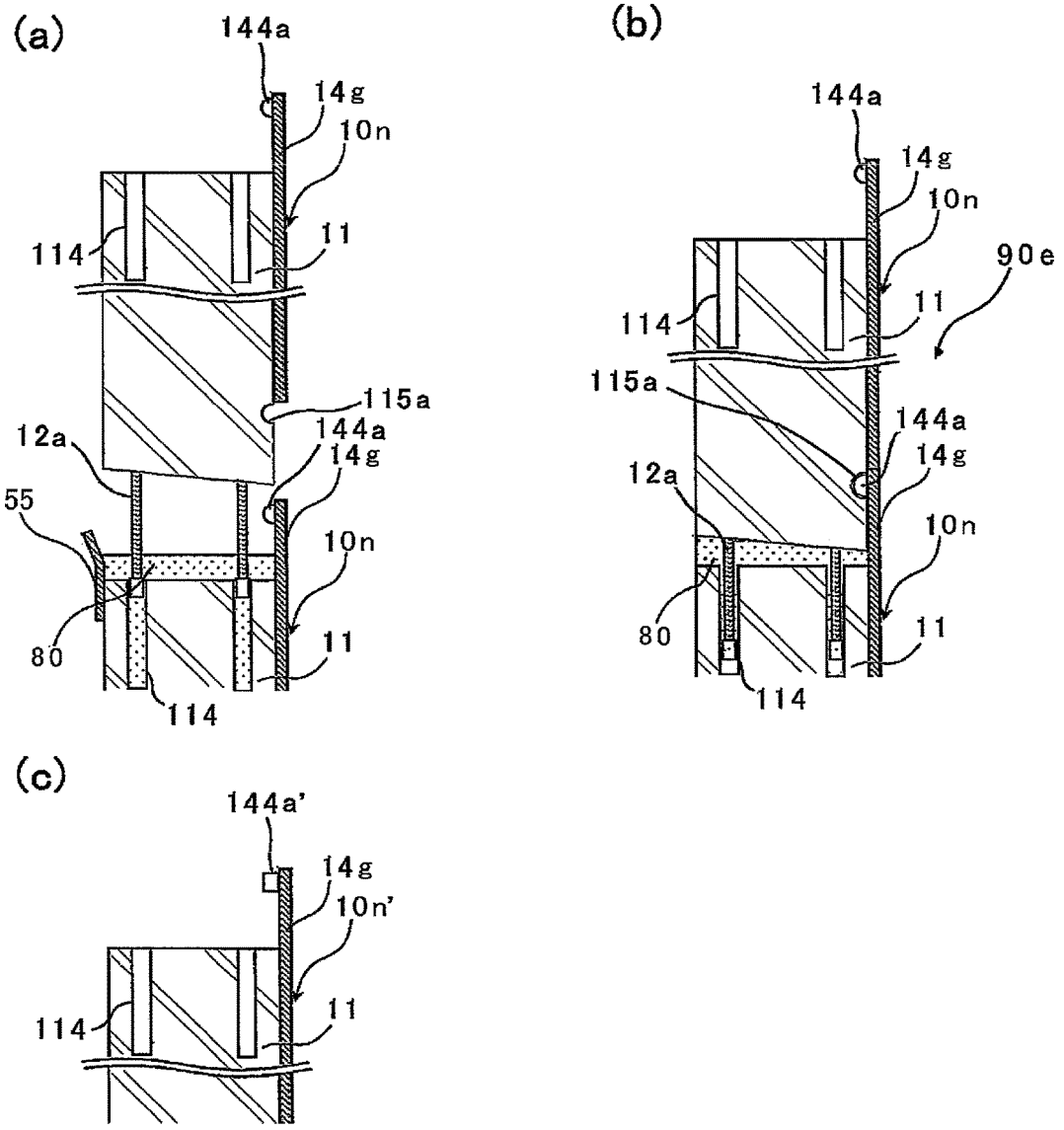
FIG. 38 is a set of views that are useful to describe the joining of upper and lower blocks 10*n*.

In the fifteenth embodiment, as shown in FIG. 38(*a*), a water stop rubber 144*a* (water stop member) is provided at the upper end of the plate 14*g* of the precast block 10*n*. The water stop rubber 144*a* extends in the width direction and spans the entire width of the precast block 10*n*. A groove 115*a* is formed at a lower portion of the inner face of the main body 11 such that the groove 115*a* extends in the width direction and spans the entire width of the main body 11.

When the upper block 10*n* is disposed, as shown in FIG. 38(*b*), the water stop rubber 144*a* of the plate 14*g* of the lower block 10*n* is inserted in the groove 115*a* of the upper block 10*n* and engaged with the groove 115*a*.

The groove 115*a* and the water stop rubber 144*a* (leakage preventing mechanism) prevent the leakage of the mortar 80. In this manner, the joining structure 90*e* that includes the upper and lower blocks 10*n* is formed.

It should be noted that as seen in the block 10*n*' of FIG. 38(*c*), a sponge 144*a*' (water stop member) having elasticity may be provided in place of the water stop rubber 144*a*. In this case, when the upper block 10*n*' is disposed, the sponge 144*a*' deforms in conformity with the shape of the groove 115*a*, and the sponge 144*a*' is fitted in and engaged with the groove 115*a*. Thus, similar advantages can be obtained. The sponge 144*a*' may be, for example, a urethane sponge that is flame-resisting.

Sixteenth Embodiment

Figure 39:
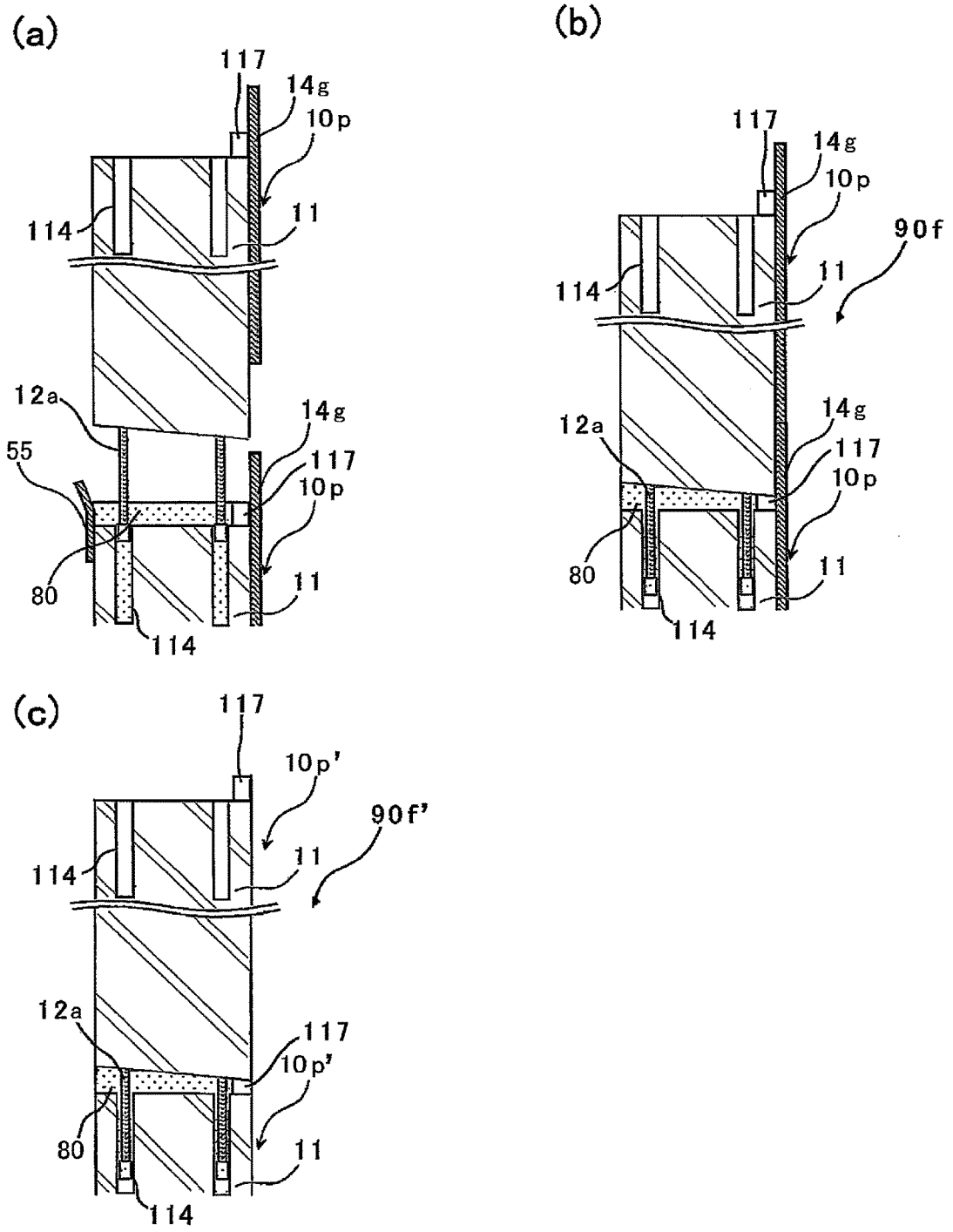
FIG. 39 is a set of views that are useful to describe the joining of upper and lower blocks 10*p*.

In the sixteenth embodiment, as shown in FIG. 39(*a*), a sponge 117 having elasticity is provided on the inner portion of the top face of the main body 11 of a precast block 10*p*. The sponge 117 extends along the plate 14*g* in the width direction, and spans the entire width of the plate 14*g*.

When the upper block 10*p* is disposed, as shown in FIG. 39(*b*), the main body 11 of the upper block 10*p* compresses and squeezes the sponge 117 of the lower block 10*p*. The sponge 117 (leakage preventing mechanism) prevents the leakage of the mortar 80. In this manner, the joining structure 90*f* that includes the upper and lower blocks 10*p* is formed.

It should be noted that as seen in a block 10*p*' and a joining structure 90*f*' of FIG. 39(*c*), the plate 14*g* may be dispensed with when the sponge 117 is provided, and the sponge 117 itself may be used as a formwork.

Seventeenth Embodiment

Figure 40:
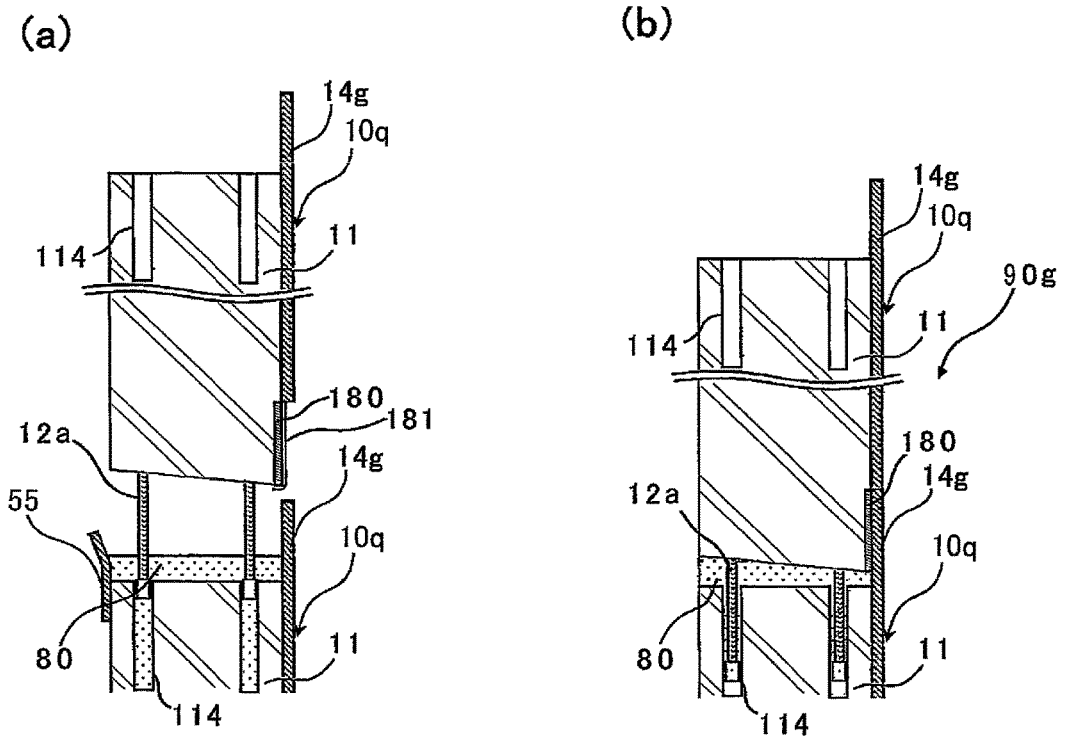
FIG. 40 is a set of views that are useful to describe the joining of upper and lower blocks 10*q*.

In the seventeenth embodiment, as shown in FIG. 40(*a*), an adhesive portion 180 is provided at a lower portion of the inner face of the main body 11 of a precast block 10*q*. The adhesive portion 180 extends in the width direction and spans the entire width of the main body 11. The adhesive portion 180 has, for example, a net-like shape-retaining member, and stiff-consistency mortar or the like, which is held in the shape-retaining member. A protection film 181 such as a sheet is provided over the surface of the adhesive portion 180 to protect the adhesive portion 180.

The protection film 181 is removed immediately before the adhesive portion 180 contacts the plate 14*g* of the lower block 10*q*. The upper block 10*q* is disposed at the above-described predetermined position. Then, as shown in FIG. 40(*b*), the plate 14*g* of the lower block 10*q* adheres to and closely contacts the adhesive portion 180 of the upper block 10*q*. The adhesive portion 180 (leakage preventing mechanism) prevents the leakage of the mortar 80. In this manner, the joining structure 90*g* that includes the upper and lower blocks 10*q* is formed.

Eighteenth Embodiment

Figure 41:
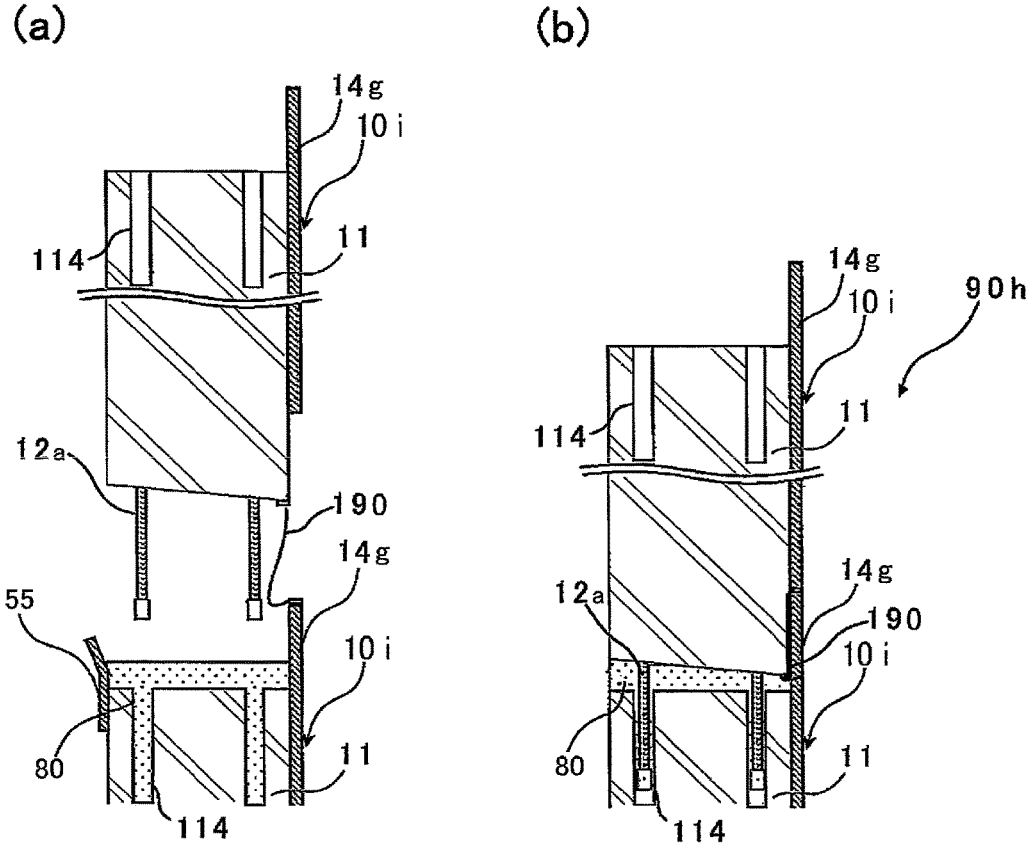
FIG. 41 is a set of views that are useful to describe the joining of the upper and lower blocks 10*i*.

In the eighteenth embodiment, the precast blocks 10*i* which are similar to those used in the eleventh embodiment are used. However, as shown in FIG. 41(*a*), a leakage preventing sheet 190 is attached between the lower portion of the inner face of the main body 11 of the upper block 10*i* and the upper end of the plate 14*g* of the lower block 10*i* immediately before the upper block 10*i* is disposed at the above-mentioned predetermined position. The leakage preventing sheet 190 extends in the width direction and spans the entire width of the main body 11.

With this situation, as the upper block 10*i* is disposed at the above-mentioned predetermined position, the sheet 190 closely contacts and is clamped between the lower portion of the inner face of the main body 11 of the upper block 10*i* and the plate 14*g* of the lower block 10*i* as shown in FIG. 41(*b*). The sheet 190 (leakage preventing mechanism) prevents the leakage of the mortar 80. In this manner, the joining structure 90*h* that includes the upper and lower blocks 10*i* is formed.

By using the leakage preventing mechanisms of the above-described twelfth to eighteenth embodiments, it is possible to prevent the extra mortar 80 from leaking to the inside of the dike 2*a* from the plate 14*g* when the upper precast block is disposed. This eliminates the work for removing the mortar 80 that leaks to the inside of the dike 2*a* and relevant works. Which one of the mechanisms should be used will be decided depending upon the easiness of the work and the cost.

Nineteenth Embodiment (1. Precast Block 10*r*)

Figure 42:
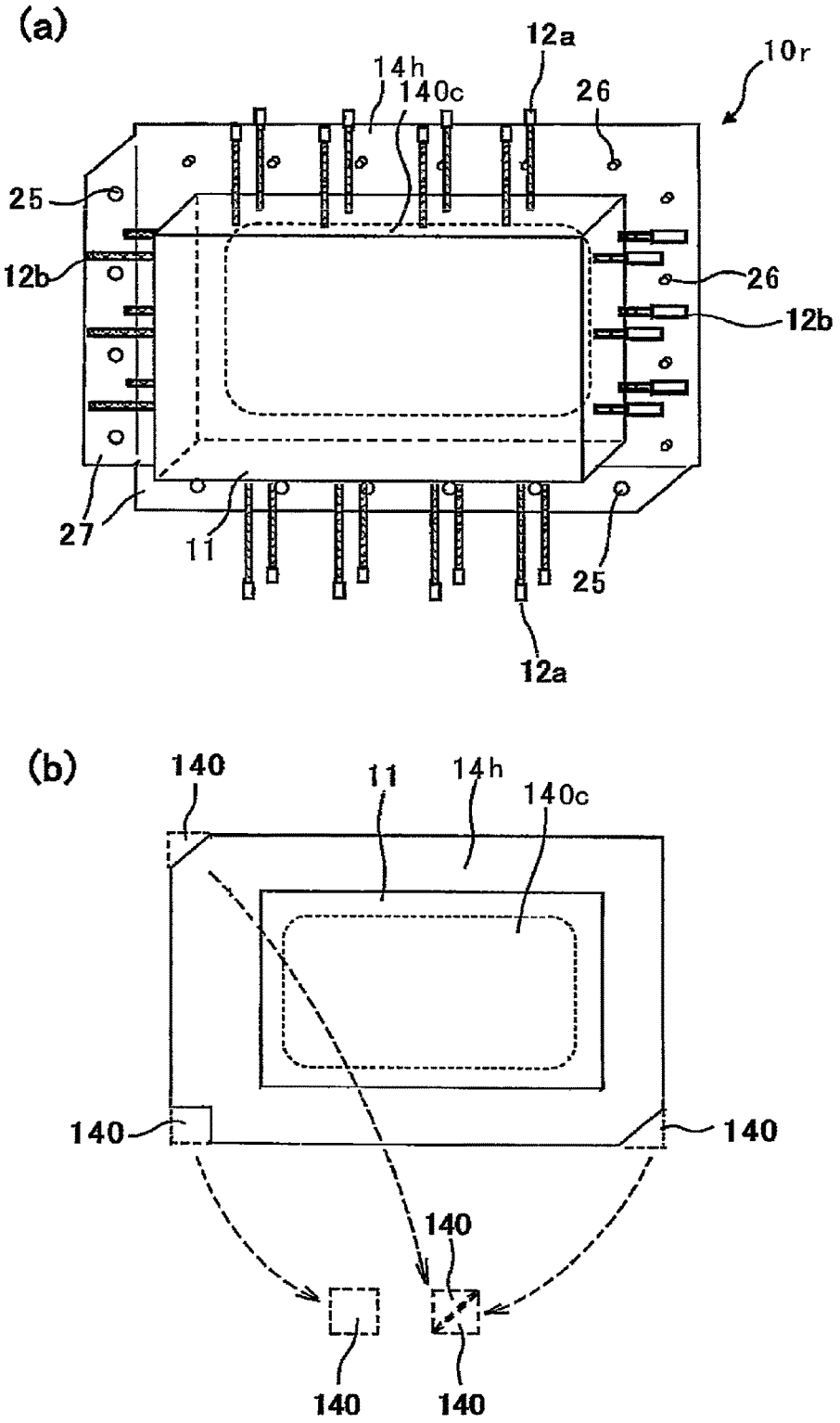
FIG. 42 is a set of views that illustrate a precast block 10*r*.

The nineteenth to the twenty-second embodiments are directed to examples of precast blocks used in the LNG tank 1 according to the present invention. FIG. 42(*a*) shows a block 10*r* according the nineteenth embodiment of the present invention. FIG. 42(*b*) shows a front view of a plate 14*h* of the block 10*r*.

The block 10*r* includes the main body 11, the coupling joints having the fixing elements 12*a*, the mechanical joints 12*b*, the plate 14*h* and other parts.

The main body 11 is a concrete member that has a rectangular plate shape. The above-mentioned coupling joints having the fixing elements 12*a*, the mechanical joints 12*b* and the plate 14*h* are mounted on the main body 11.

Each of the coupling joints 12*a* has a fixing element at a free end of each of the reinforcing steel bars that protrude from the top and bottom faces of the main body 11.

The mechanical joints 12*b* are disposed on the right and left faces of the main body 11. Those mechanical joints 12*b* which are provided on one of the right and left faces are male joints, and those mechanical joints 12*b* which are provided on the other of the right and left faces are female joints. As the free ends of the male joints are inserted and fixed in the couplers of the female joints, the male joints and the female joints of two adjacent blocks 10*r* are connected to each other.

The plate 14*h* is a metallic plate member, which is attached to the back face of the main body 11. The plate 14*h* has a frame shape with an opening 140*c* or a plate shape with no opening. Edges (protruding portions) of the plate 14*h* protrude upward, downward, rightward and leftward from the main body 11.

Bolts 26 (convex portions) are provided along the right edge and the upper edge of the plate 14*h*. Holes 25 are formed along the left edge and the lower edge of the plate 14*h*. The holes 25 are receiving portions into which the bolts 26 can be inserted. The holes 25 and the bolts 26 are provided along the respective edges in the up-down direction and the right-left direction, and constitute, in combination, a fixing mechanism for fixing the plate 14*h*.

As indicated by the bent portions 27 in FIG. 42(*a*), the left edge and the lower edge of the plate 14*h*, which have the holes 25 formed therein, are bent such that the left edge and the lower edge are positioned forward of the right edge and the upper edge, which have the bolts 26 thereon. Here, the term "forward" is used when looked at in the direction toward the front face of the main body 11 that has no plate 14*h*. The term "backward" is used when looked at in the direction toward the back face of the main body 11 that has the plate 14*h*.

If the lower left corner of the plate 14*h*, at which the left edge having the holes 25 formed therein and the lower edge meet, and the upper right corner of the plate 14*h*, at which the right edge having the bolts 26 provided thereon and the upper edge meet, are looked at, the lower left corner has a shape that is prepared by cutting out the right-angle corner in an L shape to form an internal corner. On the other hand, the upper right corner is a right-angle corner.

The upper left corner of the plate 14*h*, at which the left edge having the holes 25 formed therein and the upper edge having the bolts 26 provided thereon meet, has a shape that is prepared by slantwise cutting out the right-angle corner, i.e., chamfering. Similarly, the lower right corner of the plate 14*h*, at which the lower edge having the holes 25 formed therein and the right edge having the bolts 26 provided thereon meet, has a shape that is prepared by slantwise cutting out the right-angle corner, i.e., chamfering. In this embodiment, these corners are cut out in a direction of 45-degree inclination relative to the respective edges.

As shown in FIG. 42(*a*), the respective shapes of the upper left corner, the upper right corner, the lower left corner and the lower right corner of the plate 14*h* are decided such that the cutout portions 140 obtained from the right-angle corners can create, when combined, two substantially identical rectangular areas. This rectangular area corresponds to an overlapping portion of the plates 14*h* at a contact position, which will be described later.

(2. Structure 30 Made from the Blocks 10*r*)

Figure 43:
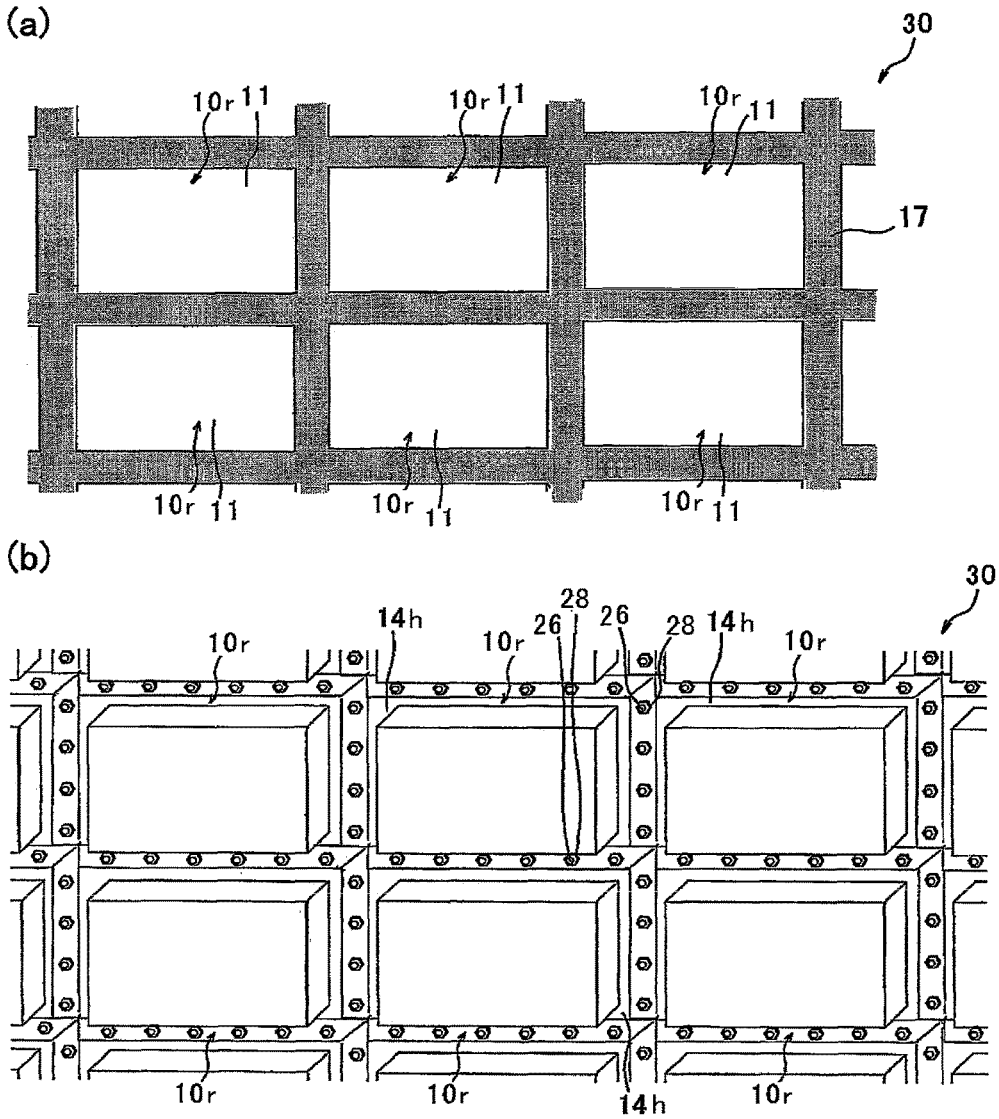
FIG. 43 is a set of views that illustrate a structure 30.

FIG. 43(*a*) shows a structure 30 (dike of the LNG tank) made from the blocks 10*r*. In the structure 30, the blocks 10*r* are arranged upward and downward as well as rightward and leftward. Concrete, i.e., filler, is poured and disposed between the main bodies 11 of each two adjacent blocks 10*r* in the up-down direction and the right-left direction to form the masonry joints 17.

At this point in time, the coupling joints having the fixing elements 12*a* (see FIG. 42(*a*)) that protrude downward from the main body 11 of the upper block 10*r* and the coupling joints having the fixing elements 12*a* (see FIG. 42(*a*)) that protrude upward from the main body 11 of the lower block 10*r* form, in combination, lap joints, and the mechanical joints 12*b* (see FIG. 42(*a*)) of the right and left blocks 10*r* are connected to each other. These joints are buried in the masonry joints 17.

In this manner, the blocks 10*r* are connected to each other in the up-down direction and the right-left direction to construct the wall-like structure 30. The edges of the plates 14*h* serve as the inner formworks when the concrete is poured and disposed.

FIG. 43(*b*) illustrates the structure 30 of FIG. 43(*a*) with the masonry joints 17 being omitted. It should also be noted that the coupling joints having the fixing elements 12*a* and the mechanical joints 12*b* are also omitted in FIG. 43(*b*).

The plates 14*h* of the upper and lower blocks 10*r* are fixed to each other by causing the lower edge (see FIG. 42(*a*)) of the plate 14*h* of the upper block 10*r*, which has the holes 25 formed therein, to lap the front of the upper edge of the plate 14*h* of the lower block 10*r*, which has the bolts 26 provided thereon, inserting the bolts 26 in the holes 25, and tightening the nuts 28.

The plates 14*h* of the right and left blocks 10*r* are fixed to each other by causing the left edge (see FIG. 42(*a*)) of the plate 14*h* of the right block 10*r*, which has the holes 25 formed therein, to lap the front of the right edge of the plate 14*h* of the left block 10*r*, which has the bolts 26 provided thereon, inserting the bolts 26 in the holes 25, and tightening the nuts 28.

(3. Method of Constructing the Structure 30 with the Blocks 10*r*)

Now, a method of constructing the structure 30 with the blocks 10*r* will be described. Here, the constructing method will be described while focusing on those blocks 10*r* which are present in the vicinity of the contact position E shown in FIG. 44(*a*). It should be noted that in the following description the constructing method will basically be described, with the masonry joints 17 being omitted, as in FIG. 43(*b*).

Figure 44:
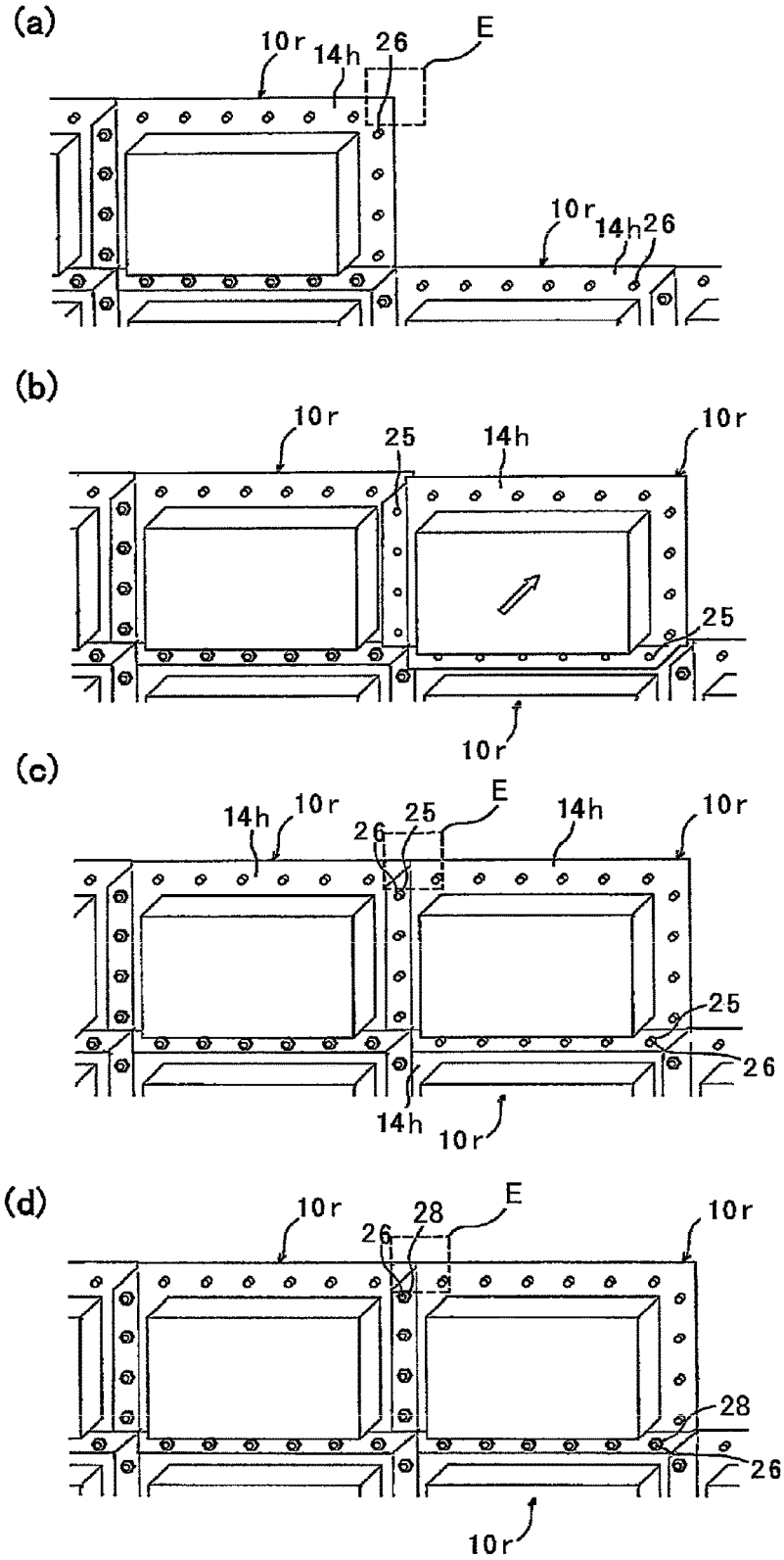
FIG. 44 is a set of views that illustrate a method of constructing the structure 30.

In this embodiment, on the right of the lower left block 10*r* from the contact position E shown in FIG. 44(*a*), disposed is a new block 10*r* as shown in FIG. 44(*b*). This block 10*r* is moved from the forward position to the rearward position as indicated by the arrow.

Figure 47:
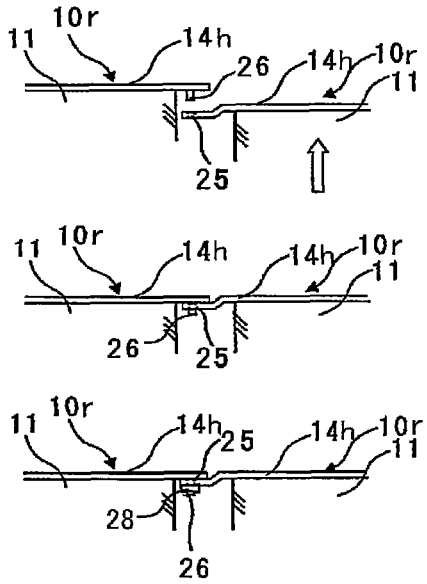
FIG. 47 is a set of views that are useful to describe the method of constructing the structure 30.
Figure 47:
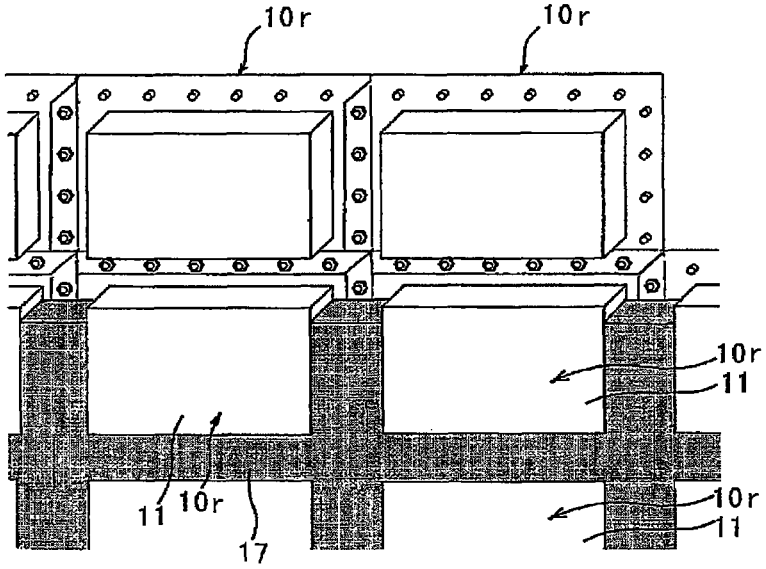
Figure 47:
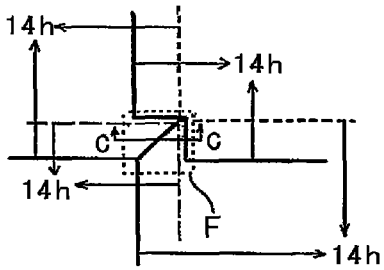
Figure 47:
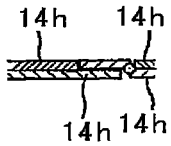

FIG. 47(*a*) illustrates the movements of the block 10*r*. As indicated by the arrow in the upper illustration of FIG. 47(*a*), the block 10*r* is moved backward. Then, as shown in the middle illustration, the bolts 26 on the right edge of the plate 14*h* of the left block 10*r* are inserted in the holes 25 of the left edge of the plate 14*h* of this block 10*r*, and the back face of the plate 14*h* of the right block 10*r* becomes level to the back face of the plate 14*h* of the left block 10*r*. This is also true to the upper and lower blocks 10*r*. Specifically, when the block 10*r* is moved backward, the bolts 26 on the upper edge of the plate 14*h* of the lower block 10*r* are inserted in the holes 25 of the lower edge of the plate 14*h* of this block 10*r*. This situation is shown in FIG. 44(*c*).

Figure 45:
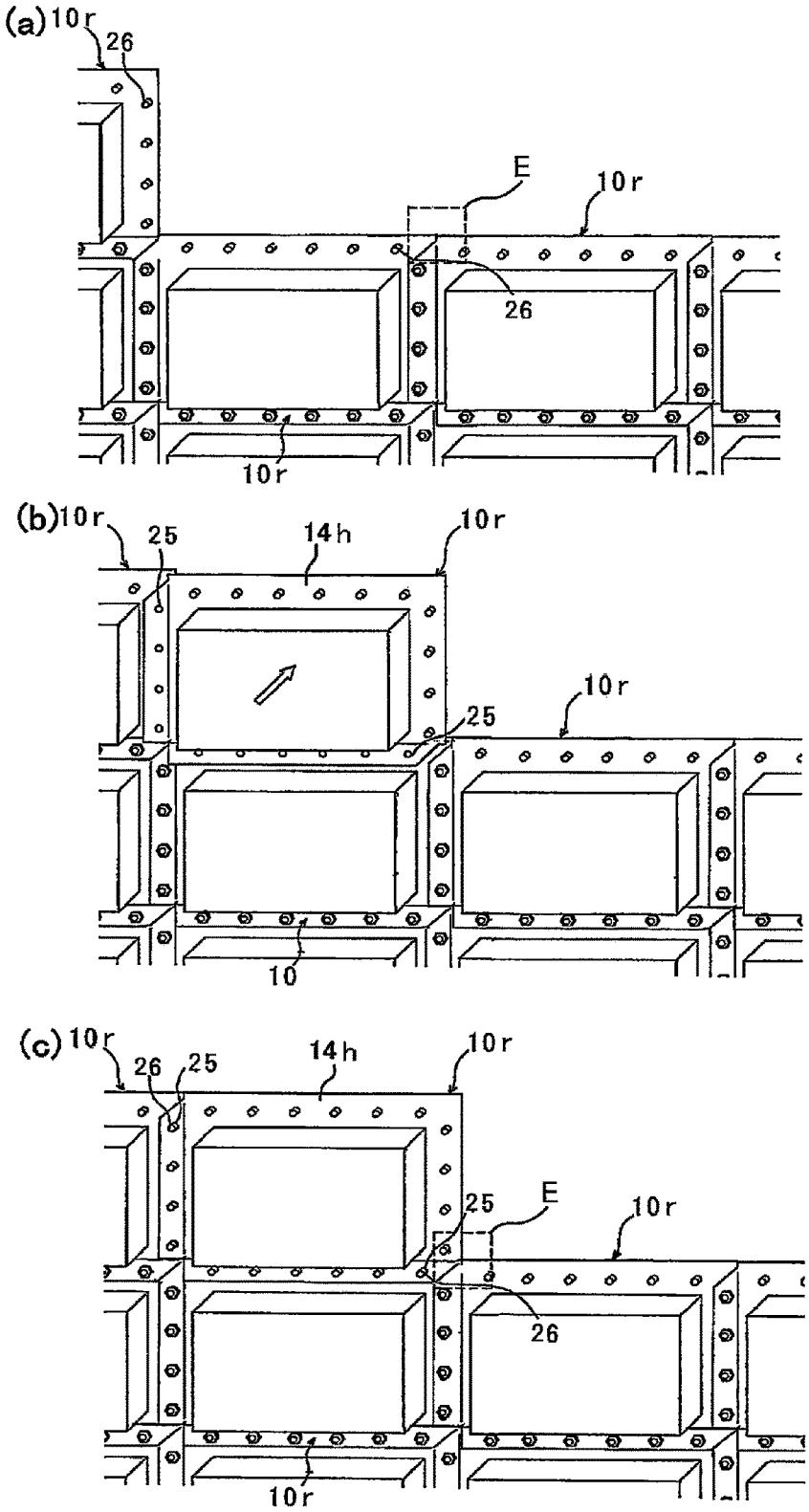
FIG. 45 is another set of views that illustrate the method of constructing the structure 30.

Subsequently, as shown in FIG. 44(*d*) and the lower illustration of FIG. 47(*a*), the nuts 28 are tightened over the bolts 26. In this manner, the blocks 10*r* are disposed from the left to the right such that the blocks 10*r* are arranged throughout the lower row. Then, the blocks 10*r* are arranged in the upper row in a similar manner. FIG. 45(*a*) shows a situation when the blocks 10*r* are arranged in the upper row before the location of a block 10*r* on the upper left of the contact position E.

Figure 46:
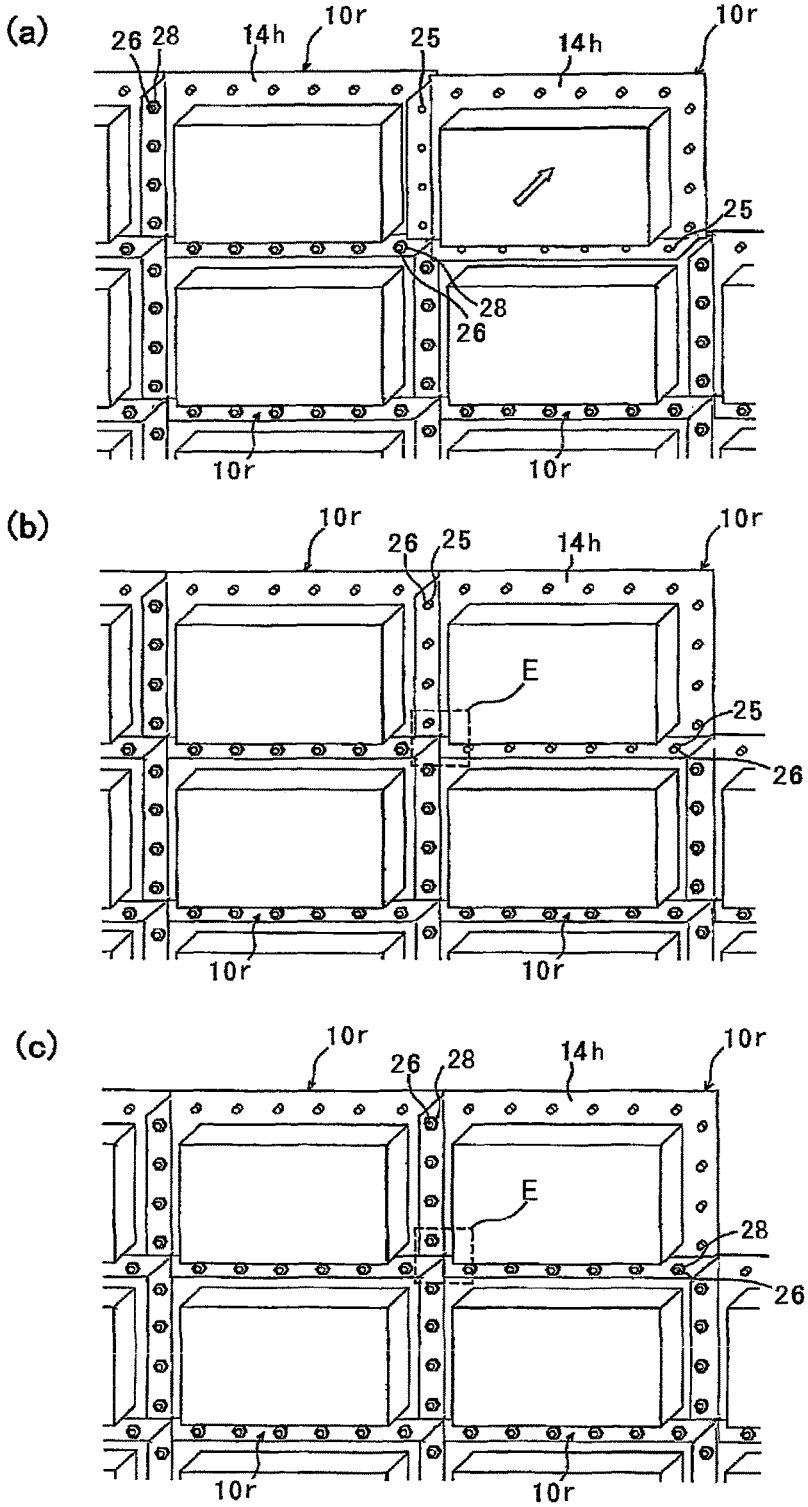
FIG. 46 is still another set of views that illustrate the method of constructing the structure 30.

The block 10*r* on the upper left of the contact position E is disposed in a similar manner to the above-described manner. Specifically, the new block 10*r* is moved from the forward position to the rearward position as indicated by the arrow in FIG. 45(*b*), and the bolts 26 on the left and lower blocks 10*r* are inserted in the holes 25 of the left and lower edges of the plate 14*h* of this block 10*r*, as shown in FIG. 45(*c*). Subsequently, the nuts 28 are tightened over the bolts 26, respectively, as shown in FIG. 46(*a*).

A block 10*r* on the upper right of the contact position E is disposed in a similar manner. Specifically, the new block 10*r* is moved from the forward position to the rearward position as indicated by the arrow in FIG. 46(*a*), and the bolts 26 on the left and lower blocks 10*r* are inserted in the holes 25 of the plate 14*h* of this block 10*r*, as shown in FIG. 46(*b*). Subsequently, the nuts 28 are tightened over the bolts 26, respectively, as shown in FIG. 46(*c*). In this manner, the blocks 10*r* are arranged in the up-down direction as well as in the right-left direction.

It should be noted that in an actual construction work, as shown in FIG. 47(*b*), the masonry joints 17 may be formed between the main bodies 11 of each two adjacent blocks 10*r* in the up-down direction and the right-left direction depending upon the progress of the building up work of the block 10*r*. The masonry joint 17 is formed by placing the outer formwork (not shown) in front of the gap between the main bodies 11, and pouring and disposing the concrete, i.e., filler, into an area defined between the outer formwork and the edges of the rear plate 14*h*, which is the inner formwork.

In the above-described manner, the blocks 10*r* are connected to each other in the up-down direction and the right-left direction. Also, the masonry joints 17 are formed between the main bodies 11 of the blocks 10*r* while using the plates 14*h* as the inner formworks for the filler. Accordingly, the above-mentioned structure 30 is formed.

(4. Overlapping Portion of the Plates 14*h*)

FIG. 47(*c*) shows the plate 14*h* at the contact position E, and FIG. 47(*d*) shows a cross-sectional view of the overlapping portion F, which is taken along the line c-c in FIG. 47(*c*).

In this embodiment, the oblique side of the lower right portion (at the lower right corner) of the plate 14*h* of the upper left block 10*r* meets (overlaps) the oblique side of the upper left portion (at the upper left corner) of the plate 14*h* of the lower right block 10*r* in the overlapping portion F indicated in the drawing.

In the overlapping portion F, the right-angle corner of the upper right corner of the plate 14*h* of the lower left block 10*r* is located at a position that corresponds to the location of the L-shaped internal corner at the lower left corner of the plate 14*h* of the upper right block 10*r*, when viewed in the plan view. As a result, the number of the plates 14*h* that overlap in the front-rear direction in the overlapping portion F does not exceed two.

As described above, this embodiment can form the masonry joints 17 with the filler while the plates 14*h* protruding from the main bodies of the blocks 10*r* are used as the inner formworks. Thus, a work for disposing the formworks from one side of the structure 30 and associated works are unnecessary. Consequently, the embodiment can avoid the interference with those works that should be conducted at one side, and it is possible to reduce the work period to be spent to construct the entire structure. Because each plate 14*h* has the above-described features at the four corners (at the four positions on the contour) of the main body 11, it can be considered that less than three plates 14*h* overlap at the contact position of the upper and lower blocks and the right and left blocks 10*r*. Thus, the disposing of the blocks 10*r* is easy.

In this embodiment, because the fixing mechanism that has the holes 25 and the bolts 26 is used to fix the plates 14*h* of the adjacent blocks 10*r*, with the plates 14*h* being lapped, it is possible to fix the positions of the plates 14*h* and construct the structure 30 appropriately. Because the holes 25 and the bolts 26 are used as the fixing mechanism, it is possible to easily fix the positions of the plates 14*h*.

Furthermore, in this embodiment, the shape of the plate 14*h* is decided in the above-described manner, and the holes 25 and the bolts 26 are provided along the upper, lower, right and left edges of the plate 14*h*. Thus, the use of the plates 14*h* enables the construction of the structure 30 with one kind of blocks 10*r*, and the efficiency of the work is high.

It should be noted, however, that the present invention is not limited to the above-described configurations. For example, the shape of the main body 11 is not limited to a particular shape, and the types of the upper, lower, right and left coupling joints are not limited to particular types. For example, the coupling joints may be loop joints.

Also, the locations of the holes 25 and the bolts 26 of the plate 14*h* are not limited to the above-described locations. For example, the locations may be reversed upside down or horizontally. Specifically, the bolts 26 may be provided along the left edge of the plate 14*h*, and the holes 25 may be formed along the right edge.

The features of the plate 14*h* at the four positions, i.e., the upper left corner, the upper right corner, the lower left corner and the lower right corner, are not limited to the above-described features as long as the cutout portions 140 can create two substantially identical rectangular areas when the cutout portions 140 are combined. For example, one of the upper left corner and the lower right corner of the plate 14*h* may be cut out in an L shape to form an internal corner and the other may be a right-angle corner, instead of obliquely cutting out the upper left corner and the lower right corner of the plate 14*h*.

Although the plate 14*h* is bent such that those edges having the holes 25 therein are positioned forward in this embodiment, the plate 14*h* may be bent such that those edges having the bolts 26 thereon may be positioned rearward. Alternatively, instead of bending the plate 14*h*, the two plates 14*h* and 14*h*' may overlap in the front-rear direction as shown in the left illustration of FIG. 48(*a*), or a plate 14*h*" may be provided at a front portion of the edge of the plate 14*h* as shown in the right illustration of FIG. 48(*a*).

Figure 48:
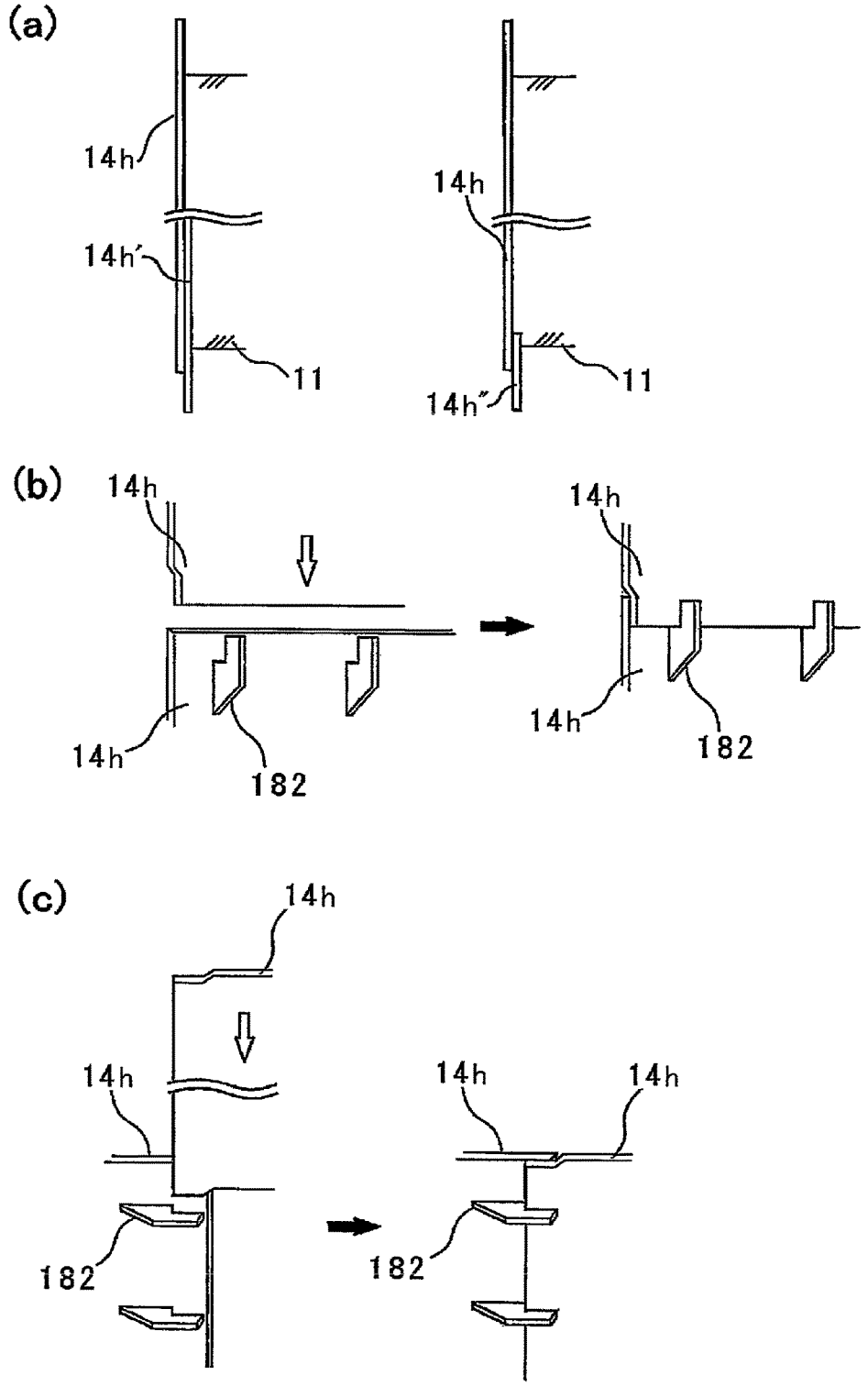
FIG. 48 is a set of views that illustrate a plate 14*h* and an exemplary fixing structure.

The fixing mechanism may not necessarily include the holes 25 and the bolts 26. For example, in the configuration of FIG. 48(*b*), plate clamping or holding portions 182, which are hook-like members, are attached to the plate 14*h* of the lower block 10*r* such that the plate holding portions 182 protrude forward. The plate holding portions 182 receive and support the plate 14*h* of the upper block 10*r* to fix the plate 14*h*. As illustrated in FIG. 48(*c*), the plate holding portions 182 may also be used to fix the plate 14*h* of the right and/or left block 10*r*. Other methods of fixing the plates 14*h* include fixing the plates 14*h* with their edges abutting on each other, without lapping the plates 14*h*. Alternatively, the plate 14*h* may be fixed to the outer formwork when the main body 11 of the block 10*r* is formed or when the masonry joints 17 are formed.

In the following description, examples of other precast blocks will be described as twentieth to twenty-third embodiments. These embodiments will be described while primarily focusing on the differences between them and the nineteenth embodiment, and the description of similar configurations will be omitted by using, for example, the same reference numerals in the drawings and the description.

Twentieth Embodiment (1. Precast Block 10*s*)

Figure 49:
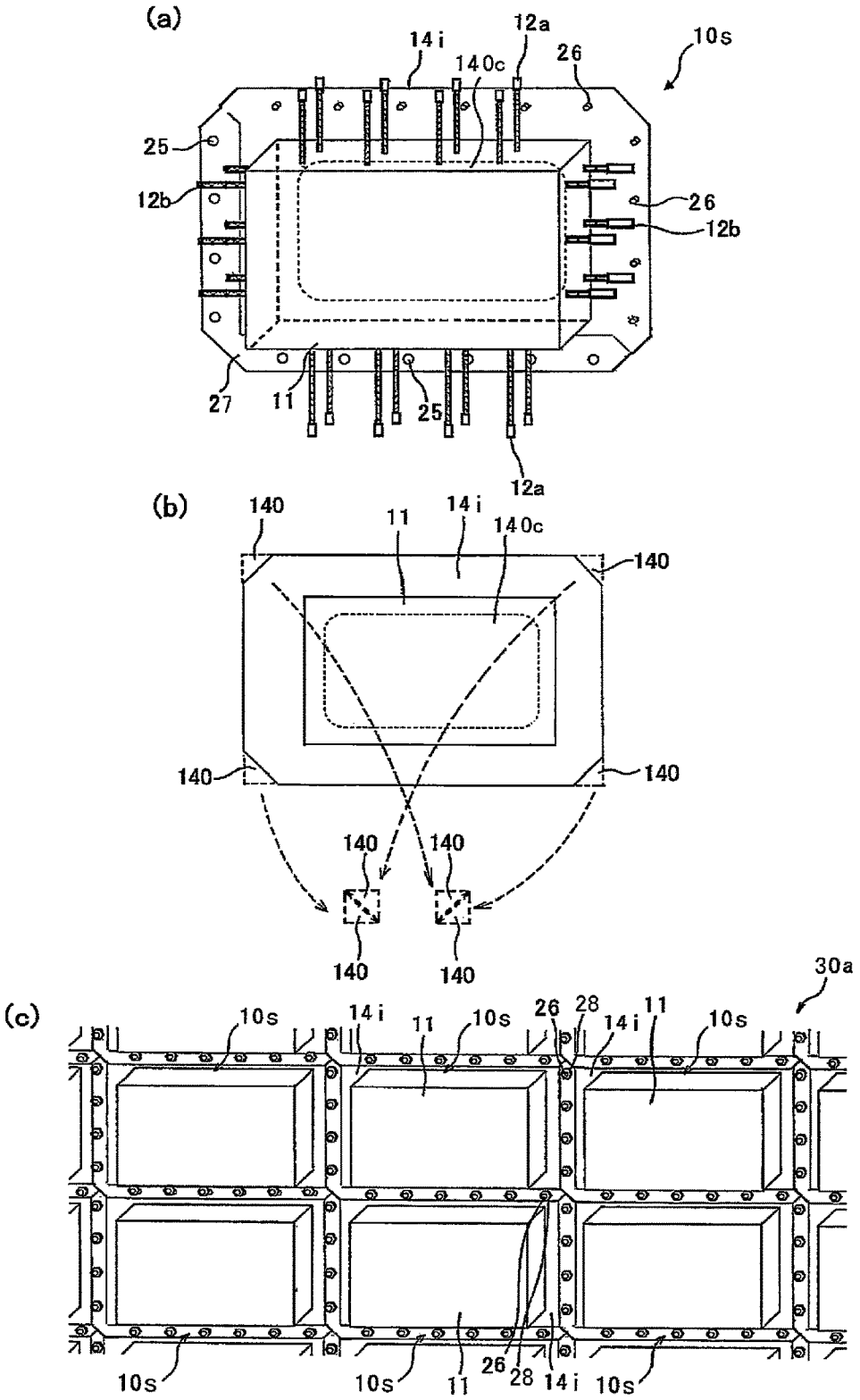
FIG. 49 is a set of views that illustrate precast blocks 10*s*.

FIG. 49(*a*) is a view illustrating a block 10*s* according to a twentieth embodiment. FIG. 49(*b*) is a front view of a plate 14*i* of the block 10*s*.

The block 10*s* differs from the nineteenth embodiment in a shape thereof at the four positions of the upper right, upper left, lower right, and lower left of the plate 14*i*.

In other words, the plate 14*i* has a shape in which right-angled corners are cut out and chamfered in an oblique direction (a direction inclined at 45 degrees relative to the edge in this embodiment) at four positions of the upper right, upper left, lower right, and lower left in the circumference of the main body 11. As shown in FIG. 49(*b*), the shapes of the four positions are defined such that two rectangular areas approximately identical to each other are created when the cutout portions 140, in which the right-angled corners are cut out, are combined. This is similar to the nineteenth embodiment.

(2. Structure 30*a* Made from the Blocks 10*s*)

FIG. 49(*c*) is a view illustrating a structure 30*a* with blocks 10*s*, with the masonry joints or the like being omitted. According to the twentieth embodiment, the blocks 10*s* are arranged in the vertical and horizontal directions, and a concrete is poured and deposited between the main bodies 11 of the adjacent blocks 10*s* to form the masonry joints 17 (as shown in FIG. 43(*a*)). Thus, the structure 30*a* in a wall shape can be constructed. Edge portions of the plate 14*i* function as inner formworks when depositing the concrete. This is similar to the nineteenth embodiment.

A method of fixing the plate 14*i* is also generally similar to the method in the nineteenth embodiment. In other words, the plates 14*i* of the blocks 10*s* adjacent to each other in the vertical and horizontal directions are fixed by lapping the edge portion of the plate 14*i* of one block 10*s*, which is provided with a hole 25 (as shown in FIG. 49(*a*)), in front of the edge portion of the plate 14*i* of the other block 10*s*, which is provided with bolts 26, inserting the bolts 26 into the holes 25, and tightening nuts 28 over the bolts.

(3. Method of Constructing the Structure 30*a* with the Blocks 10*s*)

A method of constructing the structure 30*a* with the blocks 10*s* is generally similar to the method of the nineteenth embodiment. In other words, at the right side of the block 10*s* positioned at the lower left of the contact position G as shown in FIG. 50(*a*), a new block 10*s* is moved from the forward position to backward position to be arranged, as indicated by the arrow in FIG. 50(*b*).

Figure 50:
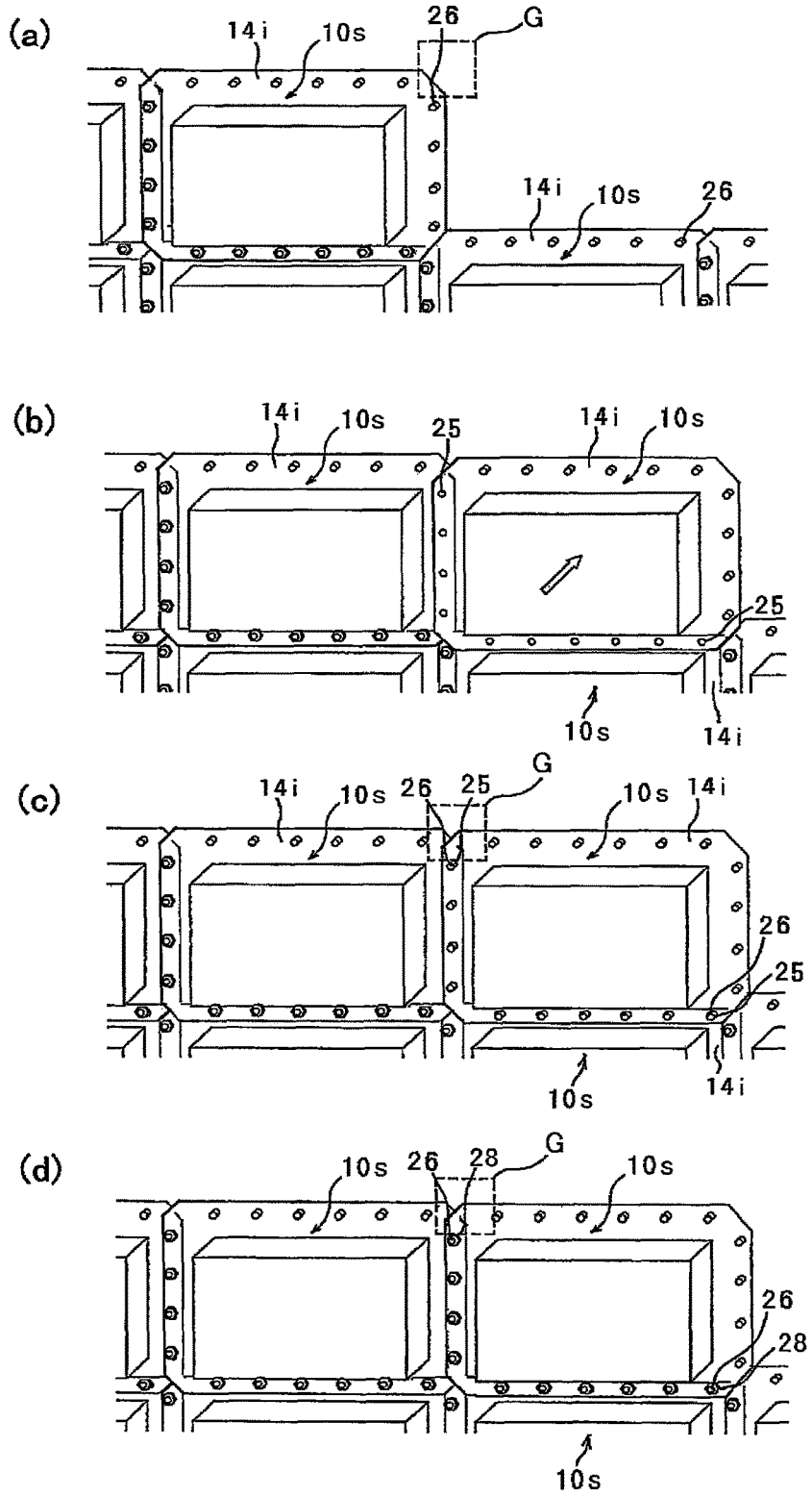
FIG. 50 is a set of views that illustrate a method of constructing a structure 30*a*.

Then, as shown in FIG. 50(*c*), the bolt 26 at the right edge of the plate 14*i* of the left block 10*s* and the bolts 26 at the upper edge of the plate 14*i* of the lower block 10*s* are inserted into the holes 25 at the left edge and the holes 25 at the lower edge of the plate 14*i* of the block 10*s* that is currently concerned, respectively.

Figure 51:
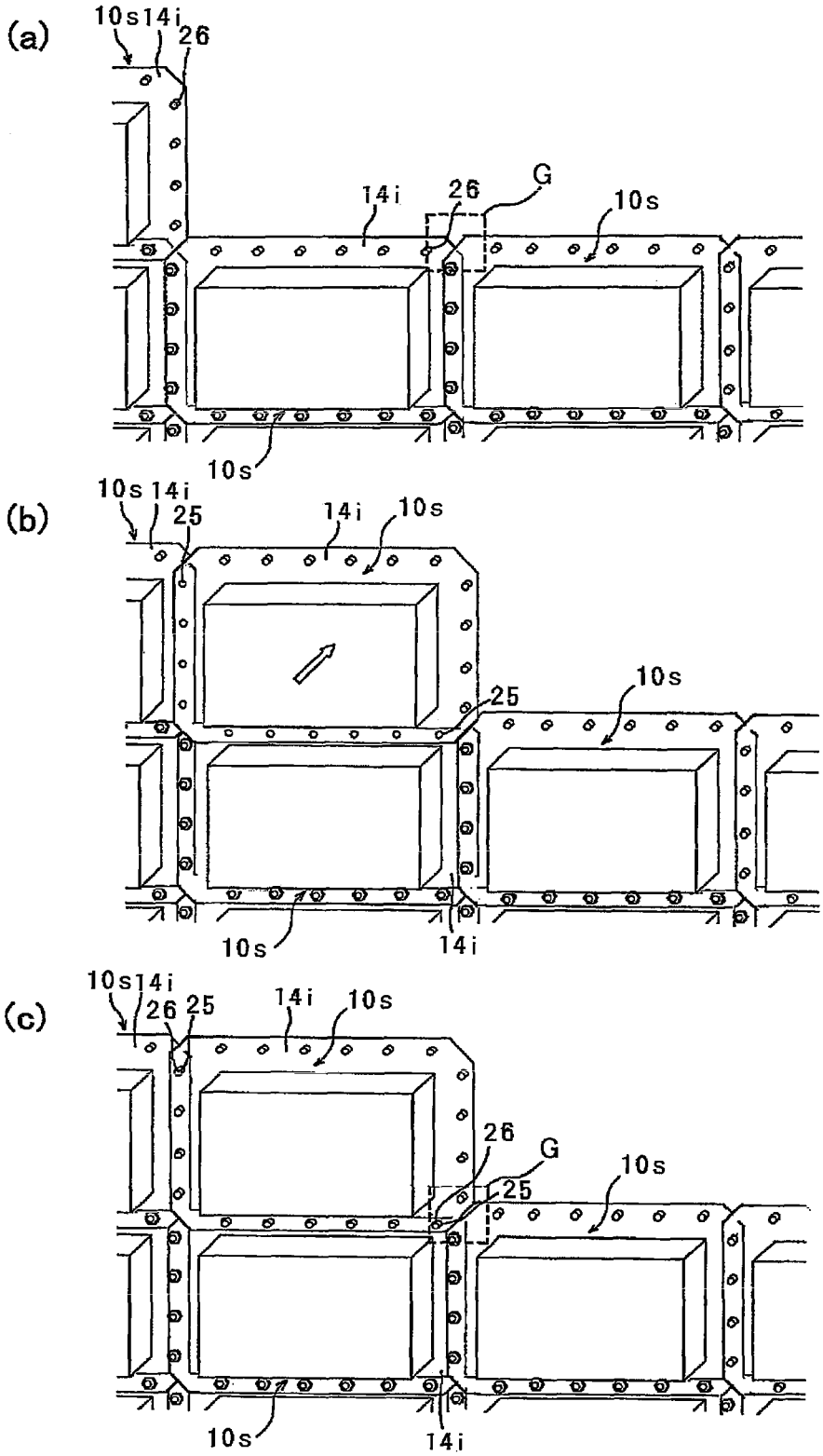
FIG. 51 is another set of views that illustrate the method of constructing the structure 30*a*.

Subsequently, as shown in FIG. 50(*d*), the nuts 28 are engaged over the bolts 26. In this way, after the blocks 10*s* are arranged from the left to the right to arrange the blocks 10*s* in the lower row, the blocks 10*s* in the upper row are arranged in the similar manner. FIG. 51(*a*) shows the state in which the blocks 10*s* in the upper row are arranged just before arranging the block 10*s* at the upper left of the contact position G.

The block 10*s* at the upper left of the contact position G is also arranged in the similar manner. As indicated by the arrow in FIG. 51(*b*), a new block 10*s* is moved from the forward position to the backward position. Then, as shown in FIG. 51(*c*), the bolts 26 of the plate 14*i* of the left and lower blocks 10*s* are inserted into the holes 25 of the plate 14*i* of the block 10*s*, and as shown in FIG. 52(*a*), the nuts 28 are tightened over the bolts 26.

Figure 52:
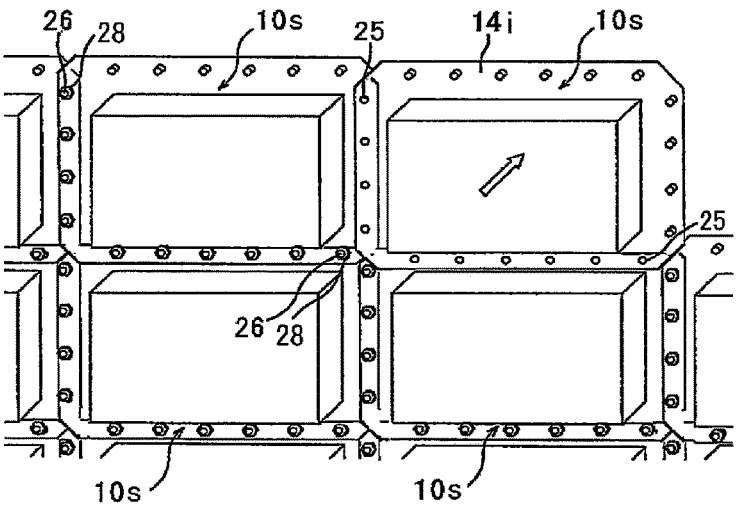
FIG. 52 is still another set of views that illustrate the method of constructing the structure 30*a*.
Figure 52:
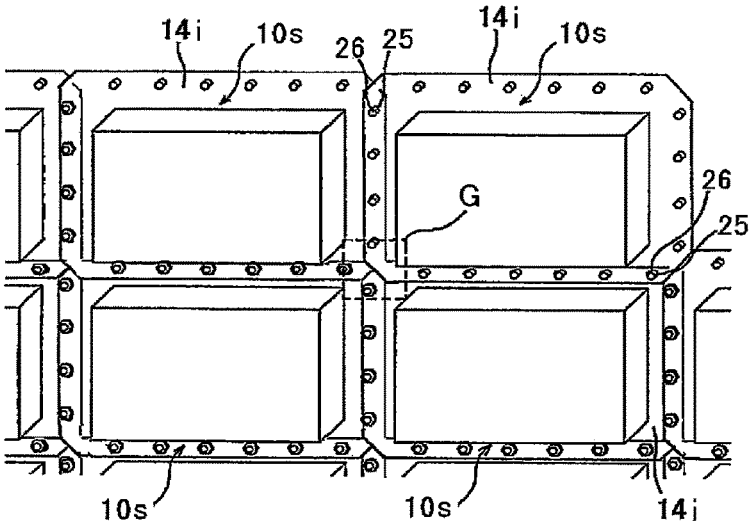
Figure 52:
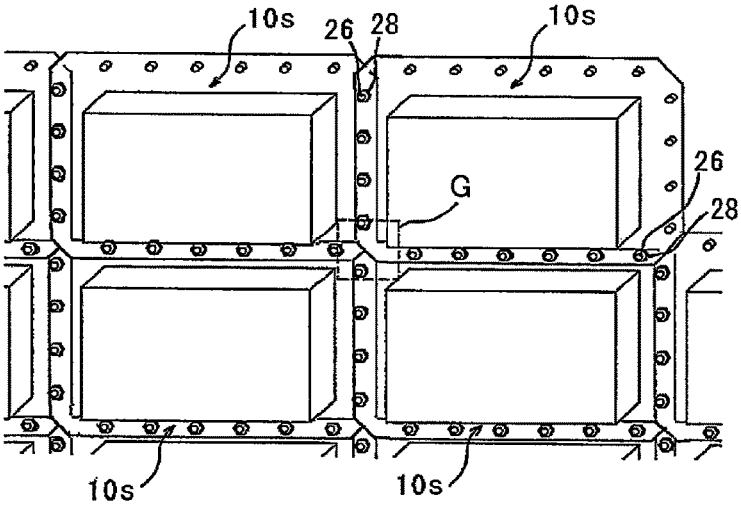

As indicated by the arrow in the FIG. 52(*a*), the block 10*s* at the upper right of the contact position G is also moved from the forward position to the backward position. Then, as shown in FIG. 52(*b*), the bolts 26 of the plate 14*i* of the left and lower blocks 10*s* are inserted into the holes 25 of the plate 14*i* of the block 10*s* that is currently concerned, and as shown in FIG. 52(*c*), the nuts 28 are tightened over the bolts 26.

As described above, the blocks 10*s* are arranged in the vertical and horizontal direction. The masonry joint can be formed by using the plate 14*i* protruding from the main body 11 as the inner formwork and depositing the concrete or the like between the inner formwork and the outer formwork (not shown).

(4. Overlapped Portion of the Plates 14*i*)

Figure 53:
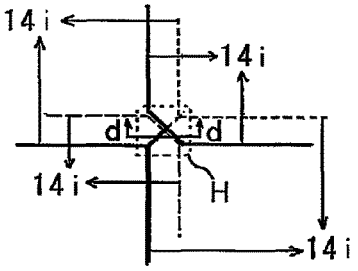
FIG. 53 is a set of views that illustrate an overlapping portion H of plates 14*i*.
Figure 53:
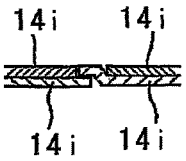

FIG. 53(*a*) is a view showing the plate 14*i* in the vicinity of the contact position G, and FIG. 53(*b*) is a cross-sectional view of an overlapped portion H taken along the line d-d in FIG. 53(*a*).

According to this embodiment, in the overlapped portion H shown in FIG. 53(*a*), a lower right position of the plate 14*i* of the upper left block 10*s* overlaps an upper left position of the plate 14*i* of the lower right block 10*s* at oblique sides thereof.

A lower left position of the plate 14*i* of the upper right block 10*s* and an upper right position of the plate 14*i* of the lower left block 10*s* are arranged such that oblique sides thereof correspond to each other on a plane. As a result, the number of the plates 14*i* overlapped in the front-rear direction at the overlapped portion H does not exceed two.

According to the twentieth embodiment, similar effects to those in the nineteenth embodiment can be obtained. As the shapes of the cutout portions 140 of the plates 14*i* are all identical to one another, it is possible to achieve an advantage that the machining and processing are easy.

Figure 54:
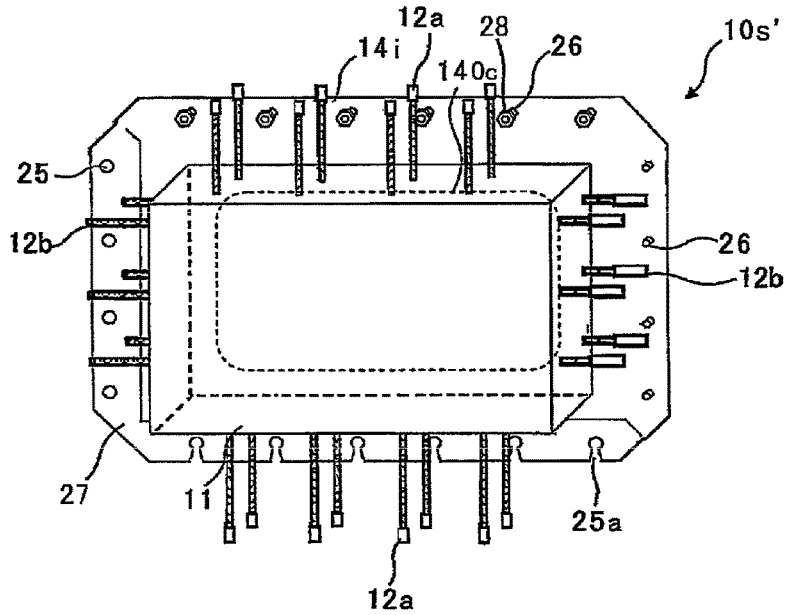
FIG. 54 is a set of views that illustrate blocks 10*s'*.
Figure 54:
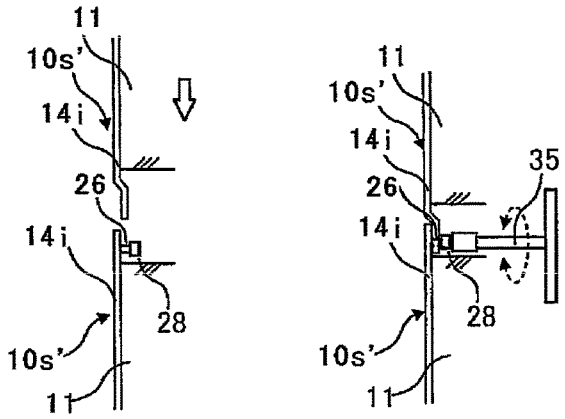
Figure 54:
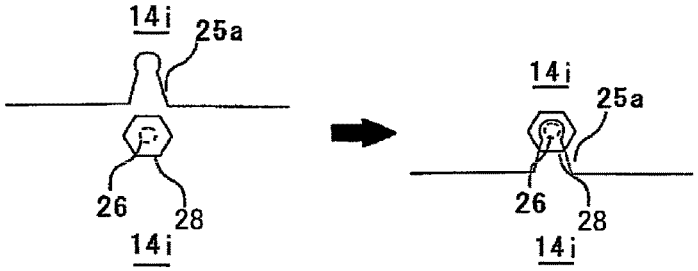

It should be noted that, as shown in the block 10*s*' in FIG. 54(*a*), it is also possible to form slits 25*a* in the lower edge of the plate 14*i* instead of the holes 25.

In this example, the bolts 26 having the nuts 28 are provided at the upper edge of the plate 14*i*. By lowering the upper block 10*s*', as indicated by the arrow in the left illustration of FIG. 54(*b*), the bolts 26 of the plate 14*i* of the lower block 10s' can be inserted into the slits 25a of the plate 14i of the upper block 10s', as shown in FIG. 54(c).

At this situation, preferably, the length of each bolt 26 at the upper edge of the plate 14i of the block 10s' (i.e., the length from the plate 14i to the nut 28) is made longer than the length of the bolt 26 at the right edge by at least the thickness of the plate. By employing this configuration, it is possible to lower the upper block 10s' without an interference with the bolts 26 of the left block 10s' such that the upper block 10s' is present in front of the lower block 10s'. Thus, the bolts 26 of the lower block 10s' can be inserted into the slits 25a of the upper block 10s'.

Subsequently, by shifting the upper block 10s' backward, the bolts 26 at the right edge of the block 10s at the left side thereof can be inserted into the holes 25 at the left edge of the plate 14i of the upper side block 10s'. It should be noted that after the bolts 26 are inserted into the slits 25a and the holes 25, as shown in the right illustration in FIG. 54(b), the nuts 28 are tightened by a wrench 35 or the like.

When the slits 25a are employed for the fixing mechanism between the upper and lower plates, the plate holding portions 182, which are the hook-shaped members as shown in FIG. 48(c), may be used as the fixing mechanism between the left and right plates. With this configuration, only by lowering the upper block 10s', it is possible to fix the upper side block 10s' such that the respective plates are lapped with one another with the lower block 10s' and the left block 10s' without shifting in the front-rear direction.

Twenty-First Embodiment (1. Precast Blocks 10t and 10u)

Figure 55:
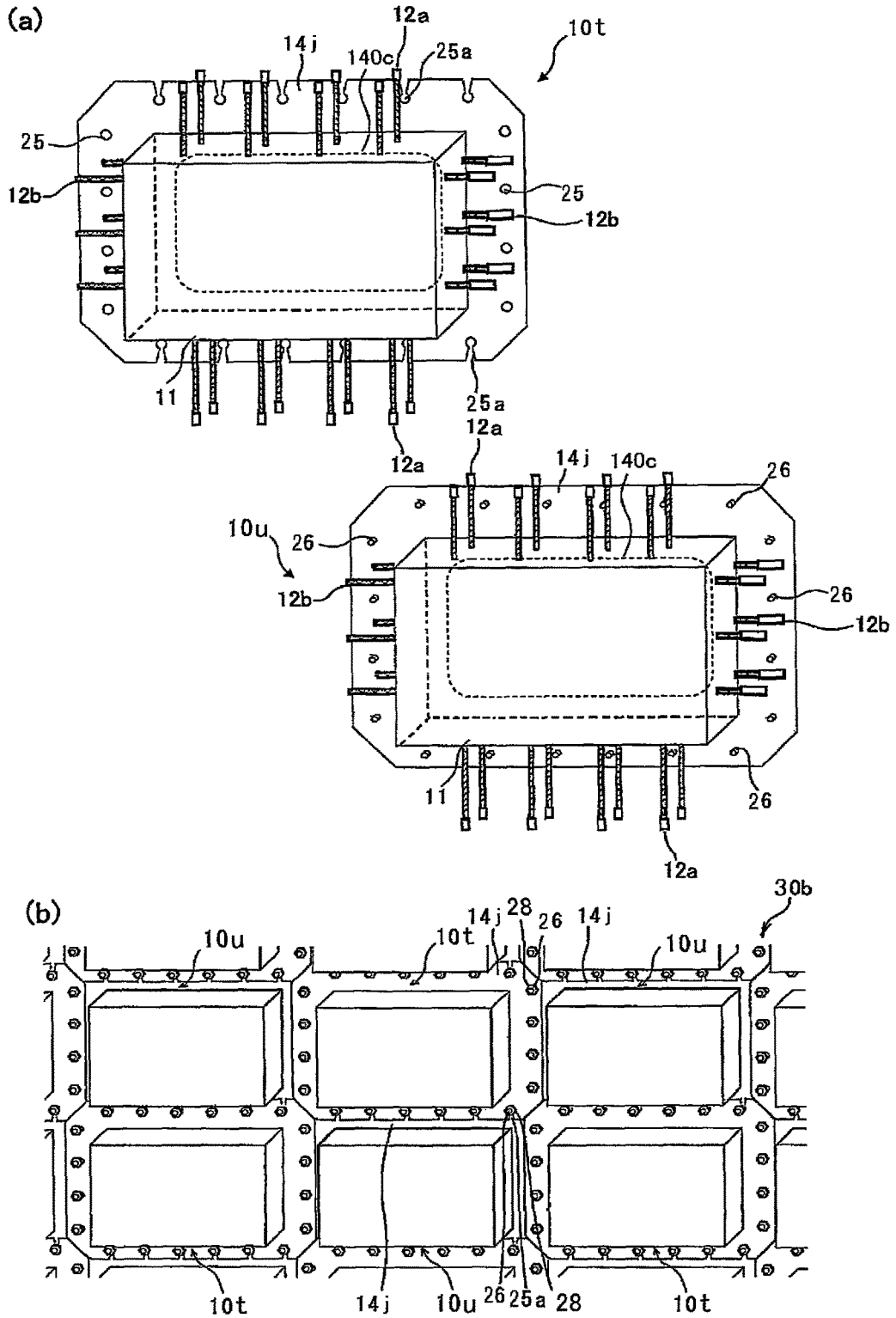
FIG. 55 is a set of views that illustrate blocks 10*t* and 10*u*.

FIG. 55(a) is a view showing precast blocks 10t and 10u according to a twenty-first embodiment. According to this embodiment, a structure is constructed by use of two types of blocks 10t and 10u as shown in the drawings.

The plates 14j of the block 10t and 10u have respective edge portions that are on the same plane without the upper, the lower, the right and the left edge portions thereof being bent. Holes 25 are formed at the right and left edges of the plate 14j of the block 10t, and slits 25a are formed at the upper and lower edge of the plate 14j of the block 10t. On the other hand, bolts 26 are provided at the respective edges of the plate 14j of the block 10u.

It should be noted that the shapes of the four positions of the upper right, the upper left, the lower right and the lower left of the plate 14j, at which the upper, the lower, the right and the left edges of the plates 14j intersect, are similar to those in the plate 14i.

(2. Structure 30b Made from the Blocks 10t and 10u)

FIG. 55(b) is a view showing a structure 30b with the blocks 10t and 10u, with the masonry joint or the like being omitted.

According to the twenty-first embodiment, blocks 10t and 10u are allocated in a zigzag manner and arranged in the vertical and horizontal directions, the concrete is deposited between the main bodies 11 of the blocks 10t and 10u adjacent to each other, and the masonry joints 17 are formed (as shown in FIG. 43(a)) so as to construct the structure 30b in a wall shape. The edge of the plate 14j, which protrudes from the main body 11, functions as an inner formwork when depositing the concrete.

The block 10t is arranged in front of the block 10u. The plates 14j of the upper and lower blocks 10t and 10u are fixed by lapping the edge provided with the slits 25a of the plate 14j of the block 10t in front of the edge provided with the bolts 26 of the plate 14j of the block 10u, inserting the bolts 26 into the slits 25a, and tightening the nuts 28 over the bolts 26.

Similar to the above-described configuration, the plates 14j of the right and left blocks 10t and 10u are also fixed by lapping the edge provided with the holes 25 of the plate 14j of the block 10t in front of the edge provided with the bolts 26 of the plate 14j of the block 10u, inserting the bolts 26 into the holes 25, and tightening the nuts 28 over the bolts 26.

(3. Method of Constructing the Structure 30b with the Blocks 10t and 10u)

Hereinafter, a method of constructing the structure 30b with the blocks 10t and 10u will be described. Here, the description will be made with focusing on the blocks 10t and 10u in the circumference of the contact position J as shown in FIG. 56(a).

Figure 56:
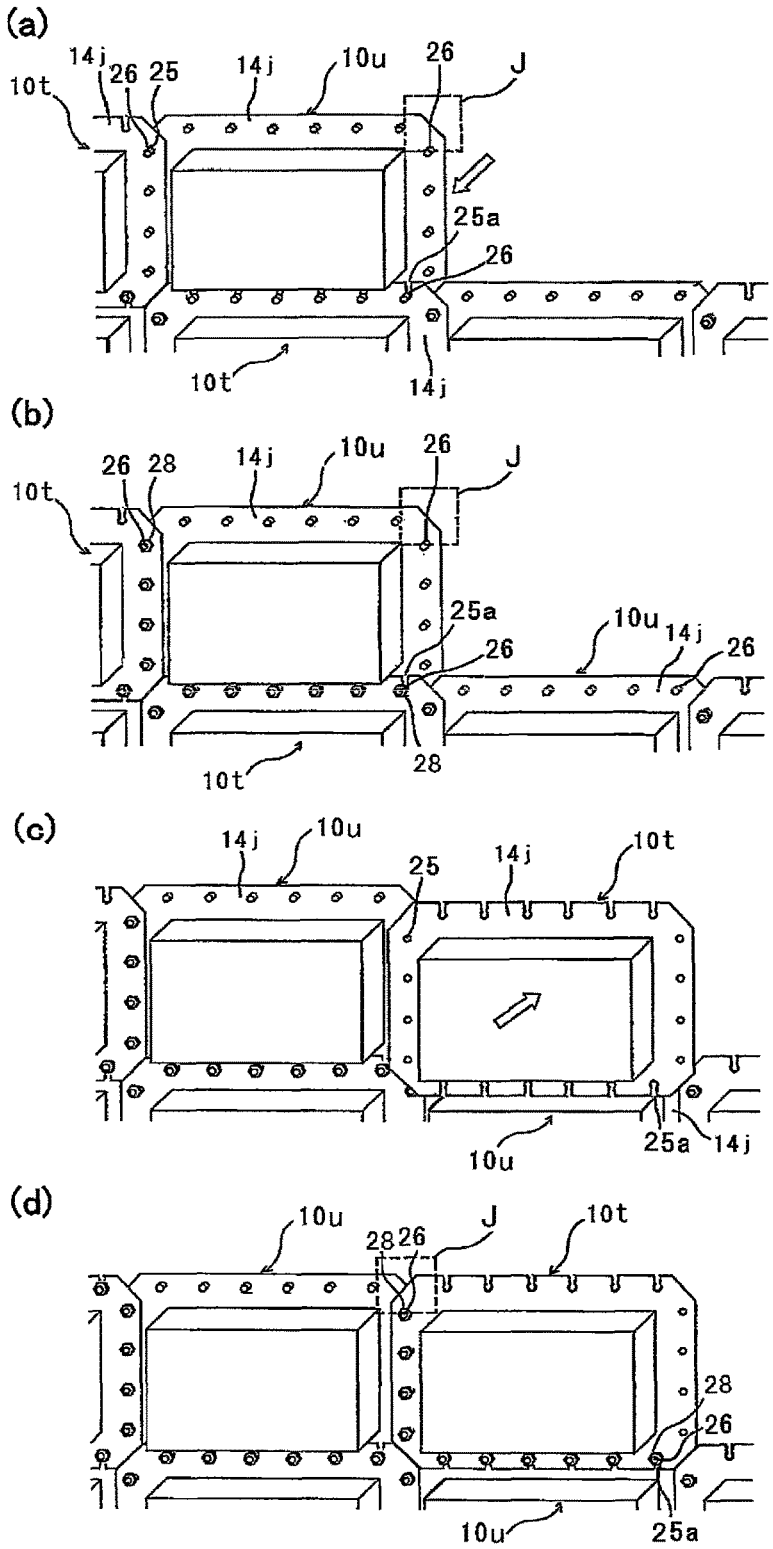
FIG. 56 is a set of views that illustrate a method of constructing a structure 30*b*.

According to this embodiment, as shown in FIG. 56(a), the block 10u at the lower left of the contact position J is, as indicated by the arrow, moved from the backward position, and the bolts 26 at the left edge and the lower edge of the plate 14j of the block 10u are inserted into the holes 25 at the right edge of the plate 14j of the left block 10t and the slits 25a at the upper edge of the plate 14j of the lower block 10t, respectively. Subsequently, as shown in FIG. 56(b), the nuts 28 are tightened over the bolts 26. FIG. 59(a) shows a lapping condition of the plates 14j in this situation.

It should be noted that, alternatively, it is possible that, after inserting the bolts 26 at the lower edge of the plate 14j of the block 10u that is currently concerned into the slits 25a at the upper edge of the plate 14j of the lower block 10t and moving it from the backward position to the forward position, the bolts 26 at the left edge of the plate 14j of the block 10u are inserted into the holes 25 at the right edge of the plate 14j of the left block 10t. In this case, similar to the block 10s', preferably, the length of each bolt 26 at the upper and lower edges is made longer than the length of the bolts 26 at the right and left edges by at least the thickness of the plate, respectively.

The block 10t at the lower right of the contact position J is, as indicated by the arrow in FIG. 56(c), moved from the forward position. Then, the bolts 26 at the right edge of the plate 14j of the left block 10u and the bolts 26 at the upper edge of the plate 14j of the lower block 10u are inserted into the holes 25 at the left edge of the plate 14j of the block 10t and the slits 25a at the lower edge of the plate 14j of the block 10t, respectively. Subsequently, as shown in FIG. 56(d), the nuts 28 are engaged over the bolts 26. Similar to the above-described configuration, it is possible to firstly insert the bolts 26 into the slits 25a, then move the block 10t from the forward position to the backward position, and then insert the bolts 26 into the holes 25.

In this way, after alternately arranging the blocks 10t and 10u from the left to the right to lay out the blocks 10t and 10u in the lower row, the blocks 10t and 10u in the upper row are similarly arranged. FIG. 57(a) shows a state in which the block 10u is arranged just before arranging the block 10t at the upper left of the contact position J.

Figure 57:
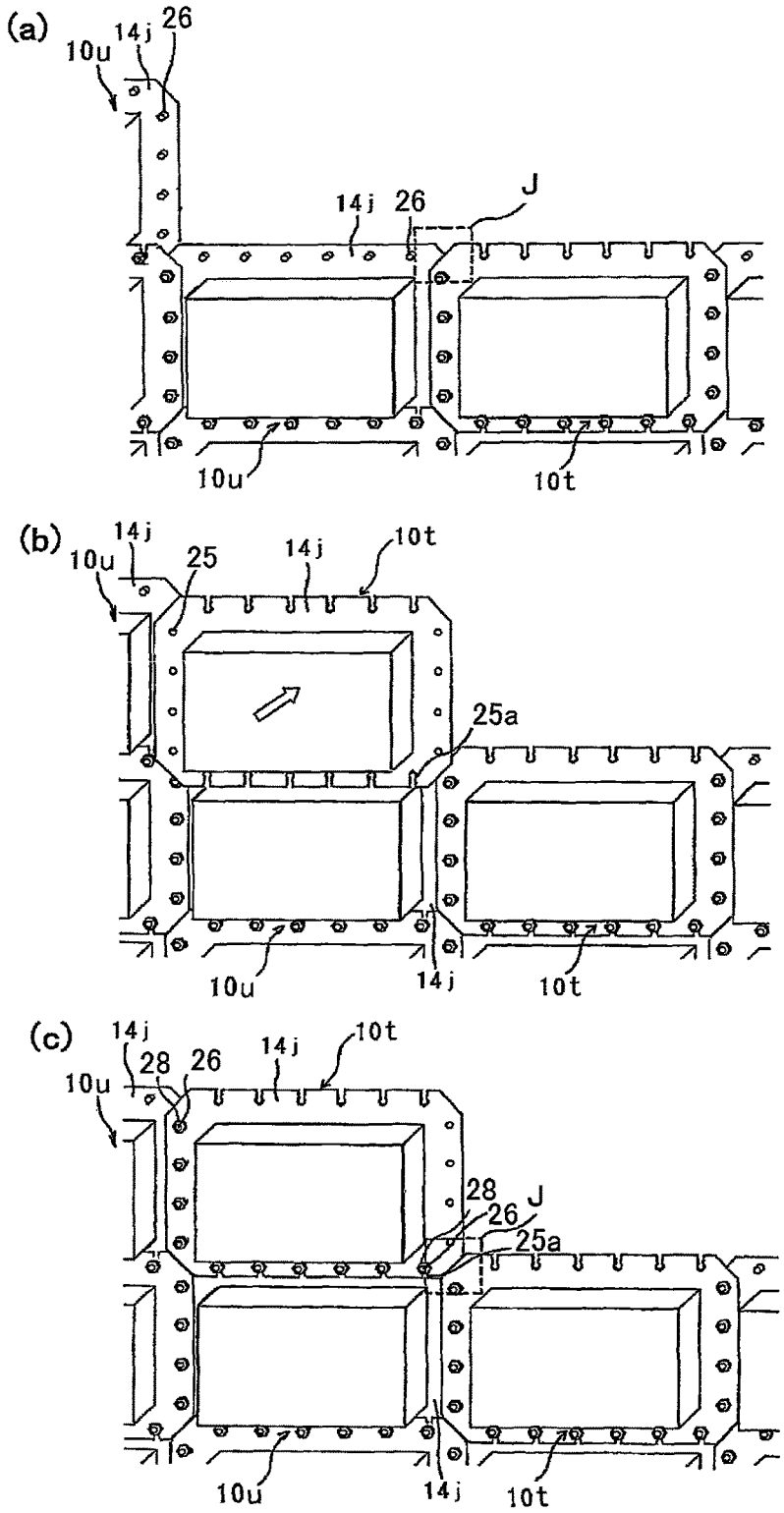
FIG. 57 is another set of views that illustrate the method of constructing the structure 30*b*.

The block 10t at the upper left of the contact position J is arranged in a similar manner to the above-described block 10t. In other words, as indicated by the arrow in FIG. 57(b), the block 10t is moved from the forward position, the bolts 26 at the right edge of the plate 14j of the left block 10u and the bolts 26 at the upper edge of the plate 14j of the lower block 10u are inserted into the holes 25 at the left edge of the plate 14j of the block 10t and the slits 25a of the lower edge of the plate 14*j* of the block 10*t*, respectively, and, as shown in FIG. 57(*c*), the nuts 28 are tightened over the respective bolts 26.

Figure 58:
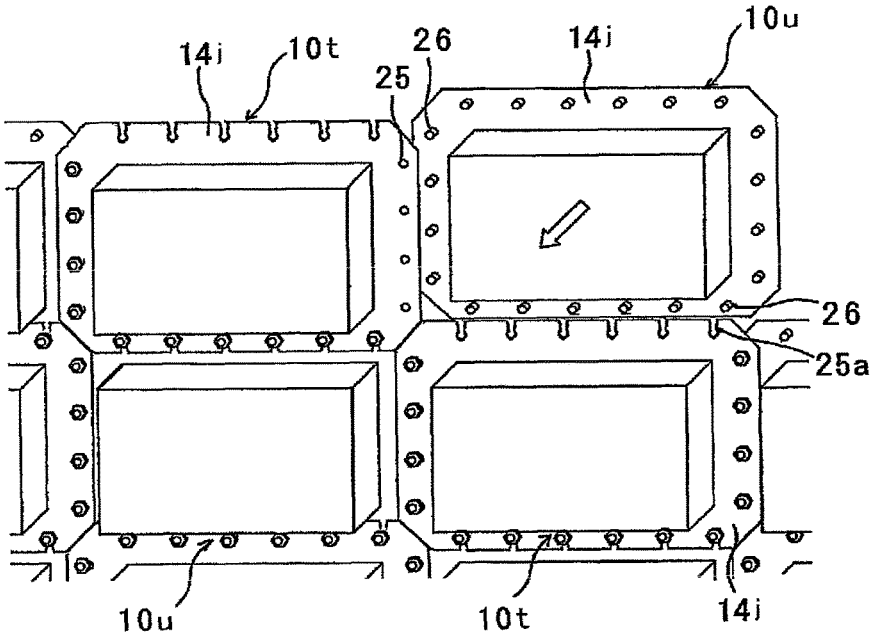
FIG. 58 is still another set of views that illustrate the method of constructing the structure 30*b*.
Figure 58:
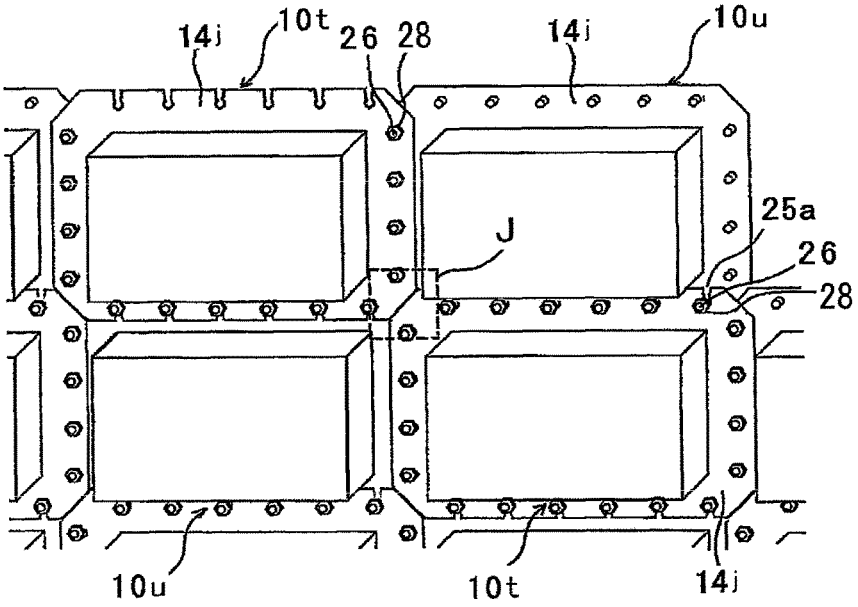

The block 10*u* at the upper right of the contact position J is also arranged in a similar manner to the above-mentioned block 10*u*. In other words, as indicated by the arrow in FIG. 58(*a*), the block 10*u* is moved from the backward position, the bolts 26 at the left edge of the plate 14*j* of the block 10*u* and the bolts 26 at the lower edge of the plate 14*j* of the block 10*u* are inserted into the holes 25 at the right edge of the plate 14*j* of the left block 10*u* and the slits 25*a* of the upper edge of the plate 14*j* of the lower block 10*u*, respectively, and, as shown in FIG. 58(*b*), the nuts 28 are engaged over the respective bolts 26.

As described above, the blocks 10*t* and 10*u* are allocated in a zigzag manner and arranged in the vertical and horizontal directions. The masonry joint can be, similar to the above-described configuration, formed by using the plate 14*j* protruding from the main body 11 as the inner formwork and depositing the concrete or the like between the inner formwork and the outer formwork (not shown).

(4. Overlapped Portion of the Plates 14*j*)

Figure 59:
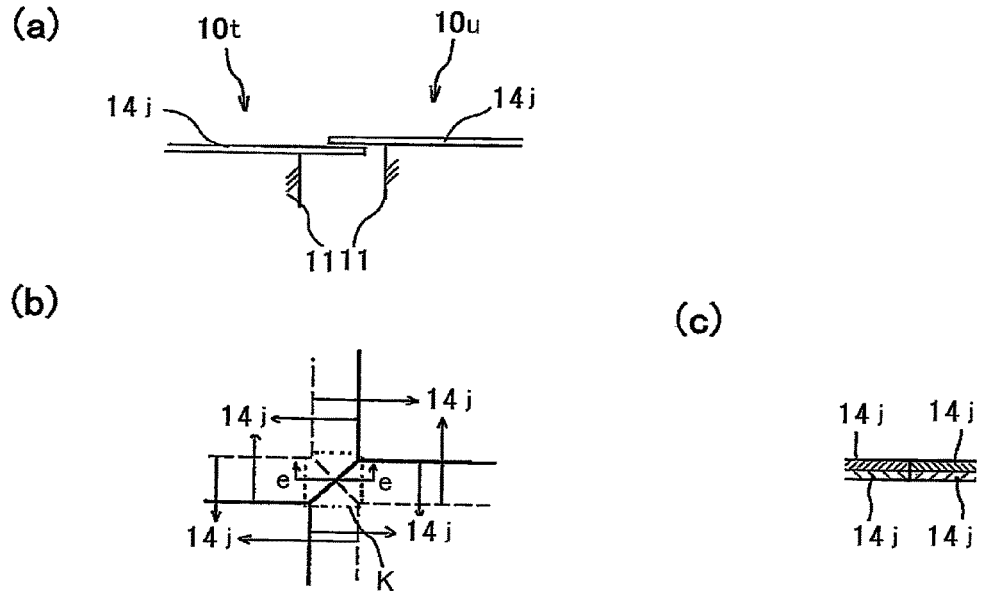
FIG. 59 is a set of views that are useful to describe the method of constructing the structure 30*b*.

FIG. 59(*b*) is a view showing the plate 14*j* in the vicinity of the contact position J, and FIG. 59(*c*) is a cross-sectional view of an overlapped portion K taken along the line e-e in FIG. 59(*b*).

According to this embodiment, in the overlapped portion K shown in the drawings, a lower right position of the plate 14*j* of the upper left block 10*t* is overlapped with an upper left position of the plate 14*j* of the lower right block 10*t* at oblique sides thereof.

An upper right position of the plate 14*j* of the lower left block 10*u* is overlapped with a lower left position of the plate 14*j* of the upper right block 10*u* at oblique sides thereof. As a result, the number of the plates 14*j* overlapped in the front-rear direction at the overlapped portion K does not exceed two.

According to the twenty-first embodiment, similar effects to those in the nineteenth embodiment can be obtained. Also, the plate 14*j* is provided with the bolts 26 only, or alternatively provided with the holes 25 and the slits 25*a* only. This brings about advantages in which the workload for machining and processing the plate 14*j* is reduced and the associated cost is also reduced. Meanwhile, according to the third embodiment, it is required to prepare the same number of two types of blocks 10*t* and 10*u*. From this viewpoint, the nineteenth and twentieth embodiments are more advantageous in which a required number (only one type) of blocks may be prepared.

It should be noted that, according to this embodiment, the plate 14*j* is not provided with the folded portion 27. Instead, the respective edges provided with the holes 25 or the slits 25*a* of the plate 14*j* of the block 10*t* may be bent and positioned forward, or the respective edges provided with the bolts 26 of the plate 14*j* of the block 10*u* may be bent and positioned backward.

Figure 60:
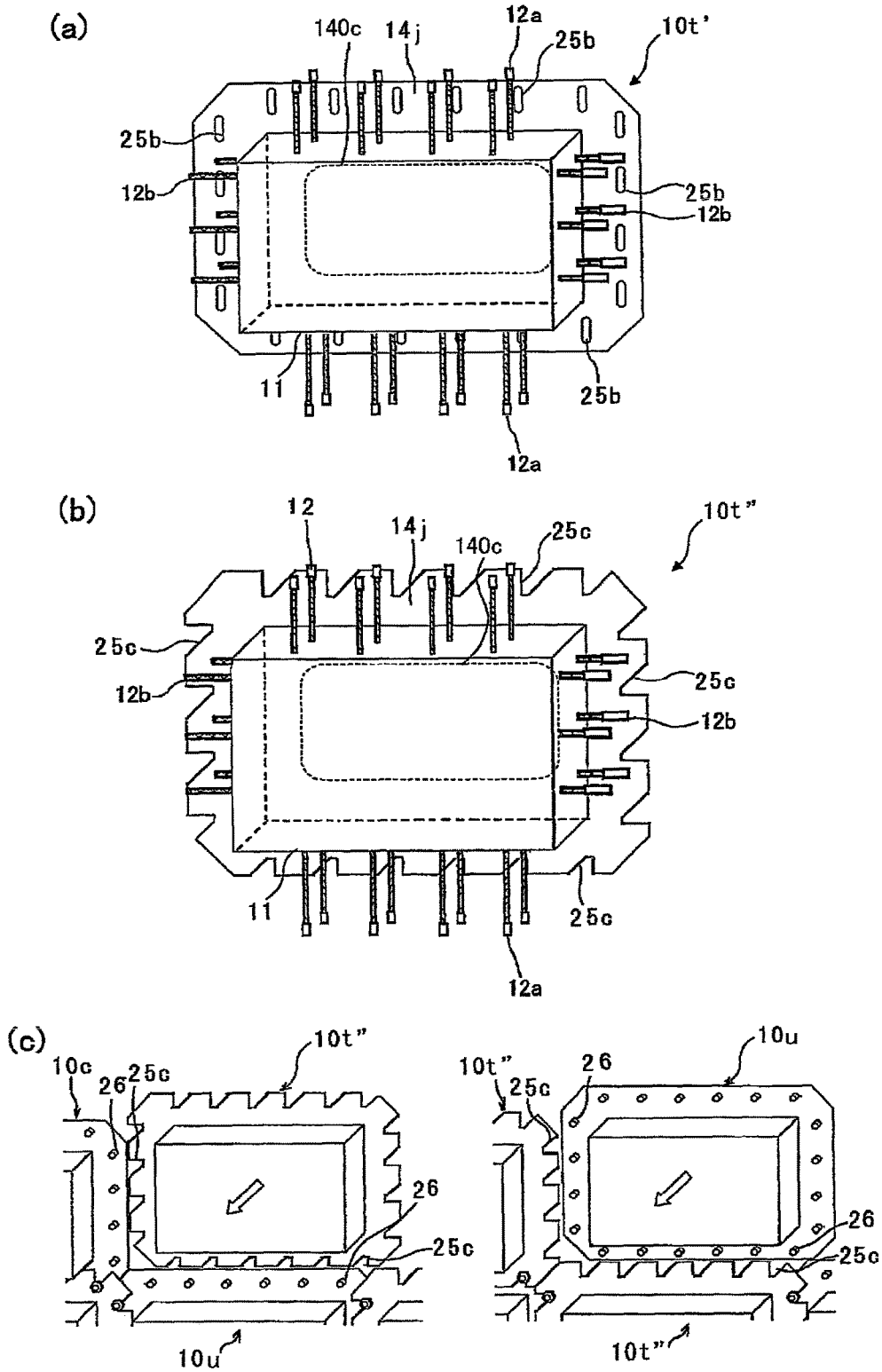
FIG. 60 is a set of views that illustrate blocks 10*t'* and 10*t''*.

As shown in the block 10*t*' in FIG. 60(*a*), at the upper, the lower, the right and the left edge portions of the plate 14*j*, elongated holes 25 *b* elongated in the vertical direction may be provided instead of the holes 25 or the slits 25*a*. In this case, it may bring about an allowance for adjusting the position in the vertical direction when the block 10*t*' or the block 10*u* is installed. Each of the elongated holes may be elongated in the horizontal direction, and in this case, the position adjusting becomes possible in the horizontal direction. Alternatively, by enlarging the diameter of the hole, adjusting the position in the vertical direction and the horizontal direction may become also possible.

As shown in a block 10*t*" in FIG. 60(*b*), at the upper, the lower, the right and the left edge portions of the plate 14*j*, oblique slots 25*c* having oblique sides may be provided instead of the holes 25 or the slits 25*a*. In the illustrated example in the drawings, the oblique sides are inclined at 45 degrees relative to the edges of the plate 14*j*, respectively.

In this case, as indicated by the arrow in the left illustration of FIG. 60(*c*), by lowering the block 10*t*" obliquely downward at 45 degrees, it is possible to insert the bolts 26 at the left and lower blocks 10*u* into the oblique slots 25*c*, respectively. Similarly, when installing the blocks 10*u*, by lowering the block 10*u* obliquely downward at 45 degrees, as indicated by the arrow in the right illustration, it is possible to insert the bolts 26 of the blocks 10*u* into the oblique slots 25*c* of the left and lower side blocks 10*t*", respectively. Thus, it is possible to eliminate the movements in the front-rear direction when inserting the bolts 26. This makes the work easier.

Twenty-Second Embodiment (1. Precast Block 10*v*)

Figure 61:
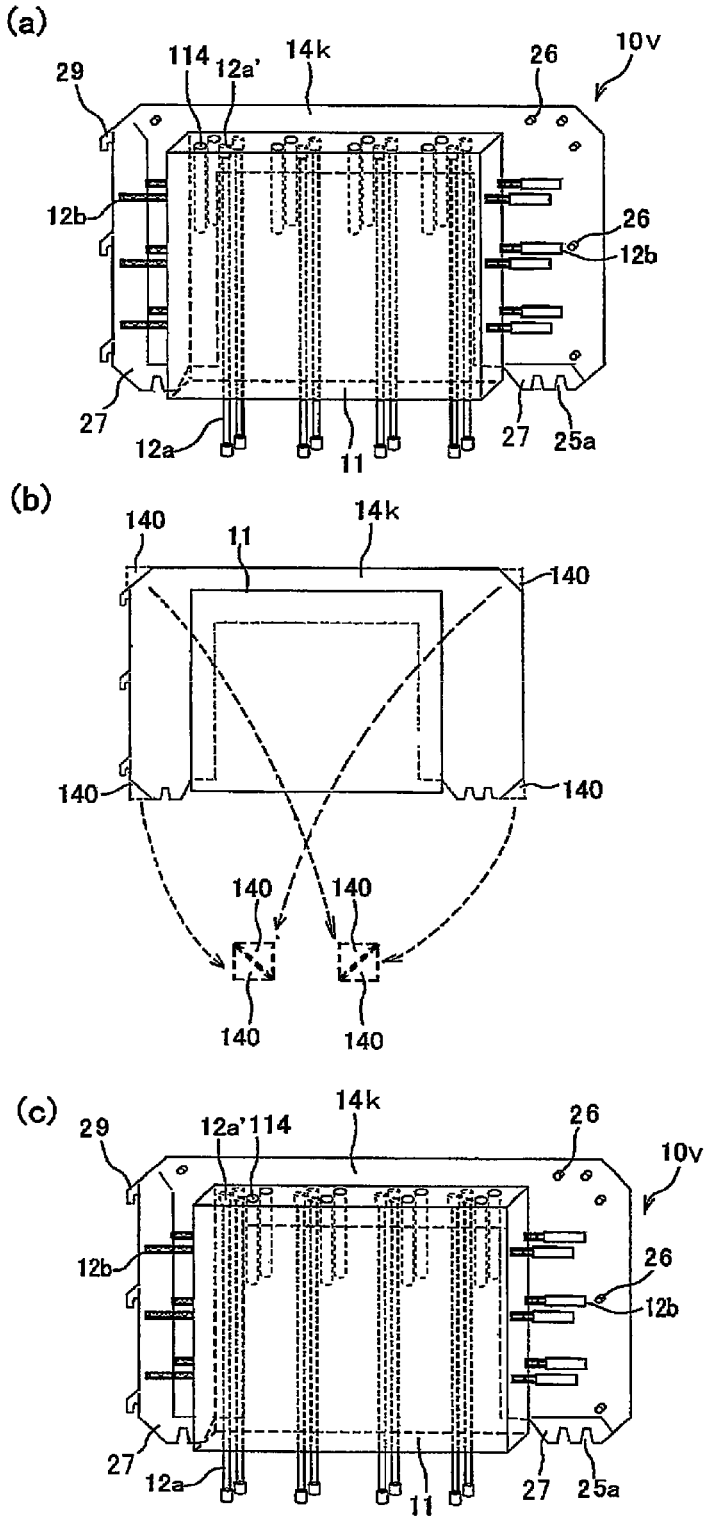
FIG. 61 is a set of views that illustrate a block 10*v*.

FIG. 61(*a*) is a view showing a precast block 10*v* according to a twenty-second embodiment, and FIG. 61(*b*) is a front view of a plate 14*k* of the block 10*v*.

The plate 14*k* of the block 10*v* has a gate-like shape, and the upper edge, the right edge and the left edge thereof protrude from the main body 11, respectively. The bolts 26 are provided at the upper edge and the right edge of the plate 14*k*.

On the other hand, hook-shaped portions 29 are provided at the left edge of the plate 14*k*. Each of the hook-shaped portions 29 is a receiving portion into which the bolt 26 can be inserted and then hooked. Slits 25*a* are formed at the lower ends of the right and left edges of the plate 14*k*. The bolts 26 at the upper edge of the plate 14*k* are arranged at positions that correspond to the slits 25*a* in the vertical direction, respectively.

The shapes of the upper right, the upper left, the lower right and the lower left positions of the plate 14*k* are similar to those in the plate 14*i*, and, as shown in FIG. 61(*b*), the shapes thereof are defined such that two rectangular areas approximately identical to each other can be created when combining the cutout portions 140 in which the right-angled corners are cut out.

As seen in the folded portion 27 in FIG. 61(*a*), the left edge of the plate 14*k* provided with the hook-like portions 29 and the lower ends of the left and right edges provided with the slits 25*a* are folded and positioned in front of the other edges provided with the bolts 26.

At the upper portion of the main body 11, a plurality of joints 12*a*', each having a fixing element made by a reinforcing bar and a fixing element, are buried and a plurality of holes 114 opening only in the top face of the main body 11 are provided. It should be noted that the joints 12*a* having the fixing elements, which protrude downward from the main body 11, and the joints 12*a*' having the fixing elements are joints in which the respective fixing elements are provided at both ends of the same reinforcing bar. The holes 114 and the joints 12*a*' (12*a*) having the fixing elements are alternately arranged in the horizontal direction of the main body 11.

(2. Structure 30*c* Made from the Blocks 10*v*)

Figure 62:
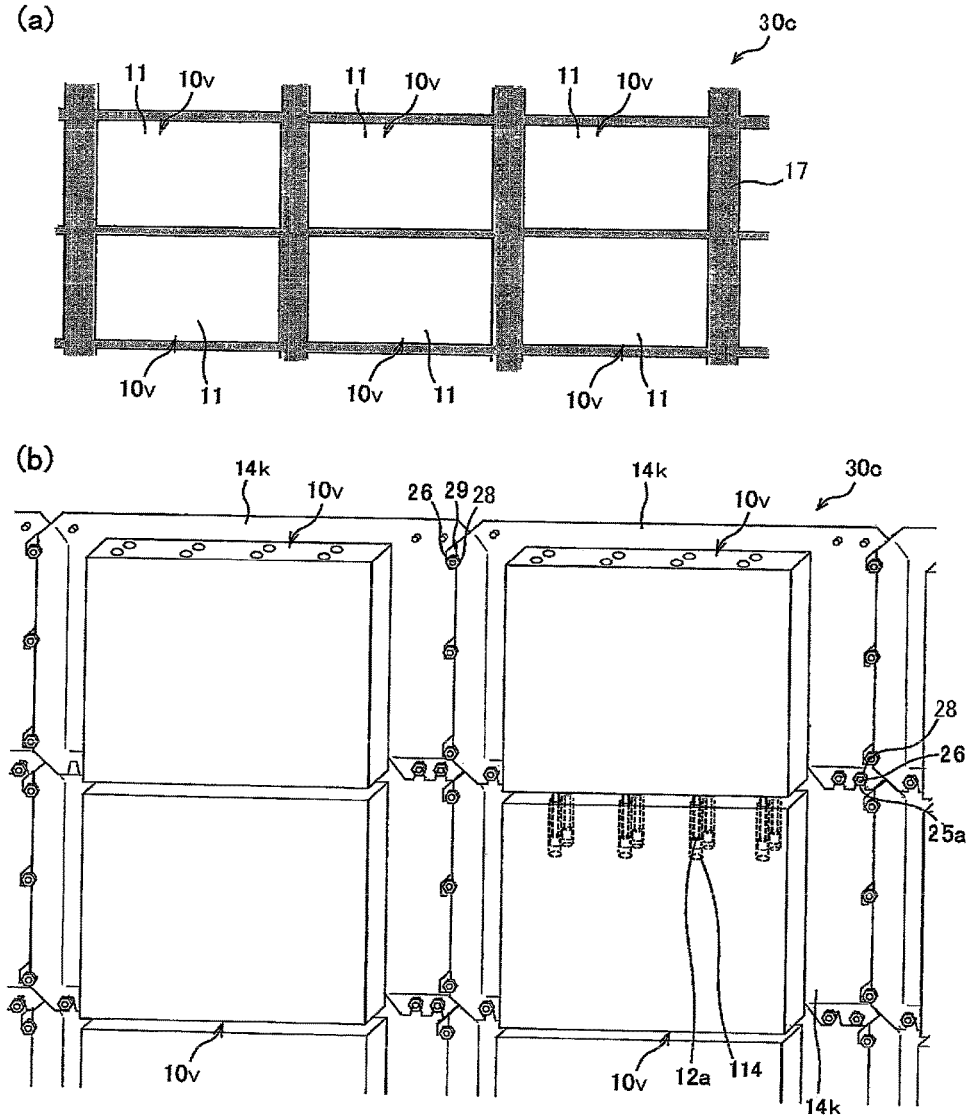
FIG. 62 is a set of views that illustrate a structure 30*c*.

FIG. 62(*a*) is a view showing a structure 30*c* made from the blocks 10*v*. According to the twenty-second embodiment, the blocks 10*v* are arranged in the vertical and horizontal directions, the filler such as the concrete, a mortar or the like is loaded between the main bodies 11 of the blocks 10*v* adjacent to one another in the vertical and horizontal directions to form the masonry joints 17 so as to construct the structure 30*c* having a wall shape. The edge of the plate 14*k* functions as an inner formwork for loading the filler.

FIG. 62(*b*) is a view showing the structure 30*c*, with the masonry joint 17 or the like being omitted. As shown in the drawing, the plates 14*k* of the left and right blocks 10*v* are fixed by lapping the left edge provided with the hook-like portions 29 of the plate 14*k* of the right block 10*v* in front of the right edge provided with the bolts 26 of the plate 14*k* of the left block 10*v*, inserting the bolts 26 into the hook-like portions 29 to be hooked, and tightening the nuts 28 over the bolts 26.

The plates 14*k* of the upper and lower blocks 10*v* are fixed by lapping the lower end portions of the left and right edges provided with the slits 25*a* of the plate 14*k* of the upper block 10*v* in front of the upper edge provided with the bolts 26 of the plate 14*k* of the lower block 10*v*, inserting the bolts 26 into the slits 25*a*, and tightening the nuts 28 over the bolts 26.

According to this embodiment, at this moment, the joints 12*a* having the fixing elements, which protrude downward from the main body 11 of the upper block 10*v* are inserted into the holes 114 of the main body 11 of the lower block 10*v*, and then overlapped with the joints 12*a*' having the fixing elements buried in the main body 11 (as shown in FIG. 61(*a*)) so as to form a lap joint.

For this reason, for one of the upper and lower blocks 10*v*, a block in which the positions of the holes 114 and the joints 12*a*' (12*a*) having the fixing elements are reversed in the block 10*v* (as shown in FIG. 61(*a*)) is used.

(3. Method of Constructing the Structure 30*c* with the Blocks 10*v*)

Hereinafter, a method of constructing a structure 30*c* with the blocks 10*v* will be described.

Figure 63:
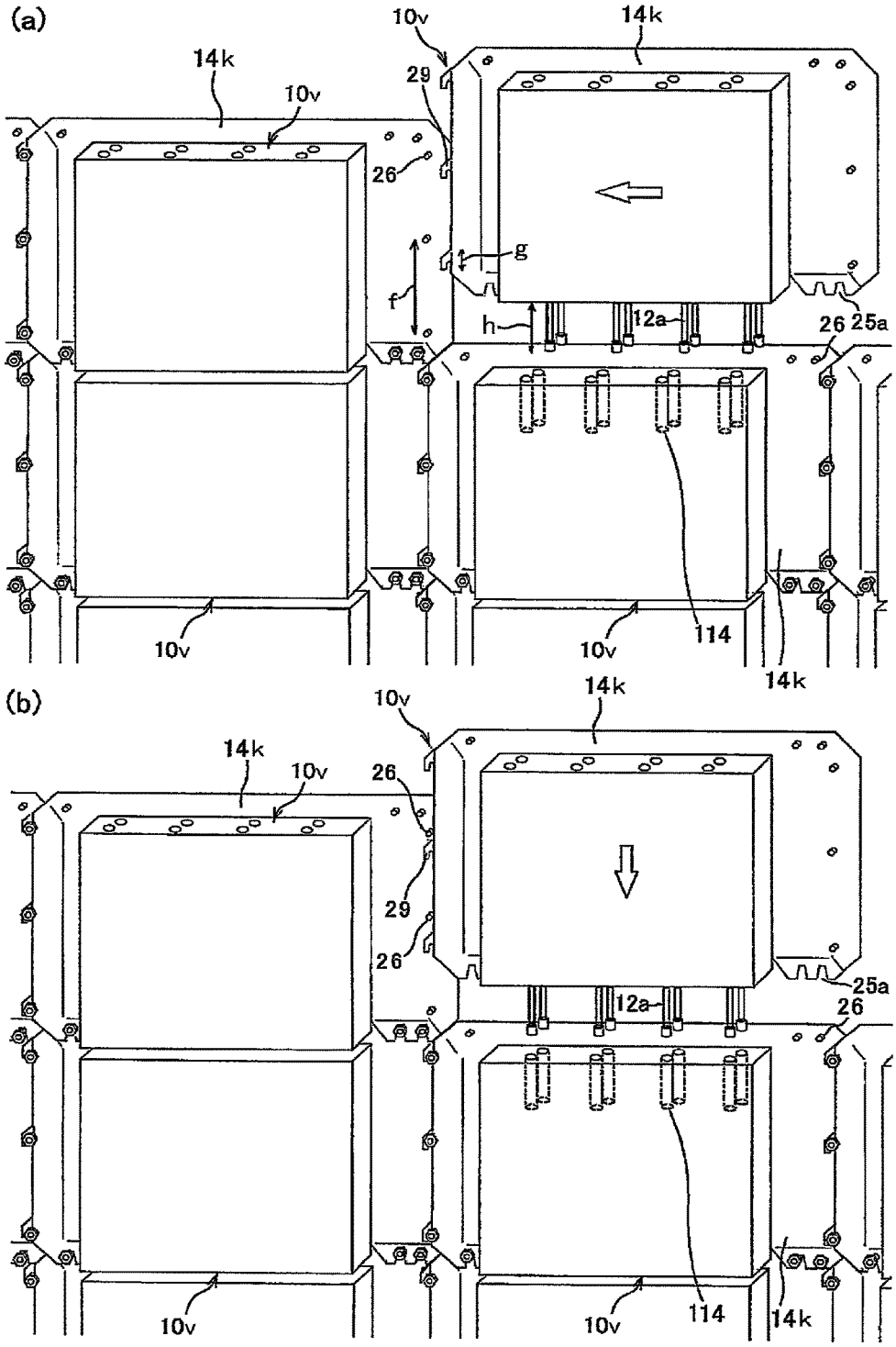
FIG. 63 is a set of views that illustrate a method of constructing the structure 30*c*.

According to this embodiment, as shown in FIG. 63(*a*), the block 10*v* is firstly arranged at the right side of the left block 10*v*, and then moved toward the left as indicated by the arrow. By doing this, as shown in FIG. 63(*b*), the hook-like portions 29 at the left edge of the plate 14*k* of the block 10*v* that is currently concerned are positioned between the upper and lower bolts 26 at the right edge of the plate 14*k* of the left block 10*v*.

Figure 64:
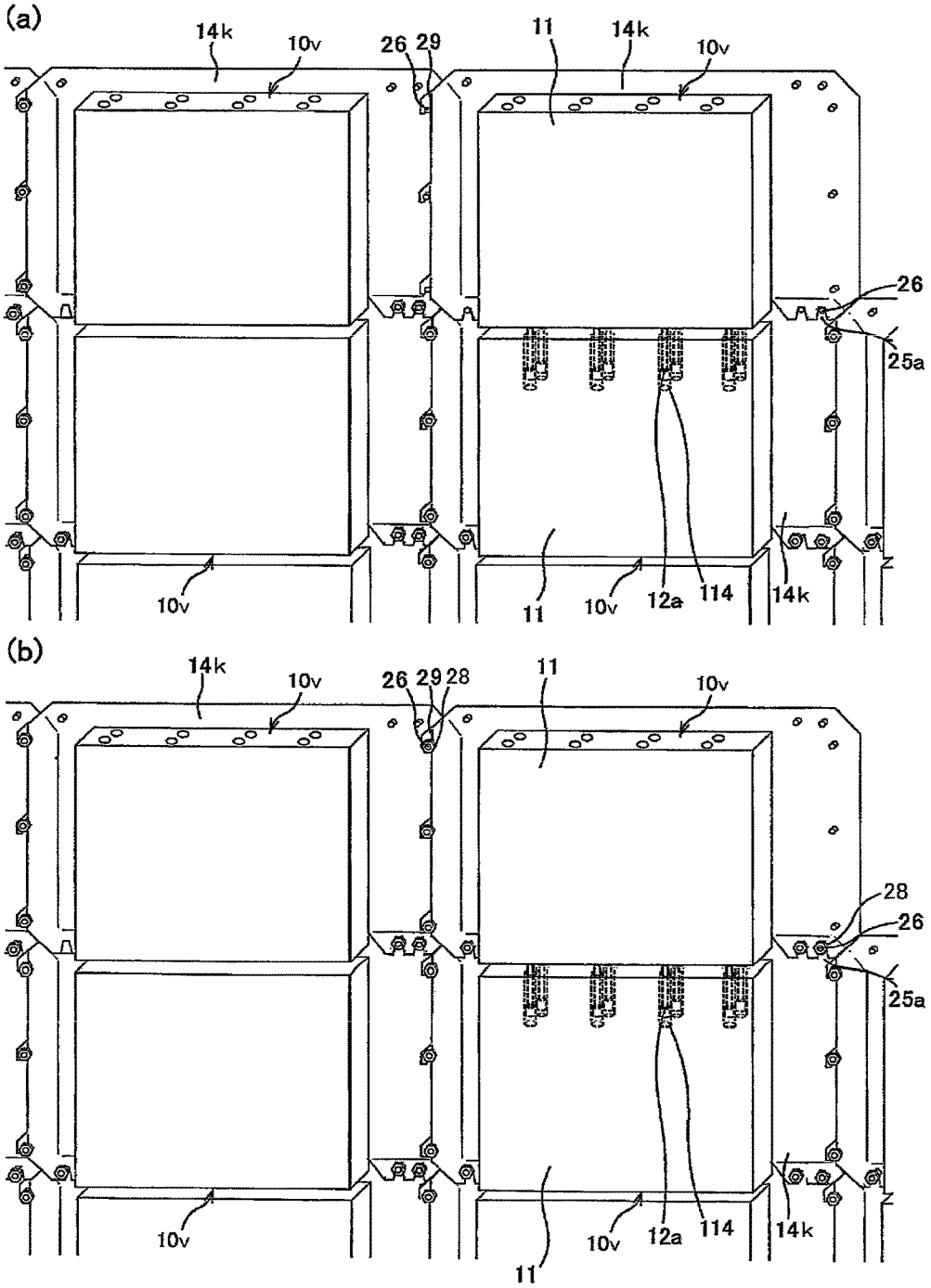
FIG. 64 is another set of views that illustrate the method of constructing the structure 30*c*.

Subsequently, as indicated by the arrow in FIG. 63(*b*), by lowering the block 10*v*, as shown in FIG. 64(*a*), the bolts 26 at the right edge of the plate 14*k* of the left block 10*v* and the bolts 26 at the upper edge portion of the plate 14*k* of the lower block 10*v* are inserted into the hook-like portions 29 and the slits 25*a* of the plate 14*k* of the block 10*v* that is currently concerned, respectively. Then, as shown in FIG. 64(*b*), the nuts 28 are tightened over the respective bolts 26.

As described above, by lowering the block 10*v*, the joints 12*a* having the fixing elements, which protrude downward from the main body 11 of the block 10*v*, are inserted into the holes 114 of the main body 11 of the lower block 10*v*.

In order to enable a series of the above-mentioned operations to the block 10*v*, it is preferable to set a pitch f in the vertical direction of the bolts 26 at the right edge of the plate 14*k* as shown in FIG. 63(*a*) to be equal to or greater than the sum of the height g of the hook-like portion 29 and the protruding length h of the joints 12*a* having the fixing elements.

Figure 65:
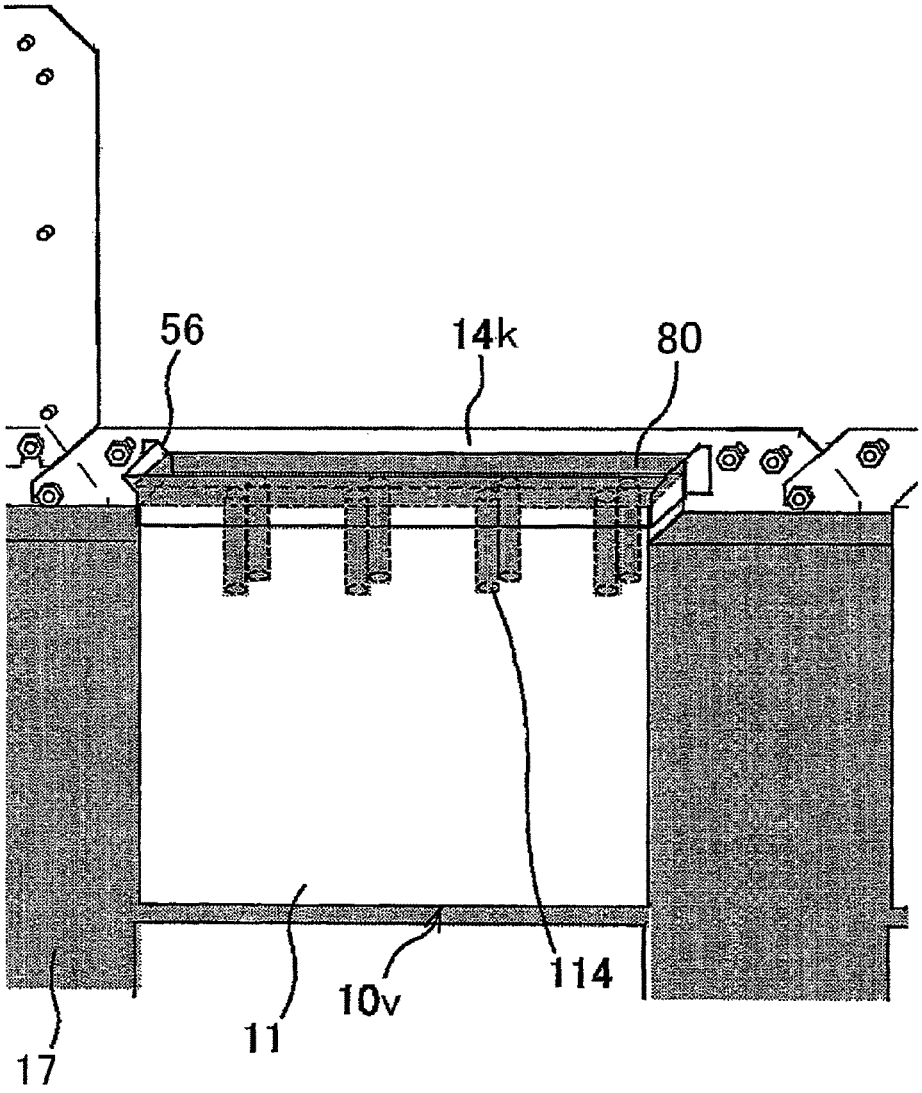
FIG. 65 is a view that illustrates mortar 80.

It should be noted that, when performing an actual construction, as shown in FIG. 65, an outer formwork 56 is provided at the upper portion of the main body 11 of the lower block 10*v*, the top face of the main body 11 is surrounded by the upper edge portion of the plate 14*k*, which serves as the inner formwork, and the outer formwork 56, the mortar 80, which serves as the filler, is provided on the top face at an appropriate time so as to lower the block 10*v* as described above. The mortar 80 is also loaded in the holes 114.

As shown in FIG. 64(*a*), when the block 10*v* is lowered, the mortar 80 is tightly loaded between the main bodies 11 of the upper and lower blocks 10*v* by the pressure from the bottom face of the main body 11 of the block 10*v* so as to form the masonry joint 17 in the horizontal direction. The masonry joint 17 in the vertical direction is also formed between the main bodies 11 of the blocks 10*v* adjacent to each other in the horizontal direction in a similar manner to the above-described manner.

In this way, the blocks 10*v* in the respective rows are installed from the left to the right, the blocks 10*v* are joined in the vertical and horizontal directions, and the masonry joints 17 are formed, thereby constructing the structure 30*c* as shown in FIG. 62(*a*). It should be noted that, at the contact position of the upper, the lower, the right and the left blocks 10*v*, the plates 14*k* of the respective blocks 10*v* are overlapped. This is similar to those in FIG. 53.

According to the twenty-second embodiment, it is possible to obtain the similar effects and advantages to those in the nineteenth embodiment. As the bolts 26 can be inserted into the hook-like portions 29 or the slits 25*a* by moving the block(s) 10*v* downward, the installation of the block(s) 10*v* becomes easy.

Twenty-Third Embodiment (1. Precast Blocks 10*w* and 10*x*)

Figure 66:
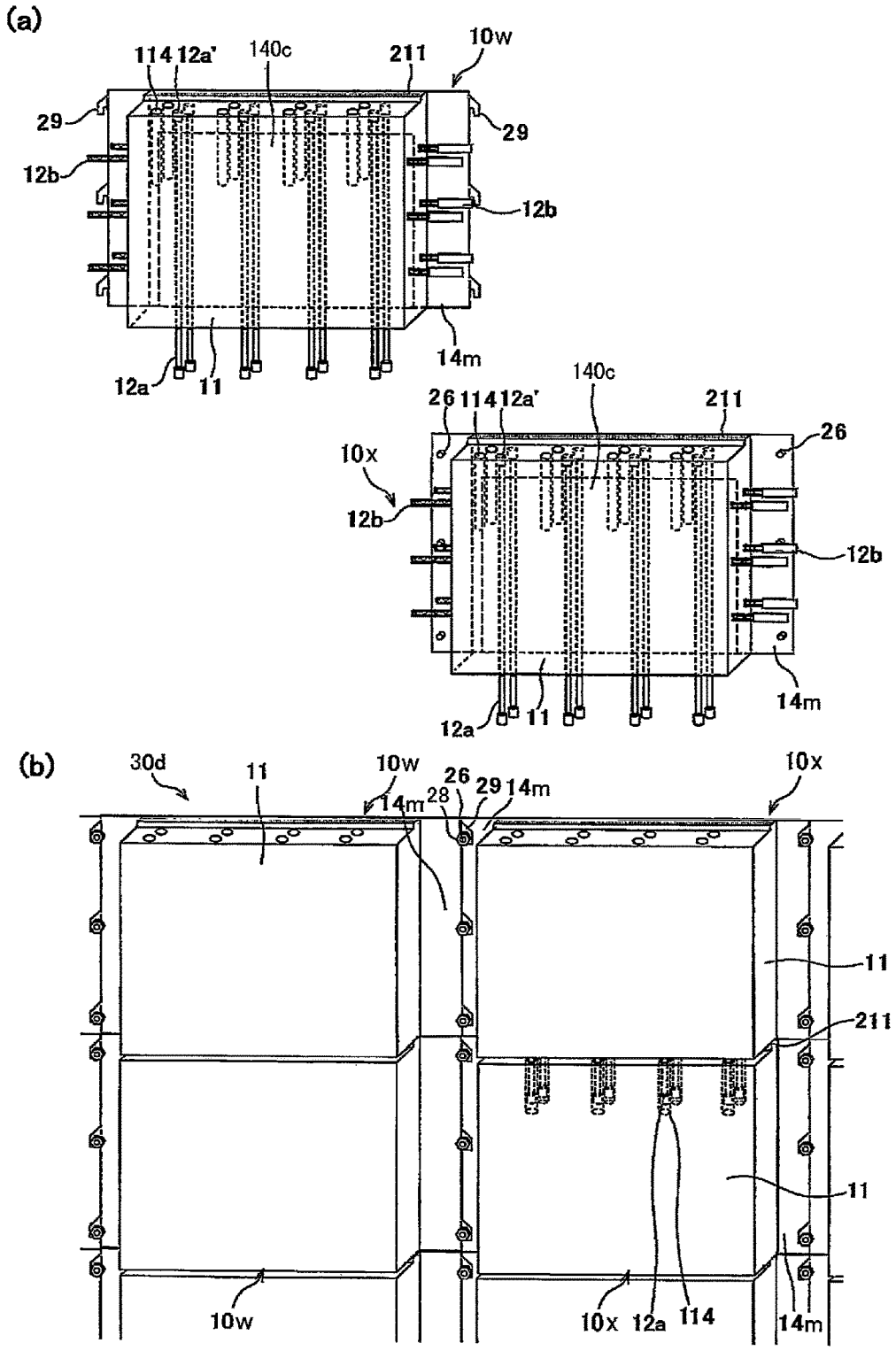
FIG. 66 is a set of views that illustrate blocks 10*w* and 10*x*.

FIG. 66(*a*) is a view showing precast blocks 10*w* and 10*x* according to a twenty-third embodiment. According to this embodiment, a structure is constructed by use of two blocks 10*w* and 10*w* as shown in the drawings.

Each of plates 14*m* of the blocks 10*w* and 10*x* has a gate-like shape, and the right and left edge portions thereof protrude from the main body 11. The block 10*w* is provided with the hook-like portions 29 at the right and left edge portions of the plate 14*m*, and the block 10*x* is provided with the bolts 26 at the right and left edge portions of the plate 14*m*. It should be noted that the plate 14*m* is not provided with the folded portion 27 or the like and thus the right and left edge portions thereof are on the same plane.

A portion on the top face of the main body 11 at the plate 14*m* side is lifted upward, and a water stop (cut off) portion 211 such as a rubber or the like is provided thereon. According to this embodiment, this lifted portion functions as an inner formwork for loading the filler. It should be noted that the main body 11 is provided with the joints 12*a* and 12*a*' having the fixing elements or the holes 114, which are similar to those in the twenty-second embodiment, in addition to the mechanical joints 12*b* on the right and left faces.

(2. Structure 30*d* Made from the Blocks 10*w* and 10*x*)

FIG. 66(*b*) is a view showing a structure 30*d* made from the blocks 10*w* and 10*x*, with the masonry joint or the like being omitted.

According to the twenty-third embodiment, the blocks 10*w* and 10*x* are alternately disposed in the horizontal direction and arranged in the vertical and horizontal directions, the filler such as the concrete, the mortar or the like is loaded between the main bodies 11 of the blocks 10*w* and 10*x* adjacent to one another to form the masonry joints 17 (as shown in FIG. 62(*a*)) so as to construct the structure 30*d* having a wall shape. Each of the right and left edges of the plate 14*m*, which protrude from the main body 11 of each of the blocks 10*w* and 10*x*, functions as an inner formwork for loading the filler.

The block 10*w* is arranged in front of the block 10*x*. The plates 14*m* of the right and left blocks 10*w* and 10*x* are fixed by lapping the edge provided with the hook-like portions 29 of the plate 14*m* of one block 10*w* in front of the edge provided with the bolts 26 of the plate 14*m* of the other block 10*x*, inserting the bolts 26 into the hook-like portions 29 to be hooked, and tightening the nuts 28 over the bolts 26.

It should be noted that, according to the twenty-third embodiment, similar to the twenty-second embodiment, the joints 12*a* having the fixing elements, which protrude downward from the main body 11 of the upper block 10*w* or 10*x* is inserted into the holes 114 of the main body 11 of the lower block 10*w* or 10*x*, and then overlapped with the joints 12*a*' having the fixing elements buried in the main body 11 that is currently concerned (as shown in FIG. 66(*a*)) so as to form a lap joint. For this reason, one of the upper and lower blocks 10*w* and 10*x* is a block in which positions of the holes 114 and the joints 12*a*' (12*a*) having the fixing elements are reversed in the block 10*w* or 10*w* shown in FIG. 66(*a*), which is also similar to those in the twenty-second embodiment.

(3. Method of Constructing the Structure 30*d* with the Blocks 10*w* and 10*x*)

Hereinafter, a method of constructing a structure 30*d* with the blocks 10*w* and 10*x* will be described.

Figure 67:
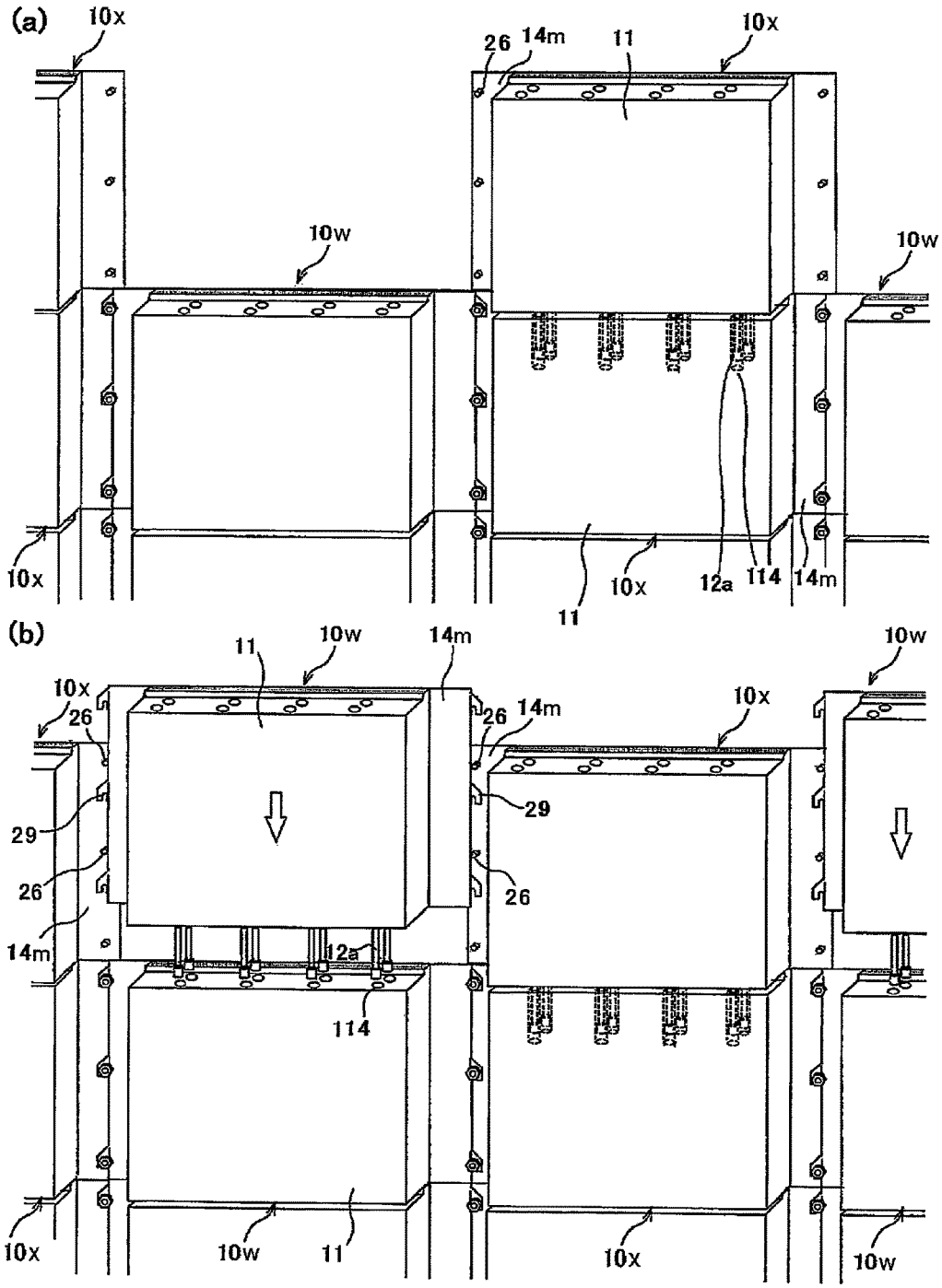
FIG. 67 is a set of views that illustrate a method of constructing a structure 30*d*.

According to this embodiment, as shown in FIG. 67(*a*), the blocks 10*x* only are firstly installed and arranged in the horizontal direction in a comb-like state. When installing the block 10*x*, the block 10*x* is lowered, and the joints 12*a* having the fixing elements, which protrude downward from the main body 11, is inserted into the holes 114 of the main body 11 of the lower block 10*x*.

Next, as shown in FIG. 67(*b*), the block 10*w* is arranged between the blocks 10*x*, and the hook-like portions 29 at the right and left edges of the plate 14*m* of the block 10*w* are positioned between the upper and lower bolts 26 provided at the edges of the plates 14*m* of the successive blocks 10*x*.

Figure 68:
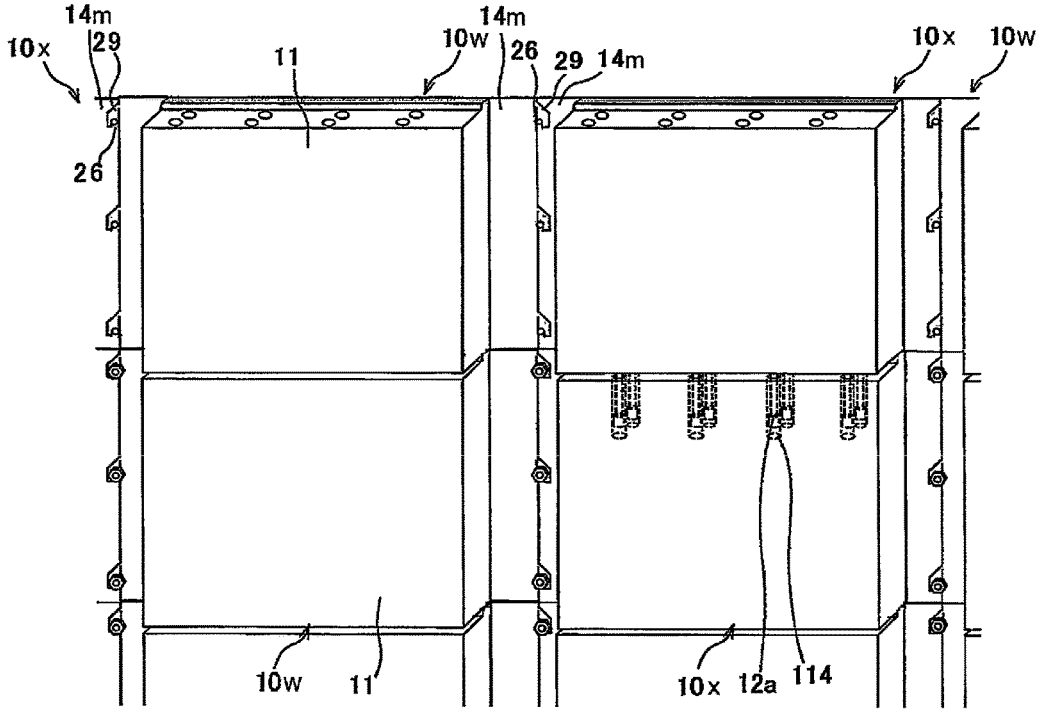
FIG. 68 is another view that illustrates the method of constructing the structure 30*d*.

Subsequently, as indicated by the arrow in FIG. 67(*b*), the block 10*w* is lowered, and, as shown in FIG. 68, the bolts 26 of the plate 14*m* of the adjacent block 10*x* are inserted into the hook-like portions 29 of the plate 14*m* of the block 10*w* that is currently concerned and then hooked.

Also, similar to installing the block 10*x*, the joints 12*a* having the fixing elements (as shown in FIG. 67(*b*)), which protrude downward from the main body 11 of the block 10*w*, are inserted into the holes 114 of the main body 11 of the lower block 10*w* (as shown in FIG. 67(*b*)). Subsequently, the nuts 28 are tightened over the respective bolts 26.

It should be noted that, similar to the twenty-second embodiment, the block 10*w* (10*x*) is arranged by lowering the block 10*w* (10*x*) after providing the mortar serving as the filler on the top face of the lower block 10*w* (10*x*) at an appropriate time. Similar to the above-described configuration, the masonry joint in the vertical direction is formed between the main bodies 11 of the blocks 10*w* and 10*x* adjacent to each other in the horizontal direction.

In this way, the blocks 10*w* and 10*x* in the respective rows are arranged, the blocks 10*w* and 10*x* are joined together in the vertical and horizontal directions to form the masonry joints 17. Thus, it is possible to construct the structure 30*d*.

According to the twenty-third embodiment, similar effects and advantages to those in the twenty-second embodiment can be obtained. It should be noted that one type of blocks 10*x* out of the two types of blocks 10*w* and 10*x* are firstly arranged and aligned in the comb-like state in this embodiment, which is similarly applicable to the installation of the blocks 10*t* and 10*u* in the twenty-first embodiment.

Twenty-Fourth Embodiment

Hereinafter, as a twenty-fourth embodiment, an example in which the precast blocks, which have been described above, are applied to a dike of an LNG tank 1 (1*b*) according to the present invention.

Figure 69:
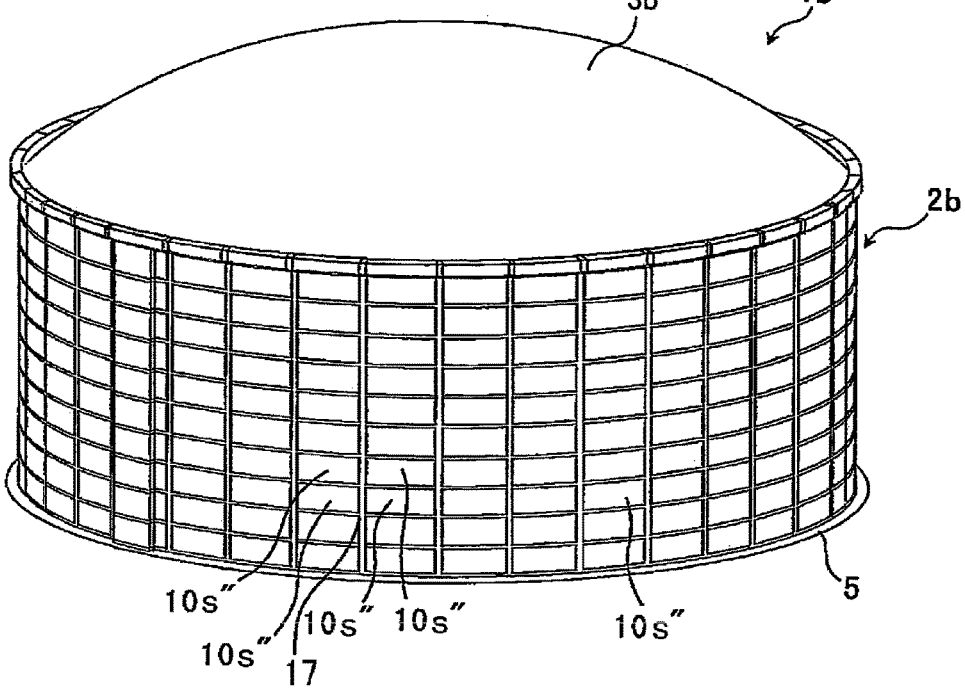
FIG. 69 is a set of views that illustrate an LNG tank 1*b* and a block 10*s''*.
Figure 69:
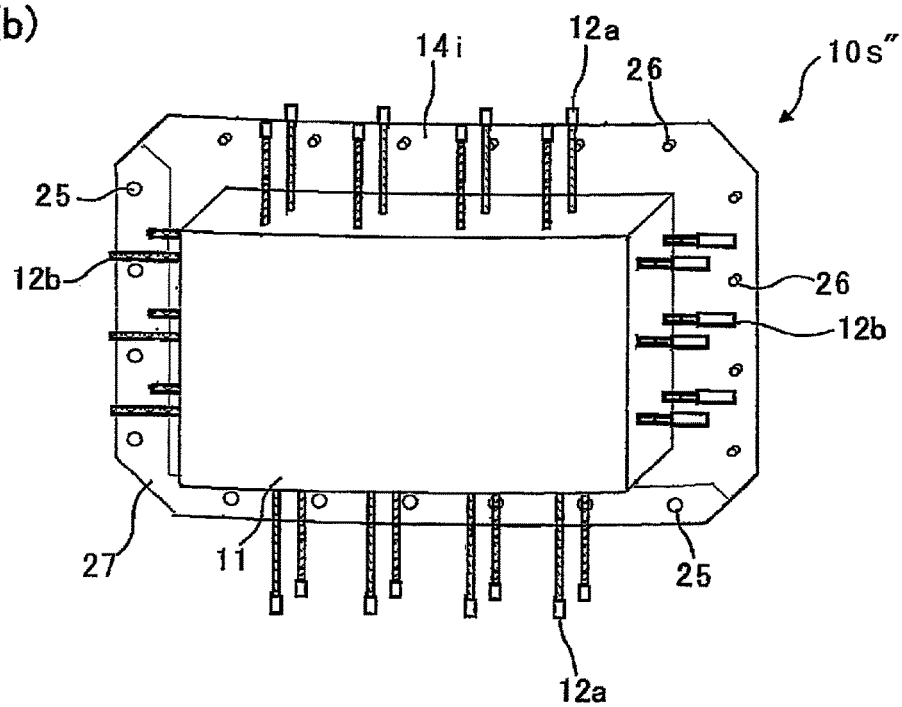

FIG. 69(*a*) is a view showing an LNG tank 1*b*. The LNG tank 1*b* is an on-ground type tank configured to store an LNG, provided with a dike 2*b* at a bottom slab 5. Inside the LNG tank 1*b*, an inner tank (not shown) and an outer tank 3*b* made of metal plates or the like are arranged. The dike 2*b* is provided in order to prevent the liquid leakage of the LNG to the outside even when the inner tank or the outer tank 3*b* undergoes the damage or the like.

When viewed in the plan view, the dike 2*b* has a round shape corresponding to the diameter of the tank, and it is possible to construct the dike 2*b* with precast blocks 10*s*" as shown in FIG. 69(*b*). The block 10*s*" is similar to the block 10*s* in the twentieth embodiment but differs in that each of the main body 11 and the plate 14*i* has an arc-shaped bending corresponding to the diameter of the tank.

According to a similar procedure to those described in FIGS. 50 to 52, the blocks 10*s*" are arranged right and left in the circumferential direction of the dike 2*b*, stacked in the upper and lower rows, such that the blocks are arranged in the vertical and horizontal directions. The masonry joints 17 are formed between the blocks 10*s*" adjacent to one another in the vertical and horizontal directions. Thus, it is possible to construct the dike 2*b*. It should be noted that the prestress is introduced in the dike 2*b* by tension members in the vertical direction and the circumferential direction (now shown), and the block 10*s*" is also provided with sheath pipes (not shown) or the like through which the tension members run.

By employing this configuration, similar effects and advantages to those in the nineteenth embodiment can be obtained. As the work for installing the formworks from the inside can be eliminated when forming the masonry joints 17, it leads to the reduction in the construction period for constructing the tank without the interference with a construction work for the inner facility such as the inner tank and the outer tank 3*b*. It should be noted that an applicable target of the precast blocks according to the nineteenth to twenty-third embodiments is not limited to the above-mentioned dike 2*b* but the precast blocks are also applicable to various structures in which the interference with a work to be performed at one side of the structural body is required to be prevented, such as a wall-like structure, a container-like structure and the like.

Twenty-Fifth Embodiment

Figure 70:
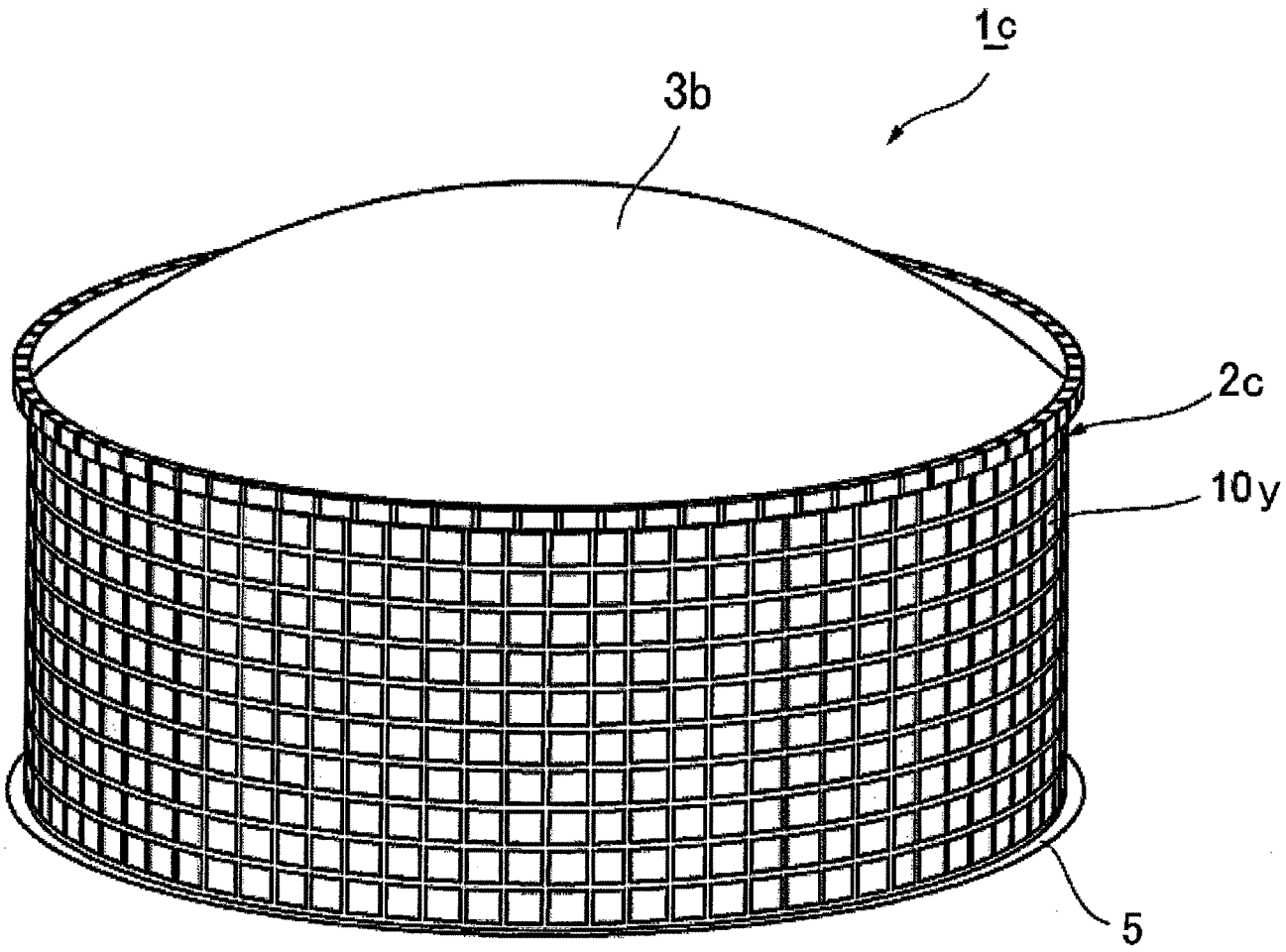
FIG. 70 is a perspective view that illustrates an LNG tank 1*c*, which is an example of a structure constructed by a joining structure of a 25th embodiment.

A twenty-fifth embodiment to a thirtieth embodiment are examples of a joining structure of the blocks in the LNG tank 1 according to the present invention. FIG. 70 is a perspective view showing an LNG tank 1 (1*c*) according to the present invention to which a joining structure and a method of joining according to the twenty-fifth embodiment are applied. The LNG tank 1*c* is a tank that stores an LNG and, for example, an on-ground type tank. An outer shape of the LNG tank 1*c* is an approximately cylindrical shape. The LNG tank 1*c* includes an inner tank for accommodating the LNG, an outer tank 3*b*, which is positioned outside the inner tank and covers an upper portion of the LNG tank 1*c*, a dike 2*c* having an annular shape and provided outside the outer tank 3*b*, and a bottom slab 5 having a disk shape, which supports the inner tank, the outer tank 3*b* and the dike 2*c* at the lower portion thereof.

The above-mentioned inner tank and the outer tank 3*b* are constituted by metal plates or the like, respectively, and the gap between the inner tank and the outer tank 3*b* maintains the LNG in a cold condition. A side wall of the outer tank 3*b*, which is formed in an annular shape, is provided so as to be arranged along the dike 2*c* inside the dike 2*c*. The dike 2*c* is provided in order to prevent the LNG from leaking to the outside. The bottom slab 5 is supported by piles buried in the ground.

The dike 2*c* is constituted by a plurality of precast members (precast blocks) 10*y*, each of which has a block shape, and the precast members 10*y* are arranged along the circumferential direction and the vertical direction of the LNG tank 1*c*. In other words, in the LNG tank 1*c*, the precast members 10*y* are arranged in the circumferential direction of the LNG tank 1*c* and stacked in the vertical direction thereof, and the masonry joints are formed between the precast members 10*y* adjacent to one another in the circumferential direction and the vertical direction so as to construct the dike 2*c*. Also, the prestress is introduced to the dike 2*c* by prestressed concrete (PC) steel wires, which extend in the vertical direction in the precast members 10*y*, and PC steel wires, which extend in the circumferential direction in the precast members 10*y*.

Figure 71:
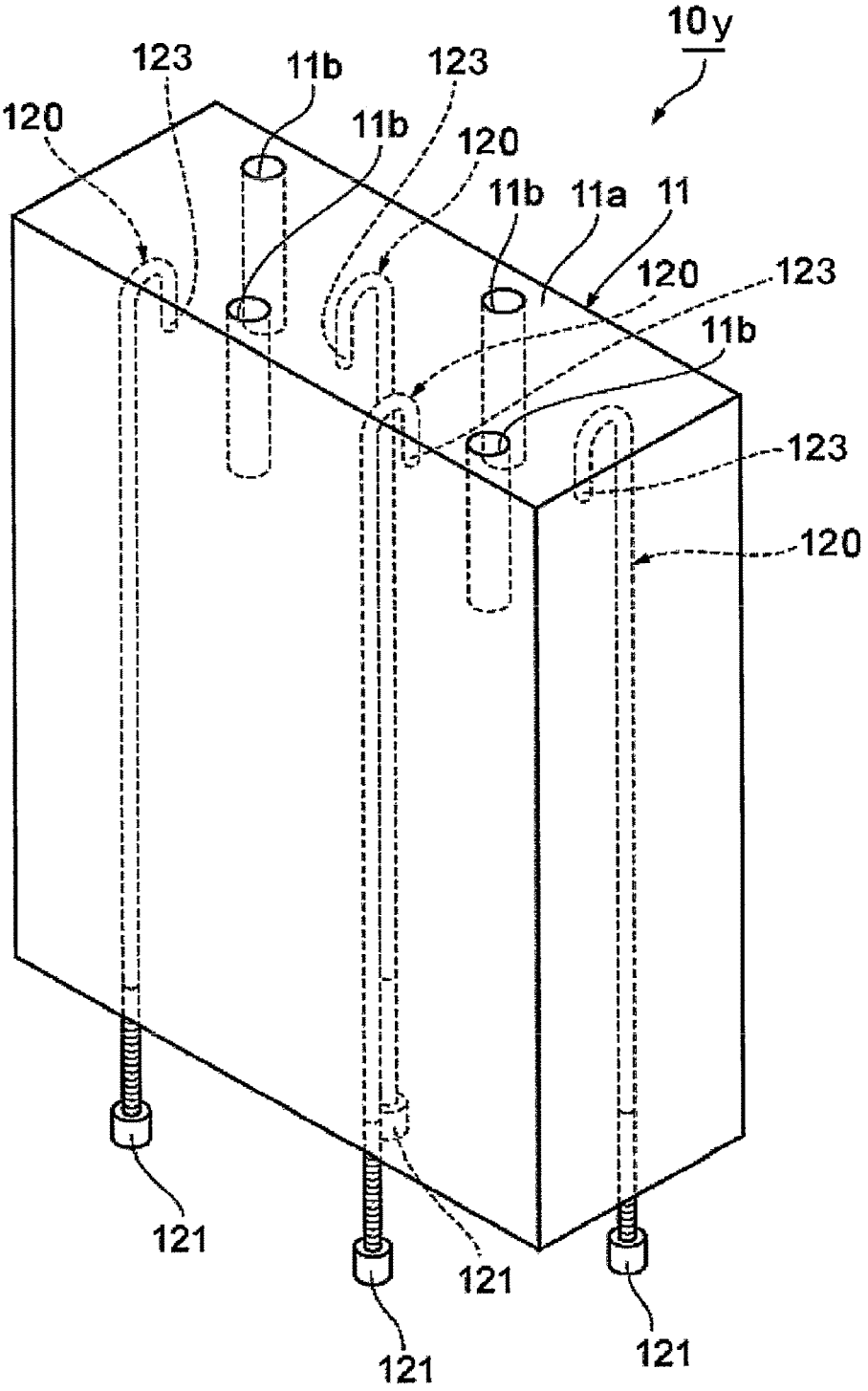
FIG. 71 is a perspective view that illustrates a first precast member 10*y* of the joining structure of the 25th embodiment.
Figure 72:
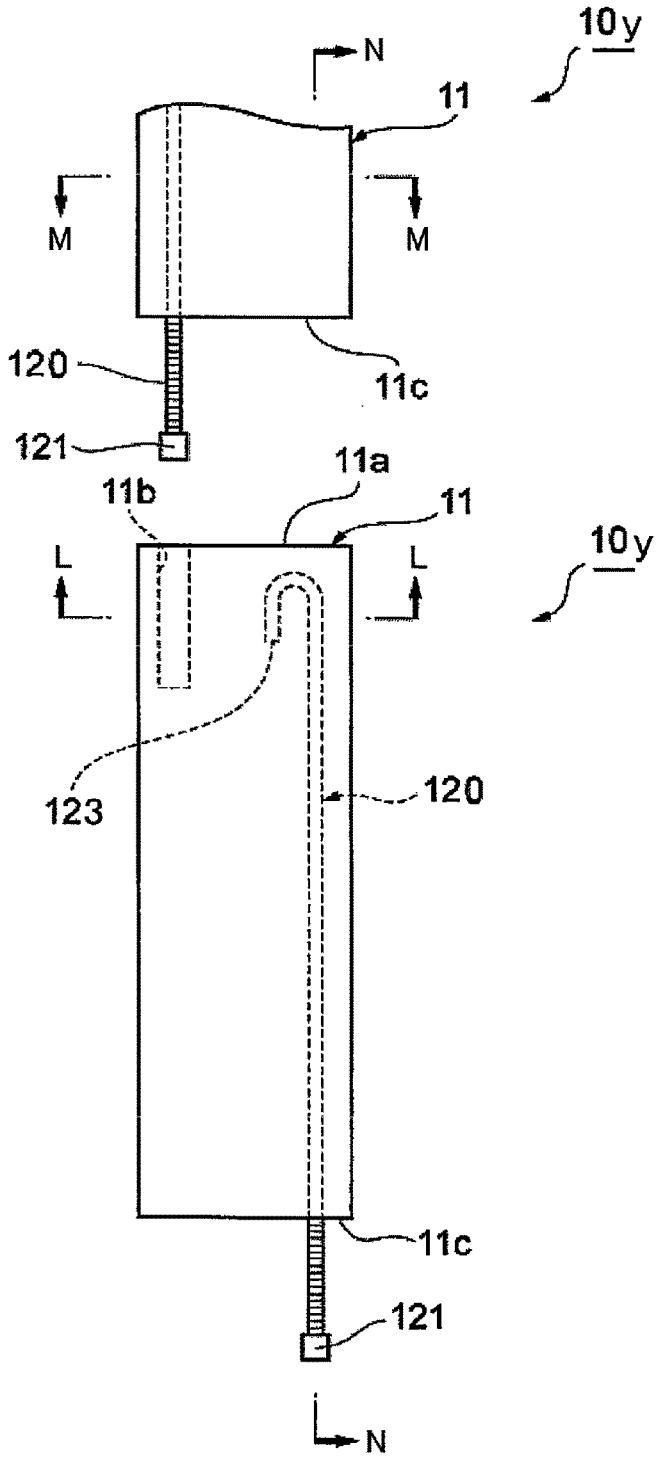
FIG. 72 is a side view that illustrates a situation when the first precast member 10*y* faces a second precast member 10*y*.
Figure 73:
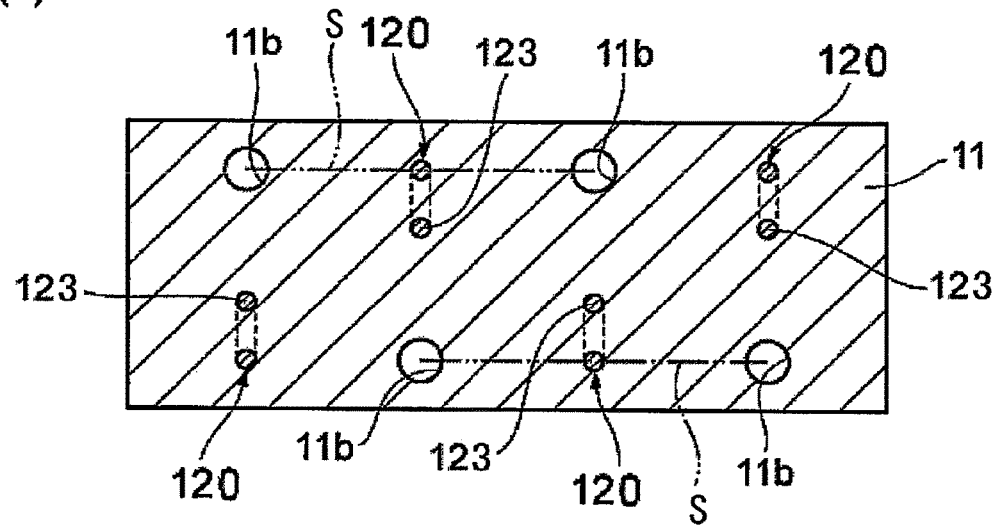
FIG. 73(*a*) is a cross-sectional view taken along the line L-L in FIG. 72.
Figure 73:
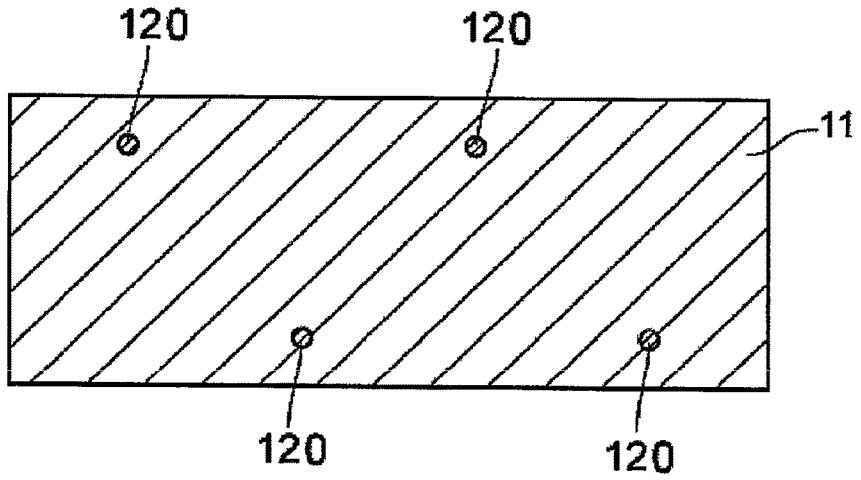

FIG. 71 is a perspective view showing the precast member 10*y* when viewed from a obliquely upward position. FIG. 72 is a side view showing the precast member 10*y*. FIG. 73(*a*) is a cross-sectional view taken along the line L-L line in FIG. 72, and FIG. 73(*b*) is a cross-sectional view taken along the line M-M in FIG. 72. As shown in FIGS. 71 to 73, the precast member 10*y* includes a main body 11, which is made of the concrete and formed in a rectangular shape, a plurality of main reinforcing steel rods or bars 120 (a first main reinforcing steel bar and a second main reinforcing steel bar), which are buried in the main body 11 and protrude from the main body 11, and fixing elements 121, which are attached at free ends of the respective main reinforcing steel bars 120. It should be noted that, in the following description, although terms "thickness direction," "up-down direction" and "length direction" are used, these terms are only used in an expediential manner based on the state illustrated in the drawings. In the following description, the "thickness direction" denotes a thickness direction of the main body 11 (direction perpendicular to the drawing sheet of FIG. 72), a "downward direction" denotes a direction from which the main reinforcing steel bar 120 protrudes, and the "length direction" denotes a direction orthogonal to the thickness direction and the up-down direction (direction perpendicular to the drawing sheet of FIG. 73).

A plurality of holes (first holes) 11*b* are formed in one of end faces (a first end face) 11*a* of the main body 11. These holes 11*b* are formed by, for example, burying sheath pipes in the main body 11. The holes 11*b* are formed so as to extend from the end face 11*a* toward the inside (downward) of the main body 11. The holes 11*b* are provided in order to allow the main reinforcing steel bars 120 and the fixing elements 121 of the different precast member 10*y* to be inserted from above and load the mortar (solidifying material or filler) M to bury the main reinforcing steel bars 120 and the fixing elements 121.

On the horizontal plane, the holes 11*b* and the main reinforcing steel bars 120 are arranged in a grid shape. The holes 11*b* and the main reinforcing steel bars 120 are alternately arranged in the length direction of the main body 11. Also, the holes 11*b* and the main reinforcing steel bars 120 are arranged to be adjacent to each other in the thickness direction of the main body 11. It should be noted that the sheath pipes through which the above-mentioned PC steel wires pass are also buried in the main body 11. It should be noted, however, that the PC wires and sheath pipes may be omitted.

The main reinforcing steel bars 120 are buried in the main body 11 and extend in the up-down direction in the main body 11, and a lower end of each of the main reinforcing steel bars 120 protrudes downward from another end face (a second end face) 11*c* of the main body 11. The end face 11*c* is an end face positioned at a lower end of the precast member 10*y*. On the other hand, an upper end of the main reinforcing steel bar 120 is in a state being buried in the main body 11 and is not exposed outside the main body 11. It should be noted that although the joints such as the mechanical joints or the joints having the fixing elements, which are similar to those described in the previous embodiments, may be also provided on right and left faces of the main body 11, an explanation will be hereinafter omitted as is irrelevant to joining the upper and lower precast members 10*y*, which will be described later.

A U-shaped hook (folded portion) 123, which is folded in a direction departing from the end face 11*a*, is provided at an upper end of each of the main reinforcing steel bars 120. The U-shaped hook 123 is arranged at an approximately middle point position of a linear segment S connecting two holes 11*b* adjacent to each other. In other words, the U-shaped hook 123 may be arranged at a middle point position of the line segment S, or alternatively arranged at a position slightly deviated from the middle point of the linear segment S.

The U-shaped hook 123 is formed by folding the upper end of the main reinforcing bar 120 inward in the thickness direction of the main body 11. In this way, it is possible to shorten the distance between the main reinforcing steel bar 120 and the hole 11*b* by folding the upper end of the main reinforcing bar 120 inward in the thickness direction. As a result, it is possible to smoothly transmit a force to the main reinforcing steel bar 120 inserted into the hole 11*b*. It should be noted that the direction to which the U-shaped hook 123 is folded is not necessarily inward in the thickness direction of the main body 11, but for example the U-shaped hook 123 may be folded in the direction inclined with respect to the thickness direction. Also, the fixing body 121 is fixed to the lower end of the main reinforcing bar 120 by, for example, the pressure bonding.

Figure 74:
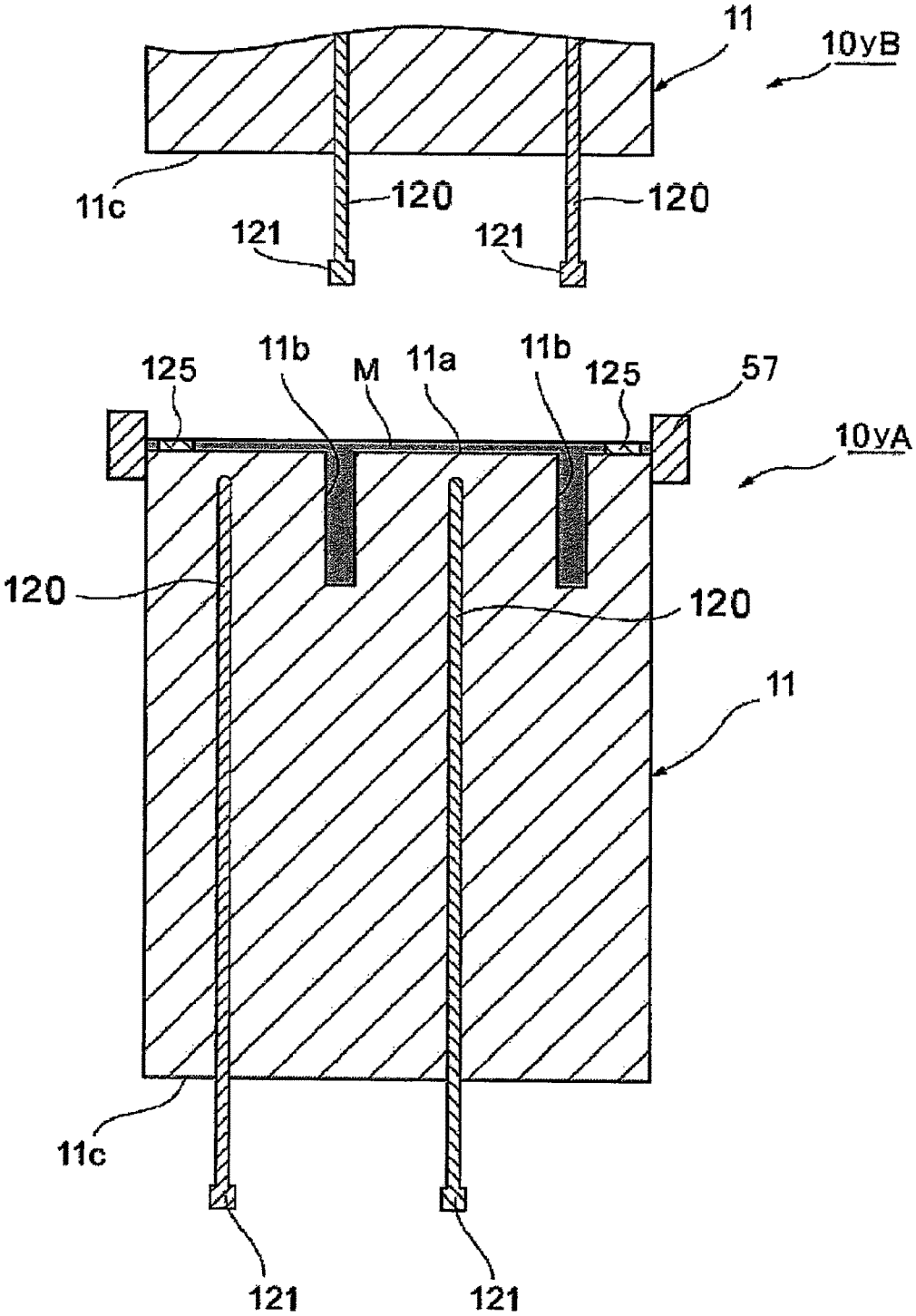
FIG. 74 is a cross-sectional view taken along the line N-N in FIG. 72.

Hereinafter, a method of joining the precast member 10*y* constituted as described above will be described. This joining method is a joining method in which the precast members 10*y* are opposed to each other in the vertical direction and the upper precast member 10*y* is stacked on the lower precast member 10*y*. As shown in FIG. 74, hereinafter, an explanation will be made with the lower precast member 10*y* being as a first precast member 10*y*A and the upper precast member 10*y* being as a second precast member 10*y*B. According to this embodiment, although the first precast member 10*y*A and the second precast member 10*y*B are identical to each other, the first precast member 10$y$A may differ from the second precast member 10$y$B in the shape thereof or the like.

Firstly, a jig 125 for adjusting the verticality of the second precast member 10$y$B is arranged on the end face 11$a$ of the first precast member 10$y$A. The jig 125 is provided in order to form (leave) a gap between the end face 11$a$ of the first precast member 10$y$A and the end face 11$c$ of the second precast member 10$y$B and also to adjust the height of the second precast member 10$y$B with respect to the first precast member 10$y$A. Next, an upper face of the jig 125 is scraped by a file or the like to uniform the height of the upper face of the jig 125. Subsequently, the second precast member 10$y$B is temporarily placed on the upper face of the jig 125 to adjust the height (verticality) of the second precast member 10$y$B with respect to the first precast member 10$y$A. After the adjustment is completed, the second precast member 10$y$B is once removed.

Next, a formwork 57 is arranged so as to surround the end face 11$a$ (upper end face) of the first precast member 10$y$A (a step of arranging a formwork). The formwork 57 is arranged by, for example, attaching the formwork 57 to the upper ends of the respective side faces of the first precast member 10$y$A by screws. After the formwork 57 is arranged, the end face 11$a$ is filled with the mortar M (a step of loading the solidifying material). At this moment, the mortar M is also disposed (loaded) around the jig 125. It should be noted that, except for FIG. 74, an illustration of the jig 125 is omitted for the simplification. As the mortar M, for example, the non-shrinkable mortar of the retarded hardening type can be used into which the retarded hardening agent is immixed and of which hardening time is equal to or greater than 5 to 6 hours. It should be noted that, in the second precast member 10$y$B, the fixing elements 121 are attached in advance at the free ends of the respective main reinforcing steel bars 120 protruding downward from the end face 11$c$ of the second precast member 10$y$B.

Then, before the loaded mortar M is cured, the end face 11$c$ of the second precast member 10$y$B is placed on the upper face of the jig 125, and the main reinforcing steel bars 120 of the second precast member 10$y$B are inserted into the holes 11$b$ of the first precast member 10$y$A (a step of inserting the second reinforcing bar). At this moment, the fixing elements 121 attached to the lower ends of the respective main reinforcing steel bars 120 are also inserted into the holes 11$b$ along with the main reinforcing bars 120.

Figure 75:
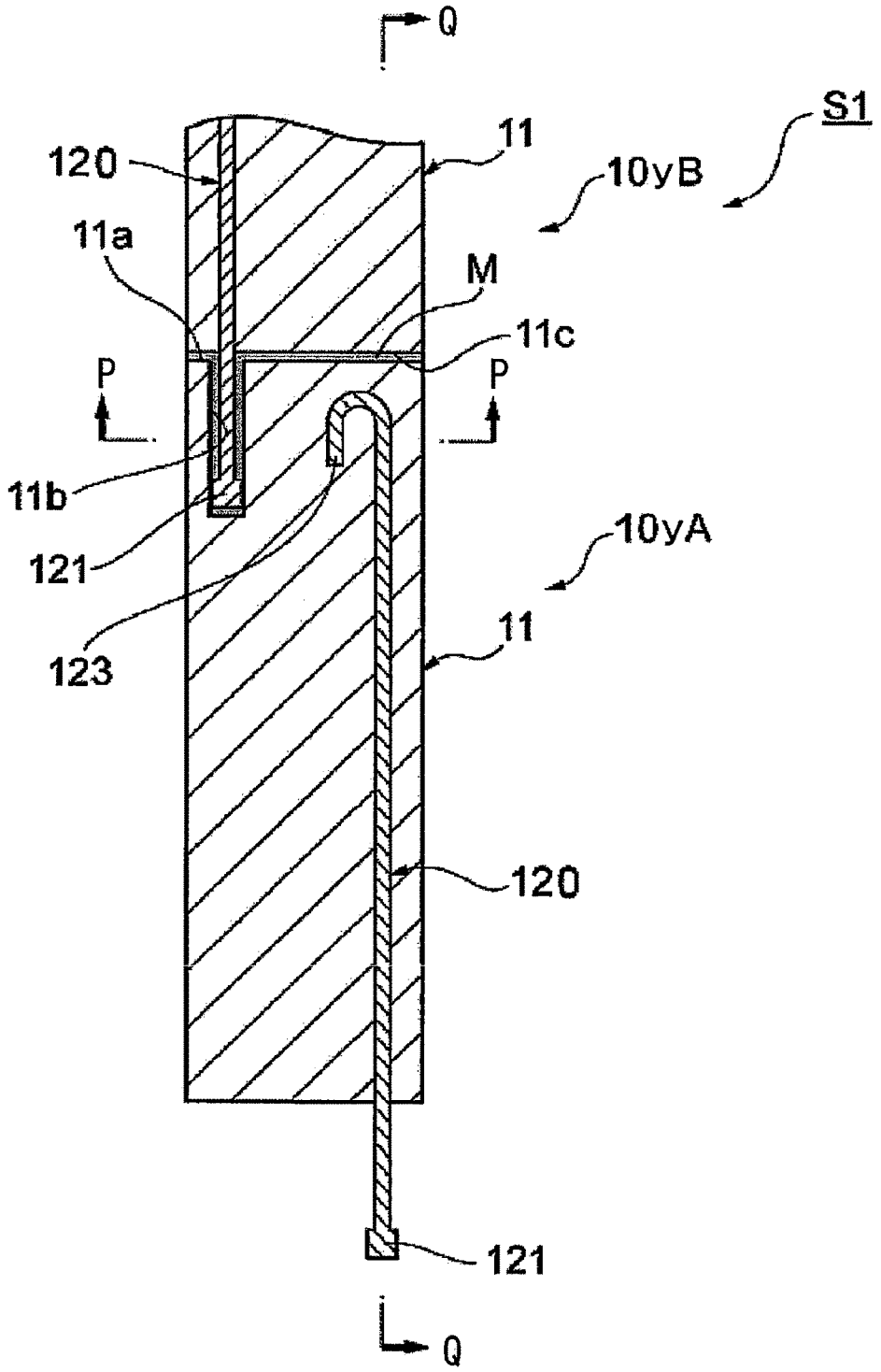
FIG. 75 is a cross-sectional view that illustrates a situation when mortar M is loaded between a first precast member 10*y*A and a second precast member 10*y*B.
Figure 76:
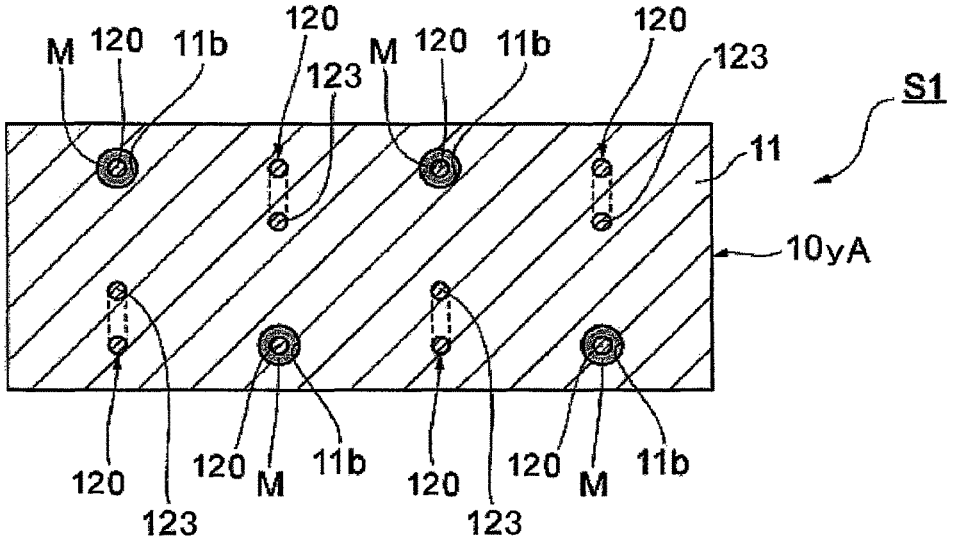
FIG. 76 is a cross-sectional view taken along the line P-P in FIG. 75.
Figure 77:
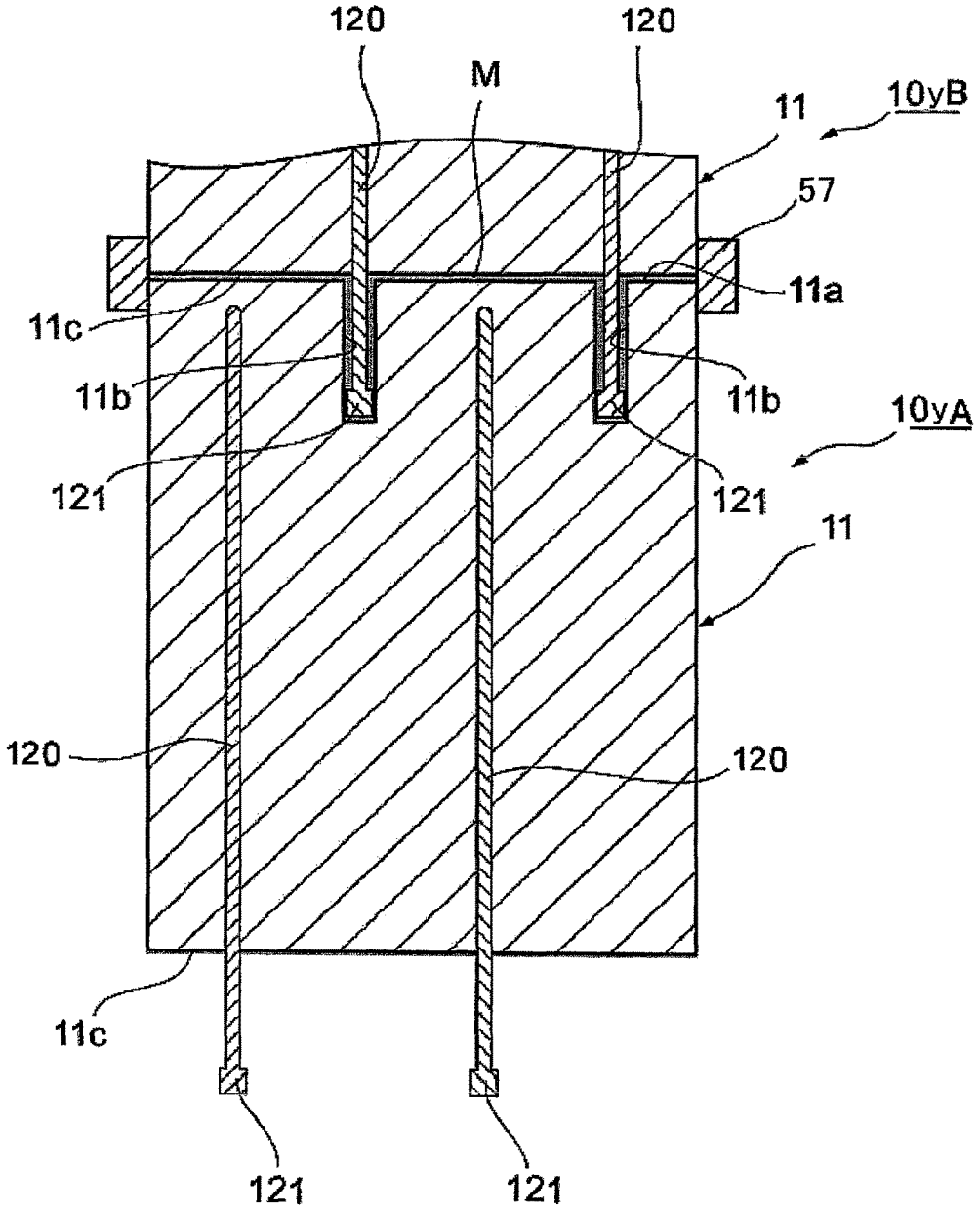
FIG. 77 is a cross-sectional view taken along the line Q-Q in FIG. 75.

As shown in FIGS. 75 and 77, by inserting the main reinforcing steel bars 120 into the holes 11$b$, the mortar M is present between the holes 11$b$ and the main reinforcing steel bars 120 in the first precast member 10$y$A. As shown in FIG. 77, the mortar M overflows from the holes 11$b$ and is compressed from above by the end face 11$c$ of the second precast member 10$y$B. As a result, the mortar M spreads in the lateral direction between the end face 11$c$ of the second precast member 10$y$B and the end face 11$a$ of the first precast member 10$y$A. Subsequently, by causing time to elapse in this condition, the mortar M is cured (a step of hardening the solidifying material). After the mortar M is cured, the formwork 57 is removed from the side face of the first precast member 10$y$A to complete a joining structure S1 according to this embodiment (as shown in FIGS. 75 an 76).

As described above, according to the joining structure S1 of this embodiment, the U-shaped hooks 123 are provided which are folded in the direction departing from the end face 11$a$, and the free ends thereof at the end face 11$a$ side of the main reinforcing bar 120 are folded. As a result, it is possible to ensure the transmission of the force between the U-shaped hooks 123 of the first precast member 10$y$A and the main reinforcing steel bars 123 inserted into the holes 11$b$ of the first precast member 10$y$A. As the U-shaped hooks 123 are provided at the free ends of the main reinforcing steel bars 120, it is possible to shorten the fixing length without the fixing elements being attached to the free ends of the respective main reinforcing steel bars 120. In this way, in the joining structure S1, the fixing elements may be eliminated and the work for attaching the fixing elements in the factory or the like can be simplified to reduce the cost or the labor associated with the machining and processing. Accordingly, it is possible to improve the workability.

In the factory, the labor for burying the main reinforcing steel bars 120 with the U-shaped hooks 123 does not differ from the labor for burying the main reinforcing steel bars without the U-shaped hooks 123. Also, the construction can be performed only by filling the holes 11$b$ with the mortar M and inserting the main reinforcing steel bars 120 into the holes 11$b$. Accordingly, also from this viewpoint, higher workability is attainable.

The U-shaped hooks 123 are buried inside the first precast member 10$y$A. Thus, as depositing the concrete for burying the U-shaped hooks 123 is eliminated, it is possible to further simplify the construction work. Because the holes 11$b$, into which the main reinforcing steel bars 120 are inserted, are only required to be prepared as the holes, it is possible to reduce the size of each of the holes to be formed in advance.

As described above, a plurality of U-shaped hooks 123 and a plurality of holes 11$b$ are alternately arranged, and each of the U-shaped hooks 123 is arranged at the middle point position of the line segment S connecting two holes 11$b$ adjacent to each other.

According to the joining method of forming the joining structure S1 of this embodiment, the formwork 57 is arranged so as to surround the end face 11$a$ and the end face 11$a$ is filled with the mortar M, and subsequently the main reinforcing bars 120 are inserted into the respective holes 11$b$ and the mortar M is hardened. In this way, the main reinforcing steel bars 120 may be inserted after arranging the formwork 57 and filling the mortar M in advance. Thus, it is possible to improve the efficiency of the work for joining the first precast member 10$y$A and the second precast member 10$y$B to each other.

Twenty-Sixth Embodiment

Figure 78:
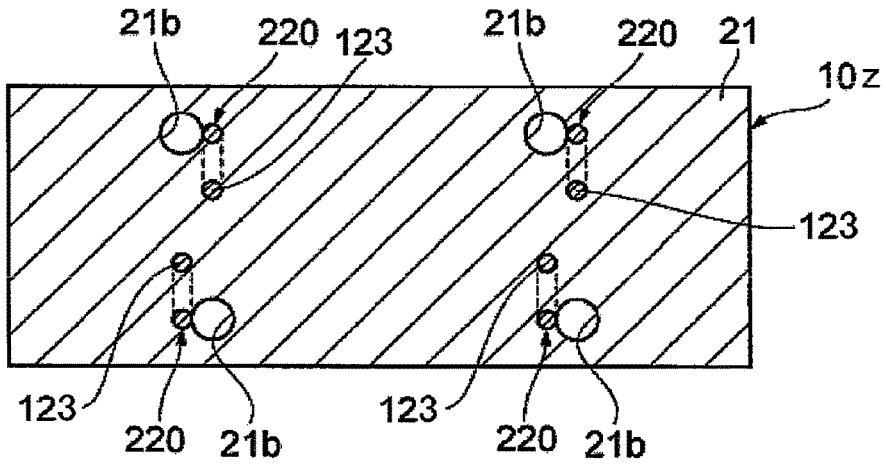
FIG. 78(*a*) is corresponding to FIG. 73(*a*) and illustrates a cross-sectional view of a precast member 10*z* of a 26th embodiment.
Figure 78:
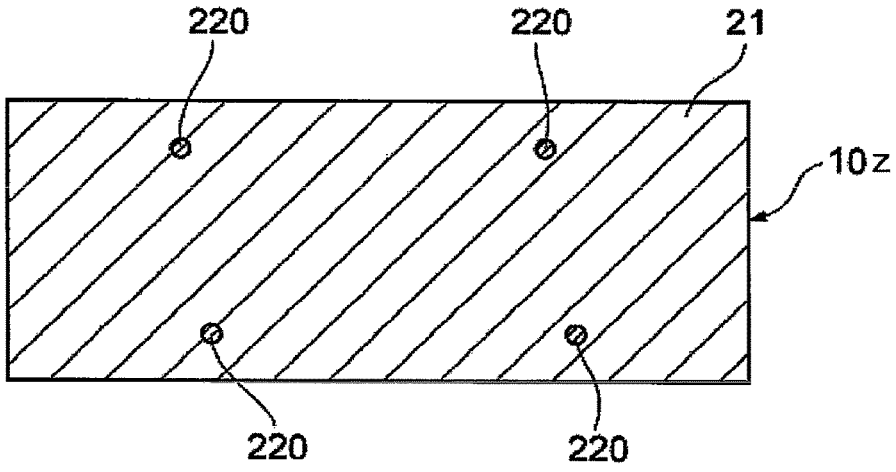
Figure 79:
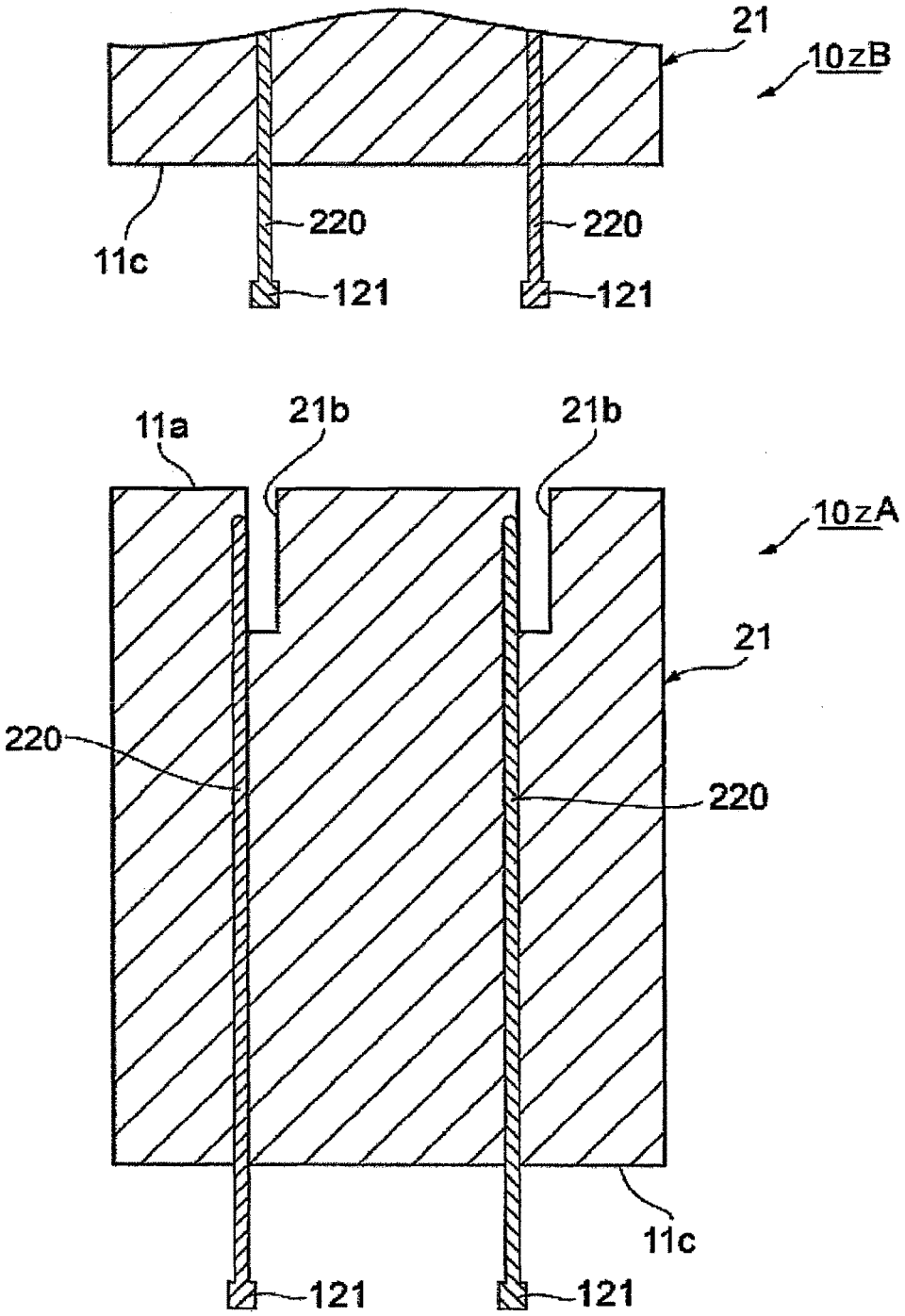
FIG. 79 illustrates a first precast member 10*z* and a second precast member 10*z* in the 26th embodiment, and is a cross-sectional view that is corresponding to FIG. 74.

Next, a joining structure and a method of joining the precast members 10$z$ according to a twenty-sixth embodiment will be described. Hereinafter, an explanation duplicated with the twenty fifth embodiment will be omitted. FIGS. 78($a$) and 78($b$) show cross-sectional views of a main body 21 and a main reinforcing bar 220 of the precast member 10$z$ according to the twenty-sixth embodiment, and are cross-sectional views corresponding to FIGS. 73($a$) and 73($b$) according to the twenty-fifth embodiment. FIG. 79 is a cross-sectional view corresponding to FIG. 74 according to the twenty-fifth embodiment.

As shown in FIGS. 78($a$), 78($b$) and 79, a precast member 10$z$ according to the twenty-sixth embodiment differs from the twenty-fifth embodiment in the arrangement of holes 21$b$ of a main body 21 and also the arrangement of main reinforcing steel bars 220. In the precast member 10$z$ according to the twenty-sixth embodiment, the U-shaped hooks 123 and the holes 21$b$ are alternately arranged along the end face 11$a$. Also, in the precast member 10$z$, the respective main reinforcing bars 220 are arranged at a proximity position to the holes 21*b*. More particularly, an upper end of each main reinforcing steel bar 220 and the associated sheath pipe, which constitutes the hole 21*b*, are bundled, and a state in which the main reinforcing bar 220 is close to the hole 21*b* is realized with the upper end of the main reinforcing bar 220 contacting the sheath pipe.

Figure 80:
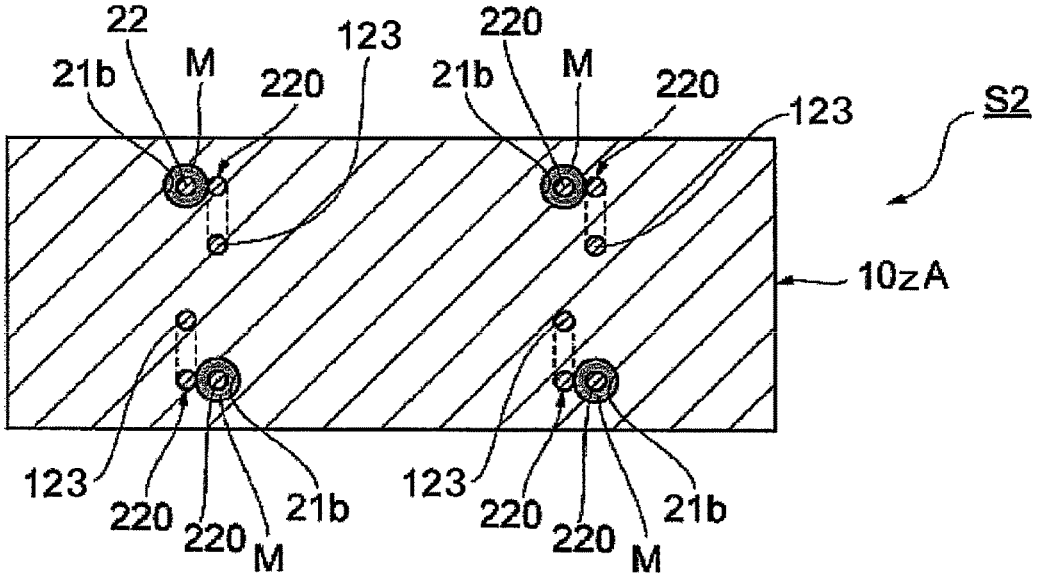
FIG. 80 illustrates a joining structure S2 in the 26th embodiment, and is a cross-sectional view that is corresponding to FIG. 76.
Figure 81:
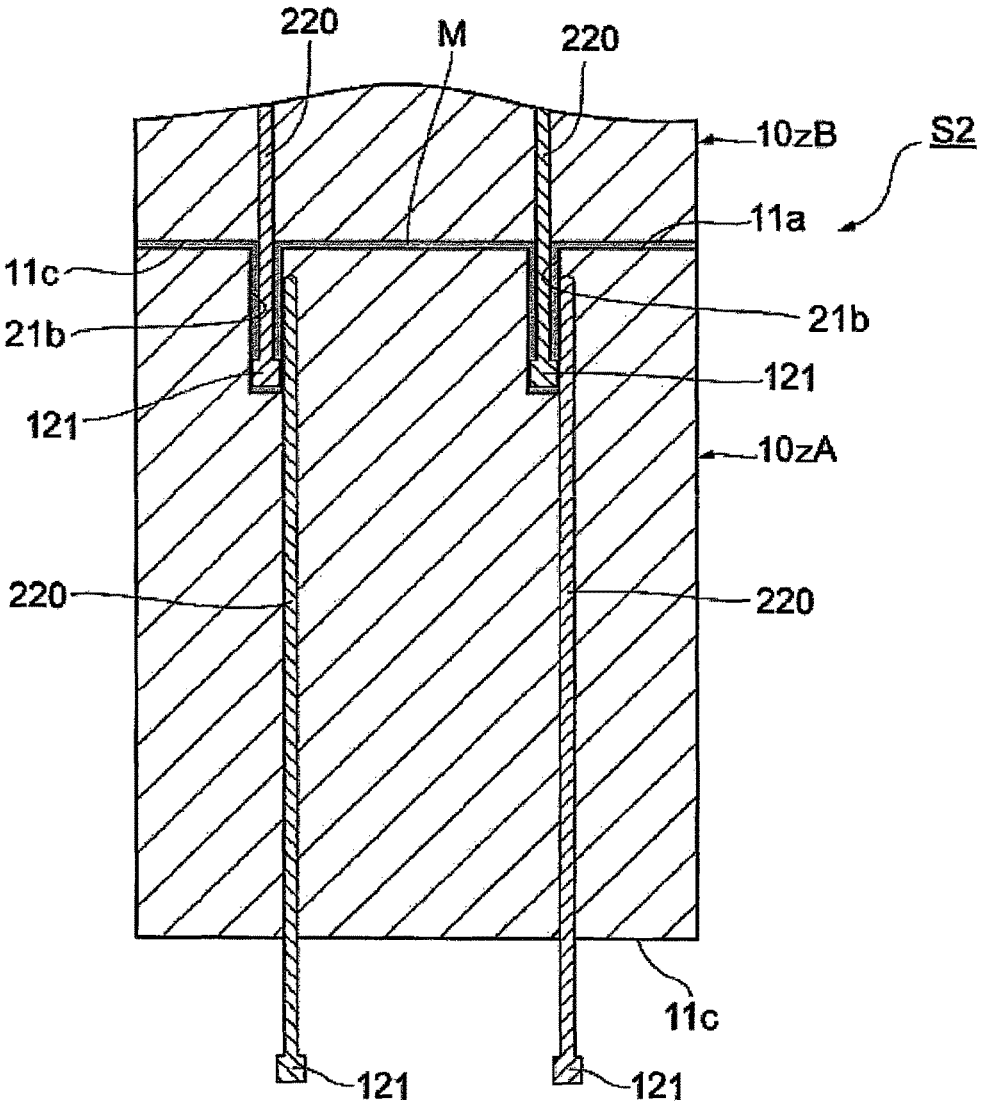
FIG. 81 illustrates the joining structure S2 in the 26th embodiment, and is a cross-sectional view that is corresponding to FIG. 77.

A joining method of joining the precast members 10*z* according to the twenty-sixth embodiment is similar to the method in the twenty-fifth embodiment. In other words, as shown in FIGS. 80 and 81, after the end face 11*a* of a first precast member 10*z*A is filled with the mortar M and the main reinforcing steel bars 220 are inserted into the holes 21*b*, the mortar M is hardened so as to form a joining structure S2 according to the twenty-sixth embodiment.

According to the joining structure S2 of the twenty-sixth embodiment, a plurality of U-shaped hooks 123 and a plurality of holes 21*b* are alternately arranged, and each of the U-shaped hooks 123 is arranged at the proximity position to the each of the holes 21*b*. Thus, as the distance becomes closer between the main reinforcing steel bars 220 of the first precast member 10*z*A and the main reinforcing steel bars 220 of the second precast member 10*z*B inserted into the holes 21*b*, it is possible to further smoothly transmit the force in the main reinforcing steel bars 220. By arranging the U-shaped hooks 123 in the proximity position to the holes 21*b*, it is possible to directly transmit the force between the main reinforcing steel bars 220 inserted into the holes 21*b* and the U-shaped hooks 123 and to clearly define the transmission path of the power. Even if steel wires (PC steel wires) or the like different from the main reinforcing steel bars 220 are buried in the vicinity of the end face 11*a*, the U-shaped hooks 123 are arranged at the proximity positions to the holes 21*b*, and therefore it is possible to transmit the force directly and smoothly in these main reinforcing steel bars 220 without being affected from the steel wires or the like.

Twenty-Seventh Embodiment

Figure 82:
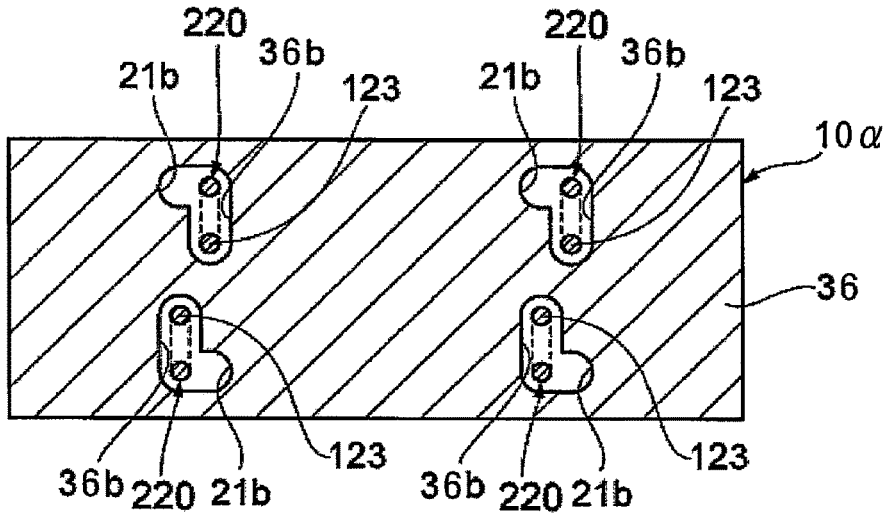
FIG. 82(*a*) is corresponding to FIG. 78(*a*) and illustrates a cross-sectional view of a precast member 10α in a 27th embodiment.
Figure 82:
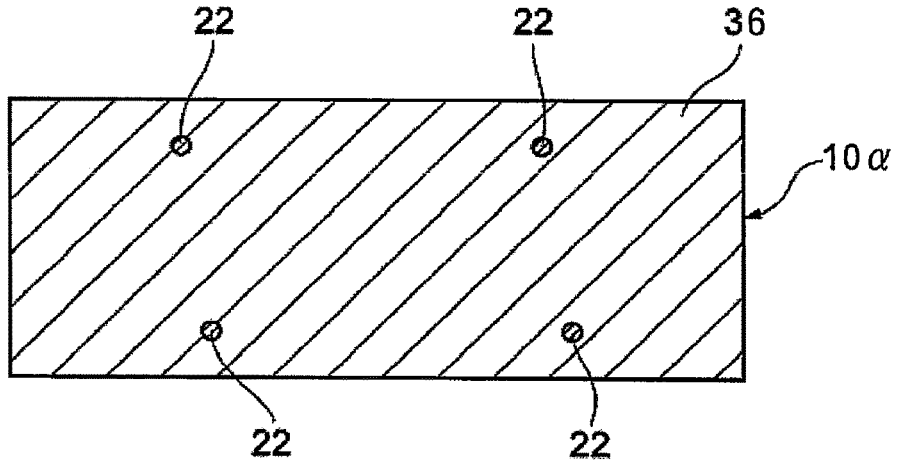
Figure 83:
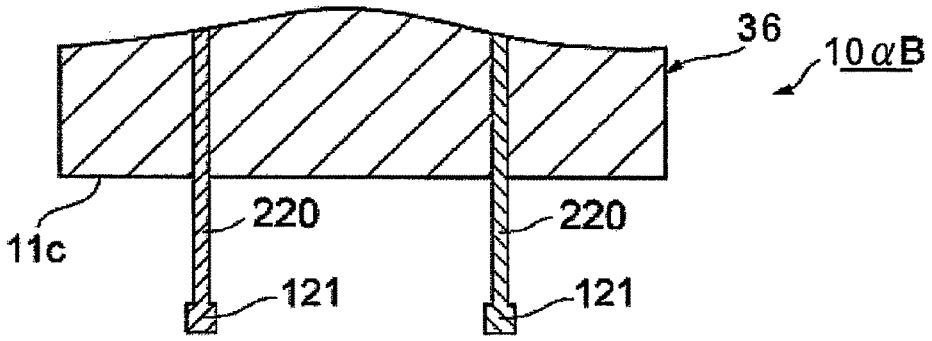
FIG. 83 illustrates a first precast member 10αA and a second precast member 10αB in the 27th embodiment, and is a cross-sectional view that is corresponding to FIG. 79.
Figure 83:
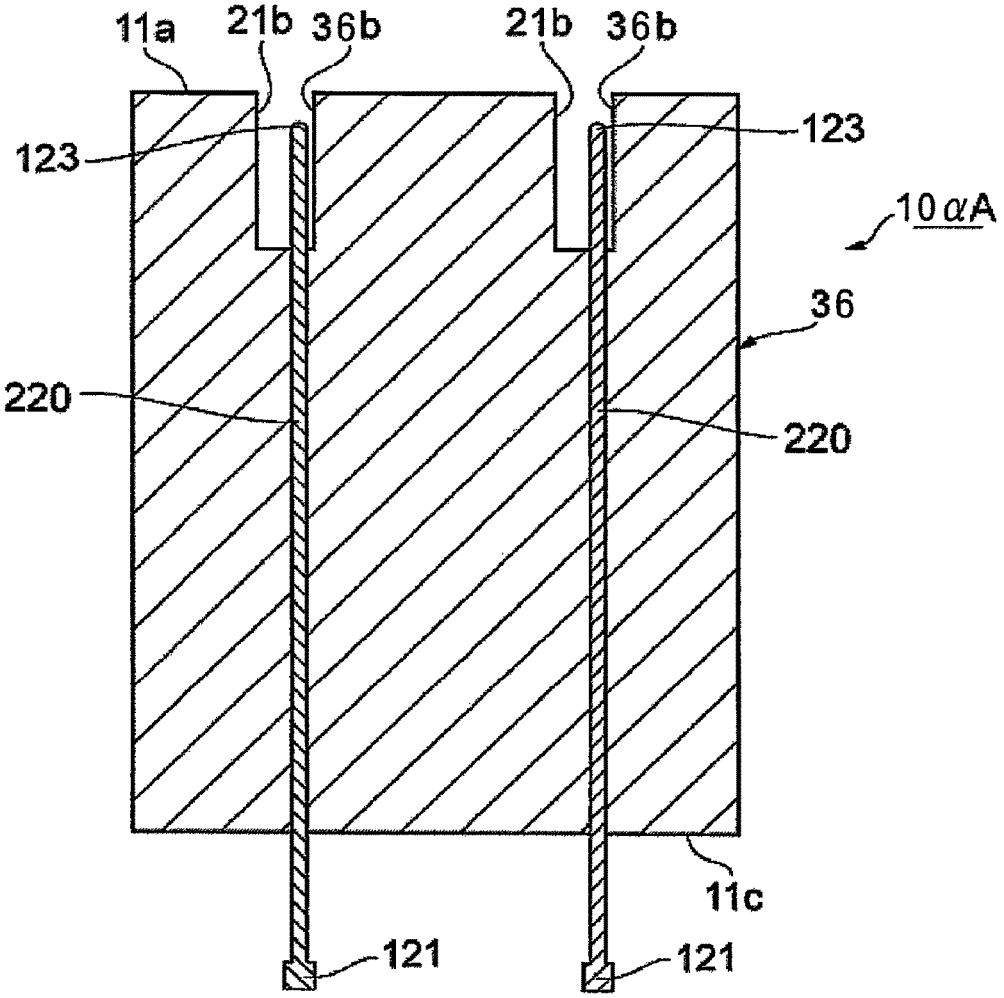

Hereinafter, a joining structure and a joining method of precast members 10α according to a twenty-seventh embodiment will be described. The precast member 10α according to the twenty-seventh embodiment differs from the twenty-sixth embodiment in a structure of a main body 36, and other structures are similar to those in the precast member 10*z* according to the twenty-sixth embodiment. FIGS. 82(*a*) and 82(*b*) show cross-sectional views of the main body 36 and main reinforcing steel bars 220 of the precast member 10α according to the twenty-seventh embodiment, and correspond to FIGS. 78(*a*) and 78(*b*) according to the twenty-sixth embodiment, respectively. FIG. 83 is a cross-sectional view corresponding to FIG. 79 according to the twenty-sixth embodiment.

As shown in FIGS. 82(*a*), 82(*b*) and 83, the main body 36 of the precast member 10α according to the twenty-seventh embodiment is provided with holes (second holes) 36*b* for exposing the U-shaped hooks 123 upward. The holes 36*b* communicate with the respective holes 21*b* through which the main reinforcing steel bars 220 are inserted from above. When viewed in the plan view, each holes 36*b* and the associated hole 21*b* constitute, in combination, an L-shaped space. The holes 36*b* and the holes 21*b* are formed by, for example, burying the sheath pipes in the main body 36.

Figure 84:
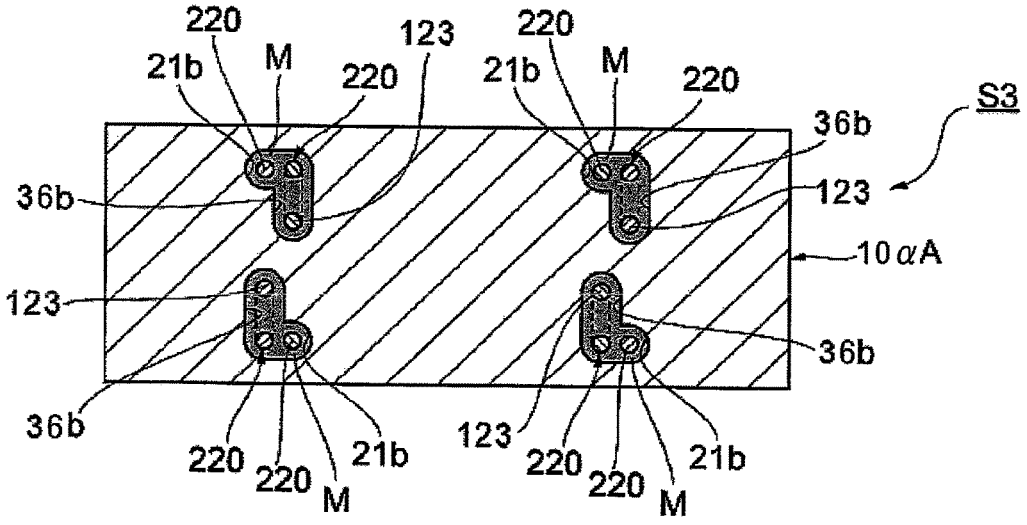
FIG. 84 illustrates a joining structure S3 in the 27th embodiment, and is a cross-sectional view that is corresponding to FIG. 80.
Figure 85:
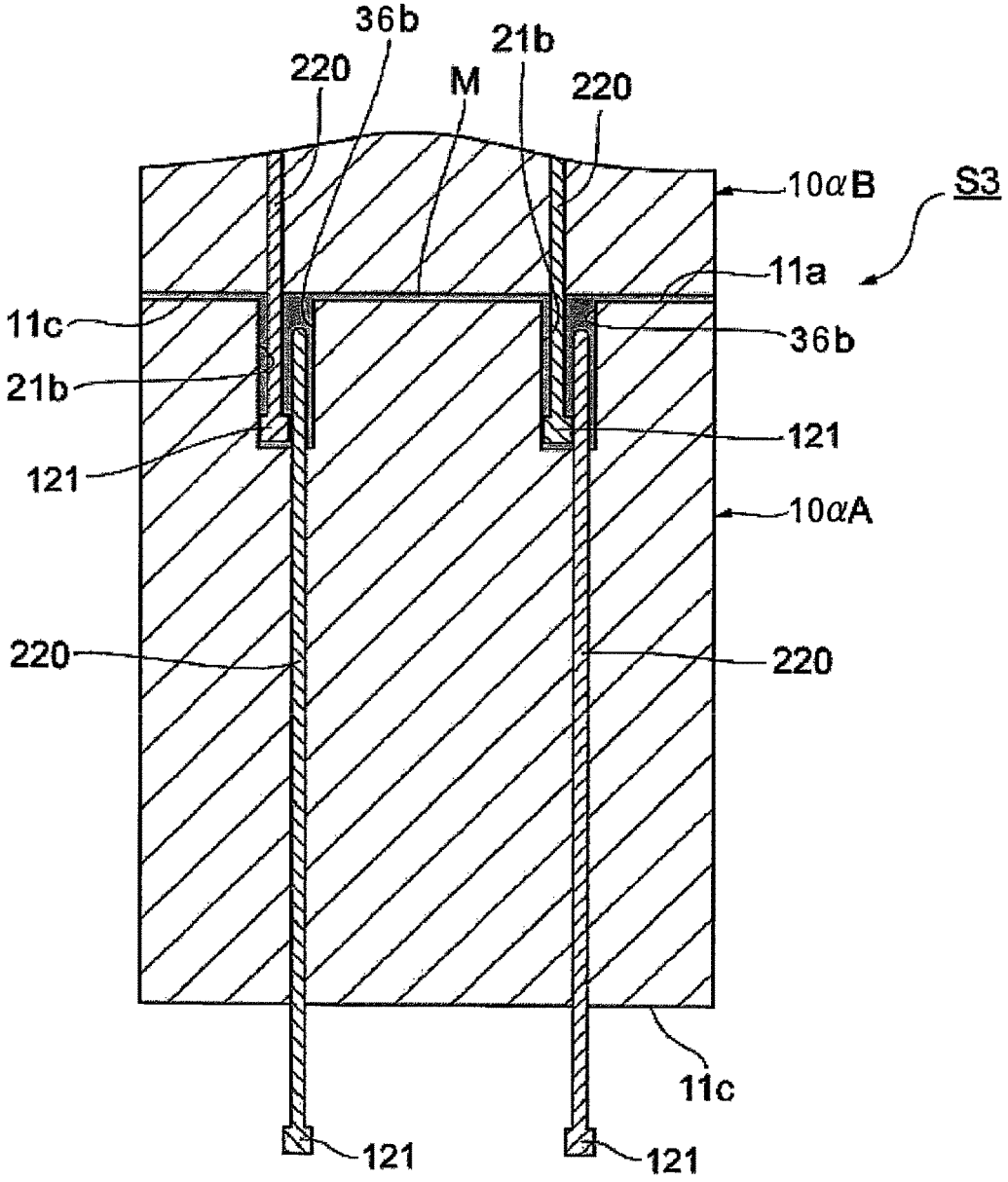
FIG. 85 illustrates the joining structure S3 in the 27th embodiment, and is a cross-sectional view that is corresponding to FIG. 81.

A joining method of joining the precast members 10α is similar to the methods in the twenty-fifth and twenty-sixth embodiments. In other words, as shown in FIGS. 84 and 85, after the end face 11*a* of the first precast member 10αA is filled with the mortar M and the main reinforcing bars 220 are inserted into the holes 21*b* from above, the mortar M is hardened so as to form a joining structure S3 according to the twenty-seventh embodiment.

As described above, according to the joining structure S3 of the twenty-seventh embodiment, the first precast member 10αA is provided with the holes 36*b* extending from the end face 11*a* to the inside of the first precast member 10αA, and the holes 36*b* are filled with the mortar M. Then, the U-shaped hooks 123 are provided inside the holes 36*b*, respectively. In this way, according to the joining structure S3, each of the U-shaped hooks 123 of the first precast member 10αA and the associated main reinforcing steel bar 220 of the second precast member 10αB are arranged in the same area (i.e., an area formed by the holes 21*b* and the holes 36*b*). As a result, it is possible to shorten the distance between the main reinforcing bar 220 of the first precast member 10αA and the main reinforcing steel bar 220 inserted from above so as to obtain the similar effect to the twenty-sixth embodiment.

Furthermore, according to the joining structure S3 of the twenty-seventh embodiment, the holes 21*b* and the holes 36*b* are entirely filled with the mortar M. Thus, the force is transmitted between the main reinforcing bars 220 via the hardened mortar M. Accordingly, it is possible to effectively increase the strength of the joints between the main reinforcing steel bars 220 by increasing the strength of the mortar M.

Twenty-Eighth Embodiment

Figure 86:
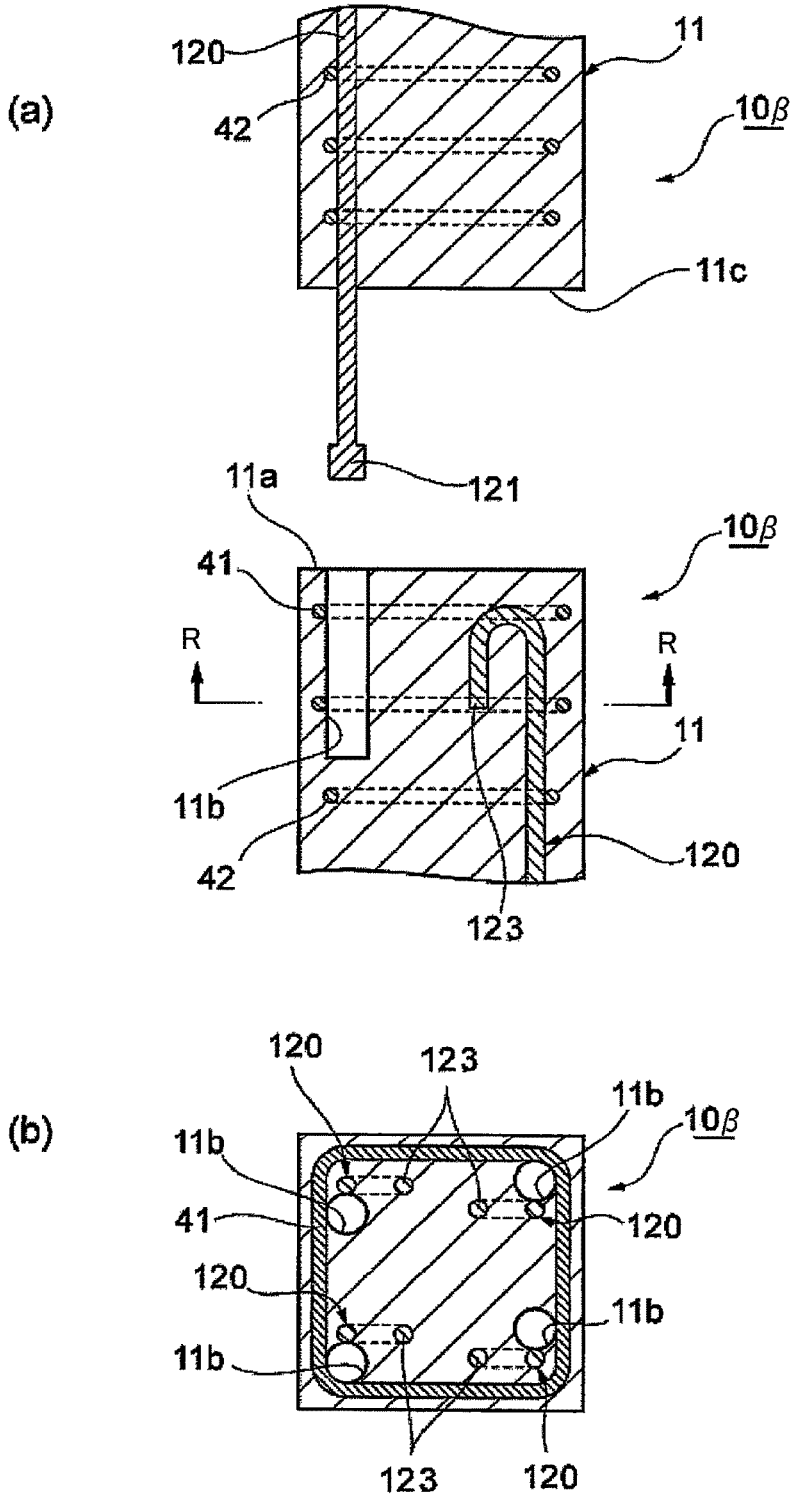
FIG. 86(*a*) is a vertical cross-sectional view of a precast member 10β in a 28th embodiment.

Hereinafter, a joining structure of the precast members 10β according to the twenty-eighth embodiment will be described. It should be noted that a joining method of the precast members 10β according to the twenty-eighth embodiment is similar to the joining method in the twenty fifth embodiment. Thus, detailed explanation thereof will be omitted. As shown in FIGS. 86(*a*) and 86(*b*), the precast member 10β is provided with tie hoops 41 and 42 arranged along a plane intersecting with the main reinforcing steel bars 120. FIG. 86(*a*) is a longitudinal cross-sectional view of the precast member 10β, and FIG. 86(*b*) is a cross-sectional view taken along the line R-R in FIG. 86(*a*).

The tie hoops 41 and 42 are buried in the main body 11 such that the tie hoops are arranged along a plurality of planes (horizontal planes) orthogonal to the main reinforcing steel bars 120, and arranged so as to surround the main reinforcing steel bars 120 inside the main body 11. The tie hoops 41 are positioned outside the holes 11*b*, and the tie hoops 42 are positioned at positions other than the outside of the holes 11*b*. The holes 11*b* and the U-shaped hook 123 are provided inside the tie hoops 41, and the main reinforcing steel bars 120 extending in the up-down direction are provided inside the tie hoops 42. Here, the tie hoops 41 positioned outside the holes 11*b* have the thinner concrete (i.e., covering) positioned outside the tie hoops 41 as compared to the tie hoops 42 positioned at the positions other than the outside of the holes 11*b*. As a result, the tie hoops 41 positioned outside the holes 11*b* are more likely to be corroded than the tie hoops 42 positioned at the positions other than the outside of the holes 11*b*.

For this reason, in the precast member 10β, the tie hoops 41 positioned outside the holes 11*b* are made of a corrosion resistant reinforcing steel bar. More particularly, the tie hoops 41 have a higher anticorrosion property by applying an epoxy coating to the tie hoops 41. It should be noted that, as materials for increasing the corrosion resistance of the tie hoops 41, for example, galvanizing may be enumerated in addition to the above-mentioned epoxy resin.

As described above, according to the twenty-eighth embodiment, it is possible to further suppress the corrosion of the tie hoops 41 in a reliable manner even when the thickness of the concrete positioned outside the tie hoops 41 is thinner, by employing the corrosion resistant reinforcing steel bars for the tie hoops 41 positioned outside the holes 11*b*.

Twenty-Ninth Embodiment

Hereinafter, a joining method according to a twenty-ninth embodiment will be described. A joining structure according to the twenty-ninth embodiment is similar to the joining structure according to the twenty-fifth embodiment, and the twenty-ninth embodiment differs from the twenty-fifth embodiment only in the joining method. Hereinafter, a duplicated description with the twenty-fifth embodiment will be omitted, and a description will be made by focusing on those configurations which are different from the twenty-fifth embodiment.

Figure 87:
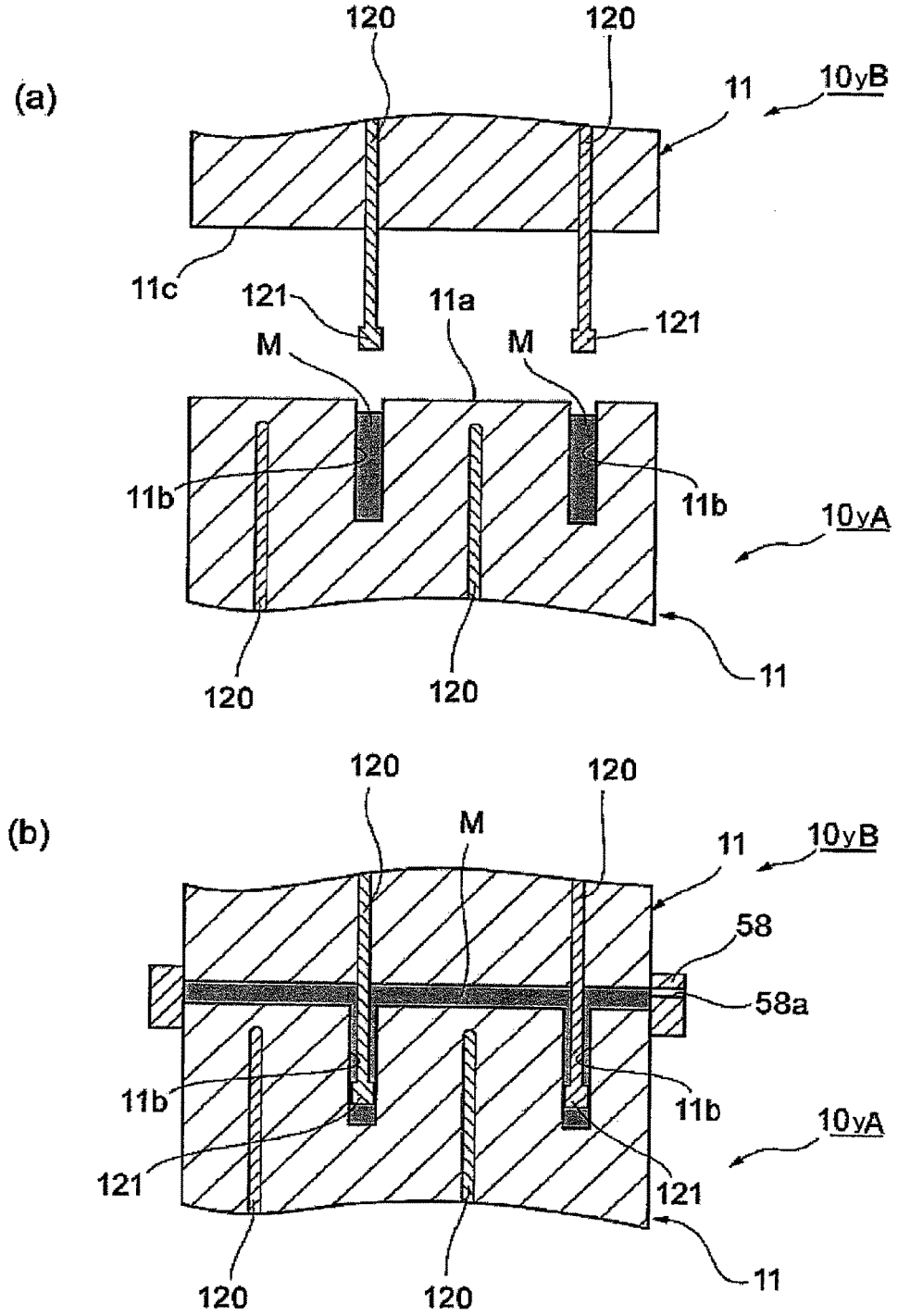
FIGS. 87(*a*) and 87(*b*) are cross-sectional views that are useful to describe a joining method of a 29th embodiment, respectively.

As shown in FIG. 87(*a*), according to the twenty-ninth embodiment, firstly the holes 11*b* of the first precast member 10*y*A are filled with the mortar M (a step of filling the first hole with the solidifying material). At this moment, each of the holes 11*b* is filled with the mortar M having a volume of, for example, 80% to 90% of that of the hole 11*b*. Subsequently, the main reinforcing steel bars 120 are inserted into the holes 11*b* from above such that a gap is formed between the end face 11*a* of the first precast member 10*y*A and the end face 11*b* of the second precast member 10*y*B (a step of inserting the second main reinforcing steel bars), and the formwork 58 is arranged so as to surround the gap.

The formwork 58 is arranged by, for example, attaching the formwork 58 to the respective side faces of the main body 11 by screws or the like. As shown in FIG. 87(*b*), the formwork 58 includes a hole 58*a*, which allows the inside to communicate with the outside. Thus, it is possible to fill the formwork 58 with the mortar M via the hole 58*a*. Therefore, after the formwork 58 is arranged as described above, a hose or the like is inserted into the hole 58*a* from the outside, and the above-mentioned gap is filled with the mortar M from outside through the hose. Subsequently, similar to the twenty-fifth embodiment, the mortar M is hardened (a step of hardening the solidifying material) and the formwork 58 is removed from the side face of the main body 11 so as to complete the joining structure according to the twenty-ninth embodiment.

As described above, according to the joining method of the twenty-ninth embodiment, the main reinforcing steel bars 120 of the second precast member 10*y*B are inserted into the respective holes 11*b* while forming the gap between the end face 11*a* and the end face 11*c* while the hole 11*b* is filled with the mortar M in advance. Then, the formwork 58 is arranged so as to surround the gap, and then the gap is filled with the mortar M from the hole 58*a* formed in the formwork 58 so as to harden the mortar M. Thus, the mortar M, which fills the gap, may be loaded and hardened after the hole 11*b* is filled with the mortar M and the main reinforcing steel bars 120 are inserted into the holes 11*b*. Accordingly, it is possible to improve the efficiency of the work for joining the first precast member 10*y*A to the second precast member 10*y*B.

Thirtieth Embodiment

Figure 88:
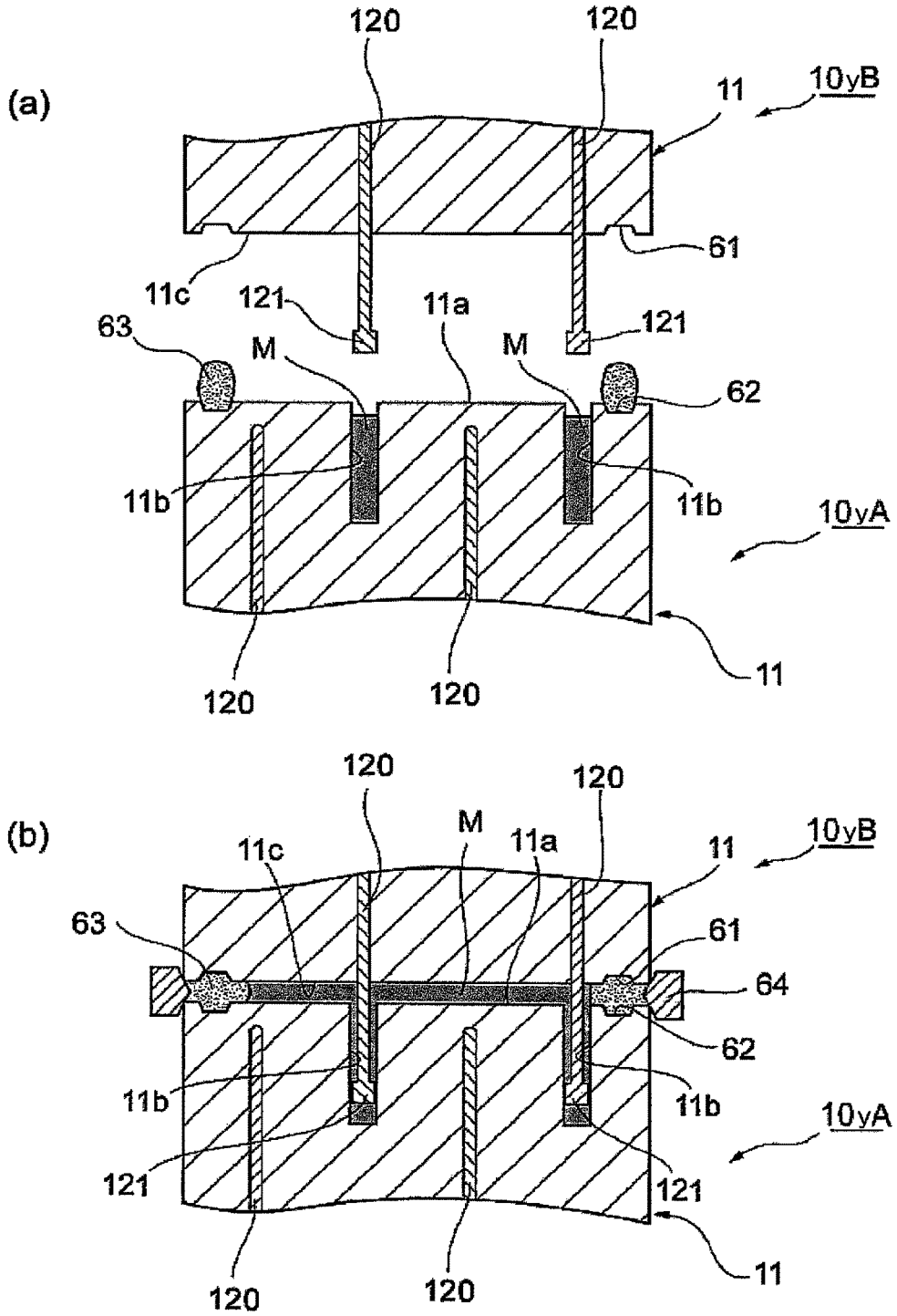
FIGS. 88(*a*) and 88(*b*) are cross-sectional views that are useful to describe a joining method of a 30th embodiment, respectively.

Now, a joining structure and a joining method according to a thirtieth embodiment will be described. As shown in FIGS. 88(*a*) and 88(*b*), a joining structure according to the thirtieth embodiment differs from the twenty-fifth embodiment in that the joining structure of the thirtieth embodiment is provided with a concave portion provided on the end face 11*a* of the first precast member 10*y*A, a butyl rubber (water stop rubber) 63 having a water stop property and arranged at the concave portion 62, and a concave portion 61 provided on the end face 11*c* of the second precast member 10*y*B.

The concave portion 61, which is positioned on the end face 11*c* of the second precast member 10*y*B, and the concave portion 62, which is positioned on the end face 11*a* of the first precast member 10*y*A, oppose to each other in the vertical direction when the second precast member 10*y*B is arranged immediately above the first precast member 10*y*B. The concave portion 61 and the concave portion 62 are formed in annular shapes in the vicinity of outer edges of the end face 11*c* and the end face 11*a*, respectively. Similar to the concave portion 61 and the concave portion 62, the butyl rubber 63 has an annular shape and is attached on the concave portion 62. The butyl rubber 63 is provided in order to infill the gap between the end face 11*a* of the first precast member 10*y*A and the end face 11*c* of the second precast member 10*y*B. The butyl rubber 63 may be expandable when sucking water, and in this case, it is possible to further improve the water stop property in the above-mentioned gap.

Next, a joining method according to the thirtieth embodiment will be described. Firstly, as shown in FIG. 88(*a*), the butyl rubber 63 is arranged on the end face 11*a* of the first precast member 10*y*A (a step of arranging the water stop rubber). Then, the holes 11*b* are filled with the mortar M (a step of filing the solidifying material). It should be noted that either the step of arranging the butyl rubber or the step of loading the mortar M may be performed first.

Next, the main reinforcing steel bars 120 of the second precast member 10*y*B are inserted into the holes 11*b* of the first precast member 10*y*A from above. Then, the butyl rubber 63 is compressed against the end face 11*c* (concave portion 61) of the second precast member 10*y*B from above to press the butyl rubber 63 (a step of pressing the water stop rubber). At this moment, as shown in FIG. 88(*b*), a caulking material 64 is tucked into a position outside of the butyl rubber 63 and between the first precast member 10*y*A and the second precast member 10*y*B. In this way, by tucking the caulking material 64, an outside portion of the butyl rubber 63 is closed.

As described above, after the main reinforcing steel bars 120 are inserted into the holes 11*b* and the butyl rubber 63 is compressed, the mortar M is hardened over a certain length of time (a step of hardening the solidifying material) so as to complete the joining structure according to the thirtieth embodiment.

As described above, according to the joining method of the thirtieth embodiment, after the butyl rubber 63 is arranged on the end face 11*a* (concave portion 62) of the first precast member 10*y*A and the holes 11*b* are filled with the mortar M, the main reinforcing bars 120 are inserted into the holes 11*b* and also butyl rubber 63 is pressed (squeezed) by the end face 11*c*. As a result, the pressed butyl rubber 63 expands in the lateral direction between the end face 11*a* and the end face 11*c*. Thus, it is possible to improve the water stop property at the joining portion between the first precast member 10*y*A and the second precast member 10*y*B. Also, according to the thirtieth embodiment, the formwork is not necessary and therefore the labor for arranging the formwork can be eliminated. Thus, it is possible to further improve the workability.

It should be noted that, according to the thirtieth embodiment, although the butyl rubber 63 is used as the water stop rubber, alternatively other water stop rubbers may be used other than the butyl rubber. In other words, for example, other water expansive rubber may be used instead of the butyl rubber 63. Also, the water stop rubber may be arranged at the concave portion 61 positioned on the end face 11*c* of the second precast member 10*y*B.

As described above, although preferred embodiments of the joining structure or the like of the LNG tank 1 according to the present invention are described, the joining structures are not limited to those described in the above-described embodiments. For example, in the above-described embodiments, as shown in FIG. 74, the jig 125 for adjusting the verticality is arranged on the end face 11*a* of the first precast member 10*y*A, and the height of the jig 125 is uniformed by scraping the upper face of the jig 125 by the file or the like. However, as the jig for adjusting the verticality, another jig may be used instead of the jig 125. For example, a jig of a bolt and a nut buried in the end face 11*a* of the first precast member 10*y*A may be used instead of the jig 125. In this case, it is possible to adjust the verticality only by changing the height of the bolt, which is done by rotating the bolt to adjust the degree of screwing of the bolt over the nut. As a result, it is possible to further facilitate the adjustment of the verticality.

Although, in the above-described embodiments, certain examples in which the mortar M is used as the solidifying material are described, other solidifying materials may be used instead of the mortar M. For example, a grout material, resin or the like may be used instead of the mortar M.

Although, in the above-described embodiments, certain examples are described in which the upper second precast member 10*y*B is stacked on the lower first precast member 10*y*A, a joining arrangement is not limited to those described. For example, the first precast member and the second precast member may be joined in the lateral direction. In this case, for example, the first precast member or the second precast member slides (moves) in the lateral direction by a rail, the reinforcing bars are inserted into the holes, and then the holes are filled with the solidifying material so as to form the joining structure.

Although, in the above-described embodiment, certain examples in which the joining structure is applied to the LNG tank 1*c* are described, respective joining structures and joining methods may be applied to structures other than the LNG tank 1*c*. For example, the present invention may be applied to a wall material or a pillar material constituting a structure other than the LNG tank, or a box culvert or the like partitioned into upper and lower parts.

As described above, while certain embodiments of the present invention have been described referring to the accompanying drawings, the technical scope of the present invention is not intended to be limited to those described in the above-described embodiments. It is apparent that a person skilled in the art would conceive various changes and modifications without departing from the spirit and technical idea recited in the appended claims, and it should be appreciated that such changes and modifications naturally belong to the technical scope of the present invention.

REFERENCE NUMERALS AND SYMBOLS

1, 1*a*, 1*b*, 1*c*, 100: LNG tank
2, 2*a*, 2*b*, 2*c*, 20: Dike
3*a*: Inner tank
3*b*: Outer tank
5*b*, 114: Hole
5*d*, 51: Supporting member
10, 10*a*, 10*b*, 10*c*, 10*d*, 10*e*, 10*f*, 10*g*, 10*g*', 10*h*, 10*i*, 10*i*', 10*i*'', 10*j*, 10*k*, 10*m*, 10*n*, 10*n*', 10*p*, 10*p*', 10*q*, 10*r*, 10*s*, 10*s*', 10*s*'', 10*t*, 10*t*', 10*t*'', 10*u*, 10*v*, 10*w*, 10*x*, 200: Precast block
10*y*, 10*z*, 10α, 10β: Precast member
11, 11*f*, 21, 36: Block main body
11*b*, 21*b*, 36*b*, 58*a*: Hole
12: Loop joint
12*a*, 12*a*', 201: Coupling joint having a fixing element
12*b*: Mechanical joint
13: Sheath pipe
14, 14*a*, 14*b*, 14*c*, 14*d*, 14*e*, 14*f*, 14*g*, 14*g*', 14*h*, 14*h*', 14*i*, 14*j*, 14*k*, 14*m*: Plate
17: Masonry joint
18, 31: Bracket
19: Pilaster
25, 140, 141*a*, 141*b*, 551: Hole
25*a*: Cutout
25*b*: Elongated hole
23*c*: Oblique cutout
26: Bolt
27: Bending portion
28, 142*b*, 146, 149: Nut
29: Hook-like portion
30, 30*a*, 30*b*, 30*c*, 30*d*: Structure
31*b*: Side wall portion
32: Jack
41, 42: Tie hoop
52, 53, 55, 56, 57, 58, 300: Formwork
54: PC steel member
60, 400: Concrete
63: Butyl rubber (water stop rubber)
80, M: Mortar
90, 90*a*, 90*a*', 90*b*, 90*c*, 90*d*, 90*e*, 90*f*, 90*f*', 90*g*, 90*h*, S1, S2, S3: Joining structure
116*a*, 140*a*, 151, 161, 171: Packing
117, 144*a*': Sponge
120, 220: Main reinforcing steel rod
121: Fixing element
123: U-shaped hook (turning back portion)
142*a*: Screw
143: Receiving portion
144*a*: Water stop rubber
150: Check valve portion
160, 170: Water stop plate
180: Bonding portion
181: Protection film
190: Sheet
211: Water stop portion

The invention claimed is:

1. A tank comprising:

a dike formed by:

a plurality of precast blocks arranged in a circumferential direction of the dike and in a vertical direction of the dike, each of the precast blocks being provided with block joints on a first side and a second side of the precast block and on at least one of an upper portion and a lower portion of the precast block, a filler provided between adjacent precast blocks so as to form masonry joints in the vertical direction and the circumferential direction of the dike, and a circumferential tension member configured to provide a prestress to the dike in the circumferential direction of the dike, and a vertical tension member configured to provide a prestress to the dike in the vertical direction of the dike, the vertical tension member being arranged so as to avoid the masonry joints in the vertical direction, wherein:

each of the plurality of precast blocks includes:

a main body, a plate protruding from the main body and functioning as a formwork for the filler in forming the masonry joints, the plate being configured to protrude at an upper position on the first side, at an upper position on the second side, at a lower position on the first side, and at a lower position on the second side in a circumference of the main body, and at least two positions of the upper position on the first side, the upper position on the second side, the lower position on the first side, and the lower position on the second side have a shape in which a right-angled corner is cut out of the plate of each precast block, and shapes of the upper and the lower positions of the first side and the upper and lower positions of the second side of the plate of each precast block are defined such that two rectangular areas identical to each other are formed by a complimentary cut out in a corner of the plate located in each of the positions.

2. The tank according to claim 1, wherein the circumferential tension member is configured to avoid the masonry joints in the circumferential direction of the dike.

3. The tank according to claim 1, wherein each of the block joints is one of: (i) a loop joint, (ii) a mechanical joint, and (iii) a joint having a fixing element.

4. The tank according to claim 1, wherein a bottom face of the main body of each of the precast blocks inclines upward toward an exterior of the dike.

5. The tank according to claim 1, wherein the plate protruding from the main body of each of the precast blocks is provided on an inner portion of each of the precast blocks.

6. The tank according to claim 5, wherein:

the plates of the precast blocks are continuous in the circumferential direction and in the vertical direction of the dike, and an inner portion of the dike is covered by a combination of the plates of the precast blocks.

7. A method of constructing the dike of the tank according to claim 1, the method comprising:

arranging the precast blocks in the circumferential direction of the dike and stacking the precast blocks in the vertical direction of the dike, each of the precast blocks being provided with block joints on the first side and the second side in the circumferential direction, thereof and at least one of the upper portion and the lower portion of each of the preset blocks in the vertical direction;

providing the filler between the precast blocks adjacent to each other in the circumferential direction and in the vertical direction of the dike so as to form the masonry joints in the vertical direction and in the circumferential direction of the dike;

introducing prestress to the dike by the circumferential tension member and the vertical tension member; and arranging the vertical tension member so as to avoid the masonry joints in the vertical direction.

8. The tank according to claim 1, wherein:

a joining structure is formed of joined upper and lower precast blocks of the plurality of precast blocks, each of the upper precast blocks includes a block joint protruding downward from a main body of each of the upper precast blocks, each of the lower precast blocks includes a hole opening in a top face of a main body of each of the lower precast blocks and a block joint embedded in an upper portion of the main body, the filler is provided on the main body of each of the lower precast blocks, and the block joint of each of the upper precast blocks is inserted into the hole of each of the lower precast blocks.

9. The tank according to claim 8, wherein the block joint of each of the upper and lower precast blocks includes a fixing element provided at a free end of a reinforcing steel bar.

10. The tank according to claim 8, wherein a bottom face of the main body of each of the upper precast blocks inclines upward.

11. The tank according to claim 8, wherein the plate protruding upward from the main body is provided on a side face of the main body of each of the lower precast blocks.

12. The tank according to claim 11, further comprising a leakage preventing mechanism configured to prevent the filler from leaking from the plate.

13. A method of constructing a dike of the tank according to claim 8, the method comprising:

providing the filler on the main body of each of the lower precast blocks; and inserting the block joint of each of the upper precast blocks into the hole of each of the lower precast blocks.

14. A tank comprising:

a dike formed by:

a plurality of precast blocks arranged in a circumferential direction of the dike and in a vertical direction of the dike, each of the precast blocks being provided with block joints on a first side and a second side in the circumferential direction and at least one of an upper portion and a lower portion in the vertical direction, a filler provided between the precast blocks adjacent to each other in the vertical direction and the circumferential direction of the dike so as to form masonry joints in the vertical direction and the circumferential direction of the dike, a circumferential tension member configured to provide a prestress in the circumferential direction of the dike, and a vertical tension member configured to provide a prestress in the vertical direction of the dike, the vertical tension member being configured to avoid the masonry joints in the vertical direction, wherein:

each of the plurality of precast blocks includes:

a main body;

a plate protruding from the main body and configured to function as a formwork for the filler when the masonry joints are formed, the plate including a fixing mechanism configured to fix the plate such that the plate overlaps the plate of a different precast block in a front-rear direction, the fixing mechanism including at least one of a convex portion and a receiving portion into which the convex portion is configured to be inserted.

15. The tank according to claim 14, wherein:

the plate protrudes upward, downward, from the first side, and from the second side of the main body, the convex portion is disposed at one of the upward and downward protruding portions of the plate and the receiving portion is disposed at the other of the upward and downward protruding portions of the plate, the convex portion is disposed at one of the protruding portion from the first side and the protruding portion from the second side of the plate and the receiving portion is disposed at the other of the protruding portion from the first side and the protruding portion from the second side of the plate, and the receiving portion is positioned in front of the protruding portion and the protruding portion is provided with the convex portion.

16. The tank according to claim 14, wherein the plate is configured to protrude upward, downward, from the first side, and from the second side of the main body, and the convex portions are disposed at the upward protruding portion, downward protruding portion, the protruding portion from the first side, and the protruding portion from the second side of the main body.

17. The tank according to claim 14, wherein the plate is configured to protrude upward, downward, from the first side, and from the second side of the main body, and the receiving portions are disposed at the upward protruding portion, downward protruding portion, the protruding portion from the first side, and the protruding portion from the second side of the main body.

18. The tank according to claim 15, wherein each of the positions including an upper position on the first side, an upper position on the second side, a lower imposition on the first side and a lower position on the second side in the circumference of the main body, has a shape in which a right-angled corner is cut out and chamfered in an oblique direction where the upward protruding portion, the downward protruding portion, the protruding portion from the first side, and the protruding portion from the second side intersect, and shapes of the upper and the lower positions of the first side and the upper and the lower positions of the second side of the plate of each precast block are defined such that two rectangular areas identical to each other are formed by a complimentary cut out in a corner of the plate located in each of the positions.

19. The tank according to claim 15, wherein:

out of the positions including an upper position on the first side, an upper position on the second side, a lower position on the first side, and a lower position on the second side in the circumference of the main body, a lower position of two positions on a first diagonal line has a shape in which a right-angled corner is cut out in an internal corner shape where the upward protruding portion, downward protruding portion, the protruding portion from the first side, and the protruding portion from the second side intersect, each of two positions on a second diagonal line has a shape in which a right-angled corner is cut out and chamfered in an oblique direction, and shapes of the positions are defined such that two rectangular areas identical to each other are formed by complimentary features of opposite corners.

20. The tank according to claim 1, wherein the precast blocks are joined together in the vertical and horizontal directions, and the masonry joints are formed by the filler between the main bodies of the adjacent precast blocks.

21. The tank according to claim 14, wherein the plates of the adjacent precast blocks overlap each other in the front-rear direction, the front-rear direction being orthogonal to the vertical direction and circumferential direction with respect to the precast blocks, and no more than two of the plates overlap in the front-rear direction at a contact position of the upper, lower, first side, and second side of precast blocks.

22. The tank according to claim 1, wherein the plates of the adjacent precast blocks are fixed together by a fixing mechanism such that the plates overlap each other in the front-rear direction.

23. The tank according to claim 15, wherein a protruding portion provided with the receiving portion of the plate of one precast block of the adjacent precast blocks overlaps in front of a protruding portion provided with the convex portion of the plate of the other precast block.

24. The tank according to claim 14, wherein:

the plate is configured to protrude upward, downward, from the first side, and from the second side of the main body, the precast block provided with the convex portions at the upward protruding portion, the downward protruding portion, the protruding portion from the first side, and the protruding portion from the second side, and the precast block provided with the receiving portions at the upward protruding portion, the downward protruding portion, the protruding portion from the first side, and the protruding portion from the second side, arranged in a zigzag manner, and the precast block provided with the receiving portions at the upward protruding portion, the downward protruding portion, the protruding portion from the first side, and the protruding portion from the second side are arranged in front of the precast block provided with the convex portions at the upward protruding portion, the downward protruding portion, the protruding portion from the first side, and the protruding portion from the second side.

25. A tank comprising:

a dike formed by:

a plurality of precast blocks arranged in a circumferential direction of the dike and in a vertical direction of the dike, each of the precast blocks being provided with joints on a first side and a second side in the circumferential direction and at least one of an upper portion and a lower portion in the vertical direction, a filler provided between adjacent precast blocks so as to form masonry joints in the vertical direction and the circumferential direction of the dike, a circumferential tension member configured to provide prestress to the dike in the circumferential direction, and a vertical tension member configured to provide prestress to the dike in the vertical direction, the vertical tension member being configured to avoid the masonry joints in the vertical direction, wherein:

the tank has a joining structure configured to join a first precast block to a second precast block, the first precast block including:

a first end face positioned at one end of the first precast block;

a first main reinforcing steel bar embedded in the first precast block; and a first hole extending from the first end face to an inside of the first precast block, and the second precast block including:

a second end face positioned at one end of the second precast block; and a second main reinforcing steel bar embedded in the second precast block, protruding from the second end face and configured to be inserted into the first hole, the first hole is filled with a solidifying material, the solidifying material burying the second main reinforcing steel bar inserted into the first hole, a fixing element is disposed at a free end of the second main reinforcing steel bar, and a folded portion is disposed at a free end of the first main reinforcing steel bar, the folded portion being folded in a direction departing from the first end face.

26. The tank according to claim 25, wherein the folded portion is embedded inside the first precast block.

27. The tank according to claim 25, wherein:

the folded portions and the first holes are alternately arranged along the first end face, and each of the folded portions is arranged at an approximately middle point position of a line segment connecting two said first holes adjacent to each other.

28. The tank according to claim 25, wherein:

the folded portions and the first holes are alternately arranged along the first end face, and each of the folded portions is arranged at a proximity position to each of the first holes.

29. The tank according to claim 25, wherein:

the first precast block further includes a second hole extending from the first end face to an inside of the first precast block, the second hole is filled with the solidifying material, and the folded portion is provided inside the second hole.

30. The tank according to claim 25, wherein:

the first precast block further includes a tie hoop disposed along a plane intersecting with the first main reinforcing steel bar, and the tie hoop is positioned outside the first hole on the plane and is an anticorrosion reinforcing steel bar.

* * * * *